US012690634B2

(12) United States Patent
Seki et al.

(10) Patent No.: US 12,690,634 B2
(45) Date of Patent: Jul. 28, 2026

(54) FIBER FOR ARTIFICIAL HAIRS, ARTIFICIAL HAIR, METHOD FOR PRODUCING FIBER FOR ARTIFICIAL HAIRS, AND METHOD FOR PRODUCING ARTIFICIAL HAIR

(71) Applicants: Aderans Co., Ltd., Tokyo (JP); Spiber Inc., Tsuruoka (JP)

(72) Inventors: Masatoshi Seki, Tokyo (JP); Hideki Takahashi, Tokyo (JP); Ren Ito, Tsuruoka (JP); Yunosuke Abe, Tsuruoka (JP)

(73) Assignees: ADERANS CO., LTD., Tokyo (JP); CRANE, INC., Yamagata (JP)

( * ) Notice: Subject to any disclaimer, the term of this patent is extended or adjusted under 35 U.S.C. 154(b) by 693 days.

(21) Appl. No.: 17/426,605

(22) PCT Filed: Jan. 30, 2020

(86) PCT No.: PCT/JP2020/003543
§ 371 (c)(1),
(2) Date: Jul. 28, 2021

(87) PCT Pub. No.: WO2020/158897
PCT Pub. Date: Aug. 6, 2020

(65) Prior Publication Data

US 2022/0095728 A1 Mar. 31, 2022

(30) Foreign Application Priority Data

Jan. 31, 2019 (JP) ..... 2019-016458
Jan. 31, 2019 (JP) ..... 2019-016472

(51) Int. Cl.
*A41G 3/00* (2006.01)
*D01F 4/02* (2006.01)

(52) U.S. Cl.
CPC ..... *A41G 3/0083* (2013.01); *D01F 4/02* (2013.01); *D10B 2211/22* (2013.01); *D10B 2503/08* (2013.01)

(58) Field of Classification Search
CPC ..... D01F 4/02; A41G 3/0083; D10B 2503/08; D10B 2211/22; C07K 14/43518
See application file for complete search history.

(56) References Cited

U.S. PATENT DOCUMENTS 11,692,015 B2 * 7/2023 Morita ..... C12N 15/70 514/13.6
2011/0297904 A1 * 12/2011 Dhinojwala ..... D01F 4/02 254/387

(Continued)

FOREIGN PATENT DOCUMENTS

CA 3055888 A1 9/2018
EP 3827682 A1 6/2021

(Continued)

OTHER PUBLICATIONS

"FR3025431_Machine Translation" is a machine translation of FR-3025431-A1. (Year: 2016).*

(Continued)

*Primary Examiner* — Larissa Rowe Emrich
(74) *Attorney, Agent, or Firm* — Pillsbury Winthrop Shaw Pittman, LLP

(57) ABSTRACT

Disclosed is a fiber for artificial hairs that is given a predetermined shape, the fiber being formed from a synthetic fibroin fiber containing a modified fibroin, and the fiber expanding when placed in a wet state and contracting when dried from a wet state. Also disclosed is a method for producing a fiber for artificial hairs that is given a predetermined shape, the method including retaining a fibroin fiber containing a modified fibroin in a state conforming to (Continued)

a predetermined shape. A wetted fibroin fiber may also be heated while being retained in a state conforming to a predetermined shape.

15 Claims, 15 Drawing Sheets

Specification includes a Sequence Listing.

(56) References Cited

U.S. PATENT DOCUMENTS

| | | | | |
|---|---|---|---|---|
| 2012/0231499 | A1† | 9/2012 | Lee | |
| 2012/0244143 | A1* | 9/2012 | Lo | D01D 5/00 424/130.1 |
| 2015/0141618 | A1* | 5/2015 | Ishikawa | D01F 4/00 530/353 |
| 2016/0348306 | A1 | 12/2016 | Van Rooij | |
| 2018/0016709 | A1 | 1/2018 | Fujita et al. | |
| 2020/0031886 | A1 | 1/2020 | Morinaga et al. | |
| 2020/0207817 | A1* | 7/2020 | Morita | C07K 14/43518 |
| 2021/0214404 | A1* | 7/2021 | Matsuo | A41G 3/00 |

FOREIGN PATENT DOCUMENTS

| | | | | |
|---|---|---|---|---|
| FR | 3025431 | A1 * | 3/2016 | A41G 3/0083 |
| JP | S45-20028 | B1 | 7/1970 | |
| JP | H10-266007 | A | 10/1998 | |
| JP | 2004137654 | A † | 5/2004 | |
| JP | 2007297737 | A | 11/2007 | |
| JP | 2010-100966 | A | 5/2010 | |
| JP | 2013-163883 | A | 8/2013 | |
| JP | 5407009 | B1 | 2/2014 | |
| JP | 6337252 | B1 | 6/2018 | |
| JP | 2022078360 | A | 5/2022 | |
| WO | 2011/069643 | A2 | 6/2011 | |
| WO | 2016/158702 | A1 | 10/2016 | |
| WO | 2018/164020 | A1 | 9/2018 | |
| WO | 2020/022395 | A1 | 1/2020 | |

OTHER PUBLICATIONS

European Patent Office, Extended European Search Report issued in EP Patent Application No. 20748244.9, May 8, 2023, pp. 1-8.

Patent Cooperation Treaty, International Search Report issued in PCT/JP2020/003543, Mar. 10, 2020, pp. 1-3.

Patent Cooperation Treaty, International Preliminary Report on Patentability issued in PCT/JP2020/003543, Aug. 12, 2021, pp. 1-8.

European Patent Office, Official Action issued in European Patent Application No. 20748244.9, Jun. 12, 2025, pp. 1-7.

* cited by examiner
† cited by third party (a)

(b)

FIBER FOR ARTIFICIAL HAIRS, ARTIFICIAL HAIR, METHOD FOR PRODUCING FIBER FOR ARTIFICIAL HAIRS, AND METHOD FOR PRODUCING ARTIFICIAL HAIR

RELATED PATENT APPLICATIONS

This application is based on and claims the benefit of priority from International Application No. PCT/JP2020/003543, filed on Jan. 30, 2020, which claims priority to Japanese Patent Application No. 2019-016458, filed on Jan. 31, 2019, and Japanese Patent Application No. 2019-016472, filed on Jan. 31, 2019 the contents of which are hereby incorporated by reference in their entirety.

SEQUENCE LISTING

The instant application contains a Sequence Listing which has been submitted electronically in ASCII format and is hereby incorporated by reference in its entirety. Said ASCII copy, created on Jul. 20, 2021, is named "051723-0562454_SequenceListing.txt" and is 243 KB in size.

TECHNICAL FIELD

The present invention relates to a fiber for artificial hairs and an artificial hair. The present invention also relates to a method for producing a fiber for artificial hairs that is given a predetermined shape, and a method for producing an artificial hair.

BACKGROUND ART

Regarding materials for artificial hairs such as wigs and false hair pieces, human hair or non-natural or synthetic fibers have been conventionally used. As the non-natural fibers for artificial hairs, polyester fibers or acrylic fibers are generally used (for example, Patent Literature 1). Non-natural fibers have an advantage that fibers having higher strength than human hair and having a desired length are stably available in large quantities with uniform product quality. Furthermore, artificial protein fibers for hairs, such as regenerated collagen fibers that are expected to have lower environmental load, have also been proposed (for example, Patent Literature 2).

However, in order to secure a wide variation of style, artificial hairs may be given a shape including a curved part or a linear shape.

CITATION LIST

Patent Literature

Patent Literature 1: JP 2007-297737 A
Patent Literature 2: WO 2016/158702 A

SUMMARY OF INVENTION

Technical Problem

Non-natural fibers feel significantly different to the touch compared to human hair and also have significant differences in view of characteristics. For example, human hair has a characteristic of being elongated by a predetermined length when absorbing water and then restoring the original length when dried, whereas none of the non-natural fibers have such a characteristic. Therefore, when a fiber for artificial hairs formed from a non-natural fiber is used, the occurrence of a feeling of discomfort between the non-natural fiber and human hair cannot be avoided. Therefore, realization of artificial hairs that are not likely to cause a feeling of discomfort between the artificial hairs and human hair is desirable. In addition, from the viewpoint of styleability, artificial hairs may be required to have a predetermined shape such as a curved part (curl part) or a linear shape.

Thus, according to an aspect of the present invention, there is provided a fiber for artificial hairs that is given a predetermined shape, the fiber being stably suppliable while using a non-natural fiber and being capable of suppressing the occurrence of a feeling of strangeness between the fiber and human hair.

In the case of a non-natural fiber for artificial hairs, generally, a shape including a curved part is given to the fiber by winding a synthetic fiber around a core material such as an aluminum pipe and heating the synthetic fiber in that state. In order to satisfactorily give a desired shape and retain the shape, heating at a high temperature of 100° C. or higher may be needed. Heating at a high temperature is likely to cause a change in the feeling of an artificial hair to the touch, a decrease in strength, and a color change. Furthermore, even from the viewpoint of securing safety of the operator, it is desirable that a desired shape can be given to a synthetic fiber for artificial hairs without requiring heating at a high temperature.

Thus, according to another aspect of the present invention, there is provided a method for obtaining a fiber for artificial hairs that is given a predetermined shape, the fiber not requiring heating at a high temperature while using a non-natural fiber.

In the case of conventional artificial protein fibers for hairs, it has been required to crosslink the protein fibers in order to give a predetermined shape and to secure retainability of the given shape. Furthermore, there has also been a need for a pretreatment using a special treatment liquid.

Thus, according to still another aspect of the present invention, there is provided a method for conveniently obtaining a fiber for artificial hairs having excellent retainability of the given shape, while using a protein fiber.

Solution to Problem

The inventors of the present invention found that fibroin fibers containing modified fibroin expand and contract similarly to human hair concomitantly with wetting and drying, and that fibroin fibers are given a predetermined shape by a simple and easy method. That is, an aspect of the present invention relates to the following.

[1] A fiber for artificial hairs that is given a predetermined shape, the fiber being formed from a synthetic fibroin fiber containing a modified fibroin, and the fiber expanding when placed in a wet state and contracting when dried from a wet state.

[2] An artificial hair including the fiber for artificial hairs according to [1].

As a result of various investigations, the inventors of the present invention found that a fibroin fiber containing a modified fibroin is given a predetermined shape without requiring heating at a high temperature. That is, another aspect of the present invention relates to the following.

[1] A method for producing a fiber for artificial hairs that is given a predetermined shape, the method including retaining a fibroin fiber containing a modified fibroin in a state conforming to a predetermined shape, in which the predetermined shape is a shape including a curved part, a linear part, or both of these.

[2] The method according to [1], in which the fibroin fiber is retained in a state conforming to a shape including a curved part, by being wound around a core material.

[3] The method according to [1] or [2], in which the diameter of the fibroin fiber is more than 30 μm.

[4] The method according to any one of [1] to [3], in which the fibroin fiber that is retained in the state conforming to a predetermined shape is heated.

[5] The method according to [4], in which the fibroin fiber that is retained in the state conforming to a predetermined shape is heated to a temperature below 100° C.

[6] The method according to any one of [1] to [5], in which the modified fibroin includes a modified spider thread fibroin.

[7] The method according to any one of [1] to [6], further including drying the fibroin fiber, in which the fibroin fiber that has been dried is wound around the core material.

[8] A method for producing an artificial hair, the method including obtaining an artificial hair fiber that is given a predetermined shape, by the method according to any one of [1] to [7].

In these methods, the fibroin fiber may be a fiber that expands when placed in a wet state and contracts when dried from a wet state.

As a result of various investigations, the present inventors found that a fibroin fiber containing a modified fibroin is easily given a predetermined shape by heating a fibroin fiber that has been wetted with water while retaining the fibroin fiber in a state conforming to a predetermined shape, without necessarily requiring crosslinking by a chemical reaction and a pretreatment using a treatment liquid, and the given shape is satisfactorily retained. That is, an aspect of the present invention relates to the following.

[1] A method for producing a fiber for artificial hairs that is given a predetermined shape, the method including heating a fibroin fiber that contains a modified fibroin and has been wetted with water, while retaining the fibroin fiber in a state conforming to a predetermined shape, in which the predetermined shape is a shape including a curved part, a linear part, or both of these.

[2] The method according to [1], further including wetting the fibroin fiber with water before retaining the fibroin fiber in the state conforming to a predetermined shape.

[3] The method according to [1] or [2], in which the fibroin fiber that is retained in the state conforming to a predetermined shape is immersed in water.

[4] The method according to [1] or [2], in which the fibroin fiber that is retained in the state conforming to a predetermined shape is exposed to water vapor.

[5] The method according to any one of [1] to [4], in which the fibroin fiber is retained in a state conforming to a predetermined shape including a curved part by being wound around a core material.

[6] The method according to any one of [1] to [5], in which the modified fibroin includes a modified spider thread fibroin.

[7] A method for producing an artificial hair, the method including obtaining a fiber for artificial hairs that is given a predetermined shape by the method according to any one of [1] to [6].

In these methods, too, the fibroin fiber may be a fiber that expands when placed in a wet state and contracts when dried from a wet state.

Advantageous Effects of Invention

According to an aspect of the present invention, a fiber for artificial hairs that is given a predetermined shape, the fiber being stably suppliable while using a non-natural fiber and being capable of suppressing the occurrence of a feeling of strangeness between the fiber and human hair, can be provided.

According to another aspect of the present invention, a fiber for artificial hairs that is given a predetermined shape can be obtained, the fiber not requiring heating at a high temperature while using a non-natural fiber that is stably suppliable.

According to still another aspect of the present invention, a fiber for artificial hairs having excellent retainability of a given shape can be conveniently obtained while using a protein fiber that can be supplied stably and has a low environmental load.

DESCRIPTION OF EMBODIMENTS

Hereinafter, embodiments for carrying out the present invention will be described in detail. However, the present invention is not intended to be limited to the following embodiments.

(Method for Producing Fiber for Artificial Hairs)

An embodiment of a method for producing a fiber for artificial hairs that is given a predetermined shape includes retaining a fibroin fiber containing a modified fibroin (synthetic fibroin fiber) in a state conforming to a predetermined shape. The predetermined shape may be a curled shape. An embodiment of the method for producing a fiber for artificial hairs that is given a predetermined shape may include heating a fibroin fiber that contains a modified fibroin and has been wetted with water while retaining the fibroin fiber in a state conforming to a predetermined shape. Through these methods, a fiber for artificial hairs that is given a predetermined shape and is formed from a fibroin fiber, can be easily obtained. The predetermined shape as referred to herein can be a shape including a curved part, a linear part, or both of these. A shape including a curved part can also be a curled shape.

Figure 1:
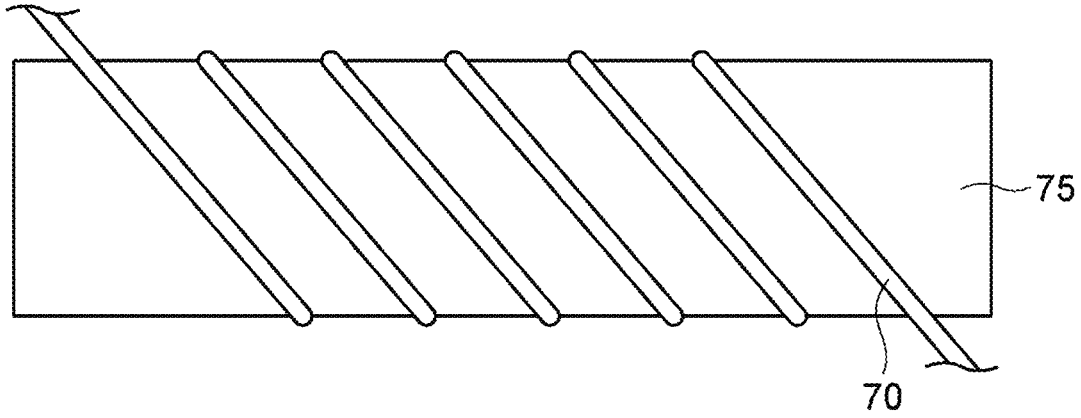
FIG. 1 is a schematic diagram illustrating an example of a method for producing a fiber for artificial hairs that is given a shape including a curved part.

FIG. 1 is a schematic diagram illustrating an example of a method for producing a fiber for artificial hairs that is given a shape including a curved part (or a curled shape). In the method shown in FIG. 1, a fibroin fiber 70 is wound along the outer peripheral surface of a cylindrical-shaped core material 75. As such, by retaining the fibroin fiber 70 in a state conforming to a curled shape at a relatively low temperature, a curled shape corresponding to the shape of the outer peripheral surface of the core material 75 is given to the fibroin fiber 70. A curled shape corresponding to the shape of the outer peripheral surface of the core material 75 may also be given to the fibroin fiber 70 by heating while retaining the fibroin fiber 70 in a state conforming to a curled shape. A fibroin fiber 70 that is given a curled shape can maintain the given shape even after being detached from the core material 75.

The diameter of the core material 75 is not particularly limited; however, the diameter is usually in the range of 1 to 100 mm. The shape of the core material is not limited to a cylindrical shape.

In the method according to the present embodiment, the fibroin fiber 70 that has been dried or wetted by water is wound around the core material 75. Here, the "dried fibroin fiber" means a fibroin fiber that has not been wetted by water. However, the dried fibroin fiber 70 may contain a small amount of unavoidable moisture. Therefore, the method according to the present embodiment may further include drying the fibroin fiber 70 before being wound around the core material 75. The fibroin fiber 70 is dried by, for example, retaining the fibroin fiber 70 in an environment at 10° C. to 100° C. The fibroin fiber 70 after drying is wound around the core material 75 without coming into contact with water or a liquid including water.

The fibroin fiber 70 wound around the core material 75 is retained in an environment at a predetermined temperature. This predetermined temperature may be a temperature that is not associated with heating in a case where the fibroin fiber 70 wound around the core material 75 is in a wet state, and specifically, the predetermined temperature may be, for example, 0° C. or higher, 10° C. or higher, or 20° C. or higher. When the fibroin fiber 70 wound around the core material 75 is in a dried state, the fibroin fiber 70 wound around the core material 75 may be heated or may not be heated. The heating temperature in a case where the fibroin fiber 70 wound around the core material 75 is heated may be higher than 40° C., 45° C. or higher, 50° C. or higher, 60° C. or higher, 70° C. or higher, 80° C. or higher, or 90° C. or higher and may be lower than 100° C. For heating, hot air may be blown toward the fibroin fiber 70. When the temperature at which the fibroin fiber is retained in a state conforming a predetermined shape is high, there is a tendency that the predetermined shape is easily given to the fibroin fiber in a short period of time.

The time for retaining the fibroin fiber 70 wound around the core material 75 is adjusted such that a shape is given to the fibroin fiber 70. Usually, the retention time may be in the range of 10 to 360 minutes and may be in the range of 30 to 90 minutes.

When the fibroin fiber 70 that has been wetted with water is retained in a state conforming to a predetermined shape, even when the fibroin fiber is not crosslinked by a chemical reaction or the like, not only the predetermined shape is easily given, but also the given shape is easily retained. It is thought that by heating the fibroin fiber 70 while retaining the fibroin fiber 70 in the presence of water, or heating the fibroin fiber 70 in a state of having been retained in the presence of water, the quantity of the β sheet structure of the modified fibroin in the fibroin fiber is increased. The present inventors speculate that as this β sheet structure functions as pseudo-crosslinking, movement of the molecular chain of the modified fibroin is limited, and as a result, the given shape is satisfactorily retained.

Before the fibroin fiber 70 is wound around the core material 75, the fibroin fiber 70 may be wetted with water in advance. When the fibroin fiber 70 is wetted with water in advance, there is a tendency that the fibroin fiber 70 that is retained in a state conforming to a predetermined shape is not likely to swell as a result of absorbing moisture. When swelling of the fibroin fiber 70 is suppressed, a predetermined shape can be given more easily to the fibroin fiber 70. For example, the fibroin fiber 70 may be brought into contact with water or an aqueous solution by immersing the fibroin fiber 70 in water or the aqueous solution or impregnating a fiber bundle including a plurality of single yarns of the fibroin fiber 70 with water or the aqueous solution. It is not necessarily essential to bring the fibroin fiber 70 into contact with pure water, and the fibroin fiber 70 may be brought into contact with an aqueous solution including additive components or a very small amount of unavoidable impurities. The concentration of components other than water in the aqueous solution to be brought into contact with the fibroin fiber 70 may be 1% by mass or less, 0.5% by mass or less, or less than 0.05% by mass, based on the total mass of the aqueous solution.

The temperature of the water or aqueous solution to be brought into contact with the fibroin fiber 70 is not particularly limited but may be, for example, 10° C. to 80° C. The time for immersion or impregnation is not particularly limited but may be, for example, 5 to 60 minutes. The fibroin fiber 70 after immersion is wound around the core material 75 while maintaining a state of being wetted with water. When the surface of the fibroin fiber 70 may get wet with water, and excessive moisture may be removed.

The fibroin fiber 70 that has been wetted with water and wound around the core material 75 may be heated at a predetermined heating temperature. The heating temperature may be 40° C. or higher, 45° C. or higher, or 50° C. or higher and may be 150° C. or lower, 140° C. or lower, 130° C. or lower, 120° C. or lower, 110° C. or lower, or lower than 100° C. For heating, hot air may be blown toward the fibroin fiber 70. When the heating temperature is high, retainability of the given shape tends to be further enhanced.

The fibroin fiber 70 wound around the core material 75 may be heated by leaving in a wet state to stand in a heating atmosphere, immersing in water that has been heated to a predetermined temperature or higher, or contacting with water vapor. The fibroin fiber 70 may be heated to a temperature exceeding 100° C. by contacting with water vapor. When the fibroin fiber 70 wound around the core material 75 is immersed in heated water or exposed to water vapor, since the fibroin fiber 70 is wetted with water at that time point, the fibroin fiber 70 to be wound around the core material 75 may not be wetted with water in advance.

The time for heating while retaining the fibroin fiber 70 wound around the core material 75 is adjusted such that a shape is given to the fibroin fiber 70. The retention time may be 5 minutes or more or 10 minutes or more and may be 240 minutes or less, 180 minutes or less, or 120 minutes or less.

While the fibroin fiber 70 wound around the core material 75 is retained in that state, it is necessary for the fibroin fiber 70 to retain a state of being wetted with water after being subjected to a heating step in a wet state, and the fibroin fiber 70 may be finally in a dry state. The fibroin fiber 70 wound around the core material 75, or the fibroin fiber 70 detached from the core material 75 may be dried by any means such as heating.

The fibroin fiber 70 to which a predetermined shape or a curled shape has been given can be used as a fiber for artificial hairs constituting an artificial hair. The fiber for artificial hairs formed from a fibroin fiber can be stably supplied and can suppress the occurrence of a feeling of strangeness between the fiber and human hair. An artificial hair can be used as, for example, hair for wigs, hair for hair pieces, hair for hair increase that is directly attached to the head, or hair for extension.

(Fibroin Fiber)

The fibroin fiber 70 can be a fiber that contains a modified fibroin as a main component and is formed by spinning a modified fibroin. The fibroin fiber 70 to be wound around the core material 75 may be a fiber that is not in direct contact with liquid water after spinning.

The fibroin fiber 70 may be a single yarn or may be a fiber bundle composed of a plurality of single yarns. The diameter (single yarn diameter) of the fibroin fiber 70 may be, for example, 10 to 100 μm. From the viewpoint of the ease of shaping and maintaining the given shape, the single yarn diameter of the fibroin fiber 70 may be more than 30 μm and may be 35 μm or more, 40 μm or more, 50 μm or more, 60 μm or more, 70 μm or more, or 80 μm or more. From a similar point of view, the single yarn diameter of the fibroin fiber 70 may be 90 μm or less, 85 μm or less, less than 80 μm, or 70 μm or less.

The term "modified fibroin" as used in the present specification refers to an artificially produced fibroin (synthetic fibroin). The modified fibroin may be a fibroin whose domain sequence is different from the amino acid sequence of naturally derived fibroin or may be a fibroin whose domain sequence is the same as the amino acid sequence of naturally derived fibroin.

The modified fibroin may be a protein containing a domain sequence represented by Formula 1: $[(A)_n$ motif-REP$]_m$ or Formula 2: $[(A)_n$ motif-REP$]_m$-$(A)_n$ motif. In the modified fibroin, an amino acid sequence (N-terminal sequence and C-terminal sequence) may be further added to either or both of the N-terminus side and the C-terminus side of the domain sequence. The N-terminal sequence and the C-terminal sequence are not limited to this but are typically regions that do not have repetitions of amino acid motifs characteristic of fibroin and include about 100 residues of amino acids.

The "modified fibroin" may be a fibroin that utilizes the amino acid sequence of naturally derived fibroin as it is, may be a fibroin whose amino acid sequence has been modified based on the amino acid sequence of the naturally derived fibroin (for example, a fibroin whose amino acid sequence has been modified by modifying a cloned gene sequence of naturally derived fibroin), or may be a fibroin that has been artificially designed and synthesized independently of naturally derived fibroin (for example, a fibroin having a desired amino acid sequence by chemically synthesizing a nucleic acid encoding a designed amino acid sequence).

In the present specification, the term "domain sequence" is an amino acid sequence that produces a crystalline region (typically, corresponding to an $(A)_n$ motif of an amino acid sequence) and an amorphous region (typically, corresponding to REP of an amino acid sequence) characteristic of fibroin and means an amino acid sequence represented by Formula 1: $[(A)_n$ motif-REP$]_m$ or Formula 2: $[(A)_n$ motif-REP$]_m$-$(A)_n$ motif. Here, the $(A)_n$ motif represents an amino acid sequence mainly including alanine residues, and the number of amino acid residues is 2 to 27. The number of amino acid residues in the $(A)_n$ motif may be an integer of 2 to 20, 4 to 27, 4 to 20, 8 to 20, 10 to 20, 4 to 16, 8 to 16, or 10 to 16. Furthermore, the proportion of the number of alanine residues with respect to the total number of amino acid residues in the $(A)_n$ motif may be 40% or more, and the proportion may be 60% or more, 70% or more, 80% or more, 83% or more, 85% or more, 86% or more, 90% or more, 95% or more, or 100%. A plurality of $(A)_n$ motifs present in the domain sequence may be such that at least seven of the motifs are composed only of alanine residues. REP represents an amino acid sequence composed of 2 to 200 amino acid residues. REP may also be an amino acid sequence composed of 10 to 200 amino acid residues. m represents an integer of 2 to 300 and may be an integer of 10 to 300. A plurality of $(A)_n$ motifs present in the domain sequence may be amino acid sequences that are identical to each other or may be different amino acid sequences. A plurality of REPs present in the domain sequence may be amino acid sequences that are identical to each other or may be different amino acid sequences.

The modified fibroin according to the present embodiment can be obtained by, for example, subjecting a cloned gene sequence of naturally derived fibroin to modification of an amino acid sequence corresponding to substitution, deletion, insertion, and/or addition of one amino acid residue or a plurality of amino acid residues. Substitution, deletion, insertion, and/or addition of amino acid residues can be performed by methods well known to those ordinarily skilled in the art, such as a site-directed mutagenesis method. Specifically, the modification may be performed according to a method described in literatures such as Nucleic Acid Res. 10, 6487 (1982), and Methods in Enzymology, 100, 448 (1983).

Naturally derived fibroin is a protein containing a domain sequence represented by Formula 1: $[(A)_n$ motif-REP$]_m$ or Formula 2: $[(A)_n$ motif-REP$]_m$-$(A)_n$ motif, and specific examples include fibroins produced by insects or spiders.

Examples of the fibroins produced by insects include silk proteins produced by silkworms such as *Bombyx mori, Bombyx mandarina, Antheraea yamamai, Anteraea pernyi, Eriogyna pyretorum, Pilosamia Cynthia ricini, Samia cynthia, Caligura japonica, Antheraea mylitta*, and *Antheraea assama*; and hornet silk proteins secreted by larvae of *Vespa simillima xanthoptera.*

More specific examples of the fibroins produced by insects include, for example, silkworm fibroin L chain (GenBank Accession Nos. M76430 (nucleotide sequence) and AAA27840.1 (amino acid sequence)).

Examples of the fibroins produced by spiders include spider silk proteins produced by spiders belonging to the genus *Araneus*, such as *Araneus ventricosus, Araneus diadematus, Araneus pinguis, Araneus pentagrammicus*, and *Araneus nojimai*; spiders belonging to the genus *Neoscona*, such as *Neoscona scylla, Neoscona nautica, Neoscona adianta*, and *Neoscona scylloides*; spiders belonging to the genus *Pronus*, such as *Pronous minutes*; spiders belonging to the genus *Cyrtarachne*, such as *Cyrtarachne bufo* and

*Cyrtarachne inaequalis*; spiders belonging to the genus *Gasteracantha*, such as *Gasteracantha kuhli* and *Gasteracantha mammosa*; spiders belonging to the genus *Ordgarius*, such as *Ordgarius hobsoni* and *Ordgarius sexspinosus*; spiders belonging to the genus *Argiope*, such as *Argiope amoena, Argiope minuta*, and *Argiope bruennich*; spiders belonging to the genus *Arachnura*, such as *Arachnura logio*; spiders belonging to the genus *Acusilas*, such as *Acusilas coccineus*; spiders belonging to the genus *Cytophora*, such as *Cyrtophora moluccensis, Cyrtophora exanthematica*, and *Cyrtophora* unicolor; spiders belonging to the genus *Poltys*, such as *Poltys illepidus*; spiders belonging to the genus *Cyclosa*, such as *Cyclosa octotuberculata, Cyclosa sedeculata, Cyclosa vallate*, and *Cyclosa atrata*; and spiders belonging to the genus *Chorizopes*, such as *Chorizopes nipponicus*; and spider silk proteins produced by spiders belonging to the genus *Tetragnatha*, such as *Tetragnatha praedonia, Tetragnatha maxillosa, Tetragnatha extensa*, and *Tetragnatha squamata*; spiders belonging to the genus *Leucauge*, such as *Leucauge magnifica, Leucauge blanda*, and *Leucauge subblanda*; spiders belonging to the genus *Nephila*, such as *Nephila clavate* and *Nephila pilipes*; spiders belonging to the genus *Menosira*, such as *Menosira ornate*; spiders belonging to the genus *Dyschiriognatha*, such as *Dyschiriognatha tenera*; spiders belonging to the genus *Latrodectus*, such as *Latrodectus mactans, Latrodectus hasseltii, Latrodectus geometricus*, and *Latrodectus tredecimguttatus*; and spiders belonging to the family Tetragnathidae, such as spiders belonging to the genus *Euprosthenops*. Examples of spider silk proteins include traction yarn proteins such as MaSp (MaSp1 and MaSp2) and ADF (ADF3 and ADF4), and MiSp (MiSp1 and MiSp2).

More specific examples of the spider silk proteins produced by spiders include, for example, fibroin-3 (adf-3) [derived from *Araneus diadematus*] (GenBank Accession Numbers AAC47010 (amino acid sequence), U47855 (nucleotide sequence)), fibroin-4 (adf-4) [derived from *Araneus diadematus*] (GenBank Accession Numbers AAC47011 (amino acid sequence), U47856 (nucleotide sequence)), dragline silk protein spidroin 1 [derived from *Nephila clavipes*] (GenBank Accession Numbers AAC04504 (amino acid sequence), U37520 (nucleotide sequence)), major ampullate spidroin 1 [derived from *Latrodectus hesperus*] (GenBank Accession Numbers ABR68856 (amino acid sequence), EF595246 (nucleotide sequence)), dragline silk protein spidroin 2 [derived from *Nephila clavata*] (GenBank Accession Number AAL32472 (amino acid sequence), AF441245 (nucleotide sequence)), major ampullate spidroin 1 [derived from *Euprosthenops australis*] (GenBank Accession Numbers CAJ00428 (amino acid sequence), AJ973155 (nucleotide sequence)), and major ampullate spidroin 2 [*Euprosthenops australis*] (GenBank Accession Numbers CAM32249.1 (amino acid sequence), AM490169 (nucleotide sequence)), minor ampullate silk protein 1 [*Nephila clavipes*] (GenBank Accession Number AAC14589.1 (amino acid sequence)), minor ampullate silk protein 2 [*Nephila clavipes*] (GenBank Accession Number AAC14591.1 (amino acid sequence)), and minor ampullate spidroin-like protein [*Nephilengys cruentata*] (GenBank Accession Number ABR37278.1 (amino acid sequence).

As a more specific example of the naturally derived fibroin, fibroin whose sequence information is registered with NCBI GenBank may be further mentioned. For example, sequences of naturally derived fibroins can be confirmed by extracting sequences for which the term spidroin, ampullate, fibroin, "silk and polypeptide", or "silk and protein" is described as a keyword in DEFINITION among the sequences including INV as DIVISION in the sequence information registered with the NCBI GenBank, and sequences in which a particular character string of product is described from CDS, or a particular character string is described from SOURCE to TISSUE TYPE.

The modified fibroin according to the present embodiment may be modified silk fibroin (a fibroin obtained by modifying the amino acid sequence of silk protein produced by silkworms), or may be modified spider thread fibroin (a fibroin obtained by modifying the amino acid sequence of spider silk protein produced by spiders). The modified fibroin may be a modified spider thread fibroin.

Specific examples of the modified fibroin include a modified fibroin derived from a large spinneret dragline protein produced at the major ampullate gland of a spider (first modified fibroin), a modified fibroin having a domain sequence in which the content of glycine residues has been reduced (second modified fibroin), a modified fibroin having a domain sequence in which the content of the $(A)_n$ motif has been reduced (third modified fibroin), a modified fibroin in which the content of glycine residues and the content of the $(A)_n$ motif have been reduced (fourth modified fibroin), a modified fibroin having a domain sequence that includes a region in which the hydropathy index is locally large (fifth modified fibroin), and a modified fibroin having a domain sequence in which the content of glutamine residues has been reduced (sixth modified fibroin).

Examples of the first modified fibroin include a protein containing a domain sequence represented by Formula 1: $[(A)_n \text{ motif-REP}]_m$. In the first modified fibroin, the number of amino acid residues of the $(A)_n$ motif may be 3 to 20, 4 to 20, 8 to 20, 10 to 20, 4 to 16, 8 to 16, or 10 to 16. In the first modified fibroin, the number of amino acid residues constituting an REP in Formula 1 may be 10 to 200 residues, 10 to 150 residues, 20 to 100 residues, or 20 to 75 residues. In the first modified fibroin, the total number of residues of glycine residues, serine residues, and alanine residues included in the amino acid sequence represented by Formula 1: $[(A)_n \text{ motif-REP}]_m$ may be 40% or more, 60% or more, or 70% or more, with respect to the total number of amino acid residues.

The first modified fibroin may be a polypeptide which contains a unit of an amino acid sequence represented by Formula 1: $[(A)_n \text{ motif-REP}]_m$ and in which the C-terminal sequence is an amino acid sequence set forth in any one of SEQ ID NO: 1 to SEQ ID NO: 3, or an amino acid sequence having an identity of 90% or higher with an amino acid sequence set forth in any one of SEQ ID NO: 1 to SEQ ID NO: 3.

The amino acid sequence set forth in SEQ ID NO: 1 is identical to an amino acid sequence including 50 residues of amino acids at the C-terminus of the amino acid sequence of ADF3 (GI: 1263287, NCBI), the amino acid sequence set forth in SEQ ID NO: 2 is identical to an amino acid sequence obtained by eliminating 20 residues from the C-terminus of the amino acid sequence set forth in SEQ ID NO: 1, and the amino acid sequence set forth in SEQ ID NO: 3 is identical to an amino acid sequence obtained by eliminating 29 residues from the C-terminus of the amino acid sequence set forth in SEQ ID NO: 1.

As a more specific example of the first modified fibroin, a modified fibroin containing: (1-i) an amino acid sequence set forth in SEQ ID NO: 4 (recombinant spider silk protein ADF3KaiLargeNRSH1), or (1-ii) an amino acid sequence having a sequence identity of 90% or higher with the amino acid sequence set forth in SEQ ID NO: 4, can be mentioned. The sequence identity may be 95% or higher.

The amino acid sequence set forth in SEQ ID NO: 4 is an amino acid sequence obtained by mutating the amino acid sequence of ADF3, in which an amino acid sequence (SEQ ID NO: 5) including a start codon, a His10 tag, and a HRV3C protease (Human rhinovirus 3C protease) recognition site has been added to the N-terminus, such that the 1st to 13th repeating regions are increased to approximately double, and the translation is terminated at the 1154th amino acid residue. The amino acid sequence at the C-terminus of the amino acid sequence set forth in SEQ ID NO: 4 is identical to the amino acid sequence set forth in SEQ ID NO: 3.

The modified fibroin of (1-i) may include the amino acid sequence set forth in SEQ ID NO: 4.

Regarding the second modified fibroin, its domain sequence has an amino acid sequence in which the content of glycine residues has been reduced compared to naturally derived fibroin. It can be said that the second modified fibroin is a modified fibroin having an amino acid sequence corresponding to an amino acid sequence in which at least one or a plurality of glycine residues in an REP has been substituted by other amino acid residue(s), as compared to naturally derived fibroin.

Regarding the second modified fibroin, its domain sequence may have an amino acid sequence corresponding to an amino acid sequence in which one glycine residue in at least one or a plurality of the motif sequences is substituted with another amino acid residue, in at least one motif sequence selected from GGX and GPGXX (provided that G represents a glycine residue, P represents a proline residue, and X represents an amino acid residue other than glycine) in an REP, as compared to naturally derived fibroin.

In the second modified fibroin, the proportion of the above-mentioned motif sequence in which a glycine residue has been substituted with another amino acid residue, may be 10% or more with respect to the entire motif sequence.

The second modified fibroin may be a modified fibrin having an amino acid sequence which contains a domain sequence represented by Formula 1: $[(A)_n \text{ motif-REP}]_m$, and in which when the total number of amino acid residues in an amino acid sequence including XGX (provided that X represents an amino acid residue other than glycine) included in all REP's in a sequence obtained by excluding the sequence ranging from the $(A)_n$ motif located on the furthermost C-terminus side to the C-terminus of the above-described domain sequence, from the above-described domain sequence, is denoted by z; and the total number of amino acid residues in a sequence obtained by excluding the sequence ranging from the $(A)_n$ motif located on the furthermost C-terminus side to the C-terminus of the above-described domain sequence, from the above-described domain sequence, is denoted by w, z/w is 30% or more, 40% or more, 50% or more, or 50.9% or more. The number of alanine residues with respect to the total number of amino acid residues in the $(A)_n$ motif may be 83% or more, 86% or more, 90% or more, 95% or more, or 100%. The number of alanine residues with respect to the total number of amino acid residues being 100% means that the $(A)_n$ motif is composed only of alanine residues.

The second modified fibroin may be such that the content proportion of the amino acid sequence including XGX is increased by substituting one glycine residue of the GGX motif with another amino acid residue. In the second modified fibroin, the content proportion of the amino acid sequence including GGX in the domain sequence may be 30% or less, 20% or less, 10% or less, 6% or less, 4% or less, or 2% or less. The content proportion of the amino acid sequence including GGX in the domain sequence can be calculated by a method similar to a method for calculating the content proportion (z/w) of the amino acid sequence including XGX as described below.

The method for calculating z/w will be described in more detail. First, for a fibroin (a modified fibroin or a naturally derived fibroin) containing a domain sequence represented by Formula 1: $[(A)_n \text{ motif-REP}]_m$, an amino acid sequence including XGX is extracted from all the REPs included in a sequence obtained by excluding the sequence ranging from the $(A)_n$ motif located on the furthermost C-terminus side to the C-terminus of the domain sequence, from the domain sequence. The total number of amino acid residues constituting XGX is z. For example, in a case where 50 amino acid sequences including XGX have been extracted (there is no overlap), z is 50×3=150. For example, in a case where there is an X included in two XGX sequences (central X) as in the case of an amino acid sequence including XGXGX, calculation is performed by deducting the overlapping portion (in the case of XGXGX, the overlapping portion is five amino acid residues). w represents the total number of amino acid residues included in a sequence obtained by excluding the sequence ranging from the $(A)_n$ motif located on the furthermost C-terminus side to the C-terminus of the domain sequence, from the domain sequence. For example, in the case of the domain sequence illustrated in FIG. 2, w is 4+50+4+100+4+10+4+20+4+30=230 (excluding the $(A)_n$ motif located at the furthermost C-terminus side). Next, z/w (%) can be calculated by dividing z by w.

Here, z/w in the naturally derived fibroin will be described. First, as described above, fibroins whose amino acid sequence information is registered with the NCBI GenBank were checked by the method mentioned as an example, and 663 kinds of fibroins (among these, there were 415 kinds of spider-derived fibroins) were extracted. z/w was calculated by the above-mentioned calculation method from the amino acid sequences of naturally derived fibroins, which contain a domain sequence represented by Formula 1: $[(A)_n \text{ motif-REP}]_m$ and in which the content proportion of the amino acid sequence including GGX in the fibroin is 6% or less, among all the extracted fibroins. As a result, it was confirmed that z/w in the naturally derived fibroins is less than 50.9% in all cases, and the maximum is 50.86%.

With regard to the second modified fibroin, z/w may be 50.9% or more, 56.1% or more, 58.7% or more, 70% or more, or 80% or more. The upper limit of z/w is not particularly limited; however, for example, z/w may be 95% or less.

The second modified fibroin can be obtained by, for example, performing modification such that at least some of nucleotide sequences encoding a glycine residue are substituted in a cloned gene sequence of naturally derived fibroin so as to encode other amino acid residues. In this case, one glycine residue in a GGX motif or a GPGXX motif may be selected as the glycine residue to be modified, and substitution may be performed such that z/w is 50.9% or more. Furthermore, the second modified fibroin can also be obtained by, for example, designing an amino acid sequence that satisfies the above-described aspects from the amino acid sequence of naturally derived fibroin, and chemically synthesizing a nucleic acid encoding the designed amino acid sequence. In all cases, in addition to the modification corresponding to a substitution of a glycine residue in an REP from the amino acid sequence of naturally derived fibroin with another amino acid residue, modification of the amino acid sequence corresponding to substitution, deletion, insertion, and/or addition of one or a plurality of amino acid residues may also be carried out.

The above-described other amino acid residue is not particularly limited as long as it is an amino acid residue other than a glycine residue; however, the other amino acid residue may be a hydrophobic amino acid residue such as a valine (V) residue, a leucine (L) residue, an isoleucine (I) residue, a methionine (M) residue, a proline (P) residue, a phenylalanine (F) residue, and a tryptophan (W) residue; or a hydrophilic amino acid residue such as a glutamine (Q) residue, an asparagine (N) residue, a serine (S) residue, a lysine (K) residue, and a glutamic acid (E) residue. The other amino acid residue may be selected from a valine (V) residue, a leucine (L) residue, an isoleucine (I) residue, a phenylalanine (F) residue, and a glutamine (Q) residue, or may be a glutamine (Q) residue.

As a more specific example of the second modified fibroin, a modified fibroin containing: (2-i) an amino acid sequence set forth in SEQ ID NO: 6 (Met-PRT380), SEQ ID NO: 7 (Met-PRT410), SEQ ID NO: 8 (Met-PRT525), or SEQ ID NO: 9 (Met-PRT799), or (2-ii) an amino acid sequence having a sequence identity of 90% or higher with the amino acid sequence set forth in SEQ ID NO: 6, SEQ ID NO: 7, SEQ ID NO: 8, or SEQ ID NO: 9, can be mentioned.

The modified fibroin of (2-i) will be described. The amino acid sequence set forth in SEQ ID NO: 6 is an amino acid sequence obtained by substituting GQX for all GGX's in the REPs of an amino acid sequence set forth in SEQ ID NO: 10 (Met-PRT313), which corresponds to naturally derived fibroin. The amino acid sequence set forth in SEQ ID NO: 7 is an amino acid sequence obtained by deleting every two $(A)_n$ motifs from the amino acid sequence set forth in SEQ ID NO: 6 from the N-terminus side toward the C-terminus side, and further inserting one $[(A)_n$ motif-REP] before the C-terminal sequence. The amino acid sequence set forth in SEQ ID NO: 8 is an amino acid sequence obtained by inserting two alanine residues into the C-terminus side of each $(A)_n$ motif of the amino acid sequence set forth in SEQ ID NO: 7, substituting some glutamine (Q) residues with serine (S) residues, and deleting some amino acids on the C-terminus side so that the molecular weight of the product becomes almost the same as the molecular weight of SEQ ID NO: 7. The amino acid sequence set forth in SEQ ID NO: 9 is an amino acid sequence obtained by adding a predetermined hinge sequence and a His tag sequence to the C-terminus of a sequence in which a region of twenty domain sequences (provided that several amino acid residues on the C-terminus side of this region have been substituted) present in the amino acid sequence set forth in SEQ ID NO: 7 is repeated four times.

The value of z/w for the amino acid sequence set forth in SEQ ID NO: 10 (corresponding to naturally derived fibroin) is 46.8%. The values of z/w for the amino acid sequence set forth in SEQ ID NO: 6, the amino acid sequence set forth in SEQ ID NO: 7, the amino acid sequence set forth in SEQ ID NO: 8, and the amino acid sequence set forth in SEQ ID NO: 9 are 58.7%, 70.1%, 66.1%, and 70.0%, respectively. Furthermore, the values of x/y for the amino acid sequences set forth in SEQ ID NO: 10, SEQ ID NO: 6, SEQ ID NO: 7, SEQ ID NO: 8, and SEQ ID NO: 9 at a jagged ratio (will be described below) of 1:1.8 to 11.3 are 15.0%, 15.0%, 93.4%, 92.7%, and 89.8%, respectively.

The modified fibroin of (2-i) may include an amino acid sequence set forth in SEQ ID NO: 6, SEQ ID NO: 7, SEQ ID NO: 8, or SEQ ID NO: 9.

The modified fibroin of (2-ii) is a modified fibroin containing an amino acid sequence having a sequence identity of 90% or higher with an amino acid sequence set forth in SEQ ID NO: 6, SEQ ID NO: 7, SEQ ID NO: 8, or SEQ ID NO: 9. The modified fibroin of (2-ii) is also a protein containing the domain sequence represented by Formula 1: $[(A)_n$ motif-REP$]_m$. The above-described sequence identity may be 95% or higher.

The modified fibroin of (2-ii) may have a sequence identity of 90% or higher with an amino acid sequence set forth in SEQ ID NO: 6, SEQ ID NO: 7, SEQ ID NO: 8, or SEQ ID NO: 9, and when the total number of amino acid residues of an amino acid sequence including XGX (provided that X represents an amino acid residue other than glycine) included in the REP is denoted by z, and the total number of amino acid residues in the REP in the domain sequence is denoted by w, z/w may be 50.9% or more.

The second modified fibroin may contain a tag sequence at either or both of the N-terminus and the C-terminus. This enables isolation, immobilization, detection, and visualization of the modified fibroin.

Regarding the tag sequence, for example, an affinity tag utilizing specific affinity (binding property, affinity) with another molecule may be mentioned. A specific example of the affinity tag may be a histidine tag (His tag). A His tag is a short peptide in which about 4 to 10 histidine residues are lined up, and since the His tag has a property of specifically binding to a metal ion such as nickel, the His tag can be utilized for isolation of a modified fibroin by chelating metal chromatography. Specific examples of the tag sequence include an amino acid sequence set forth in SEQ ID NO: 11 (an amino acid sequence containing a His-tag sequence and a hinge sequence).

Furthermore, a tag sequence such as glutathione-S-transferase (GST) that specifically binds to glutathione, or a maltose-binding protein (MBP) that specifically binds to maltose, can also be utilized.

Furthermore, an "epitope tag" that utilizes an antigen-antibody reaction can also be utilized. By adding a peptide exhibiting antigenicity (epitope) as a tag sequence, an antibody against this epitope can be bound. Examples of the epitope tag include an HA (peptide sequence of hemagglutinin of influenza virus) tag, a myc tag, and a FLAG tag. The modified fibroin can easily be purified with high specificity by utilizing an epitope tag.

A tag sequence that has been made cleavable with a particular protease can also be used. By treating a protein adsorbed through the tag sequence with a protease, a modified fibroin from which the tag sequence has been detached can be collected.

As a more specific example of a modified fibroin containing a tag sequence, a modified fibroin containing: (2-iii) an amino acid sequence set forth in SEQ ID NO: 12 (PRT380), SEQ ID NO: 13 (PRT410), SEQ ID NO: 14 (PRT525), or SEQ ID NO: 15 (PRT799), or (2-iv) an amino acid sequence having a sequence identity of 90% or higher with an amino acid sequence set forth in SEQ ID NO: 12, SEQ ID NO: 13, SEQ ID NO: 14, or SEQ ID NO: 15, can be mentioned.

The amino acid sequences set forth in SEQ ID NO: 16 (PRT313), SEQ ID NO: 12, SEQ ID NO: 13, SEQ ID NO: 14, and SEQ ID NO: 15 are amino acid sequences obtained by adding an amino acid sequence set forth in SEQ ID NO: 11 (containing a His tag sequence and a hinge sequence) to the N-termini of the amino acid sequences set forth in SEQ ID NO: 10, SEQ ID NO: 6, SEQ ID NO: 7, SEQ ID NO: 8, and SEQ ID NO: 9, respectively.

The modified fibroin of (2-iii) may include the amino acid sequence set forth in SEQ ID NO: 12, SEQ ID NO: 13, SEQ ID NO: 14, or SEQ ID NO: 15.

The modified fibroin of (2-iv) is a modified fibroin containing an amino acid sequence having a sequence identity of 90% or higher with an amino acid sequence set forth in SEQ ID NO: 12, SEQ ID NO: 13, SEQ ID NO: 14, or SEQ ID NO: 15. The modified fibroin of (2-iv) is also a protein containing the domain sequence represented by Formula 1: $[(A)_n$ motif-REP$]_m$. The above-described sequence identity may be 95% or higher.

The modified fibroin of (2-iv) may also be a modified fibroin which has a sequence identity of 90% or higher with an amino acid sequence set forth in SEQ ID NO: 12, SEQ ID NO: 13, SEQ ID NO: 14, or SEQ ID NO: 15, and in which when the total number of amino acid residues in the amino acid sequence including XGX (provided that X represents an amino acid residue other than glycine) included in the REP is denoted by z, and the total number of amino acid residues in the REP in the domain sequence is denoted by w, z/w is 50.9% or more.

The second modified fibroin may contain a secretory signal for releasing a protein produced in the recombinant protein production system to the outside of a host. The sequence of the secretory signal can be appropriately set according to the type of the host.

Regarding the third modified fibroin, its domain sequence has an amino acid sequence in which the content of the $(A)_n$ motif has been reduced as compared to naturally derived fibroin. The domain sequence of the third modified fibroin can be said to have an amino acid sequence corresponding to an amino acid sequence in which at least one or a plurality of the $(A)_n$ motifs have been deleted, as compared to naturally derived fibroin.

The third modified fibroin may have an amino acid sequence corresponding to an amino acid sequence obtained by deleting 10% to 40% of the $(A)_n$ motifs from naturally derived fibroin.

Regarding the third modified fibroin, its domain sequence may have an amino acid sequence corresponding to an amino acid sequence in which at least one $(A)_n$ motif in every one to three $(A)_n$ motifs has been deleted from the N-terminal side to the C-terminal side, as compared to naturally derived fibroin.

Regarding the third modified fibroin, its domain sequence may have an amino acid sequence corresponding to an amino acid sequence in which at least a deletion of two consecutive $(A)_n$ motifs and a deletion of one $(A)_n$ motif are repeated in this order from the N-terminus side to the C-terminus side, as compared to naturally derived fibroin.

Regarding the third modified fibroin, its domain sequence may have an amino acid sequence corresponding to an amino acid sequence in which at least every two $(A)_n$ motifs have been deleted from the N-terminus side toward the C-terminus side.

The third modified fibroin may also have an amino acid sequence which contains a domain sequence represented by Formula 1: $[(A)_n$ motif-REP$]_m$, and in which when the numbers of amino acid residues in the REP in two adjacent $[(A)_n$ motif-REP] units are sequentially compared from the N-terminus side toward the C-terminus side, and in a case where the number of amino acid residues in the REP having a smaller number of amino acid residues is designated as 1, the maximum value of the sum value obtained by adding the numbers of amino acid residues in two adjacent $[(A)_n$ motif-REP] units where the ratio of the number of amino acid residues in the other REP is 1.8 to 11.3 is designated as x, while the total number of amino acid residues in the domain sequence is designated as y, x/y is 20% or more, 30% or more, 40% or more, or 50% or more. The number of alanine residues with respect to the total number of amino acid residues in the $(A)_n$ motif may be 83% or more, 86% or more, 90% or more, 95% or more, or 100%. The number of alanine residues with respect to the total number of amino acid residues being 100% means that the $(A)_n$ motif is composed only of alanine residues.

Figure 2:
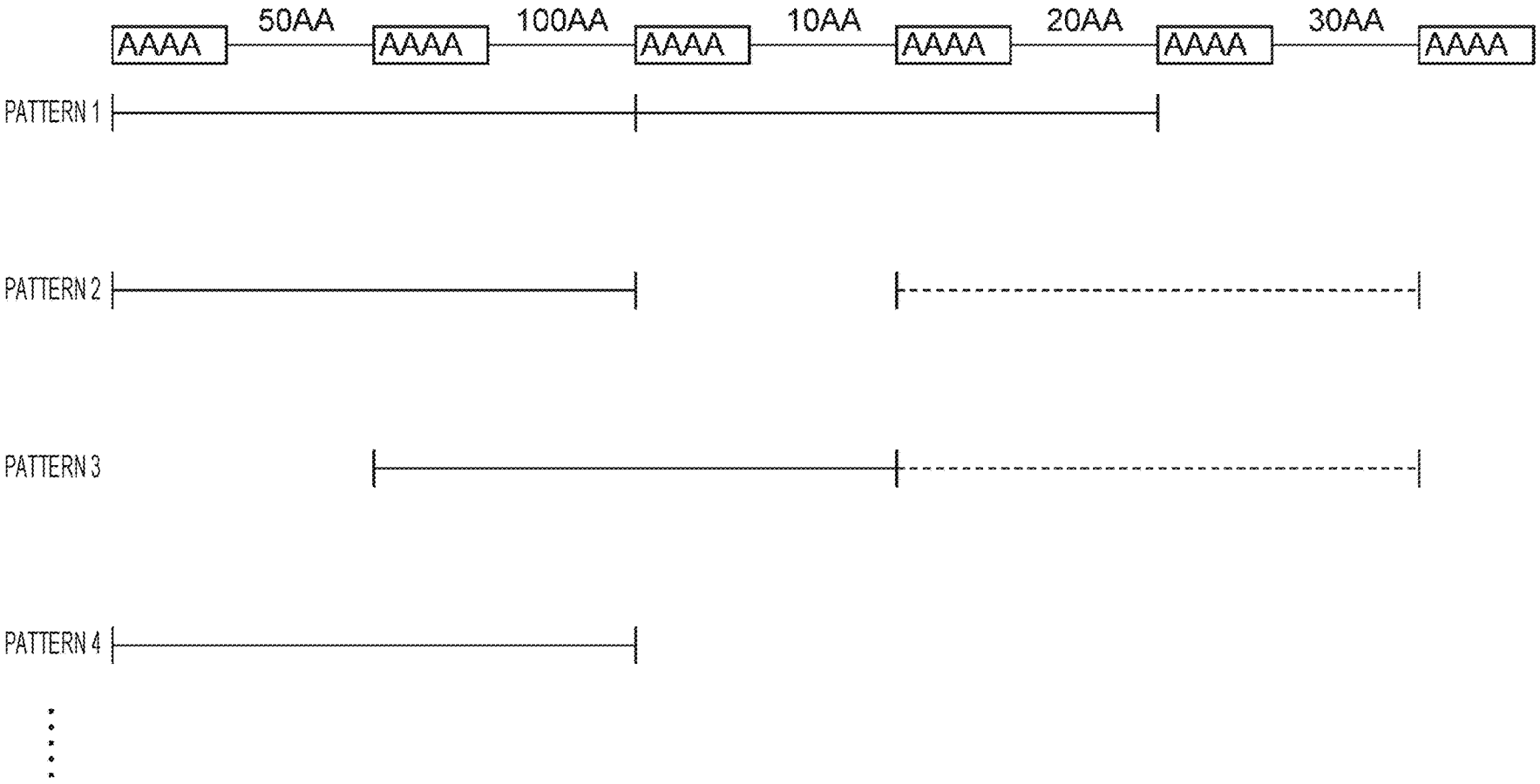
FIG. 2 is a schematic diagram illustrating an example of a domain sequence of a modified fibroin.

A calculation method for x/y will be described in more detail with reference to FIG. 2. FIG. 2 illustrates a domain sequence in which the N-terminal sequence and the C-terminal sequence have been excluded from a modified fibroin. This domain sequence has a sequence of $(A)_n$ motif-first REP (50 amino acid residues)-$(A)_n$ motif-second REP (100 amino acid residues)-$(A)_n$ motif-third REP (10 amino acid residues)-$(A)_n$ motif-fourth REP (20 amino acid residues)-$(A)_n$ motif-fifth REP (30 amino acid residues)-$(A)_n$ motif, from the N-terminus side (left side).

Two adjacent $[(A)_n$ motif-REP] units are sequentially selected from the N-terminus side to the C-terminus side so as to have no overlaps. At this time, there may be an unselected $[(A)_n$ motif-REP] unit. FIG. 2 illustrates pattern 1 (a comparison between first REP and second REP and a comparison between third REP and fourth REP), pattern 2 (a comparison between first REP and second REP and a comparison between fourth REP and fifth REP), pattern 3 (a comparison between second REP and third REP and a comparison between fourth REP and fifth REP), and pattern 4 (a comparison between first REP and second REP). There are also other selection methods in addition to this.

Next, for each of the patterns, the numbers of amino acid residues of the respective REPs in the selected two adjacent $[(A)_n$ motif-REP] units are compared with each other. The comparison is carried out, when the unit having a smaller number of amino acid residues is designated as 1, by determining the ratio of the number of amino acid residues on the other unit. For example, in the case of making a comparison between the first REP (50 amino acid residues) and the second REP (100 amino acid residues), when the first REP having a smaller number of amino acid residues is designated as 1, the ratio of the number of amino acid residues of the second REP is 100/50=2. Similarly, in the case of making a comparison between the fourth REP (20 amino acid residues) and the fifth REP (30 amino acid residues), when the fourth REP having a smaller number of amino acid residues is designated as 1, the ratio of the number of amino acid residues of the fifth REP is 30/20=1.5.

In FIG. 2, a combination of $[(A)_n$ motif-REP] units in which when the unit having a smaller number of amino acid residues is designated as 1, the ratio of the number of amino acid residues of the other unit is 1.8 to 11.3, is indicated by a solid line. In the present specification, this ratio is referred to as jagged ratio. The combination of $[(A)_n$ motif-REP] units in which when the unit having a smaller number of amino acid residues is designated as 1, the ratio of the number of amino acid residues of the other unit is less than 1.8 or more than 11.3, is indicated by a broken line.

In each pattern, all the numbers of amino acid residues in two adjacent $[(A)_n$ motif-REP] units shown by the solid lines are summed up (the numbers of amino acid residues in the REPs as well as in the $(A)_n$ motifs are added). The sum values obtained by summing up are compared, and the sum value of the pattern whose sum value is the maximum (maximum value of the sum value) is denoted by x. In the example shown in FIG. 2, the sum value of the pattern 1 is the maximum.

Then, x/y (%) can be calculated by dividing x by the total number of amino acid residues y of the domain sequence.

In the third modified fibroin, x/y may be 50% or more, 60% or more, 65% or more, 70% or more, 75% or more, or 80% or more. The upper limit of x/y is not particularly limited, and for example, x/y may be 100% or less. The jagged ratio may be 1:1.9 to 11.3, and x/y may be 89.6% or more. The jagged ratio may be 1:1.8 to 3.4, and x/y may be 77.1% or more. The jagged ratio may be 1:1.9 to 8.4, and x/y may be 75.9% or more. The jagged ratio may be 1:1.9 to 4.1, and x/y may be 64.2% or more.

When the third modified fibroin is a modified fibroin in which at least seven of a plurality of the $(A)_n$ motifs present in the domain sequence are composed only of alanine residues, x/y may be 46.4% or more, 50% or more, 55% or more, 60% or more, 70% or more, or 80% or more. The upper limit of x/y is not particularly limited and may be 100% or less.

Here, x/y in the naturally derived fibroin will be described. First, as described above, fibroins whose amino acid sequence information is registered with the NCBI GenBank were checked by the method mentioned as an example, and 663 kinds of fibroins (among these, there were 415 kinds of spider-derived fibroins) were extracted. x/y was calculated by the above-mentioned calculation method from the amino acid sequences of naturally derived fibroins composed of a domain sequence represented by Formula 1: $[(A)_n \text{ motif-REP}]_m$ among all the extracted fibroins. As a result, x/y in the naturally derived fibroins was less than 64.2% in all cases, and the maximum was 64.14%.

The third modified fibroin can be obtained by, for example, deleting one or a plurality of sequences encoding the $(A)_n$ motif from a cloned gene sequence for the naturally derived fibroin such that x/y is 64.2% or more. In addition, the third modified fibroin can also be obtained by, for example, designing an amino acid sequence corresponding to an amino acid sequence in which one or a plurality of $(A)_n$ motifs have been deleted from the amino acid sequence of naturally derived fibroin such that x/y is 64.2% or more, and chemically synthesizing a nucleic acid encoding the designed amino acid sequence. In all cases, in addition to the modification corresponding to a deletion of the $(A)_n$ motif from the amino acid sequence of naturally derived fibroin, modification of the amino acid sequence corresponding to substitution, deletion, insertion, and/or addition of one or a plurality of amino acid residues may also be carried out.

As a more specific example of the third modified fibroin, a modified fibroin containing: (3-i) an amino acid sequence set forth in SEQ ID NO: 17 (Met-PRT399), SEQ ID NO: 7 (Met-PRT410), SEQ ID NO: 8 (Met-PRT525), or SEQ ID NO: 9 (Met-PRT799), or (3-ii) an amino acid sequence having a sequence identity of 90% or higher with the amino acid sequence set forth in SEQ ID NO: 17, SEQ ID NO: 7, SEQ ID NO: 8, or SEQ ID NO: 9, can be mentioned.

The modified fibroin of (3-i) will be described. The amino acid sequence set forth in SEQ ID NO: 17 is an amino acid sequence obtained by deleting every two $(A)_n$ motifs from the amino acid sequence set forth in SEQ ID NO: 10 (Met-PRT313), which corresponds to naturally derived fibroin, from the N-terminus side toward the C-terminus side, and inserting one $[(A)_n \text{ motif-REP}]$ before the C-terminal sequence. The amino acid sequence set forth in SEQ ID NO: 7, SEQ ID NO: 8, or SEQ ID NO: 9 is as described in connection with the second modified fibroin.

The value of x/y for the amino acid sequence set forth in SEQ ID NO: 10 (corresponding to naturally derived fibroin) at a jagged ratio of 1:1.8 to 11.3 is 15.0%. The values of x/y for the amino acid sequence set forth in SEQ ID NO: 17 and the amino acid sequence set forth in SEQ ID NO: 7 are both 93.4%. The value of x/y for the amino acid sequence set forth in SEQ ID NO: 8 is 92.7%. The value of x/y for the amino acid sequence set forth in SEQ ID NO: 9 is 89.8%. The values of z/w for the amino acid sequences set forth in SEQ ID NO: 10, SEQ ID NO: 17, SEQ ID NO: 7, SEQ ID NO: 8, and SEQ ID NO: 9 are 46.8%, 56.2%, 70.1%, 66.1%, and 70.0%, respectively.

The modified fibroin of (3-i) may include an amino acid sequence set forth in SEQ ID NO: 17, SEQ ID NO: 7, SEQ ID NO: 8, or SEQ ID NO: 9.

The modified fibroin of (3-ii) is a modified fibroin containing an amino acid sequence having a sequence identity of 90% or higher with an amino acid sequence set forth in SEQ ID NO: 17, SEQ ID NO: 7, SEQ ID NO: 8, or SEQ ID NO: 9. The modified fibroin of (3-ii) is also a protein containing the domain sequence represented by Formula 1: $[(A)_n \text{ motif-REP}]_m$. The above-described sequence identity may be 95% or higher.

The modified fibroin of (3-ii) may have a sequence identity of 90% or higher with an amino acid sequence set forth in SEQ ID NO: 17, SEQ ID NO: 7, SEQ ID NO: 8, or SEQ ID NO: 9, and when the numbers of amino acid residues in the REPs in two adjacent $[(A)_n \text{ motif-REP}]$ units are sequentially compared from the N-terminus side toward the C-terminus side, and the number of amino acid residues in the REP having a smaller number of amino acid residues is designated as 1, and when the maximum value of the sum value obtained by adding the numbers of amino acid residues in two adjacent $[(A)_n \text{ motif-REP}]$ units where the ratio of the number of amino acid residues in the other REP is 1.8 to 11.3 (jagged ratio is 1:1.8 to 11.3) is designated as x, while the total number of amino acid residues in the domain sequence is designated as y, x/y is 64.2% or more.

The third modified fibroin may be such that either or both of the N-terminus and the C-terminus contain the above-mentioned tag sequence.

As a more specific example of a modified fibroin containing a tag sequence, a modified fibroin containing: (3-iii) an amino acid sequence set forth in SEQ ID NO: 18 (PRT399), SEQ ID NO: 13 (PRT410), SEQ ID NO: 14 (PRT525), or SEQ ID NO: 15 (PRT799); or (3-iv) an amino acid sequence having a sequence identity of 90% or higher with an amino acid sequence set forth in SEQ ID NO: 18, SEQ ID NO: 13, SEQ ID NO: 14, or SEQ ID NO: 15, can be mentioned.

The amino acid sequences set forth in SEQ ID NO: 18, SEQ ID NO: 13, SEQ ID NO: 14, and SEQ ID NO: 15 are amino acid sequences obtained by adding the amino acid sequence set forth in SEQ ID NO: 11 (including a His tag sequence and a hinge sequence) to the N-terminus of the amino acid sequences set forth in SEQ ID NO: 17, SEQ ID NO: 7, SEQ ID NO: 8, and SEQ ID NO: 9, respectively.

The modified fibroin of (3-iii) may be a modified fibroin including an amino acid sequence set forth in SEQ ID NO: 18, SEQ ID NO: 13, SEQ ID NO: 14, or SEQ ID NO: 15.

The modified fibroin of (3-iv) is a modified fibroin containing an amino acid sequence having a sequence identity of 90% or higher with the amino acid sequence set forth in SEQ ID NO: 18, SEQ ID NO: 13, SEQ ID NO: 14, or SEQ ID NO: 15. The modified fibroin of (3-iv) is also a protein containing the domain sequence represented by Formula 1: $[(A)_n \text{ motif-REP}]_m$. The above-described sequence identity may be 95% or higher.

The modified fibroin of (3-iv) may have a sequence identity of 90% or higher with an amino acid sequence set forth in SEQ ID NO: 18, SEQ ID NO: 13, SEQ ID NO: 14, or SEQ ID NO: 15, and when the numbers of amino acid residues in the REPs of two adjacent [$(A)_n$ motif-REP] units are sequentially compared from the N-terminus side toward the C-terminus side, and the number of amino acid residues in an REP having a smaller number of amino acid residues is designated as 1, and when the maximum value of the sum value obtained by adding the numbers of amino acid residues in two adjacent [$(A)_n$ motif-REP] units where the ratio of the number of amino acid residues in the other REP is 1.8 to 11.3 is designated as x, and the total number of amino acid residues in the domain sequence is designated as y, x/y is 64.2% or more.

The third modified fibroin may contain a secretory signal for releasing a protein produced in a recombinant protein production system to the outside of a host. The sequence of the secretory signal can be appropriately set according to the type of the host.

Regarding the fourth modified fibroin, its domain sequence has an amino acid sequence in which the content of glycine residues has been reduced, and the content of the $(A)_n$ motifs has also been reduced, as compared to naturally derived fibroin. It can be said that the domain sequence of the fourth modified fibroin has an amino acid sequence corresponding to an amino acid sequence in which at least one or a plurality of $(A)_n$ motifs have been deleted, and at least one or a plurality of glycine residues in the REP have also been substituted with other amino acid residue(s), as compared to naturally derived fibroin. That is, the fourth modified fibroin is a modified fibroin having the features of the second modified fibroin and third modified fibroin in combination. Specific embodiments and the like are as described in connection with the second modified fibroin and the third modified fibroin.

As a more specific example of the fourth modified fibroin, a modified fibroin containing: (4-i) an amino acid sequence set forth in SEQ ID NO: 7 (Met-PRT410), SEQ ID NO: 8 (Met-PRT525), SEQ ID NO: 9 (Met-PRT799), SEQ ID NO: 13 (PRT410), SEQ ID NO: 14 (PRT525), or SEQ ID NO: 15 (PRT799); or (4-ii) an amino acid sequence having a sequence identity of 90% or higher with the amino acid sequence set forth in SEQ ID NO: 7, SEQ ID NO: 8, SEQ ID NO: 9, SEQ ID NO: 13, SEQ ID NO: 14, or SEQ ID NO: 15, can be mentioned. Specific embodiments of the modified fibroin containing the amino acid sequence set forth in SEQ ID NO: 7, SEQ ID NO: 8, SEQ ID NO: 9, SEQ ID NO: 13, SEQ ID NO: 14, or SEQ ID NO: 15 are as described above.

Regarding the fifth modified fibroin, its domain sequence may have an amino acid sequence containing a region in which the hydropathy index is locally high, the amino acid sequence corresponding to an amino acid sequence in which one or a plurality of amino acid residues in the REP have been substituted with an amino acid residue(s) having a high hydropathy index, and/or an amino acid sequence in which one or a plurality of amino acid residues having a high hydropathy index have been inserted into the REP, as compared to naturally derived fibroin.

The region in which the hydropathy index is locally high may be composed of two to four consecutive amino acid residues.

The above-mentioned amino acid residue having a high hydropathy index may be an amino acid residue selected from isoleucine (I), valine (V), leucine (L), phenylalanine (F), cysteine (C), methionine (M), and alanine (A).

The fifth modified fibroin may further have modifications of an amino acid sequence corresponding to substitution, deletion, insertion, and/or addition of one or a plurality of amino acid residues as compared to naturally derived fibroin, in addition to modification corresponding to substitution of one or a plurality of amino acid residues in the REP with an amino acid residue having a large hydropathy index, and/or insertion of one or a plurality of amino acid residues having a large hydropathy index into the REP, as compared to naturally derived fibroin.

The fifth modified fibroin can be obtained by, for example, substituting one or a plurality of hydrophilic amino acid residues (for example, amino acid residues having a negative hydropathy index) in the REP from a cloned gene sequence of naturally derived fibroin with a hydrophobic amino acid residue(s) (for example, amino acid residues having a positive hydropathy index), and/or inserting one or a plurality of hydrophobic amino acid residues into the REP. Furthermore, the fifth modified fibroin can also be obtained by, for example, designing an amino acid sequence corresponding to an amino acid sequence in which one or a plurality of hydrophilic amino acid residues in the REP have been substituted with a hydrophobic amino acid residue(s), and/or one or a plurality of hydrophobic amino acid residues have been inserted into the REP, from the amino acid sequence of naturally derived fibroin, and chemically synthesizing a nucleic acid encoding the designed amino acid sequence. In all cases, in addition to the modification of the amino acid sequence corresponding to substitution of one or a plurality of hydrophilic amino acid residues in the REP from the amino acid sequence of naturally derived fibroin substituted with hydrophobic amino acid residue(s), and/or insertion of one or a plurality of hydrophobic amino acid residues into the REP, modification of an amino acid sequence corresponding to substitution, deletion, insertion, and/or addition of one or a plurality of amino acid residues may be further carried out.

The fifth modified fibroin may also have an amino acid sequence which contains a domain sequence represented by Formula 1: $[(A)_n \text{ motif-REP}]_m$, and in which for all the REPs included in a sequence obtained by excluding the sequence ranging from the $(A)_n$ motif located on the furthermost C-terminus side to the C-terminus of the domain sequence from the domain sequence, when the total number of amino acid residues included in a region in which the average value of the hydropathy indices of four consecutive amino acid residues is 2.6 or more is designated as p, and the total number of amino acid residues included in a sequence obtained by excluding the sequence ranging from the $(A)_n$ motif located on the furthermost C-terminus side to the C-terminus of the domain sequence from the domain sequence is designated as q, p/q is 6.2% or more.

Regarding the hydropathy index of the amino acid residue, a known index (Hydropathy index: Kyte J, & Doolittle R (1982), "A simple method for displaying the hydropathic character of a protein", J. Mol. Biol., 157, pp. 105-132) is used. Specifically, the hydropathy index (hereinafter, also referred to as "HI") of each amino acid is indicated in the following Table 1.

TABLE 1

| Amino acid | HI |
|---|---|
| Isoleucine (Ile) | 4.5 |
| Valine (Val) | 4.2 |
| Leucine (Leu) | 3.8 |
| Phenylalanine (Phe) | 2.8 |
| Cysteine (Cys) | 2.5 |
| Methionine (Met) | 1.9 |
| Alanine (Ala) | 1.8 |

TABLE 1-continued

| Amino acid | HI |
|---|---|
| Glycine (Gly) | −0.4 |
| Threonine (Thr) | −0.7 |
| Serine (Ser) | −0.8 |
| Tryptophan (Trp) | −0.9 |
| Tyrosine (Tyr) | −1.3 |
| Proline (Pro) | −1.6 |
| Histidine (His) | −3.2 |
| Asparagine (Asn) | −3.5 |
| Aspartic acid (Asp) | −3.5 |
| Glutamine (Gln) | −3.5 |
| Glutamic acid (Glu) | −3.5 |
| Lysine (Lys) | −3.9 |
| Arginine (Arg) | −4.5 |

A calculation method for p/q will be described in more detail. For the calculation, a sequence obtained by excluding the sequence ranging from the $(A)_n$ motif located on the furthermost C-terminus side to the C-terminus of the domain sequence from a domain sequence represented by Formula 1: $[(A)_n \text{ motif-REP}]_m$ (hereinafter, referred to as "sequence A") is used. First, for all the REPs included in the sequence A, the average value of the hydropathy indices of four consecutive amino acid residues is calculated. The average value of the hydropathy index is determined by dividing the total sum of HI of the respective amino acid residues included in the four consecutive amino acid residues by 4 (number of amino acid residues). The average value of the hydropathy index is determined for all of the four consecutive amino acid residues (each of the amino acid residues is used for calculating the average values for 1 to 4 times). Next, a region in which the average value of the hydropathy indices of four consecutive amino acid residues is 2.6 or more is specified. Even in a case where a certain amino acid residue corresponds to a plurality of "four consecutive amino acid residues whose average value of the hydropathy indices is 2.6 or more", the amino acid residue is counted as one amino acid residue in the region. Then, the total number of amino acid residues included in the region is p. Also, the total number of amino acid residues included in the sequence A is q.

Figure 3:
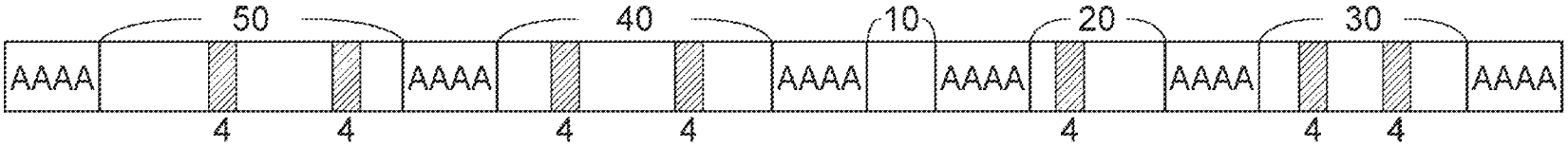
FIG. 3 is a schematic diagram illustrating an example of a domain sequence of a modified fibroin.

For example, in a case where the "four consecutive amino acid residues whose average value of the hydropathy indices is 2.6 or more" are extracted at 20 sites (no overlap), in a region where the average value of the hydropathy indices of four consecutive amino acid residues is 2.6 or more, twenty sets of four consecutive amino acid residues (no overlap) are included, and p is such that 20×4=80. For example, in a case where two sets of the "four consecutive amino acid residues whose average value of the hydropathy indices is 2.6 or more" overlap by only one amino acid residue, in a region where the average value of the hydropathy indices of four consecutive amino acid residues is 2.6 or more, the number of amino acid residues included is 7 (p=2×4−1=7. "−1" is the deduction for overlap). For example, in the case of the domain sequence shown in FIG. 3, since there are seven sets of the "four consecutive amino acid residues whose average value of the hydropathy indices is 2.6 or more" without overlap, p is such that 7×4=28. Furthermore, for example, in the case of the domain sequence shown in FIG. 3, q is such that 4+50+4+40+4+10+4+20+4+30=170 (the $(A)_n$ motif existing at the end of the C-terminus side is not included). Next, p/q (%) can be calculated by dividing p by q. In the case of FIG. 3, p/q is 28/170=16.47%.

With regard to the fifth modified fibroin, p/q may be 6.2% or more, 7% or more, 10% or more, 20% or more, or 30% or more. The upper limit of p/q is not particularly limited but may be, for example, 45% or less.

The fifth modified fibroin can be obtained by, for example, modifying a cloned amino acid sequence of naturally derived fibroin into an amino acid sequence containing a region in which the hydropathy index is locally high, by substituting one or a plurality of hydrophilic amino acid residues (for example, amino acid residues having a negative hydropathy index) in the REP with hydrophobic amino acid residues (for example, amino acid residues having a positive hydropathy index), and/or inserting one or a plurality of hydrophobic amino acid residues into the REP, so as to satisfy the above-described conditions for p/q. Furthermore, the fifth modified fibroin can also be obtained by, for example, designing an amino acid sequence that satisfies the above-described conditions for p/q from the amino acid sequence of naturally derived fibroin, and chemically synthesizing a nucleic acid encoding the designed amino acid sequence. In all cases, in addition to the modification corresponding to a substitution of one or a plurality of amino acid residues in the REP with an amino acid residue(s) having a high hydropathy index, and/or an insertion of one or a plurality of amino acid residues having a high hydropathy index into the REP, modification corresponding to substitution, deletion, insertion, and/or addition of one or a plurality of amino acid residues may be further carried out, as compared to naturally derived fibroin.

The amino acid residue with a high hydropathy index is not particularly limited but may be an amino acid residue selected from isoleucine (I), valine (V), leucine (L), phenylalanine (F), cysteine (C), methionine (M), and alanine (A). The amino acid residue having a high hydropathy index may also be an amino acid residue selected from valine (V), leucine (L), and isoleucine (I).

As a more specific example of the fifth modified fibroin, a modified fibroin containing: (5-i) an amino acid sequence set forth in SEQ ID NO: 19 (Met-PRT720), SEQ ID NO: 20 (Met-PRT665), or SEQ ID NO: 21 (Met-PRT666), or (5-ii) an amino acid sequence having a sequence identity of 90% or higher with an amino acid sequence set forth in SEQ ID NO: 19, SEQ ID NO: 20, or SEQ ID NO: 21, can be mentioned.

The modified fibroin of (5-i) will be described. The amino acid sequence set forth in SEQ ID NO: 19 is an amino acid sequence obtained by inserting an amino acid sequence each including three amino acid residues (VLI) at two sites in every other REP in the amino acid sequence set forth in SEQ ID NO: 7 (Met-PRT410), except for the domain sequence at the end on the C-terminus side, further substituting some of glutamine (Q) residues with serine (S) residues, and deleting some amino acids on the C-terminus side. The amino acid sequence set forth in SEQ ID NO: 20 is an amino acid sequence obtained by inserting an amino acid sequence each including three amino acid residues (VLI) at one site in every other REP in the amino acid sequence set forth in SEQ ID NO: 8 (Met-PRT525). The amino acid sequence set forth in SEQ ID NO: 21 is an amino acid sequence obtained by inserting an amino acid sequence each including three amino acid residues (VLI) at two sites in every other REP in the amino acid sequence set forth in SEQ ID NO: 8.

The modified fibroin of (5-i) may include an amino acid sequence set forth in SEQ ID NO: 19, SEQ ID NO: 20, or SEQ ID NO: 21.

The modified fibroin of (5-ii) contains an amino acid sequence having a sequence identity of 90% or higher with an amino acid sequence set forth in SEQ ID NO: 19, SEQ ID NO: 20, or SEQ ID NO: 21. The modified fibroin of (5-ii)

is also a protein including a domain sequence set forth in Formula 1: $[(A)_n$ motif-REP$]_m$. The above-described sequence identity may be 95% or higher.

The modified fibroin of (5-ii) may have a sequence identity of 90% or higher with an amino acid sequence set forth in SEQ ID NO: 19, SEQ ID NO: 20, or SEQ ID NO: 21, and for all the REPs included in a sequence obtained by excluding the sequence ranging from the $(A)_n$ motif located on the furthermost C-terminus side to the C-terminus of the domain sequence from the domain sequence, when the total number of amino acid residues included in a region in which the average value of the hydropathy indices of four consecutive amino acid residues is 2.6 or more is designated as p, and the total number of amino acid residues included in a sequence obtained by excluding the sequence from the $(A)_n$ motif located at the furthermost C-terminus side to the C-terminus of the domain sequence from the domain sequence is designated as q, p/q is 6.2% or more.

The fifth modified fibroin may contain a tag sequence at either or both of the N-terminus and the C-terminus.

As a more specific example of the modified fibroin containing a tag sequence, a modified fibroin containing: (5-iii) an amino acid sequence set forth in SEQ ID NO: 22 (PRT720), SEQ ID NO: 23 (PRT665), or SEQ ID NO: 24 (PRT666), or (5-iv) an amino acid sequence having a sequence identity of 90% or higher with the amino acid sequence set forth in SEQ ID NO: 22, SEQ ID NO: 23, or SEQ ID NO: 24, can be mentioned.

The amino acid sequences set forth in SEQ ID NO: 22, SEQ ID NO: 23, and SEQ ID NO: 24 are amino acid sequences obtained by adding the amino acid sequence set forth in SEQ ID NO: 11 (containing a His tag sequence and a hinge sequence) to the N-termini of the amino acid sequences set forth in SEQ ID NO: 19, SEQ ID NO: 20, and SEQ ID NO: 21, respectively.

The modified fibroin of (5-iii) may include an amino acid sequence set forth in SEQ ID NO: 22, SEQ ID NO: 23, or SEQ ID NO: 24.

The modified fibroin of (5-iv) is a modified fibroin containing an amino acid sequence having a sequence identity of 90% or higher with an amino acid sequence set forth in SEQ ID NO: 22, SEQ ID NO: 23, or SEQ ID NO: 24. The modified fibroin of (5-iv) is also a protein containing the domain sequence represented by Formula 1: $[(A)_n$ motif-REP$]_m$. The above-described sequence identity may be 95% or higher.

The modified fibroin of (5-iv) may have a sequence identity of 90% or higher with an amino acid sequence set forth in SEQ ID NO: 22, SEQ ID NO: 23, or SEQ ID NO: 24, and for all the REPs included in a sequence obtained by excluding the sequence ranging from the $(A)_n$ motif located on the furthermost C-terminus side to the C-terminus of the domain sequence from the domain sequence, when the total number of amino acid residues included in a region in which the average value of the hydropathy indices of four consecutive amino acid residues is 2.6 or more is designated as p, and the total number of amino acid residues included in a sequence obtained by excluding the sequence from the $(A)_n$ motif located on the furthermost C-terminus side to the C-terminus of the domain sequence from the domain sequence is designated as q, p/q is 6.2% or more.

The fifth modified fibroin may contain a secretory signal for releasing a protein produced in a recombinant protein production system to the outside of a host. The sequence of the secretory signal can be appropriately set according to the type of the host.

The sixth modified fibroin has an amino acid sequence in which the content of glutamine residues has been reduced, as compared to naturally derived fibroin.

Regarding the sixth modified fibroin, at least one motif selected from a GGX motif and a GPGXX motif may be included in the amino acid sequence of REP.

In a case where the sixth modified fibroin contains a GPGXX motif in the REP, the percentage content of the GPGXX motif is usually 1% or more and may be 5% or more or 10% or more. The upper limit of the percentage content of the GPGXX motif is not particularly limited and may be 50% or less or 30% or less.

In the present specification, the "percentage content of the GPGXX motif" is a value calculated by the following method.

With regard to a fibroin (modified fibroin or naturally derived fibroin) containing a domain sequence represented by Formula 1: $[(A)_n$ motif-REP$]_m$ or Formula 2: $[(A)_n$ motif-REP$]_m$-$(A)_n$ motif, for all the REPs included in a sequence obtained by excluding the sequence ranging from the $(A)_n$ motif located on the furthermost C-terminus side to the C-terminus of the domain sequence from the domain sequence, when the number at which the total number of the numbers of GPGXX motifs included in the region becomes three times (that is, corresponding to the total number of G and P in the GPGXX motif) is designated as s, and the total number of amino acid residues of all the REPs obtained by excluding the sequence from the $(A)_n$ motif located on the furthermost C-terminus side to the C-terminus of the domain sequence from the domain sequence and further excluding the $(A)_n$ motif is designated as t, the percentage content of the GPGXX motif is calculated as s/t.

With regard to the calculation of the percentage content of the GPGXX motif, "a sequence obtained by excluding the sequence ranging from the $(A)_n$ motif located on the furthermost C-terminus side to the C-terminus of the domain sequence from the domain sequence" is the target of the calculation because in the "sequence ranging from the $(A)_n$ motif located on the furthermost C-terminus side to the C-terminus of the domain sequence" (sequence corresponding to an REP), a sequence having low correlation with a sequence characteristic of fibroin may be included, and when m is small (that is, when the domain sequence is short), since the sequence affects the results of calculation of the percentage content of the GPGXX motif, this influence needs to be eliminated. Incidentally, in a case where a "GPGXX motif" is located at the C-terminus of REP, even when "XX" is, for example, "AA", the motif is dealt with as "GPGXX motif".

Figure 4:
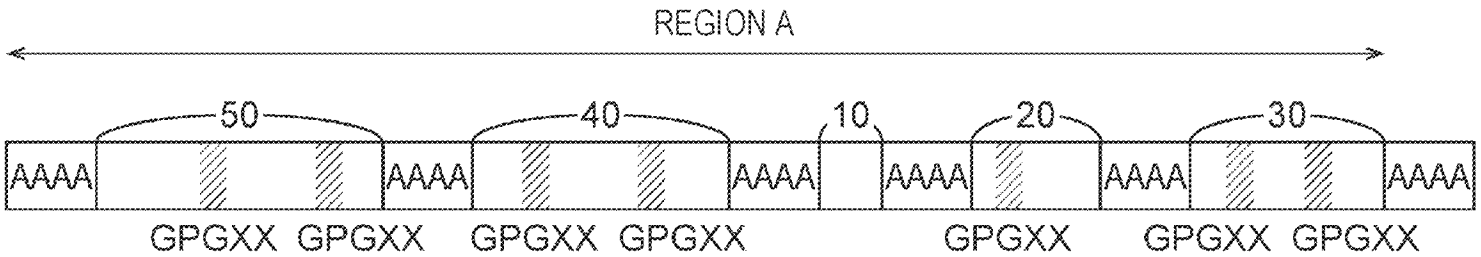
FIG. 4 is a schematic diagram illustrating an example of a domain sequence of a modified fibroin.

FIG. 4 is a schematic diagram illustrating a domain sequence of modified fibroin. The calculation method for the percentage content of the GPGXX motif will be specifically described with reference to FIG. 4. First, in the domain sequence ("$[(A)_n$ motif-REP$]_m$-$(A)_n$ motif" type) of the modified fibroin shown in FIG. 4, since all REPs are included in the "sequence obtained by excluding the sequence ranging from the $(A)_n$ motif located on the furthermost C-terminus side to the C-terminus of the domain sequence from the domain sequence" (in FIG. 4, the sequence represented by "region A"), the number of the GPGXX motifs for calculating s is 7, and s is 7×3=21. Similarly, since all REPs are included in the "sequence obtained by excluding the sequence ranging from the $(A)_n$ motif located on the furthermost C-terminus side to the C-terminus of the domain sequence from the domain sequence" (in FIG. 4, the sequence represented by "region A"), the total number t of amino acid residues in all the REPs, which is obtained by further excluding the $(A)_n$ motif from the sequence, is 50+40+10+20+30=150. Next, s/t (%) can be calculated by dividing s by t, and in the case of the modified fibroin of FIG. 4, s/t (%) is 21/150=14.0%.

The percentage content of glutamine residue in the sixth modified fibroin may be 9% or less, 7% or less, 4% or less, or 0%.

According to the present specification, the "percentage content of glutamine residue" is a value calculated by the following method.

With regard to a fibroin (modified fibroin or naturally derived fibroin) containing a domain sequence represented by Formula 1: $[(A)_n \text{ motif-REP}]_m$ or Formula 2: $[(A)_n \text{ motif-REP}]_m\text{-}(A)_n$ motif, for all the REPs included in a sequence obtained by excluding the sequence ranging from the $(A)_n$ motif located on the furthermost C-terminus side to the C-terminus of the domain sequence from the domain sequence (sequence corresponding to "region A" in FIG. 4), when the total number of glutamine residues included in that region is designated as u, and the total number of amino acid residues in all the REPs, which is obtained by excluding the sequence ranging from the $(A)_n$ motif located on the furthermost C-terminus side to the C-terminus of the domain sequence from the domain sequence and further excluding the $(A)_n$ motif, is designated as t, the percentage content of glutamine residue is calculated as u/t. For the calculation of the percentage content of glutamine residue, the reason for targeting the "sequence excluding the sequence ranging from the $(A)_n$ motif located on the furthermost C-terminus side to the C-terminus of the domain sequence from the domain sequence" is similar to the above-mentioned reason.

Regarding the sixth modified fibroin, its domain sequence may have an amino acid sequence corresponding to an amino acid sequence in which one or a plurality of glutamine residues in the REP have been deleted or substituted with other amino acid residue(s), as compared to naturally derived fibroin.

The "other amino acid residue(s)" may be an amino acid residue other than a glutamine residue but may also be an amino acid residue with a higher hydropathy index than that of a glutamine residue. The hydropathy indices of the amino acid residues are as shown in Table 1.

As shown in Table 1, examples of the amino acid residue with a higher hydropathy index than that of a glutamine residue include amino acid residues selected from isoleucine (I), valine (V), leucine (L), phenylalanine (F), cysteine (C), methionine (M), alanine (A), glycine (G), threonine (T), serine (S), tryptophan (W), tyrosine (Y), proline (P), and histidine (H). Among these, the amino acid residue may be an amino acid residue selected from isoleucine (I), valine (V), leucine (L), phenylalanine (F), cysteine (C), methionine (M), and alanine (A), or may be an amino acid residue selected from isoleucine (I), valine (V), leucine (L), and phenylalanine (F).

The degree of hydrophobicity of REP in the sixth modified fibroin may be −0.8 or higher, −0.7 or higher, 0 or higher, 0.3 or higher, or 0.4 or higher. The upper limit of the degree of hydrophobicity of REP is not particularly limited, and the degree of hydrophobicity of REP may be 1.0 or lower or 0.7 or lower.

According to the present specification, the "degree of hydrophobicity of REP" is a value calculated by the following method.

With regard to a fibroin (modified fibroin or naturally derived fibroin) containing a domain sequence represented by Formula 1: $[(A)_n \text{ motif-REP}]_m$ or Formula 2:$[(A)_n \text{ motif-REP}]_m\text{-}(A)_n$ motif, for all the REPs included in a sequence obtained by excluding the sequence ranging from the $(A)_n$ motif located on the furthermost C-terminus side to the C-terminus of the domain sequence from the domain sequence (sequence corresponding to "region A" in FIG. 4), when the total sum of the hydropathy indices of the respective amino acid residues in the region is designated as v, and the total number of amino acid residues in all the REPs, which is obtained by excluding the sequence from the $(A)_n$ motif located on the furthermost C-terminus side to the C-terminus of the domain sequence from the domain sequence and further excluding the $(A)_n$ motif, is designated as t, the degree of hydrophobicity of REP is calculated as v/t. For the calculation of the degree of hydrophobicity of REP, the reason for targeting the "sequence obtained by excluding the sequence ranging from the $(A)_n$ motif located on the furthermost C-terminus side to the C-terminus of the domain sequence from the domain sequence" is similar to the reason described above.

Regarding the sixth modified fibroin, its domain sequence may have further modification of the amino acid sequence corresponding to substitution, deletion, insertion, and/or addition of one or a plurality of amino acid residues, in addition to the modification of deletion of one or a plurality of glutamine residues in the REP and/or substitution of one or a plurality of glutamine residues in the REP with other amino acid residue(s), as compared to naturally derived fibroin.

The sixth modified fibroin can be obtained from, for example, a cloned gene sequence of naturally derived fibroin by deleting one or a plurality of glutamine residues in the REP and/or substituting one or a plurality of glutamine residues in the REP with other amino acid residue(s). Furthermore, the sixth modified fibroin can also be obtained by, for example, designing an amino acid sequence corresponding to an amino acid sequence in which one or a plurality of glutamine residues in the REP have been deleted and/or one or a plurality of glutamine residues in the REP have been substituted with other amino acid residue(s), from the amino acid sequence of naturally derived fibroin, and chemically synthesizing a nucleic acid encoding the designed amino acid sequence.

As a more specific example of the sixth modified fibroin, (6-i) a modified fibroin containing an amino acid sequence set forth in SEQ ID NO: 25 (Met-PRT888), SEQ ID NO: 26 (Met-PRT965), SEQ ID NO: 27 (Met-PRT889), SEQ ID NO: 28 (Met-PRT916), SEQ ID NO: 29 (Met-PRT918), SEQ ID NO: 30 (Met-PRT699), SEQ ID NO: 31 (Met-PRT698), SEQ ID NO: 32 (Met-PRT966), SEQ ID NO: 41 (Met-PRT917), or SEQ ID NO: 42 (Met-PRT1028), or (6-ii) a modified fibroin containing an amino acid sequence having a sequence identity of 90% or higher with the amino acid sequence set forth in SEQ ID NO: 25, SEQ ID NO: 26, SEQ ID NO: 27, SEQ ID NO: 28, SEQ ID NO: 29, SEQ ID NO: 30, SEQ ID NO: 31, SEQ ID NO: 32, SEQ ID NO: 41, or SEQ ID NO: 42, can be mentioned.

The modified fibroin of (6-i) will be described. The amino acid sequence set forth in SEQ ID NO: 25 is an amino acid sequence obtained by substituting every QQ in the amino acid sequence set forth in SEQ ID NO: 7 (Met-PRT410) with VL. The amino acid sequence set forth in SEQ ID NO: 26 is an amino acid sequence obtained by substituting every QQ in the amino acid sequence set forth in SEQ ID NO: 7 with TS and substituting the remaining Qs with As. The amino acid sequence set forth in SEQ ID NO: 27 is an amino acid sequence obtained by substituting every QQ in the amino acid sequence set forth in SEQ ID NO: 7 with VL and substituting the remaining Qs with Is. The amino acid sequence set forth in SEQ ID NO: 28 is obtained by substituting every QQ in the amino acid sequence set forth in SEQ ID NO: 7 with VI and substituting the remaining Qs with Ls. The amino acid sequence set forth in SEQ ID NO: 29 is obtained by substituting every QQ in the amino acid sequence set forth in SEQ ID NO: 7 with VF and substituting the remaining Qs with Is.

The amino acid sequence set forth in SEQ ID NO: 30 is an amino acid sequence obtained by substituting every QQ in the amino acid sequence set forth in SEQ ID NO: 8 (Met-PRT525) with VL. The amino acid sequence set forth in SEQ ID NO: 31 is an amino acid sequence obtained by substituting every QQ in the amino acid sequence set forth in SEQ ID NO: 8 with VL and substituting the remaining Qs with Is.

The amino acid sequence set forth in SEQ ID NO: 32 is an amino acid sequence obtained by substituting every QQ with VF and substituting the remaining Qs with Is, in a sequence in which a region of twenty domain sequences present in the amino acid sequence set forth in SEQ ID NO: 7 (Met-PRT410) is repeated twice.

The amino acid sequence set forth in SEQ ID NO: 41 (Met-PRT917) is an amino acid sequence obtained by substituting every QQ in the amino acid sequence set forth in SEQ ID NO: 7 with LI and substituting the remaining Qs with Vs. The amino acid sequence set forth in SEQ ID NO: 42 (Met-PRT1028) is an amino acid sequence obtained by substituting every QQ in the amino acid sequence set forth in SEQ ID NO: 7 with IF and substituting the remaining Qs with Ts.

In the amino acid sequences set forth in SEQ ID NO: 25, SEQ ID NO: 26, SEQ ID NO: 27, SEQ ID NO: 28, SEQ ID NO: 29, SEQ ID NO: 30, SEQ ID NO: 31, SEQ ID NO: 32, SEQ ID NO: 41, and SEQ ID NO: 42, the percentage content of glutamine residue is 9% or less in all cases (Table 2).

TABLE 2

| Modified fibroin | | Percentage content of glutamine residue | Percentage content of GPGXX motif | Degree of hydrophobicity of REP |
|---|---|---|---|---|
| Met-PRT410 | (SEQ ID NO: 7) | 17.7% | 27.9% | −1.52 |
| Met-PRT888 | (SEQ ID NO: 25) | 6.3% | 27.9% | −0.07 |
| Met-PRT965 | (SEQ ID NO: 26) | 0.0% | 27.9% | −0.65 |
| Met-PRT889 | (SEQ ID NO: 27) | 0.0% | 27.9% | 0.35 |
| Met-PRT916 | (SEQ ID NO: 28) | 0.0% | 27.9% | 0.47 |
| Met-PRT918 | (SEQ ID NO: 29) | 0.0% | 27.9% | 0.45 |
| Met-PRT699 | (SEQ ID NO: 30) | 3.6% | 26.4% | −0.78 |
| Met-PRT698 | (SEQ ID NO: 31) | 0.0% | 26.4% | −0.03 |
| Met-PRT966 | (SEQ ID NO: 32) | 0.0% | 28.0% | 0.35 |
| Met-PRT917 | (SEQ ID NO: 41) | 0.0% | 27.9% | 0.46 |
| Met-PRT1028 | (SEQ ID NO: 42) | 0.0% | 28.1% | 0.05 |

The modified fibroin of (6-i) may be a modified fibroin including an amino acid sequence set forth in SEQ ID NO: 25, SEQ ID NO: 26, SEQ ID NO: 27, SEQ ID NO: 28, SEQ ID NO: 29, SEQ ID NO: 30, SEQ ID NO: 31, SEQ ID NO: 32, SEQ ID NO: 41, or SEQ ID NO: 42.

The modified fibroin of (6-ii) is a modified fibroin containing an amino acid sequence having a sequence identity of 90% or higher with an amino acid sequence set forth in SEQ ID NO: 25, SEQ ID NO: 26, SEQ ID NO: 27, SEQ ID NO: 28, SEQ ID NO: 29, SEQ ID NO: 30, SEQ ID NO: 31, SEQ ID NO: 32, SEQ ID NO: 41, or SEQ ID NO: 42. The modified fibroin of (6-ii) is also a protein containing a domain sequence represented by Formula 1: $[(A)_n \text{ motif-REP}]_m$ or Formula 2: $[(A)_n \text{ motif-REP}]_m\text{-}(A)_n$ motif. The above-described sequence identity may be 95% or higher.

The percentage content of glutamine residue in the modified fibroin of (6-ii) may be 9% or less. Furthermore, the percentage content of GPGXX motif in the modified fibroin of (6-ii) may be 10% or more.

The sixth modified fibroin may contain a tag sequence at either or both of the N-terminus and the C-terminus. This enables isolation, immobilization, detection, and visualization of the modified fibroin.

As a more specific example of the modified fibroin having a tag sequence, (6-iii) a modified fibroin containing an amino acid sequence set forth in SEQ ID NO: 33 (PRT888), SEQ ID NO: 34 (PRT965), SEQ ID NO: 35 (PRT889), SEQ ID NO: 36 (PRT916), SEQ ID NO: 37 (PRT918), SEQ ID NO: 38 (PRT699), SEQ ID NO: 39 (PRT698), SEQ ID NO: 40 (PRT966), SEQ ID NO: 43 (PRT917), or SEQ ID NO: 44 (PRT1028), or (6-iv) a modified fibroin containing an amino acid sequence having a sequence identity of 90% or higher with an amino acid sequence set forth in SEQ ID NO: 33, SEQ ID NO: 34, SEQ ID NO: 35, SEQ ID NO: 36, SEQ ID NO: 37, SEQ ID NO: 38, SEQ ID NO: 39, SEQ ID NO: 40, SEQ ID NO: 43, or SEQ ID NO: 44, can be mentioned.

The amino acid sequences set forth in SEQ ID NO: 33, SEQ ID NO: 34, SEQ ID NO: 35, SEQ ID NO: 36, SEQ ID NO: 37, SEQ ID NO: 38, SEQ ID NO: 39, SEQ ID NO: 40, SEQ ID NO: 43, and SEQ ID NO: 44 are amino acid sequences obtained by adding the amino acid sequence set forth in SEQ ID NO: 11 (containing a His tag sequence and a hinge sequence) to the N-terminus of the amino acid sequences set forth in SEQ ID NO: 25, SEQ ID NO: 26, SEQ ID NO: 27, SEQ ID NO: 28, SEQ ID NO: 29, SEQ ID NO: 30, SEQ ID NO: 31, SEQ ID NO: 32, SEQ ID NO: 41, and SEQ ID NO: 42, respectively. Since this is merely addition of a tag sequence to the N-terminus, there is no change in the percentage content of glutamine residue, and in the amino acid sequences set forth in SEQ ID NO: 33, SEQ ID NO: 34, SEQ ID NO: 35, SEQ ID NO: 36, SEQ ID NO: 37, SEQ ID NO: 38, SEQ ID NO: 39, SEQ ID NO: 40, SEQ ID NO: 43, and SEQ ID NO: 44, the percentage content of glutamine residue is 9% or less in all cases (Table 3).

TABLE 3

| Modified fibroin | | Percentage content of glutamine residue | Percentage content of GPGXX motif | Degree of hydrophobicity of REP |
|---|---|---|---|---|
| PRT888 | (SEQ ID NO: 33) | 6.3% | 27.9% | −0.07 |
| PRT965 | (SEQ ID NO: 34) | 0.0% | 27.9% | −0.65 |
| PRT889 | (SEQ ID NO: 35) | 0.0% | 27.9% | 0.35 |
| PRT916 | (SEQ ID NO: 36) | 0.0% | 27.9% | 0.47 |
| PRT918 | (SEQ ID NO: 37) | 0.0% | 27.9% | 0.45 |
| PRT699 | (SEQ ID NO: 38) | 3.6% | 26.4% | −0.78 |
| PRT698 | (SEQ ID NO: 39) | 0.0% | 26.4% | −0.03 |
| PRT966 | (SEQ ID NO: 40) | 0.0% | 28.0% | 0.35 |
| PRT917 | (SEQ ID NO: 43) | 0.0% | 27.9% | 0.46 |
| PRT1028 | (SEQ ID NO: 44) | 0.0% | 28.1% | 0.05 |

The modified fibroin of (6-iii) may be a modified fibroin including the amino acid sequence set forth in SEQ ID NO: 33, SEQ ID NO: 34, SEQ ID NO: 35, SEQ ID NO: 36, SEQ ID NO: 37, SEQ ID NO: 38, SEQ ID NO: 39, SEQ ID NO: 40, SEQ ID NO: 43, or SEQ ID NO: 44.

The modified fibroin of (6-iv) is a modified fibroin containing an amino acid sequence having a sequence identity of 90% or higher with an amino acid sequence set forth in SEQ ID NO: 33, SEQ ID NO: 34, SEQ ID NO: 35, SEQ ID NO: 36, SEQ ID NO: 37, SEQ ID NO: 38, SEQ ID NO: 39, SEQ ID NO: 40, SEQ ID NO: 43, or SEQ ID NO: 44. The modified fibroin of (6-iv) is also a protein containing a domain sequence represented by Formula 1: $[(A)_n \text{ motif-REP}]_m$ or Formula 2: $[(A)_n \text{ motif-REP}]_m\text{-}(A)_n$ motif. The above-described sequence identity may be 95% or higher.

In the modified fibroin of (6-iv), the percentage content of glutamine residue may be 9% or less. Furthermore, in the modified fibroin of (6-iv), the percentage content of GPGXX motif may be 10% or more.

The sixth modified fibroin may be a modified fibroin containing a secretory signal for releasing a protein produced in a recombinant protein production system to the outside of a host. The sequence of the secretory signal can be appropriately set according to the type of the host.

The modified fibroin may also be a modified fibroin having at least two or more features in combination, among the features possessed by the modified fibroin of the first embodiment, the modified fibroin of the second embodiment, the modified fibroin of the third embodiment, the modified fibroin of the fourth embodiment, the modified fibroin of the fifth embodiment, and the modified fibroin of the sixth embodiment.

The modified fibroin may be a hydrophobic modified fibroin, from the viewpoint that contraction by contact with moisture can be suppressed. According to the present specification, the "hydrophobic modified fibroin" is a modified fibroin whose value obtained by determining the total sum of the hydropathy indices (HI) of all the amino acid residues constituting the modified fibroin and then dividing the total sum by the total number of amino acid residues (average HI) is 0 or more. The average value of the hydropathy index (average HI) of the modified fibroin may be 0.5 or more, or 0.6 or more. The average value of the hydropathy index (average HI) of the modified fibroin may be 1.2 or less, or 0.9 or less. The hydropathy index is as shown in Table 1. Furthermore, a modified fibroin having an average HI or less than 0 is also referred to as a hydrophobic modified fibroin.

Examples of the hydrophobic modified fibroin include modified fibroins containing an amino acid sequence set forth in SEQ ID NO: 27, SEQ ID NO: 28, SEQ ID NO: 29, SEQ ID NO: 30, SEQ ID NO: 31, SEQ ID NO: 32, SEQ ID NO: 33, or SEQ ID NO: 43; and an amino acid sequence set forth in SEQ ID NO: 35, SEQ ID NO: 37, SEQ ID NO: 38, SEQ ID NO: 39, SEQ ID NO: 40, SEQ ID NO: 41, or SEQ ID NO: 44.

Examples of a hydrophilic modified fibroin include modified fibroins containing an amino acid sequence set forth in SEQ ID NO: 4; an amino acid sequence set forth in SEQ ID NO: 6, SEQ ID NO: 7, SEQ ID NO: 8, or SEQ ID NO: 9; an amino acid sequence set forth in SEQ ID NO: 13, SEQ ID NO: 11, SEQ ID NO: 14, or SEQ ID NO: 15; an amino acid sequence set forth in SEQ ID NO: 18, SEQ ID NO: 7, SEQ ID NO: 8, or SEQ ID NO: 9; an amino acid sequence set forth in SEQ ID NO: 17, SEQ ID NO: 11, SEQ ID NO: 14, or SEQ ID NO: 15; or an amino acid sequence set forth in SEQ ID NO: 19, SEQ ID NO: 20, or SEQ ID NO: 21.

Each of the modified fibroins according to the above-described embodiments can all be produced by, for example, expressing a nucleic acid encoding the modified fibroin using a host transformed with an expression vector that has the nucleic acid sequence and one or a plurality of regulatory sequences operatively linked to the nucleic acid sequence.

The method for producing a nucleic acid encoding a modified fibroin is not particularly limited. For example, the nucleic acid can be produced by a method of utilizing a gene encoding naturally derived fibroin to amplify and clone the gene by a polymerase chain reaction (PCR) or the like, and modifying the nucleic acid by a genetic engineering technique, or a method of chemically synthesizing the nucleic acid. The method of chemically synthesizing a nucleic acid is also not particularly limited, and for example, a gene can be chemically synthesized by a method of linking an oligonucleotide that has been automatically synthesized with AKTA oligopilot plus 10/100 (GE Healthcare Japan Corporation) or the like, by PCR or the like based on the amino acid sequence information of fibroin obtained from the NCBI web database and the like. At this time, in order to facilitate purification and/or confirmation of the modified fibroin, a nucleic acid encoding a modified fibroin including an amino acid sequence obtained by adding an amino acid sequence including a start codon and a His10 tag to the N-terminus of the above-described amino acid sequence, may be synthesized.

The regulatory sequence is a sequence that controls the expression of the modified fibroin in a host (for example, a promoter, an enhancer, a ribosome binding site, a transcription termination sequence, and the like) and can be appropriately selected according to the type of the host. As a promoter, an inducible promoter that functions in a host cell and can induce expression of a modified fibroin, may be used. An inducible promoter is a promoter that can control transcription due to the presence of an inducer (expression inducer), the absence of a repressor molecule, or physical factors such as an increase or decrease in temperature, osmotic pressure, or pH value.

The type of the expression vector can be appropriately selected according to the type of the host, from a plasmid vector, a virus vector, a cosmid vector, a fosmid vector, an artificial chromosome vector, and the like. As the expression vector, an expression vector which is capable of autonomous replication in a host cell or is capable of incorporation into the chromosome of a host, and contains a promoter at a position where a nucleic acid encoding a modified fibroin can be transcribed, is suitably used.

As the host, prokaryotes and eukaryotes such as yeast, filamentous fungi, insect cells, animal cells, and plant cells can all be used.

Preferred examples of a prokaryote host include bacteria belonging to the genus *Escherichia*, the genus *Brevibacillus*, the genus *Serratia*, the genus *Bacillus*, the genus *Microbacterium*, the genus *Brevibacterium*, the genus *Corynebacterium*, and the genus *Pseudomonas*. Examples of microorganisms belonging to the genus *Escherichia* include *Escherichia coli*. Examples of microorganisms belonging to the genus *Brevibacillus* include *Brevibacillus agri*. Examples of microorganisms belonging to the genus *Serratia* include *Serratia liquefaciens*. Examples of microorganisms belonging to the genus *Bacillus* include *Bacillus subtilis*. Examples of microorganisms belonging to the genus *Microbacterium* include *Microbacterium ammoniaphilum*. Examples of microorganisms belonging to the genus *Brevibacterium* include *Brevibacterium divaricatum*. Examples of microorganisms belonging to the genus *Corynebacterium* include *Corynebacterium ammoniagenes*. Examples of the microorganism belonging to the genus *Pseudomonas* include *Pseudomonas putida*.

In a case where a prokaryote is used as a host, examples of the vector into which a nucleic acid encoding a modified fibroin is introduced include pBTrp2 (manufactured by Boehringer Mannheim Corporation), pGEX (manufactured by Pharmacia Corporation), pUC18, pBluescriptII, pSupex, pET22b, pCold, pUB110, and pNCO2 (Japanese Unexamined Patent Publication No. 2002-238569).

Examples of a eukaryotic host include yeast and filamentous fungi (molds and the like). Examples of the yeast include yeasts belonging to the genus *Saccharomyces*, the genus *Pichia*, and the genus *Schizosaccharomyces*. Examples of the filamentous fungi include filamentous fungi belonging to the genus *Aspergillus*, the genus *Penicillium*, and the genus *Trichoderma*.

In a case where a eukaryote is used as a host, examples of the vector into which a nucleic acid encoding a modified fibroin is introduced include YEP13 (ATCC37115) and YEp24 (ATCC37051). Regarding a method for introducing an expression vector into the above-described host cell, any method can all be used as long as it is a method for introducing a DNA into the host cell. For example, a method of using calcium ions [Proc. Natl. Acad. Sci. USA, 69, 2110 (1972)], an electroporation method, a spheroplast method, a protoplast method, a lithium acetate method, and a competent method may be mentioned.

Regarding a method for expressing a nucleic acid by a host transformed with an expression vector, secretory production, fusion protein expression, and the like can be carried out, in addition to direct expression, according to the methods described in Molecular Cloning, 2nd Edition, or the like.

A modified fibroin can be produced by, for example, culturing a host transformed with an expression vector in a culture medium, producing and accumulating the modified fibroin in the culture medium, and collecting the modified fibroin from the culture medium. The method of culturing a host in a culture medium can be carried out according to a method that is conventionally used for culturing a host.

In a case where the host is a prokaryote such as *Escherichia coli* or a eukaryote such as yeast, any of a natural medium and a synthetic medium may be used as the culture medium, as long as it is a medium containing a carbon source, a nitrogen source, inorganic salts, and the like that can be assimilated by the host and is capable of efficiently performing culturing of the host.

As the carbon source, any carbon source that can be assimilated by a transformed microorganism may be used, and for example, carbohydrates such as glucose, fructose, sucrose, molasses containing these, starch, and starch hydrolysates containing these; organic acids such as acetic acid and propionic acid; and alcohols such as ethanol and propanol, can be used. As the nitrogen source, for example, ammonia, ammonium salts of inorganic acids or organic acids, such as ammonium chloride, ammonium sulfate, ammonium acetate, and ammonium phosphate; other nitrogen-containing compounds; and peptone, meat extract, yeast extract, corn steep liquor, casein hydrolysate, soybean cake, and soybean cake hydrolysate, various fermented microbial cells, and digestion products thereof, can be used. As the inorganic salts, for example, monopotassium phosphate, dipotassium phosphate, magnesium phosphate, magnesium sulfate, sodium chloride, ferrous sulfate, manganese sulfate, copper sulfate, and calcium carbonate can be used.

Culture of a prokaryote such as *Escherichia coli* or a eukaryote such as yeast can be carried out, for example, under aerobic conditions such as shaking culture or deep aeration stirring culture. The culturing temperature is, for example, 15° C. to 40° C. The culturing time is usually 16 hours to 7 days. The pH of the culture medium during culturing may be maintained at 3.0 to 9.0. Adjustment of the pH of the culture medium can be performed using an inorganic acid, an organic acid, an alkali solution, urea, calcium carbonate, ammonia, and the like.

Furthermore, during culturing, antibiotic substances such as ampicillin and tetracycline may also be added to the culture medium, as necessary. When culturing a microorganism transformed with an expression vector that uses an inducible promoter as a promoter, if necessary, an inducer may be added to the medium. For example, in the case of culturing a microorganism transformed with an expression vector that uses a lac promoter, isopropyl-β-D-thiogalactopyranoside or the like may be added to the medium, and in the case of culturing a microorganism transformed with an expression vector that uses a trp promoter, indole acrylic acid or the like may be added to the medium.

Isolation and purification of the expressed modified fibroin can be performed by a method that is conventionally used. For example, in a case where the modified fibroin is expressed in a state of being dissolved in cells, after completion of culture, the host cells are collected by centrifugal separation and suspended in a water-based buffer solution, subsequently the host cells are disrupted using an ultrasonic disruptor, a French press, a Manton-Gaulin homogenizer, a Dyno Mill, or the like, and a cell-free extract is obtained. From a supernatant obtained by centrifugally separating this cell-free extract, a purified preparation can be obtained by methods that are conventionally used for the isolation and purification of a modified fibroin, that is, methods such as a solvent extraction method, a salting-out method using ammonium sulfate or the like, a desalting method, a precipitation method using an organic solvent, an anion exchange chromatography method using a resin such as diethylaminoethyl (DEAE)-sepharose or DIAION HPA-75 (manufactured by Mitsubishi Chemical Corporation), a cation exchange chromatography method using a resin such as S-sepharose FF (manufactured by Pharmacia Corporation), a hydrophobic chromatography method using a resin such as butyl sepharose or phenyl sepharose, a gel filtration method using a molecular sieve, an affinity chromatography method, a chromatofocusing method, and an electrophoresis method such as isoelectric point electrophoresis, singly or in combination.

Furthermore, in a case where a modified fibroin has formed an insoluble matter in the cell and is expressed, host cells are similarly collected and then disrupted, centrifugal separation is carried out, and thereby the insoluble matter of the modified fibroin is collected as a precipitated fraction. The insoluble matter of the modified fibroin thus collected can be solubilized with a protein denaturing agent. After this operation, a purified preparation of the modified fibroin can be obtained by a similar isolation and purification method as described above. In a case where the modified fibroin is secreted outside the cells, the modified fibroin can be collected from the culture supernatant. That is, the culture supernatant is obtained by treating a culture product by a technique such as centrifugal separation, and from the culture supernatant, a purified preparation can be obtained by using a similar isolation and purification method as described above.

A fibroin fiber that is given a predetermined shape or a curled shape may expand when placed in a wet state and contract when dried from a wet state. By giving a predetermined shape to the fibroin fiber that expands when placed in a wet state and contracts when dried from a wet state according to the above-mentioned method, a fiber for artificial hairs that is given a predetermined shape, which expands when placed in a wet state and contracts when dried from a wet state, can be easily produced. The predetermined shape may be a shape including a curved part, a linear part, or both of these.

The recovery rate of the fibroin fiber that expands when placed in a wet state and contracts when dried from a wet state, the recovery rate being defined by the following Formula (1), may be 95% or higher.

Recovery rate=(Length of fibroin fiber when dried from wet state/length of fibroin fiber before being placed in wet state)×100(%) Formula (1):

As the recovery rate defined by Formula (1) is higher, the behavior at the time of wetting and drying is close to that of human hair, and therefore, the occurrence of a feeling of strangeness between artificial hair and human hair can be suppressed. The recovery rate of the fibroin fiber as defined by Formula (1) may be 96% or higher, 97% or higher, 98% or higher, or 99% or higher.

The elongation rate of the fibroin fiber as defined by the following Formula (4) may be 17% or less. The elongation rate defined by Formula (4) is an index of the elongation characteristics obtainable when the fibroin fiber is placed in a wet state.

Elongation rate={(Length of fibroin fiber in wet state/length of fibroin fiber before being placed in wet state)−1}×100(%) Formula (4):

The elongation rate defined by Formula (4) may be, for example, 15% or less, 13% or less, 10% or less, or 5% or less. The elongation rate defined by Formula (4) may be, for example, more than 0%, 1% or more, 2% or more, 5% or more, 10% or more, or 13% or more. The elongation rate of the fibroin fiber according to the present embodiment may be, for example, more than 0% and 17% or less, more than 0% and 15% or less, 2% or more and 15% or less, 5% or more and 15% or less, 5% or more and 13% or less, 5% or more and 10% or less, more than 0% and 10% or less, or more than 0% and 5% or less. From the viewpoint of further reducing the feeling of strangeness between artificial hair and human hair, the elongation rate defined by Formula (4) may be small.

The contraction rate C of the fibroin fiber as defined by the following Formula (5) may be 17% or less. The contraction rate C defined by Formula (5) is an index of the contraction characteristics obtainable when the fibroin fiber is dried from a wet state.

Contraction rate C={1−(length of fibroin fiber when dried from wet state/length of fibroin fiber in wet state)}×100(%). Formula (5):

The contraction rate C defined by Formula (5) may be 15% or less, 13% or less, 10% or less, or 5% or less. The contraction rate C defined by Formula (5) may be more than 0%, 1% or more, 2% or more, 5% or more, 10% or more, or 13% or more. The contraction rate C of the fibroin fiber according to the present embodiment may be, for example, more than 0% and 17% or less, more than 0% and 15% or less, 2% or more and 15% or less, 5% or more and 15% or less, 5% or more and 13% or less, 5% or more and 10% or less, more than 0% and 10% or less, or more than 0% and 5% or less. From the viewpoint of further reducing the feeling of strangeness between artificial hair and human hair, the contraction rate C defined by Formula (5) may be low.

The fibroin fiber may be a fiber having a contraction history of being irreversibly contracted by being brought into contact with water after spinning. In that case, contraction rate A of the fibroin fiber as defined by the following Formula (2) may be 2% or less. For a fibroin fiber having a contraction rate A of 2% or more is such that the behavior at the time of wetting and drying is closer to that of human hair.

Contraction rate A={1−(length of fiber irreversibly contracted by being brought into contact with water after spinning/length of fiber before being brought into contact with water after spinning)}×100(%) Formula (2):

The contraction rate A defined by Formula (2) may be 2.5% or more, 3% or more, 3.5% or more, 4% or more, 4.5% or more, 5% or more, 5.5% or more, 6% or more, 10% or more, 15% or more, 20% or more, or 25% or more. The upper limit of the contraction rate A defined by Formula (2) is not particularly limited; however, the contraction rate A may be 80% or less, 60% or less, 40% or less, 20% or less, 10% or less, 7% or less, 6% or less, 5% or less, 4% or less, or 3% or less.

The fibroin fiber may also be a fiber having a contraction history of being irreversibly contracted by being brought into contact with water after spinning and then being further contracted by drying. In this case, contraction rate B of the fibroin fiber as defined by the following Formula (3) may be more than 7%. The fibroin fiber having a contraction rate B defined by Formula (3) of more than 7% is such that the behavior of the fibroin fiber at the time of wetting and drying is closer to that of human hair.

Contraction rate B={1−(length of fiber being irreversibly contracted by being brought into contact with water after spinning and then being further contracted by drying/length of fiber before being brought into contact with water after spinning)}×100(%) Formula (3):

The contraction rate B defined by Formula (3) may be 10% or more, 15% or more, more than 25%, 32% or more, 40% or more, 48% or more, 56% or more, 64% or more, or 72% or more. The upper limit of the contraction rate B defined by Formula (3) is not particularly limited; however, the contraction rate B is usually 80% or less.

Concavities or grooves extending in the direction of fiber axis may be formed on the surface of the fibroin fiber. A fibroin fiber having a surface where concavities or grooves are formed shows suppressed glossiness and can realize an outer appearance similar to that of human hair. Regarding a method of providing concavities on the surface of the fibroin fiber, for example, a method of performing spinning by a wet spinning method at the time of spinning a raw material fiber, a method of lowering the rate of desolventization (for example, a method of adding the solvent of a dope solution to a coagulating liquid), and the methods described in WO 2016/201369 A (for example, a method of lengthening the staying time in a coagulation bath (60 seconds or longer), and a method of changing the solvent ratio in the coagulation bath) can be employed.

The thermal contraction rate of the fibroin fiber defined by the following Formula (6) may be 4% or less.

$$\text{Thermal contraction rate}=\{1-(\text{length of fibroin fiber when heated to } 160^\circ\text{ C.}/\text{length of fibroin fiber before heating})\}\times 100(\%) \quad \text{Formula (6):}$$

A fiber for artificial hairs formed from a fibroin fiber containing a modified fibroin has a softening point at a temperature that is higher than that of general synthetic fibers and is comparable to that of human hair. Therefore, the fibroin fiber has a small thermal contraction rate (thermal contraction rate defined by Formula (6)) at 160° C. The hot air temperature of hair dryers is set to 120° C. to 140° C., and the suitable temperature for use of hair curling tongs is 170° C. or lower. Since the thermal contraction rate defined by Formula (6) is small, the damage occurring at the time of using a hair dryer or a hair curling tong can be suppressed. The thermal contraction rate defined by Formula (6) may be, for example, 4% or less, 3% or less, or 2.5% or less.

A fibroin fiber containing a modified fibroin can be used as an animal-free (not containing any animal-derived component) material.

A fibroin fiber 70 can be produced according to a conventional spinning method using a dope solution containing a modified fibroin. The dope solution is produced by, for example, adding a modified fibroin to a solvent such as dimethyl sulfoxide (DMSO), N,N-dimethylformamide (DMF), formic acid, or hexafluoroisopropanol (HFIP) together with an inorganic salt as a dissolution promoter as necessary, and dissolving the mixture. An intended fibroin fiber can be obtained by performing spinning using this dope solution according to a known spinning method such as wet spinning, dry spinning, dry-wet spinning, or dry-wet spinning. The spinning method may also be melt spinning.

Figure 5:
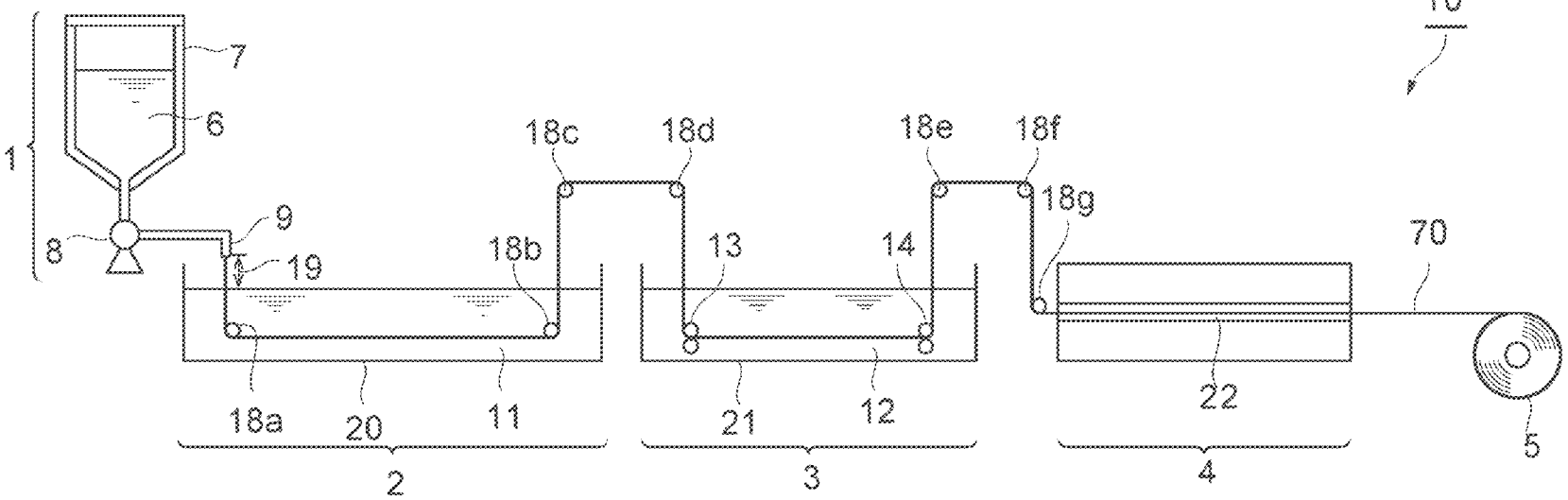
FIG. 5 is a schematic diagram illustrating an example of a spinning apparatus for producing a fibroin fiber.

FIG. 5 is a schematic diagram illustrating an example of a spinning apparatus for producing a fibroin fiber. A spinning apparatus 10 shown in FIG. 5 is an example of a spinning apparatus for dry-wet spinning and includes an extrusion device 1, an undrawn yarn production device 2, a wet heat drawing device 3, and a drying device 4.

A dope solution 6 stored in a reservoir 7 is extruded through a spinneret 9 by a gear pump 8. On a laboratory scale, a cylinder may be filled with the dope solution, and the dope solution may be extruded through a nozzle using a syringe pump. Next, the extruded dope solution 6 is fed into a coagulating liquid 11 in a coagulating liquid tank 20 through an air gap 19, the modified fibroin is coagulated by removing the solvent, and a fibrous coagulated body is formed. Next, the fibrous coagulated body is then fed into warm water 12 in a drawing bath 21 and then drawn. The draw ratio is determined by the speed ratio between a feed nip roller 13 and a take-up nip roller 14. Subsequently, the drawn fibrous coagulated body is fed into the drying device 4 and dried in a thread guide 22, and the fibroin fiber 70 is obtained as a wound yarn body 5. 18*a* to 18*g* are yarn guides.

The coagulating liquid 11 may be any solvent that can be desolventized, and examples include lower alcohols having 1 to 5 carbon atoms such as methanol, ethanol, and 2-propanol, and acetone. The coagulating liquid 11 may also contain water. The temperature of the coagulating liquid 11 may be 0° C. to 30° C. In a case where a syringe pump having a nozzle with a diameter of 0.1 to 0.6 mm is used as the spinneret 9, the extrusion speed may be 0.2 to 6.0 ml/hour or 1.4 to 4.0 ml/hour per hole. The distance that coagulated protein passes in the coagulating liquid 11 (substantially, the distance from a thread guide 18*a* to a thread guide 18*b*) may be a length over which desolventization can be efficiently performed, and for example, the distance is 200 to 500 mm. The take-up speed for the undrawn yarn may be, for example, 1 to 20 m/min or 1 to 3 m/min. The retention time in the coagulating liquid 11 may be, for example, 0.01 to 3 minutes or 0.05 to 0.15 minutes. Drawing (pre-drawing) may be performed in the coagulating liquid 11. The coagulating liquid tank 20 may be provided in multiple stages, and drawing may be performed in each stage or in a specific stage, as necessary.

As the drawing of the fibroin fiber 70, for example, in addition to the pre-drawing performed in the coagulating liquid tank 20 and wet heat drawing performed in the drawing bath 21 described above, dry heat drawing can also be adopted.

Wet heat drawing can be performed in hot water, in a solution obtained by adding an organic solvent or the like to hot water, or during steam heating. The temperature may be, for example, 50° C. to 90° C. or 75° C. to 85° C. During wet heat drawing, an undrawn yarn (or pre-drawn yarn) may be drawn to, for example, 1 to 10 times or 2 to 8 times.

Dry heat drawing can be performed using an electric tubular furnace, a dry heat plate, or the like. The temperature for dry heat drawing may be, for example, 140° C. to 270° C. or 160° C. to 230° C. During dry heat drawing, an undrawn yarn (or pre-drawn yarn) may be drawn to, for example, 0.5 to 8 times or 1 to 4 times.

Wet heat drawing and dry heat drawing may be performed each independently, or these may be performed in multiple stages or in combination. Wet heat drawing and dry heat drawing can be performed in appropriate combination, for example, in a manner in which first-stage drawing is performed by wet heat drawing and second-stage drawing is performed by dry heat drawing, or in a manner in which first-stage drawing is performed by wet heat drawing, second-stage drawing is performed by wet heat drawing, and third-stage drawing is performed by dry heat drawing.

The final draw ratio may be more than 1 time, 2 times or more, 3 times or more, 4 times or more, 5 times or more, 6 times or more, 7 times or more, 8 times or more, or 9 times or more, and may be 40 times or less, 30 times or less, 20 times or less, 15 times or less, 14 times or less, 13 times or less, 12 times or less, 11 times or less, or 10 times or less, all with respect to undrawn yarn (or pre-drawn yarn). When the fibroin fiber is a fiber spun at a draw ratio of 2 times or more, the contraction rate obtainable at the time of bringing the fibroin fiber into contact with water to be in a wet state becomes higher.

The fibroin fiber 70 formed by spinning may be contracted. The fibroin fiber obtainable through a step of contracting can have a property of expanding when placed in a wet state and contracting when dried from a wet state. The step of contracting may include, for example, after spinning, bringing the fibroin fiber 70 before being brought into contact with water to contract irreversibly. After the contact with water, the fibroin fiber 70 may be further contracted by drying.

In the step of contacting between fibroin and water, after spinning, the fibroin fiber 70 before being brought into contact with water is brought into contact with water to place the fibroin fiber 70 in a wet state. A wet state means a state in which at least a portion of the fibroin fiber 70 is in a state of being wetted with water. As a result, the fibroin fiber 70 can be irreversibly contracted without depending on external force.

The temperature of water to be brought into contact with the fibroin fiber 70 may be lower than the boiling point. As a result, handleability, workability in the contracting step, and the like are enhanced. From the viewpoint of sufficiently shortening the contraction time, the temperature of water may be 10° C. or higher, 40° C. or higher, or 70° C. or higher. The temperature of water may also be 90° C. or lower.

The method of bringing water into contact with the fibroin fiber 70 is not particularly limited. Examples of the method include a method of immersing the fibroin fiber 70 in water, a method of spraying water to the fibroin fiber 70 at normal temperature or in the form of heated steam or the like, and a method of exposing the fibroin fiber 70 to a high-humidity environment filled with water vapor. From the viewpoint that shortening of the contraction time can be effectively promoted, and also simplification of processing facilities and the like can be realized, a method of immersing the fibroin fiber 70 in water may be employed.

When the fibroin fiber 70 is brought into contact with water in a relaxed state, the fibroin fiber 70 may not only contract but also be curled to become wavy. In order to prevent the occurrence of such curling, for example, the fibroin fiber 70 may be brought into contact with water in an unrelaxed state, by bringing the fibroin fiber 70 into contact with water while applying tension in the direction of fiber axis, or the like.

The fibroin fiber 70 in a wet state may be further contracted by drying. Drying may be performed by, for example, natural drying or forced drying using a drying facility. As the drying facility, any known drying facilities of contact type or non-contact type can all be used. The drying temperature may be, for example, a temperature lower than the temperature at which the modified fibroin is decomposed or the fibroin fiber 70 is subjected to thermal damage, and for example, the drying temperature may be 20° C. to 150° C. or 50° C. to 100° C. The drying time is appropriately set according to the drying temperature or the like, and for example, a time during which the influence on the product quality and physical properties of the fibroin fiber 70 due to over-drying can be eliminated as far as possible, is employed.

Figure 6:
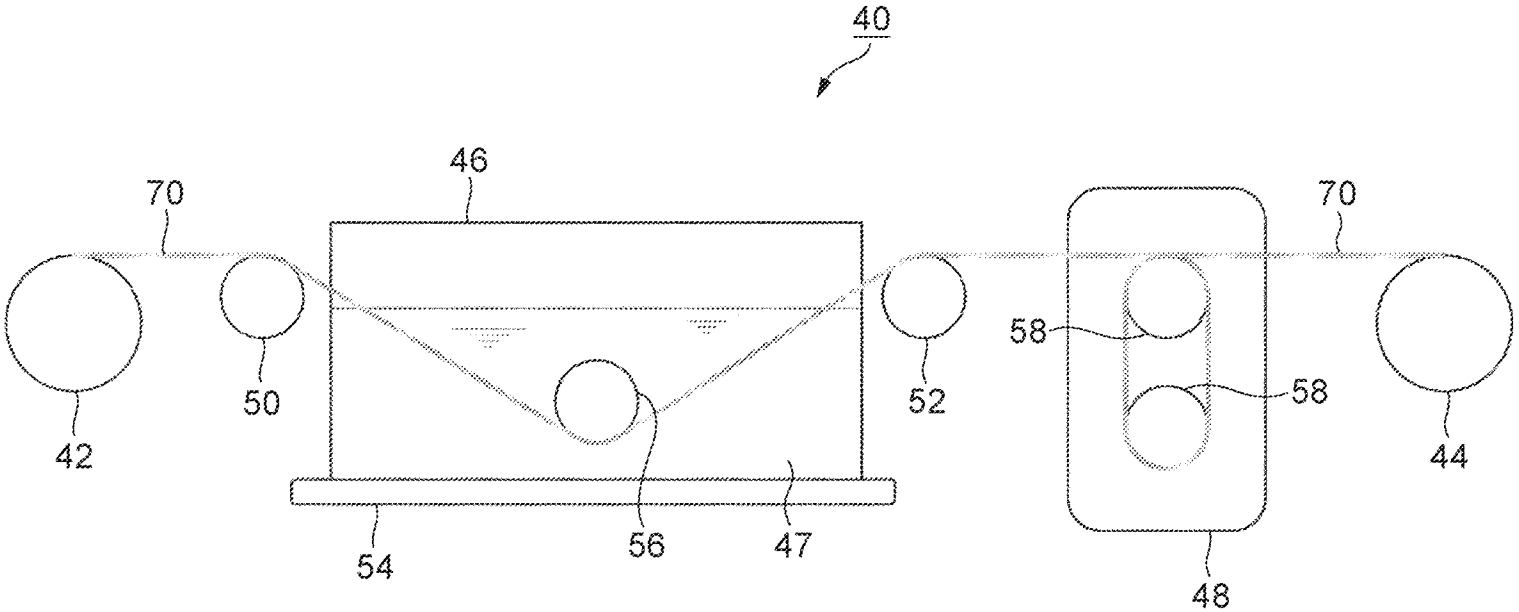
FIG. 6 is a schematic diagram illustrating an example of a production apparatus for producing a fibroin fiber.

FIG. 6 is a schematic diagram illustrating an example of a production apparatus for producing a fibroin fiber. The production apparatus 40 shown in FIG. 6 is an apparatus for contracting the fibroin fiber 70 formed by spinning. The production apparatus 40 has a feed roller 42 that sends out the fibroin fiber 70; a winder 44 that winds up the contracted fibroin fiber 70; a water bath 46 for bringing the fibroin fiber 70 into contact with water; and a dryer 48 for drying the fibroin fiber 70 in a wet state.

A wound material of the fibroin fiber 70 is mounted on the feed roller 42. The fibroin fiber 70 is fed out continuously and automatically by the rotation of an electric motor or the like. The winder 44 winds the contracted fibroin fiber 70 continuously and automatically by the rotation of an electric motor. The feeding speed of the fibroin fiber 70 by the feed roller 42 and the winding speed of the fibroin fiber 70 by the winder 44 can be controlled independently of each other. The winding speed of the winder 44 may be slower than the feeding speed of the feed roller 42. Accordingly, since the fibroin fiber 70 contracts due to contact with water 47 in a tense state without being unrelaxed between the feed roller 42 and the winder 44, the occurrence of curling can be prevented. Due to the contact with water 47, the fibroin fiber 70 contracts irreversibly.

The water bath 46 and the dryer 48 are disposed in order between the feed roller 42 and the winder 44 from the upstream side in the feed direction of the fibroin fiber 70. The production apparatus 40 has relay rollers 50 and 52 that mediate the fibroin fiber 70.

The water bath 46 includes a heater 54, and water 47 heated by the heater 54 is accommodated in the water bath 46. In the water bath 46, a tension roller 56 is installed in a state of being immersed in the water 47. The fibroin fiber 70 fed out from the feed roller 42 travels in the water bath 46 toward the winder 44 side while being immersed in the water 47 in a state of being wound around the tension roller 56.

The dryer 48 has a pair of hot rollers 58. The fibroin fiber 70 that is released from the water bath 46 and travels toward the winder 44 is wound around the pair of hot rollers 58. The fibroin fiber 70 in a wet state is heated by the pair of hot rollers 58 and is dried thereby in the dryer 48. The fibroin fiber 70 is further contracted by this drying. The fibroin fiber 70 after drying is wound around the winder 44.

By controlling the ratio between the feeding speed of the feed roller 42 and the winding speed of the winder 44, the fibroin fiber 70 can be further contracted, and the length of the fibroin fiber 70 can be made unchanged.

Figure 7:
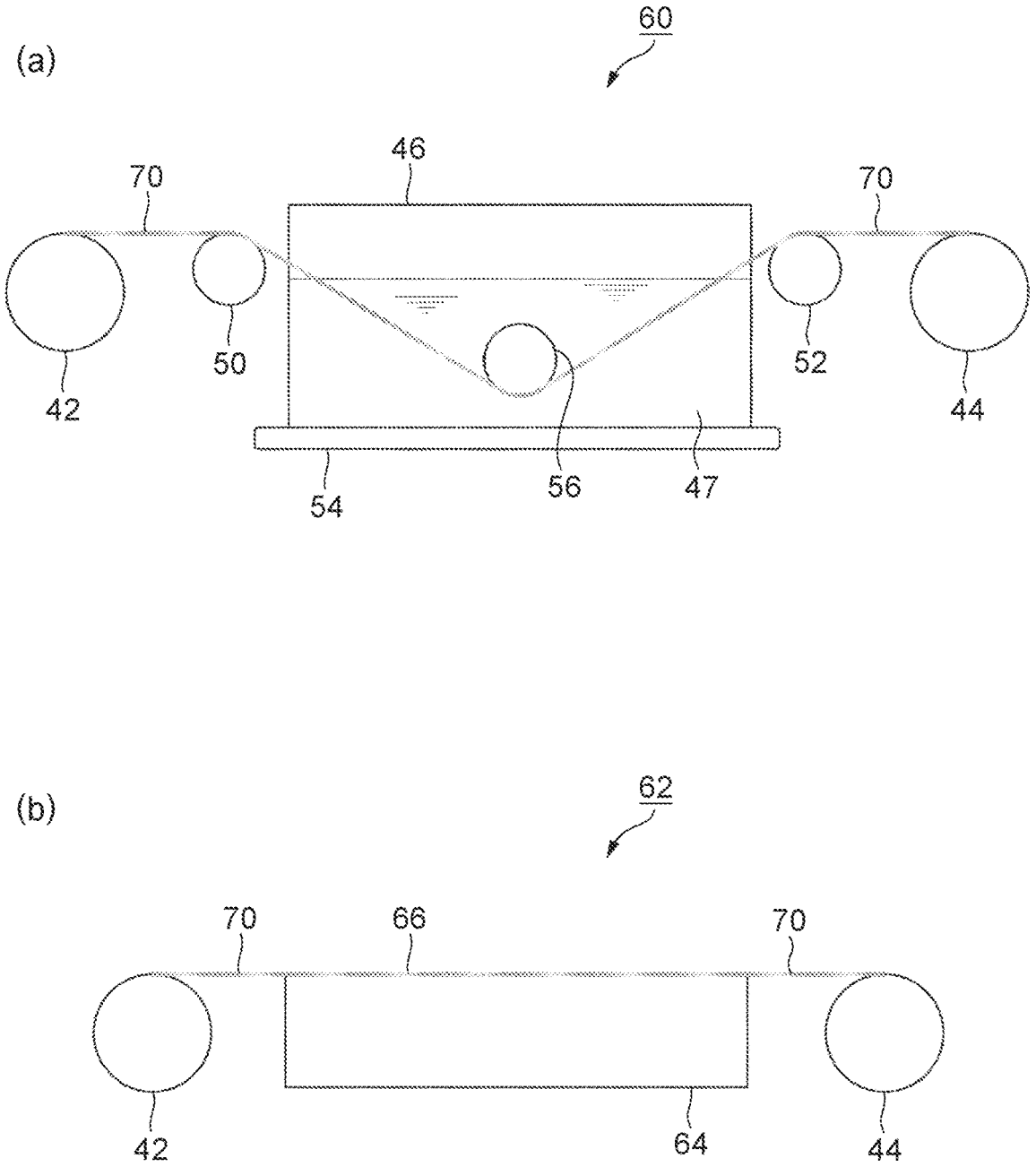
FIG. 7 is a schematic diagram illustrating an example of a production apparatus for producing a fibroin fiber.

FIG. 7 is a schematic diagram illustrating another example of the production apparatus for producing a fibroin fiber. The production apparatus of FIG. 7 is also an apparatus for contracting a fibroin fiber 70 formed by spinning, and the apparatus includes a processing device 60 for bringing the fibroin fiber 70 into contact with water and a drying device 62 for drying the fibroin fiber 70 in a wet state, these being provided independently.

The processing device 60 of FIG. 7(*a*) includes a feed roller 42, a water bath 46, and a winder 44, and these are disposed in order from the upstream toward the downstream in the travel direction of the fibroin fiber 70. The fibroin fiber 70 fed out from the feed roller 42 is immersed in water 47 in the water bath 46. As a result, the fibroin fiber 70 contracts. The fibroin fiber 70 after immersion is wound around the winder 44. The feed roller 42 and the winder 44 may be omitted, and the fibroin fiber may be immersed in water in a so-called batch manner.

The drying device 62 illustrated in FIG. 7(*b*) has a feed roller 42, a winder 44, and a dry heat plate 64 disposed between these. The fibroin fiber 70 fed out from the feed roller 43 is dried by traveling while coming into contact with a dry heat surface 66 of the dry heat plate 64. By controlling the ratio between the feeding speed of the feed roller 42 and the winding speed of the winder 44, the fibroin fiber 70 can be further contracted, and the length of the fibroin fiber 70 can also be made unchanged. Drying by the drying device 62 is not essential.

EXAMPLES

Hereinafter, the present invention will be described more specifically based on Examples and the like. However, the present invention is not intended to be limited to following Examples.

1. Fibroin Fiber (1) Modified Fibroin

A nucleic acid encoding a modified fibroin (PRT966) set forth in SEQ ID NO: 40 was synthesized. In the synthesized nucleic acid, an NdeI site was added to the 5'-end and an EcoRI site was added to the downstream of a stop codon. The nucleic acid was cloned into a cloning vector (pUC118). Subsequently, the same nucleic acid was cleaved by subjecting the nucleic acid to a restriction enzyme treatment with NdeI and EcoRI. The cleaved nucleic acid was recombined into a protein expression vector pET-22b(+) to obtain an expression vector.

*Escherichia coli* BLR (DE3) was transformed with the obtained expression vector pET-22b(+). The transformed *Escherichia coli* was cultured in 2 mL of an LB medium containing ampicillin for 15 hours. The culture solution was added to 100 mL of a seed culture medium containing ampicillin (Table 4) such that the $OD_{600}$ was 0.005. The culture solution temperature was maintained at 30° C., flask culture was carried out for about 15 hours until the $OD_{600}$ reached 5, and thus a seed culture solution was obtained.

TABLE 4

| Reagent | Concentration (g/L) |
|---|---|
| Glucose | 5.0 |
| $KH_2PO_4$ | 4.0 |
| $K_2HPO_4$ | 9.3 |
| Yeast Extract | 6.0 |
| Ampicillin | 0.1 |

The seed culture solution was added to a jar fermenter, to which 500 mL of a production medium (Table 5) had been added, such that the $OD_{600}$ reached 0.05. Culturing was carried out by maintaining the culture solution temperature at 37° C. and controlling the pH to be constant at 6.9. Furthermore, the dissolved oxygen concentration in the culture solution was maintained at 20% of the dissolved oxygen saturation concentration.

TABLE 5

| Reagent | Concentration (g/L) |
|---|---|
| Glucose | 12.0 |
| $KH_2PO_4$ | 9.0 |
| $MgSO_4 \cdot 7H_2O$ | 2.4 |
| Yeast Extract | 15 |
| $FeSO_4 \cdot 7H_2O$ | 0.04 |
| $MnSO_4 \cdot 5H_2O$ | 0.04 |
| $CaCl_2 \cdot 2H_2O$ | 0.04 |
| ADEKA NOL (ADEKA, LG-295S) | 0.1 (ml/L) |

Immediately after glucose in the production medium had been completely consumed, a feed solution (455 g of glucose/1 L and 120 g of Yeast Extract/1 L) was added at a rate of 1 mL/min. Culturing was carried out by maintaining the culture solution temperature at 37° C. and controlling the pH to be constant at 6.9. Culturing was carried out for 20 hours while maintaining the dissolved oxygen concentration in the culture solution at 20% of the dissolved oxygen saturation concentration. Thereafter, 1 M isopropyl-β-thiogalactopyranoside (IPTG) was added to the culture solution to a final concentration of 1 mM, and expression of the intended modified fibroin was induced. At a time point when 20 hours had passed after addition of IPTG, the culture solution was centrifuged, and bacterial cells were collected. SDS-PAGE was carried out using the bacterial cells prepared from the culture solution before the addition of IPTG and after the addition of IPTG, and the expression of the intended modified fibroin was confirmed by the IPTG addition-dependent appearance of a band equivalent to the size of the intended modified fibroin.

The bacterial cells collected 2 hours after the addition of IPTG were washed with a 20 mM Tris-HCl buffer solution (pH 7.4). The bacterial cells after washing were suspended in a 20 mM Tris-HCl buffer solution (pH 7.4) containing about 1 mM PMSF, and the bacterial cells were disrupted with a high-pressure homogenizer (manufactured by GEA Niro Soavi SpA). The disrupted cells were centrifuged, and a precipitate was obtained. The obtained precipitate was washed with a 20 mM Tris-HCl buffer solution (pH 7.4) until the obtained precipitate became highly pure. The precipitate after washing was suspended in an 8 M guanidine buffer solution (8 M guanidine hydrochloride, 10 mM sodium dihydrogen phosphate, 20 mM NaCl, 1 mM Tris-HCl, pH 7.0) so as to obtain a concentration of 100 mg/mL, and the precipitate was dissolved by stirring the suspension with a stirrer at 60° C. for 30 minutes. After dissolution, dialysis was carried out in water using a dialysis tube (cellulose tube 36/32 manufactured by Sanko Junyaku Co., Ltd.). The white aggregated protein obtained after dialysis was collected by centrifugation. Water was removed from the collected aggregated protein in a freeze-dryer, and a freeze-dried powder of the intended modified fibroin was obtained.

(2) Production of Fibroin Fiber

Dimethyl sulfoxide (DMSO) in which 4.0% by mass of lithium chloride was used as a solvent, and the freeze-dried powder of the modified fibroin was dissolved in the solvent. Subsequently, insoluble matters and foams were removed, and a modified fibroin solution was obtained. A fibroin fiber was produced by dry-wet spinning using the obtained modified fibroin solution as a dope solution. The draw ratio was 6 times.

Single yarns of a plurality of the fibroin fibers having a length of about 30 cm were bundled to obtain fiber bundles having a fiber fineness of 150 denier. A 0.8-g lead weight was attached to each fiber bundle. The fiber bundles in that state were immersed in water at 40° C. for 10 minutes, and the fibroin fibers were contracted by the immersion. Subsequently, the fiber bundles taken out from water were dried by leaving the fiber bundles to stand at room temperature for 2 hours. As a result, dried fiber bundles of fibroin fibers containing a modified fibroin and having a single yarn diameter of 15 μm, 30 μm, 40 μm, 60 μm, or 80 μm were obtained. The obtained fiber bundles were submitted to the following shaping test for the fibroin fiber.

2. Shaping Test (Test 1) The fibroin fiber after drying was wound around a cylindrical-shaped metal core material having a diameter of about 25 mm. The fibroin fiber wound around the core material was retained in a constant-temperature and constant-humidity chamber at 20° C., 40° C., 60° C., or 90° C.

for 60 minutes. However, when the fibroin fiber having a single yarn diameter of 15 μm or 30 μm was retained at 20° C. or 40° C., the retention time was set to 180 minutes. Under similar conditions, a shaping test for silk fiber was also carried out.

The fibroin fiber removed from the core material was observed, and the extent to which a curled shape was given was determined by the following criteria.

A: A clear curled shape was retained.

B: Although the extent was weak compared to "A", it was confirmed that the shape was retained to a certain extent.

C: Retaining of the curled shape was not recognized.

TABLE 6

| | Single yarn diameter | Heating temperature 20° C. | 40° C. | 60° C. | 90° C. |
|---|---|---|---|---|---|
| Fibroin fiber | 15 μm | B | B | B | B |
| | 30 μm | B | B | B | A |
| | 40 μm | A | A | A | A |
| | 60 μm | A | A | A | A |
| | 80 μm | B | A | A | A |
| Silk fiber | | C | C | C | C |

Figure 8:
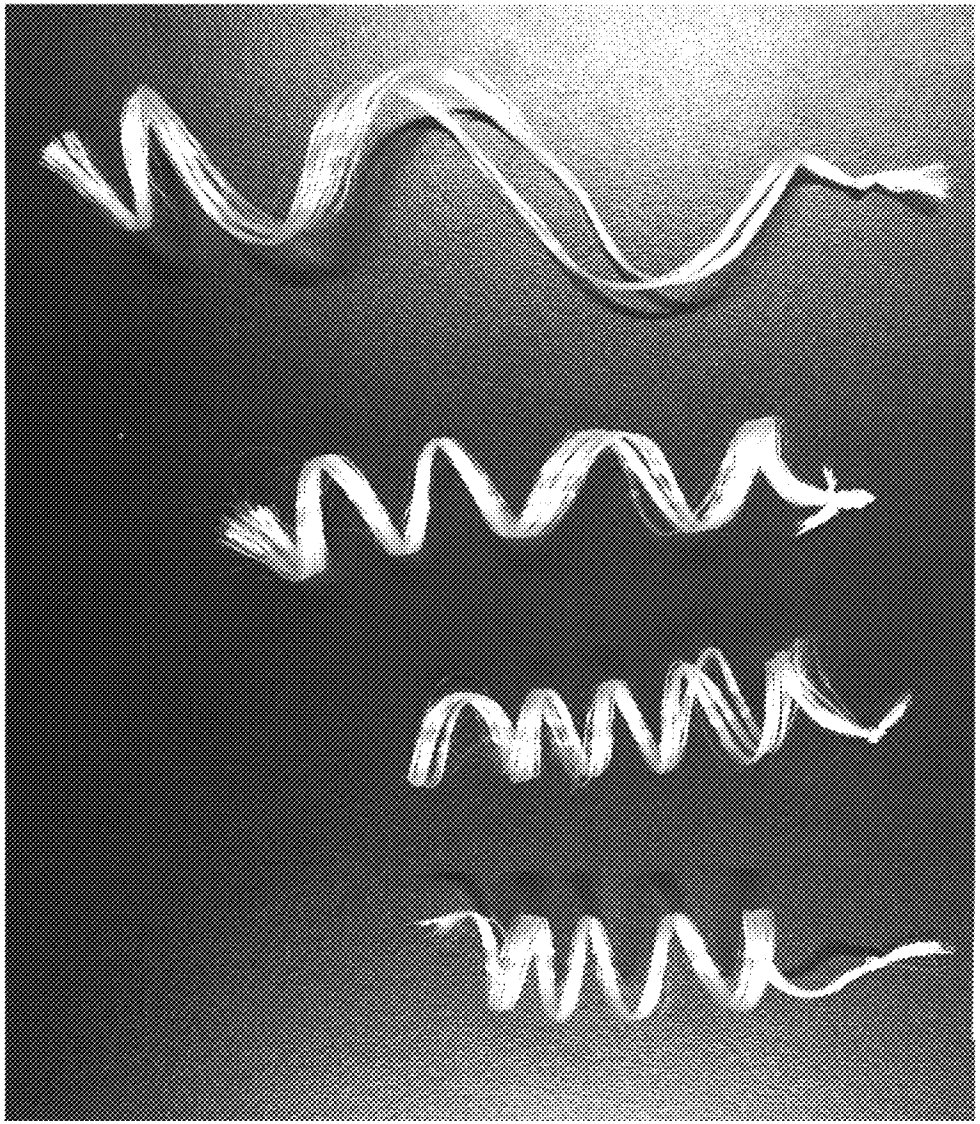
FIG. 8 is a picture (photograph) of fibroin fibers that are given shapes including curved parts.
Figure 9:
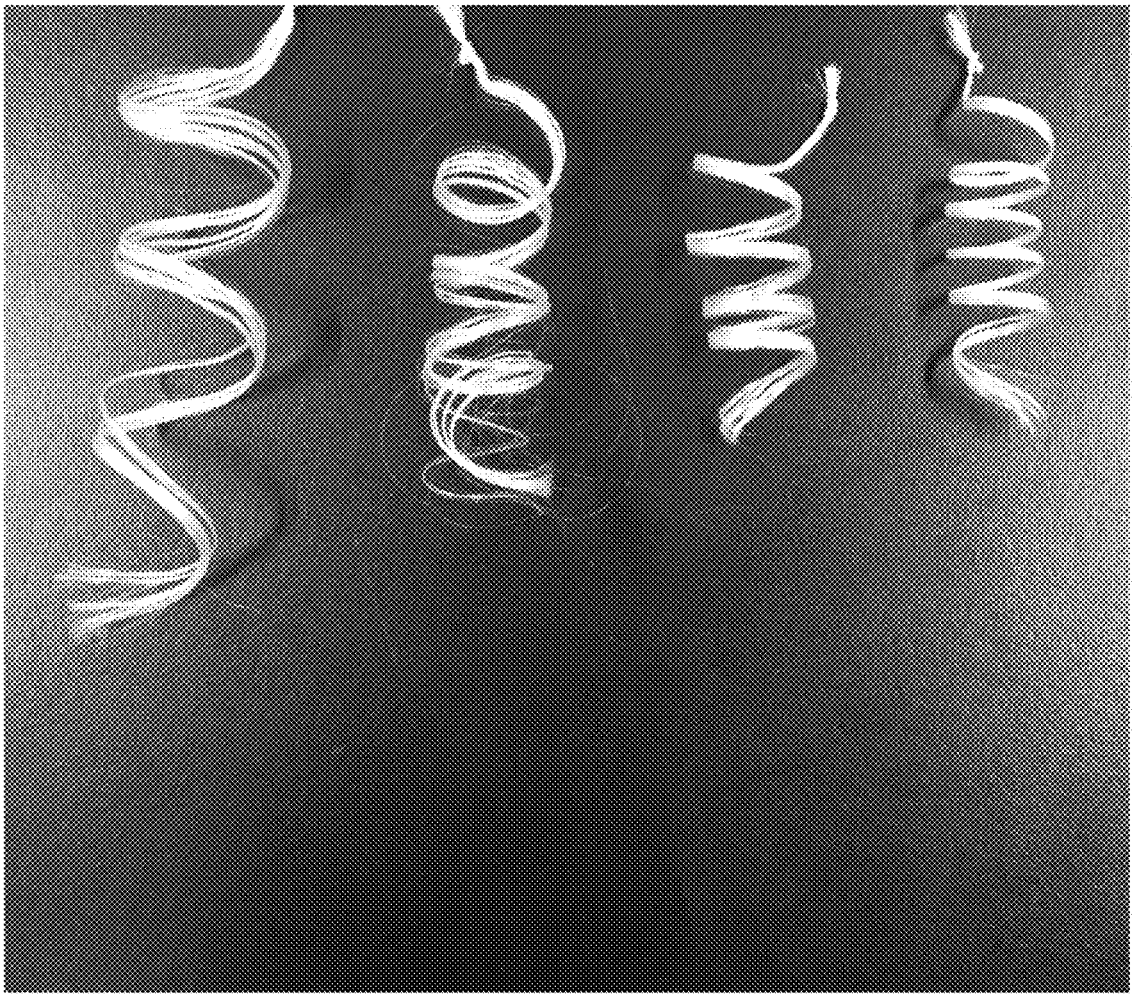
FIG. 9 is a picture (photograph) of fibroin fibers that are given shapes including curved parts.

As shown in Table 6, it was confirmed that a predetermined shape (here, a curled shape) can be given to a fibroin fiber by retaining a dry state fibroin fiber in a state conforming to the predetermined shape. FIG. 8 is a photograph of fibroin fibers having a single yarn diameter of 40 μm after the shaping test. FIG. 9 is a photograph of fibroin fibers having a single yarn diameter of 60 μm after the shaping test. FIG. 8 and FIG. 9 show fibroin fibers retained at 20° C., 40° C., 60° C., or 90° C. in order from the left-hand side.

(Test 2-1)

Each fibroin fiber after drying was immersed in water at room temperature (about 20° C.) for 20 minutes. Subsequently, the fibroin fiber in a wet state was wound around a cylindrical-shaped metal core material having a diameter of about 25 mm. The fibroin fiber wound around the core material was retained for 1 hour while being heated at 20° C., 40° C., 60° C., or 90° C. in a constant-temperature and constant-humidity chamber.

The fibroin fiber removed from the core material was observed, and the extent to which a curled shape was given was determined according to criteria similar to those of Test 1.

TABLE 7

| | Single yarn diameter | Wet/dry | Retention temperature 20° C. | 40° C. | 60° C. | 90° C. |
|---|---|---|---|---|---|---|
| Fibroin fiber | 15 μm | Wet | A | A | A | A |
| | 30 μm | Wet | A | A | A | A |
| | 40 μm | Wet | A | A | A | A |
| | 60 μm | Wet | A | A | A | A |
| | 80 μm | Wet | A | A | A | A |

Figure 10:
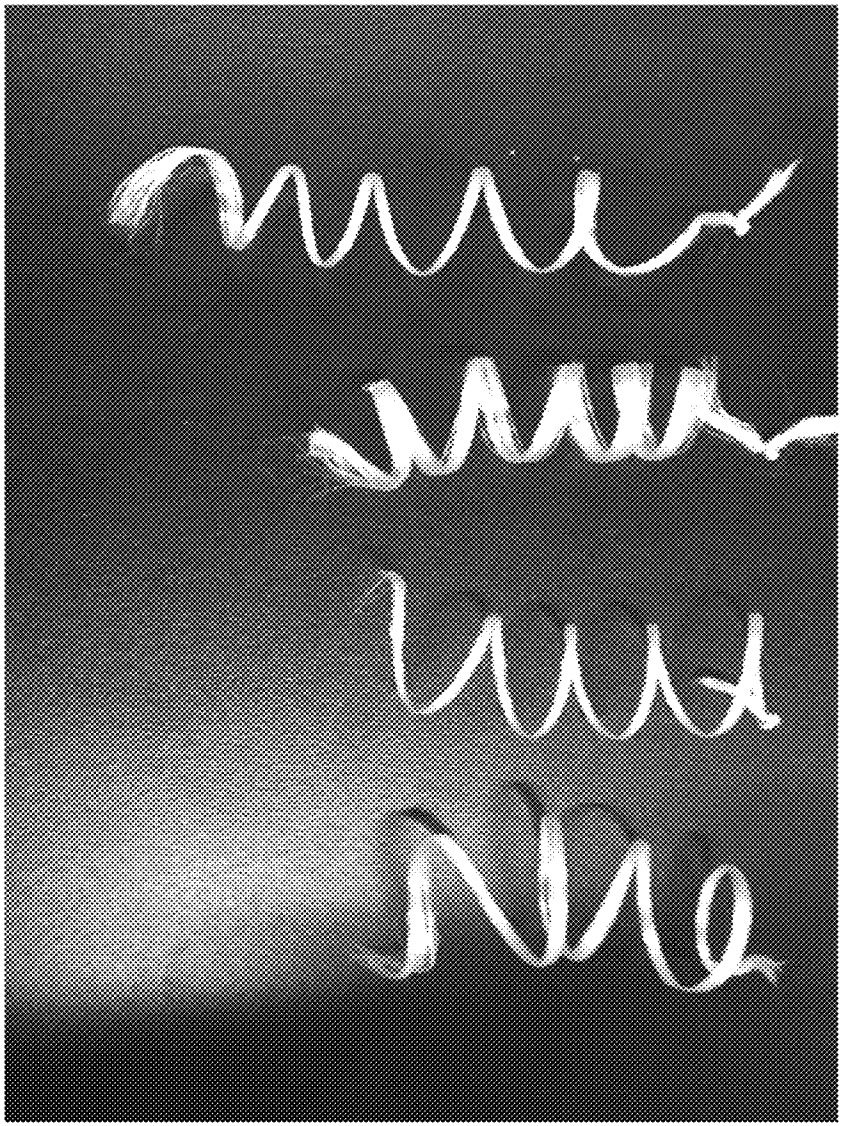
FIG. 10 is a picture (photograph) of fibroin fibers that are given shapes including curved parts.
Figure 11:
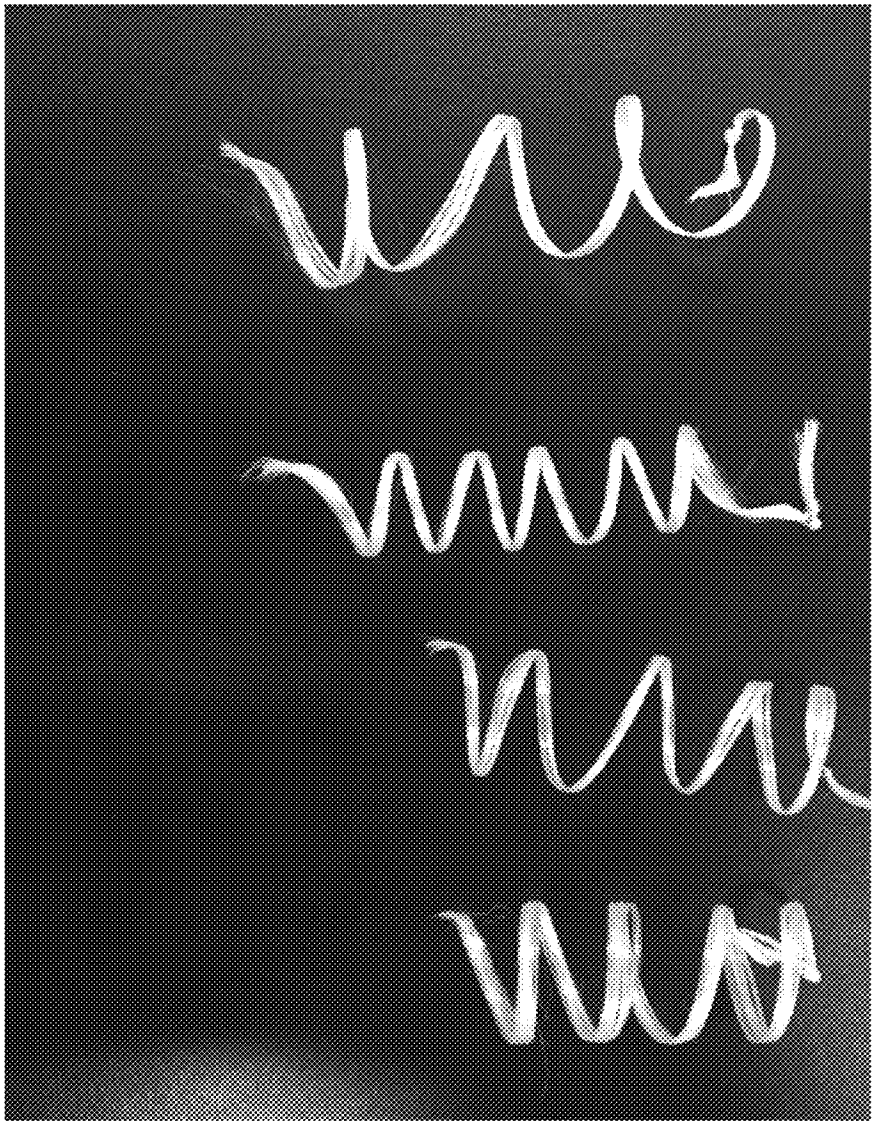
FIG. 11 is a picture (photograph) of fibroin fibers that are given shapes including curved parts.

As shown in Table 7, it was confirmed that a predetermined shape (here, a curled shape) can be given to a fibroin fiber by retaining a wet state fibroin fiber in a state conforming to the predetermined shape. FIG. 10 is a photograph of fibroin fibers having a single yarn diameter of 40 μm after the shaping test. FIG. 11 is a photograph of fibroin fibers having a single yarn diameter of 60 μm after the shaping test. FIG. 10 and FIG. 11 show fibroin fibers retained in a wet state at 20° C., 40° C., 60° C., or 90° C. in order from the left-hand side.

(Test 2-2)

Figure 12:
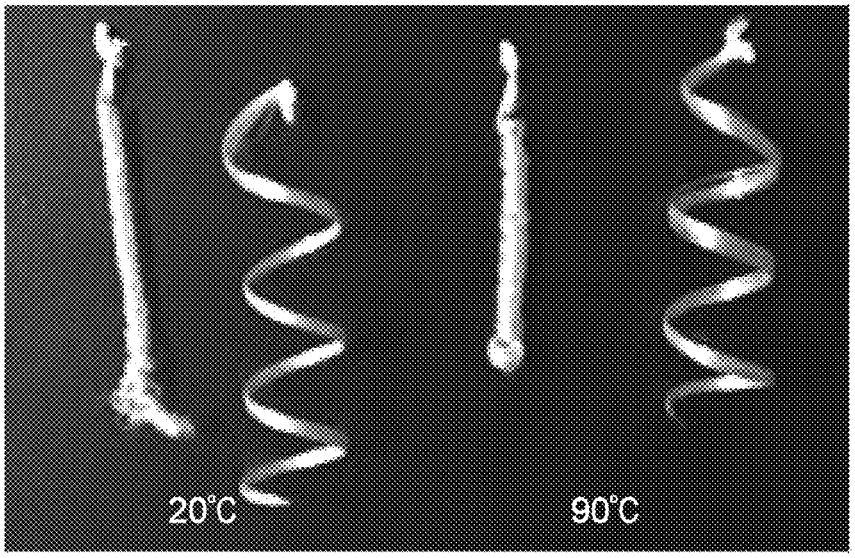
FIG. 12 is a picture (photograph) of fibroin fibers that are given shapes including curved parts.

A fibroin fiber having a single yarn diameter of 80 μm was immersed in water at room temperature (about 20° C.) for 20 minutes. Subsequently, the fibroin fiber in a wet state was wound around a cylindrical-shaped metal core material having a diameter of about 5 mm or 25 mm. The fibroin fiber wound around the core material was retained while being heated in a state of being immersed in water at 20° C., 40° C., 60° C., or 90° C. for 1 hour. The fibroin fiber taken out from water was dried by heating for 1 hour in a state of wound around a core material in a high-temperature and constant-humidity chamber at 60° C. The fibroin fiber removed from the core material was observed, and the extent to which a curled shape was given was determined according to criteria similar to those of Test 1. Results are shown in Table 8. FIG. 12 is a photograph of fibroin fibers after the shaping test at 20° C. or 90° C.

TABLE 8

| | Core material diameter | Retention temperature 20° C. | 40° C. | 60° C. | 90° C. |
|---|---|---|---|---|---|
| Fibroin fiber (single yarn diameter 80 μm) | 5 mm | A | A | A | A |
| | 25 mm | A | A | A | A |

(Test 2-3)

Figure 13:
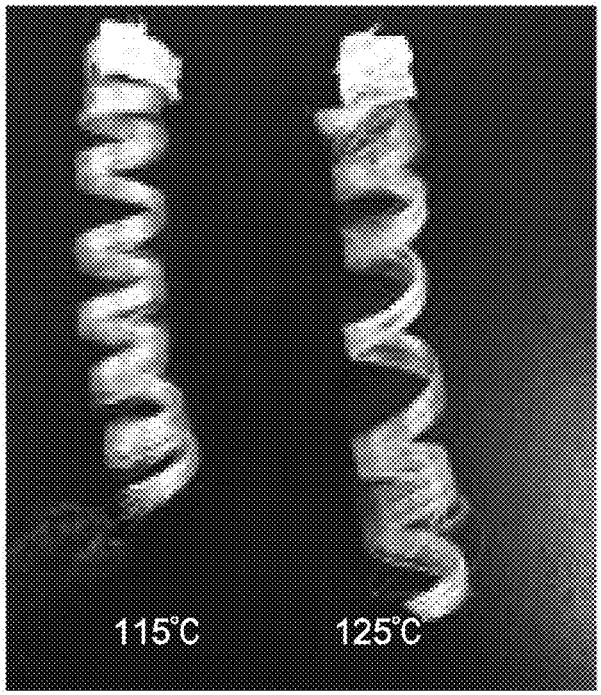
FIG. 13 is a picture (photograph) of fibroin fibers that are given shapes including curved parts.

A fibroin fiber having a single yarn diameter of 80 μm was immersed in water at room temperature (about 20° C.) for 20 minutes. Subsequently, the fibroin fiber in a wet state was wound around a cylindrical-shaped metal core material having a diameter of about 25 mm. The fibroin fiber wound around the core material was retained while being heated in a state of being exposed to water vapor at 115° C. or 125° C. for 2 hours in an autoclave. The fibroin fiber taken out from the autoclave was dried by heating for 20 minutes in a state of wound around a core material in a high-temperature and constant-humidity chamber at 70° C. The fibroin fiber removed from the core material was observed, and the result of determining the extent to which a curled shape was given according to criteria similar to those of Test 1 was "A". FIG. 13 is a photograph of fibroin fibers after the shaping test at 115° C. or 125° C. A curled shape was given more intensely.

(Test 2-4: Evaluation of Shape Retainability)

A curled shape was given to fibroin fibers having a single yarn diameter of 80 μm, under the conditions of Test 2-1 of wetting the fibroin fibers by water immersion and then retaining the fibers in an atmosphere at 90° C., the conditions of Test 2-2 of retaining the fibroin fibers in hot water at 90° C., or the conditions of Test 2-3 of retaining the fibroin fibers in a state of being exposed to steam at 115° C. In order to evaluate the retainability of shape, the fibroin fibers that had been given a shape were submitted to a water-washing test of immersing the fibroin fibers in water at room temperature (about 20° C.) for 20 minutes and drying the fibroin fibers after immersion in a dryer.

Figure 14:
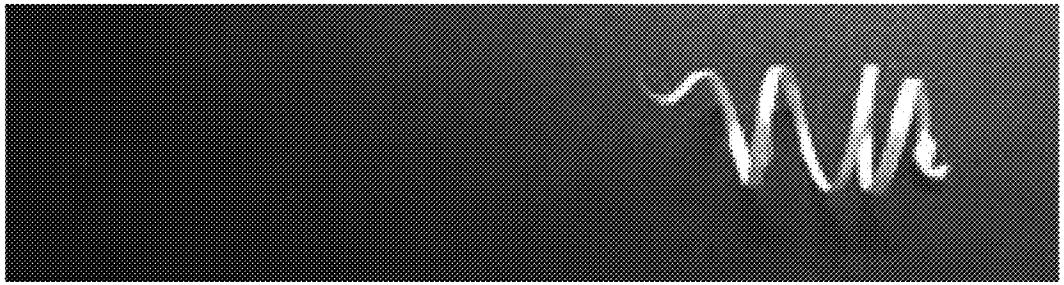
FIG. 14 is a picture (photograph) of fibroin fibers that are given shapes including curved parts.
Figure 14:
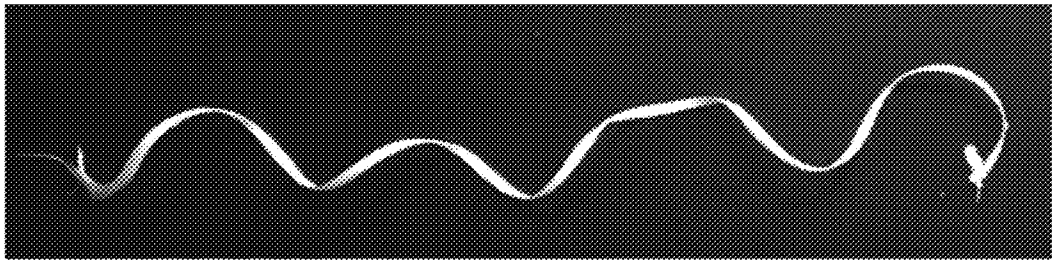

FIG. 14 is photographs of fibroin fibers that were given a shape under the conditions of Test 2-1, taken before and after a water-washing test. FIG. 14(*a*) shows a fibroin fiber that was given a shape by retaining the fiber in an atmosphere at 90° C., and FIG. 14(*b*) shows the same fibroin fiber after a water-washing test. It was confirmed that after water-washing, the curled shape remained to a certain extent.

Figure 15:
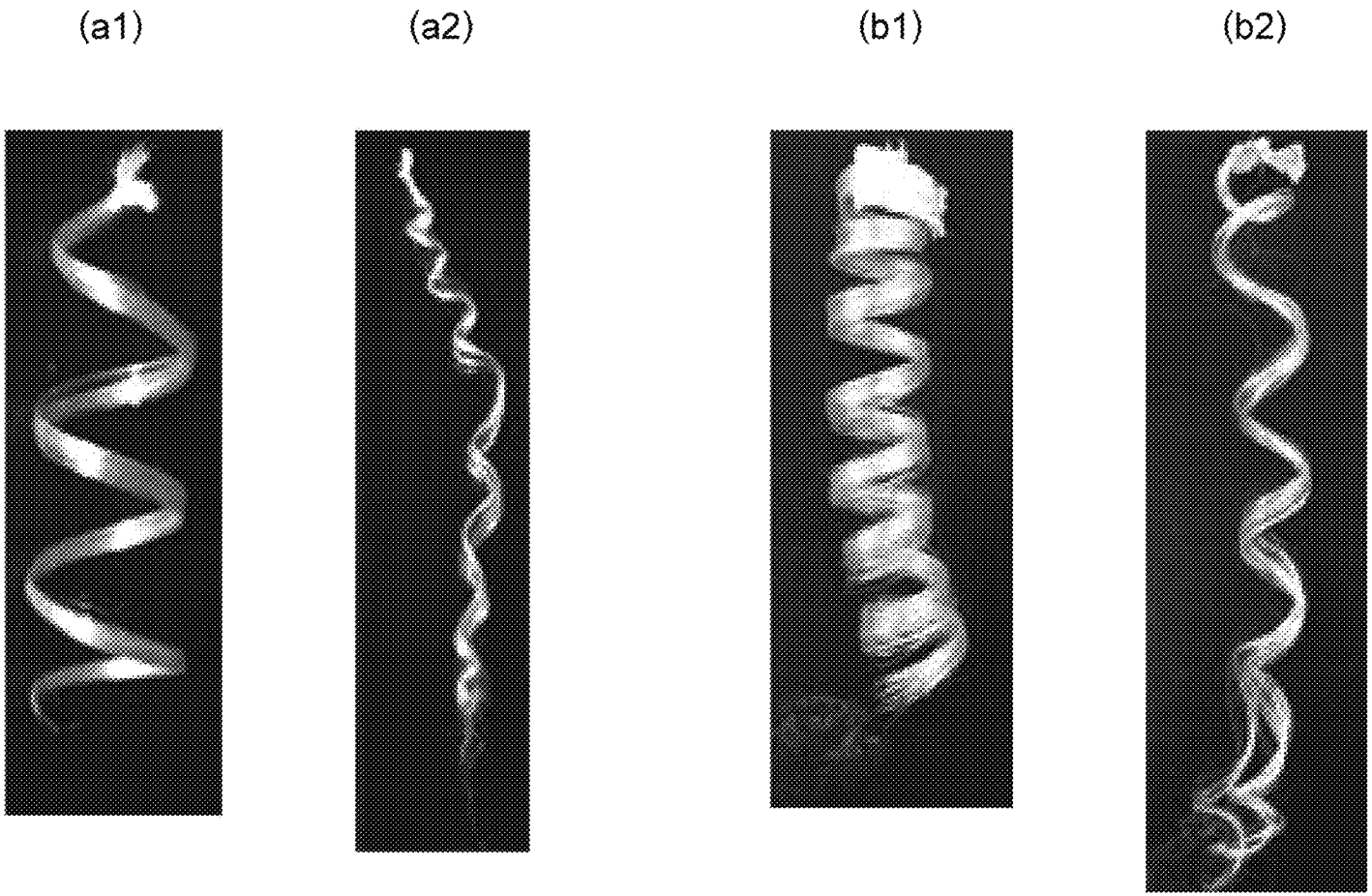
FIG. 15 is a picture (photograph) of fibroin fibers that are given shapes including curved parts.

FIG. 15 is photographs of fibroin fibers that were given a curled shape under the conditions of Test 2-2 or Test 2-3, taken before and after a washing test. FIG. 15(*a*1) shows a fibroin fiber that was given a shape under the conditions of Test 2-2 of retaining the fibers in hot water at 90° C., and FIG. 15(*a*2) shows the same fibroin fiber after a water-washing test. FIG. 15(*b*1) shows a fibroin fiber that was given a shape under the conditions of Test 2-3 of retaining the fibers in steam at 115° C., and FIG. 15(*b*2) shows the same fibroin fiber after a water-washing test. It was verified that fibroin fibers that were given a shape by retaining the fibers in hot water or water vapor are superior from the viewpoint of shape retainability.

(Test 2-5: Evaluation of Shape Retainability)

A curled shape was given to a fibroin fiber having a single yarn diameter of 80 μm under the conditions of Test 2-3, while the temperature of water vapor and the retention time were changed as shown in Table 9. Each fibroin fiber that was given a curled shape was repeatedly submitted to a washing test similar to Test 2-4. The number of times of the washing test performed until the given shape was substantially lost was recorded.

TABLE 9

| Steam temperature | Retention time | Number of times of water-washing test until shape loss |
|---|---|---|
| 105° C. | 10 minutes | 2 |
| | 60 minutes | 2 |
| | 120 minutes | 3 |
| 110° C. | 10 minutes | 2 |
| | 60 minutes | 2 |
| | 120 minutes | 7 |
| 115° C. | 10 minutes | 4 |
| | 60 minutes | 11 |
| | 120 minutes | 15 |
| 120° C. | 10 minutes | 4 |
| | 60 minutes | 8 |
| | 120 minutes | 7 |
| 125° C. | 10 minutes | 5 |
| | 60 minutes | 10 |
| | 120 minutes | 3 |
| 135° C. | 10 minutes | 4 |
| | 60 minutes | 6 |
| | 120 minutes | 3 |

Water Stretchability

The lengths in a dry state (length of a fibroin fiber before being placed in a wet state) of a fibroin fiber before being given a shape and of fibroins that were given a curled shape, which were obtained in Test Example 1 or Test Example 2-1, were respectively measured. Next, a 0.8-g lead weight was attached to each fibroin fiber, and the fibroin fiber in that state was immersed in water at 40° C. for 10 minutes. Subsequently, the length of each fibroin fiber in water (length of a fibroin fiber when placed in a wet state) was measured. Measurement of the length of each fibroin fiber in water was carried out while having a 0.8-g lead weight attached to each fibroin fiber, so that curls would be removed from each fibroin fiber. Next, each fibroin fiber taken out from water was dried by leaving the fiber at room temperature for 2 hours while having a 0.8-g lead weight attached to the fibroin fiber. Subsequently, the length of each fibroin fiber in water (length of a fibroin fiber when dried from a wet state) was measured. From the obtained measured values, the recovery rate, elongation rate, and contraction rate C of each fibroin fiber were calculated by the following Formula (1), Formula (4), and Formula (5).

Recovery rate=(Length of fibroin fiber when dried from wet state/length of fibroin fiber before being placed in wet state)×100(%). Formula (1):

Elongation rate={(Length of fibroin fiber when placed in wet state/length of fibroin fiber before being placed in wet state)−1}×100(%) Formula (4):

Contraction rate C={1−(length of fibroin fiber when dried from wet state/length of fibroin fiber when placed in wet state)}×100(%). Formula (5):

The fibroin fibers of various Examples that were given a curled shape exhibited an elongation rate of 2% to 17%, a contraction rate C of 2% to 17%, and a recovery rate of 95% to 100%. That is, these fibroin fibers exhibited a characteristic that the fibroin fibers expand when placed in a wet state and contract when dried from a wet state.

REFERENCE SIGNS LIST

1 Extrusion device
2 Undrawn yarn production device
3 Wet heat drawing device
4 Drying device
6 Dope solution
10 Spinning apparatus
20 Coagulating liquid tank
21 Drawing bath
40 Production apparatus
42 Feed roller
44 Winder
46 Water bath
48 Dryer
54 Heater
56 Tension roller
58 Hot roller
60 Processing device
62 Drying device
64 Dry heat plate
70 Fibroin fiber
75 Core material Sequence Listing

SEQUENCE LISTING

```
<160> NUMBER OF SEQ ID NOS: 44

<210> SEQ ID NO 1
<211> LENGTH: 50
<212> TYPE: PRT
<213> ORGANISM: Araneus diadematus

<400> SEQUENCE: 1
```

```
Ser Gly Cys Asp Val Leu Val Gln Ala Leu Leu Glu Val Val Ser Ala
1               5                   10                  15

Leu Val Ser Ile Leu Gly Ser Ser Ser Ile Gly Gln Ile Asn Tyr Gly
            20                  25                  30

Ala Ser Ala Gln Tyr Thr Gln Met Val Gly Gln Ser Val Ala Gln Ala
        35                  40                  45

Leu Ala
    50


<210> SEQ ID NO 2
<211> LENGTH: 30
<212> TYPE: PRT
<213> ORGANISM: Araneus diadematus

<400> SEQUENCE: 2

Ser Gly Cys Asp Val Leu Val Gln Ala Leu Leu Glu Val Val Ser Ala
1               5                   10                  15

Leu Val Ser Ile Leu Gly Ser Ser Ser Ile Gly Gln Ile Asn
            20                  25                  30


<210> SEQ ID NO 3
<211> LENGTH: 21
<212> TYPE: PRT
<213> ORGANISM: Araneus diadematus

<400> SEQUENCE: 3

Ser Gly Cys Asp Val Leu Val Gln Ala Leu Leu Glu Val Val Ser Ala
1               5                   10                  15

Leu Val Ser Ile Leu
            20


<210> SEQ ID NO 4
<211> LENGTH: 1154
<212> TYPE: PRT
<213> ORGANISM: Artificial Sequence
<220> FEATURE:
<223> OTHER INFORMATION: recombinant spider silk protein
      ADF3KaiLargeNRSH1

<400> SEQUENCE: 4

Met His His His His His His His His His His Ser Ser Gly Ser Ser
1               5                   10                  15

Leu Glu Val Leu Phe Gln Gly Pro Ala Arg Ala Gly Ser Gly Gln Gln
            20                  25                  30

Gly Pro Gly Gln Gln Gly Pro Gly Gln Gln Gly Pro Gly Gln Gln Gly
        35                  40                  45

Pro Tyr Gly Pro Gly Ala Ser Ala Ala Ala Ala Ala Ala Gly Gly Tyr
    50                  55                  60

Gly Pro Gly Ser Gly Gln Gln Gly Pro Ser Gln Gln Gly Pro Gly Gln
65                  70                  75                  80

Gln Gly Pro Gly Gly Gln Gly Pro Tyr Gly Pro Gly Ala Ser Ala Ala
                85                  90                  95

Ala Ala Ala Ala Gly Gly Tyr Gly Pro Gly Ser Gly Gln Gln Gly Pro
            100                 105                 110

Gly Gly Gln Gly Pro Tyr Gly Pro Gly Ser Ser Ala Ala Ala Ala Ala
        115                 120                 125

Ala Gly Gly Asn Gly Pro Gly Ser Gly Gln Gln Gly Ala Gly Gln Gln
    130                 135                 140

Gly Pro Gly Gln Gln Gly Pro Gly Ala Ser Ala Ala Ala Ala Ala Ala
```

```
145                 150                 155                 160

Gly Gly Tyr Gly Pro Gly Ser Gly Gln Gln Gly Pro Gly Gln Gln Gly
                165                 170                 175

Pro Gly Gly Gln Gly Pro Tyr Gly Pro Gly Ala Ser Ala Ala Ala Ala
            180                 185                 190

Ala Ala Gly Gly Tyr Gly Pro Gly Ser Gly Gln Gly Pro Gly Gln Gln
        195                 200                 205

Gly Pro Gly Gly Gln Gly Pro Tyr Gly Pro Gly Ala Ser Ala Ala Ala
    210                 215                 220

Ala Ala Ala Gly Gly Tyr Gly Pro Gly Ser Gly Gln Gln Gly Pro Gly
225                 230                 235                 240

Gln Gln Gly Pro Gly Gln Gln Gly Pro Gly Gly Gln Gly Pro Tyr Gly
                245                 250                 255

Pro Gly Ala Ser Ala Ala Ala Ala Ala Ala Gly Gly Tyr Gly Pro Gly
            260                 265                 270

Tyr Gly Gln Gln Gly Pro Gly Gln Gln Gly Pro Gly Gly Gln Gly Pro
        275                 280                 285

Tyr Gly Pro Gly Ala Ser Ala Ala Ser Ala Ala Ser Gly Gly Tyr Gly
    290                 295                 300

Pro Gly Ser Gly Gln Gln Gly Pro Gly Gln Gln Gly Pro Gly Gly Gln
305                 310                 315                 320

Gly Pro Tyr Gly Pro Gly Ala Ser Ala Ala Ala Ala Ala Ala Gly Gly
                325                 330                 335

Tyr Gly Pro Gly Ser Gly Gln Gln Gly Pro Gly Gln Gln Gly Pro Gly
            340                 345                 350

Gln Gln Gly Pro Gly Gln Gln Gly Pro Gly Gly Gln Gly Pro Tyr Gly
        355                 360                 365

Pro Gly Ala Ser Ala Ala Ala Ala Ala Ala Gly Gly Tyr Gly Pro Gly
    370                 375                 380

Ser Gly Gln Gln Gly Pro Gly Gln Gln Gly Pro Gly Gln Gln Gly Pro
385                 390                 395                 400

Gly Gln Gln Gly Pro Gly Gln Gln Gly Pro Gly Gln Gln Gly Pro Gly
                405                 410                 415

Gln Gln Gly Pro Gly Gln Gln Gly Pro Gly Gln Gln Gly Pro Gly Gly
            420                 425                 430

Gln Gly Ala Tyr Gly Pro Gly Ala Ser Ala Ala Ala Gly Ala Ala Gly
        435                 440                 445

Gly Tyr Gly Pro Gly Ser Gly Gln Gln Gly Pro Gly Gln Gln Gly Pro
    450                 455                 460

Gly Gln Gln Gly Pro Gly Gln Gln Gly Pro Gly Gln Gln Gly Pro Gly
465                 470                 475                 480

Gln Gln Gly Pro Gly Gln Gln Gly Pro Gly Gln Gln Gly Pro Tyr Gly
                485                 490                 495

Pro Gly Ala Ser Ala Ala Ala Ala Ala Ala Gly Gly Tyr Gly Pro Gly
            500                 505                 510

Ser Gly Gln Gln Gly Pro Gly Gln Gln Gly Pro Gly Gln Gln Gly Pro
        515                 520                 525

Gly Gly Gln Gly Pro Tyr Gly Pro Gly Ala Ala Ser Ala Ala Val Ser
    530                 535                 540

Val Ser Arg Ala Arg Ala Gly Ser Gly Gln Gln Gly Pro Gly Gln Gln
545                 550                 555                 560

Gly Pro Gly Gln Gln Gly Pro Gly Gln Gln Gly Pro Tyr Gly Pro Gly
                565                 570                 575
```

```
Ala Ser Ala Ala Ala Ala Ala Ala Gly Gly Tyr Gly Pro Gly Ser Gly
            580                 585                 590

Gln Gln Gly Pro Ser Gln Gln Gly Pro Gly Gln Gln Gly Pro Gly Gly
        595                 600                 605

Gln Gly Pro Tyr Gly Pro Gly Ala Ser Ala Ala Ala Ala Ala Ala Gly
    610                 615                 620

Gly Tyr Gly Pro Gly Ser Gly Gln Gln Gly Pro Gly Gly Gln Gly Pro
625                 630                 635                 640

Tyr Gly Pro Gly Ser Ser Ala Ala Ala Ala Ala Ala Gly Gly Asn Gly
                645                 650                 655

Pro Gly Ser Gly Gln Gln Gly Ala Gly Gln Gln Gly Pro Gly Gln Gln
            660                 665                 670

Gly Pro Gly Ala Ser Ala Ala Ala Ala Ala Ala Gly Gly Tyr Gly Pro
        675                 680                 685

Gly Ser Gly Gln Gln Gly Pro Gly Gln Gln Gly Pro Gly Gly Gln Gly
    690                 695                 700

Pro Tyr Gly Pro Gly Ala Ser Ala Ala Ala Ala Ala Ala Gly Gly Tyr
705                 710                 715                 720

Gly Pro Gly Ser Gly Gln Gly Pro Gly Gln Gln Gly Pro Gly Gly Gln
                725                 730                 735

Gly Pro Tyr Gly Pro Gly Ala Ser Ala Ala Ala Ala Ala Ala Gly Gly
            740                 745                 750

Tyr Gly Pro Gly Ser Gly Gln Gln Gly Pro Gly Gln Gln Gly Pro Gly
        755                 760                 765

Gln Gln Gly Pro Gly Gly Gln Gly Pro Tyr Gly Pro Gly Ala Ser Ala
    770                 775                 780

Ala Ala Ala Ala Ala Gly Gly Tyr Gly Pro Gly Tyr Gly Gln Gln Gly
785                 790                 795                 800

Pro Gly Gln Gln Gly Pro Gly Gly Gln Gly Pro Tyr Gly Pro Gly Ala
                805                 810                 815

Ser Ala Ala Ser Ala Ala Ser Gly Gly Tyr Gly Pro Gly Ser Gly Gln
            820                 825                 830

Gln Gly Pro Gly Gln Gln Gly Pro Gly Gly Gln Gly Pro Tyr Gly Pro
        835                 840                 845

Gly Ala Ser Ala Ala Ala Ala Ala Ala Gly Gly Tyr Gly Pro Gly Ser
    850                 855                 860

Gly Gln Gln Gly Pro Gly Gln Gln Gly Pro Gly Gln Gln Gly Pro Gly
865                 870                 875                 880

Gln Gln Gly Pro Gly Gly Gln Gly Pro Tyr Gly Pro Gly Ala Ser Ala
                885                 890                 895

Ala Ala Ala Ala Ala Gly Gly Tyr Gly Pro Gly Ser Gly Gln Gln Gly
            900                 905                 910

Pro Gly Gln Gln Gly Pro Gly Gln Gln Gly Pro Gly Gln Gln Gly Pro
        915                 920                 925

Gly Gln Gln Gly Pro Gly Gln Gln Gly Pro Gly Gln Gln Gly Pro Gly
    930                 935                 940

Gln Gln Gly Pro Gly Gln Gln Gly Pro Gly Gly Gln Gly Ala Tyr Gly
945                 950                 955                 960

Pro Gly Ala Ser Ala Ala Ala Gly Ala Ala Gly Gly Tyr Gly Pro Gly
                965                 970                 975

Ser Gly Gln Gln Gly Pro Gly Gln Gln Gly Pro Gly Gln Gln Gly Pro
            980                 985                 990
```

```
Gly Gln Gln Gly Pro Gly Gln Gln  Gly Pro Gly Gln Gln  Gly Pro Gly
        995                 1000                 1005

Gln Gln  Gly Pro Gly Gln Gln  Gly Pro Tyr Gly Pro  Gly Ala Ser
    1010                 1015                 1020

Ala Ala  Ala Ala Ala Ala Gly  Gly Tyr Gly Pro Gly  Ser Gly Gln
    1025                 1030                 1035

Gln Gly  Pro Gly Gln Gln Gly  Pro Gly Gln Gln Gly  Pro Gly Gly
    1040                 1045                 1050

Gln Gly  Pro Tyr Gly Pro Gly  Ala Ala Ser Ala Ala  Val Ser Val
    1055                 1060                 1065

Gly Gly  Tyr Gly Pro Gln Ser  Ser Ser Val Pro Val  Ala Ser Ala
    1070                 1075                 1080

Val Ala  Ser Arg Leu Ser Ser  Pro Ala Ala Ser Ser  Arg Val Ser
    1085                 1090                 1095

Ser Ala  Val Ser Ser Leu Val  Ser Ser Gly Pro Thr  Lys His Ala
    1100                 1105                 1110

Ala Leu  Ser Asn Thr Ile Ser  Ser Val Val Ser Gln  Val Ser Ala
    1115                 1120                 1125

Ser Asn  Pro Gly Leu Ser Gly  Cys Asp Val Leu Val  Gln Ala Leu
    1130                 1135                 1140

Leu Glu  Val Val Ser Ala Leu  Val Ser Ile Leu
    1145                 1150


<210> SEQ ID NO 5
<211> LENGTH: 24
<212> TYPE: PRT
<213> ORGANISM: Artificial Sequence
<220> FEATURE:
<223> OTHER INFORMATION: His tag and start codon

<400> SEQUENCE: 5

Met His His His His His His His His His His Ser Ser Gly Ser Ser
1               5                   10                  15

Leu Glu Val Leu Phe Gln Gly Pro
            20


<210> SEQ ID NO 6
<211> LENGTH: 597
<212> TYPE: PRT
<213> ORGANISM: Artificial Sequence
<220> FEATURE:
<223> OTHER INFORMATION: Met-PRT380

<400> SEQUENCE: 6

Met Gly Pro Gly Gln Gln Gly Pro Tyr Gly Pro Gly Ala Ser Ala Ala
1               5                   10                  15

Ala Ala Ala Gly Gln Asn Gly Pro Gly Ser Gly Gln Gln Gly Pro Gly
            20                  25                  30

Gln Ser Ala Ala Ala Ala Ala Gly Gln Tyr Gly Pro Gly Gln Gln Gly
        35                  40                  45

Pro Gly Gln Gln Gly Pro Gly Ser Ser Ala Ala Ala Ala Ala Gly Pro
    50                  55                  60

Gly Gln Tyr Gly Pro Gly Gln Gln Gly Pro Ser Ala Ser Ala Ala Ala
65                  70                  75                  80

Ala Ala Gly Pro Gly Ser Gly Gln Gln Gly Pro Gly Ala Ser Ala Ala
                85                  90                  95

Ala Ala Ala Gly Gln Tyr Gly Pro Gly Gln Gln Gly Pro Gly Gln Gln
            100                 105                 110
```

```
Gly Pro Gly Ser Ser Ala Ala Ala Ala Ala Gly Gln Tyr Gly Ser Gly
        115                 120                 125

Pro Gly Gln Gln Gly Pro Tyr Gly Ser Ala Ala Ala Ala Ala Gly Pro
    130                 135                 140

Gly Ser Gly Gln Tyr Gly Gln Gly Pro Tyr Gly Pro Gly Ala Ser Ala
145                 150                 155                 160

Ala Ala Ala Ala Gly Pro Gly Gln Tyr Gly Pro Gly Gln Gln Gly Pro
                165                 170                 175

Ser Ala Ser Ala Ala Ala Ala Ala Gly Ser Gly Gln Gln Gly Pro Gly
            180                 185                 190

Gln Tyr Gly Pro Tyr Ala Ser Ala Ala Ala Ala Ala Gly Gln Tyr Gly
        195                 200                 205

Ser Gly Pro Gly Gln Gln Gly Pro Tyr Gly Pro Gly Gln Ser Ala Ala
    210                 215                 220

Ala Ala Ala Gly Ser Gly Gln Gln Gly Pro Gly Gln Gln Gly Pro Tyr
225                 230                 235                 240

Ala Ser Ala Ala Ala Ala Ala Gly Pro Gly Gln Gln Gly Pro Tyr Gly
                245                 250                 255

Pro Gly Ser Ser Ala Ala Ala Ala Ala Gly Gln Tyr Gly Tyr Gly Pro
            260                 265                 270

Gly Gln Gln Gly Pro Tyr Gly Pro Gly Ala Ser Ala Ala Ala Ala Ala
        275                 280                 285

Gly Gln Asn Gly Pro Gly Ser Gly Gln Tyr Gly Pro Gly Gln Gln Gly
    290                 295                 300

Pro Gly Gln Ser Ala Ala Ala Ala Ala Gly Pro Gly Gln Gln Gly Pro
305                 310                 315                 320

Tyr Gly Pro Gly Ala Ser Ala Ala Ala Ala Ala Gly Gln Tyr Gly Pro
                325                 330                 335

Gly Gln Gln Gly Pro Gly Gln Tyr Gly Pro Gly Ser Ser Ala Ala Ala
            340                 345                 350

Ala Ala Gly Pro Gly Gln Gln Gly Pro Tyr Gly Pro Gly Ser Ser Ala
        355                 360                 365

Ala Ala Ala Ala Gly Gln Tyr Gly Pro Gly Gln Gln Gly Pro Tyr Gly
    370                 375                 380

Pro Gly Gln Ser Ala Ala Ala Ala Ala Gly Gln Tyr Gln Gln Gly Pro
385                 390                 395                 400

Gly Gln Gln Gly Pro Tyr Gly Pro Gly Ala Ser Ala Ala Ala Ala Ala
                405                 410                 415

Gly Pro Gly Gln Gln Gly Pro Tyr Gly Pro Gly Ala Ser Ala Ala Ala
            420                 425                 430

Ala Ala Gly Pro Gly Gln Tyr Gly Pro Gly Gln Gln Gly Pro Ser Ala
        435                 440                 445

Ser Ala Ala Ala Ala Ala Gly Gln Tyr Gly Ser Gly Pro Gly Gln Tyr
    450                 455                 460

Gly Pro Tyr Gly Pro Gly Gln Ser Ala Ala Ala Ala Ala Gly Pro Gly
465                 470                 475                 480

Ser Gly Gln Gln Gly Gln Gly Pro Tyr Gly Pro Gly Ala Ser Ala Ala
                485                 490                 495

Ala Ala Ala Gly Gln Tyr Gly Pro Gly Gln Gln Gly Pro Tyr Gly Pro
            500                 505                 510

Gly Gln Ser Ala Ala Ala Ala Ala Gly Pro Gly Ser Gly Gln Tyr Gly
        515                 520                 525
```

```
Pro Gly Ala Ser Ala Ala Ala Ala Ala Gly Gln Asn Gly Pro Gly Ser
    530                 535                 540

Gly Gln Tyr Gly Pro Gly Gln Gln Gly Pro Gly Gln Ser Ala Ala Ala
545                 550                 555                 560

Ala Ala Gly Gln Tyr Gln Gln Gly Pro Gly Gln Gln Gly Pro Tyr Gly
                565                 570                 575

Pro Gly Ala Ser Ala Ala Ala Ala Ala Gly Pro Gly Ser Gly Gln Gln
            580                 585                 590

Gly Pro Gly Ala Ser
        595


<210> SEQ ID NO 7
<211> LENGTH: 590
<212> TYPE: PRT
<213> ORGANISM: Artificial Sequence
<220> FEATURE:
<223> OTHER INFORMATION: Met-PRT410

<400> SEQUENCE: 7

Met Gly Pro Gly Gln Gln Gly Pro Tyr Gly Pro Gly Ala Ser Ala Ala
1               5                   10                  15

Ala Ala Ala Gly Gln Asn Gly Pro Gly Ser Gly Gln Gln Gly Pro Gly
            20                  25                  30

Gln Ser Gly Gln Tyr Gly Pro Gly Gln Gln Gly Pro Gly Gln Gln Gly
        35                  40                  45

Pro Gly Ser Ser Ala Ala Ala Ala Ala Gly Pro Gly Gln Tyr Gly Pro
    50                  55                  60

Gly Gln Gln Gly Pro Ser Ala Ser Ala Ala Ala Ala Ala Gly Pro Gly
65                  70                  75                  80

Ser Gly Gln Gln Gly Pro Gly Ala Ser Gly Gln Tyr Gly Pro Gly Gln
                85                  90                  95

Gln Gly Pro Gly Gln Gln Gly Pro Gly Ser Ser Ala Ala Ala Ala Ala
            100                 105                 110

Gly Gln Tyr Gly Ser Gly Pro Gly Gln Gln Gly Pro Tyr Gly Ser Ala
        115                 120                 125

Ala Ala Ala Ala Gly Pro Gly Ser Gly Gln Tyr Gly Gln Gly Pro Tyr
    130                 135                 140

Gly Pro Gly Ala Ser Gly Pro Gly Gln Tyr Gly Pro Gly Gln Gln Gly
145                 150                 155                 160

Pro Ser Ala Ser Ala Ala Ala Ala Ala Gly Ser Gly Gln Gln Gly Pro
                165                 170                 175

Gly Gln Tyr Gly Pro Tyr Ala Ser Ala Ala Ala Ala Ala Gly Gln Tyr
            180                 185                 190

Gly Ser Gly Pro Gly Gln Gln Gly Pro Tyr Gly Pro Gly Gln Ser Gly
        195                 200                 205

Ser Gly Gln Gln Gly Pro Gly Gln Gln Gly Pro Tyr Ala Ser Ala Ala
    210                 215                 220

Ala Ala Ala Gly Pro Gly Gln Gln Gly Pro Tyr Gly Pro Gly Ser Ser
225                 230                 235                 240

Ala Ala Ala Ala Ala Gly Gln Tyr Gly Tyr Gly Pro Gly Gln Gln Gly
                245                 250                 255

Pro Tyr Gly Pro Gly Ala Ser Gly Gln Asn Gly Pro Gly Ser Gly Gln
            260                 265                 270

Tyr Gly Pro Gly Gln Gln Gly Pro Gly Gln Ser Ala Ala Ala Ala Ala
        275                 280                 285
```

```
Gly Pro Gly Gln Gln Gly Pro Tyr Gly Pro Gly Ala Ser Ala Ala Ala
    290                 295                 300

Ala Ala Gly Gln Tyr Gly Pro Gly Gln Gln Gly Pro Gly Gln Tyr Gly
305                 310                 315                 320

Pro Gly Ser Ser Gly Pro Gly Gln Gln Gly Pro Tyr Gly Pro Gly Ser
                325                 330                 335

Ser Ala Ala Ala Ala Ala Gly Gln Tyr Gly Pro Gly Gln Gln Gly Pro
            340                 345                 350

Tyr Gly Pro Gly Gln Ser Ala Ala Ala Ala Ala Gly Gln Tyr Gln Gln
        355                 360                 365

Gly Pro Gly Gln Gln Gly Pro Tyr Gly Pro Gly Ala Ser Gly Pro Gly
    370                 375                 380

Gln Gln Gly Pro Tyr Gly Pro Gly Ala Ser Ala Ala Ala Ala Ala Gly
385                 390                 395                 400

Pro Gly Gln Tyr Gly Pro Gly Gln Gln Gly Pro Ser Ala Ser Ala Ala
                405                 410                 415

Ala Ala Ala Gly Gln Tyr Gly Ser Gly Pro Gly Gln Tyr Gly Pro Tyr
            420                 425                 430

Gly Pro Gly Gln Ser Gly Pro Gly Ser Gly Gln Gln Gly Gln Gly Pro
        435                 440                 445

Tyr Gly Pro Gly Ala Ser Ala Ala Ala Ala Ala Gly Gln Tyr Gly Pro
    450                 455                 460

Gly Gln Gln Gly Pro Tyr Gly Pro Gly Gln Ser Ala Ala Ala Ala Ala
465                 470                 475                 480

Gly Pro Gly Ser Gly Gln Tyr Gly Pro Gly Ala Ser Gly Gln Asn Gly
                485                 490                 495

Pro Gly Ser Gly Gln Tyr Gly Pro Gly Gln Gln Gly Pro Gly Gln Ser
            500                 505                 510

Ala Ala Ala Ala Ala Gly Gln Tyr Gln Gln Gly Pro Gly Gln Gln Gly
        515                 520                 525

Pro Tyr Gly Pro Gly Ala Ser Ala Ala Ala Ala Ala Gly Gln Tyr Gly
    530                 535                 540

Ser Gly Pro Gly Gln Gln Gly Pro Tyr Gly Pro Gly Gln Ser Gly Ser
545                 550                 555                 560

Gly Gln Gln Gly Pro Gly Gln Gln Gly Pro Tyr Ala Ser Ala Ala Ala
                565                 570                 575

Ala Ala Gly Pro Gly Ser Gly Gln Gln Gly Pro Gly Ala Ser
            580                 585                 590


<210> SEQ ID NO 8
<211> LENGTH: 565
<212> TYPE: PRT
<213> ORGANISM: Artificial Sequence
<220> FEATURE:
<223> OTHER INFORMATION: Met-PRT525

<400> SEQUENCE: 8

Met Gly Pro Gly Gln Gln Gly Pro Tyr Gly Pro Gly Ala Ser Ala Ala
1               5                   10                  15

Ala Ala Ala Ala Ala Gly Ser Asn Gly Pro Gly Ser Gly Gln Gln Gly
            20                  25                  30

Pro Gly Gln Ser Gly Gln Tyr Gly Pro Gly Gln Gln Gly Pro Gly Gln
        35                  40                  45

Gln Gly Pro Gly Ser Ser Ala Ala Ala Ala Ala Ala Ala Gly Pro Gly
    50                  55                  60
```

```
Gln Tyr Gly Pro Gly Gln Gln Gly Pro Ser Ala Ser Ala Ala Ala Ala
65                  70                  75                  80

Ala Ala Ala Gly Pro Gly Ser Gly Gln Gln Gly Pro Gly Ala Ser Gly
                85                  90                  95

Gln Tyr Gly Pro Gly Gln Gln Gly Pro Gly Gln Gln Gly Pro Gly Ser
            100                 105                 110

Ser Ala Ala Ala Ala Ala Ala Ala Gly Ser Tyr Gly Ser Gly Pro Gly
        115                 120                 125

Gln Gln Gly Pro Tyr Gly Ser Ala Ala Ala Ala Ala Ala Ala Gly Pro
    130                 135                 140

Gly Ser Gly Gln Tyr Gly Gln Gly Pro Tyr Gly Pro Gly Ala Ser Gly
145                 150                 155                 160

Pro Gly Gln Tyr Gly Pro Gly Gln Gln Gly Pro Ser Ala Ser Ala Ala
                165                 170                 175

Ala Ala Ala Ala Ala Gly Ser Gly Gln Gln Gly Pro Gly Gln Tyr Gly
            180                 185                 190

Pro Tyr Ala Ser Ala Ala Ala Ala Ala Ala Ala Gly Ser Tyr Gly Ser
        195                 200                 205

Gly Pro Gly Gln Gln Gly Pro Tyr Gly Pro Gly Gln Ser Gly Ser Gly
    210                 215                 220

Gln Gln Gly Pro Gly Gln Gln Gly Pro Tyr Ala Ser Ala Ala Ala Ala
225                 230                 235                 240

Ala Ala Ala Gly Pro Gly Gln Gln Gly Pro Tyr Gly Pro Gly Ser Ser
                245                 250                 255

Ala Ala Ala Ala Ala Ala Ala Gly Ser Tyr Gly Tyr Gly Pro Gly Gln
            260                 265                 270

Gln Gly Pro Tyr Gly Pro Gly Ala Ser Gly Gln Asn Gly Pro Gly Ser
        275                 280                 285

Gly Gln Tyr Gly Pro Gly Gln Gln Gly Pro Gly Pro Ser Ala Ala Ala
    290                 295                 300

Ala Ala Ala Ala Gly Pro Gly Gln Gln Gly Pro Tyr Gly Pro Gly Ala
305                 310                 315                 320

Ser Ala Ala Ala Ala Ala Ala Ala Gly Ser Tyr Gly Pro Gly Gln Gln
                325                 330                 335

Gly Pro Gly Gln Tyr Gly Pro Gly Ser Ser Gly Pro Gly Gln Gln Gly
            340                 345                 350

Pro Tyr Gly Pro Gly Ser Ser Ala Ala Ala Ala Ala Ala Ala Gly Ser
        355                 360                 365

Tyr Gly Pro Gly Gln Gln Gly Pro Tyr Gly Pro Gly Pro Ser Ala Ala
    370                 375                 380

Ala Ala Ala Ala Ala Gly Ser Tyr Gln Gln Gly Pro Gly Gln Gln Gly
385                 390                 395                 400

Pro Tyr Gly Pro Gly Ala Ser Gly Pro Gly Gln Gln Gly Pro Tyr Gly
                405                 410                 415

Pro Gly Ala Ser Ala Ala Ala Ala Ala Ala Ala Gly Pro Gly Gln Tyr
            420                 425                 430

Gly Pro Gly Gln Gln Gly Pro Ser Ala Ser Ala Ala Ala Ala Ala Ala
        435                 440                 445

Ala Gly Ser Tyr Gly Ser Gly Pro Gly Gln Tyr Gly Pro Tyr Gly Pro
    450                 455                 460

Gly Gln Ser Gly Pro Gly Ser Gly Gln Gln Gly Gln Gly Pro Tyr Gly
465                 470                 475                 480

Pro Gly Ala Ser Ala Ala Ala Ala Ala Ala Ala Gly Ser Tyr Gly Pro
```

```
                485                 490                 495

Gly Gln Gln Gly Pro Tyr Gly Pro Gly Pro Ser Ala Ala Ala Ala Ala
            500                 505                 510

Ala Ala Gly Pro Gly Ser Gly Gln Tyr Gly Pro Gly Ala Ser Gly Gln
        515                 520                 525

Asn Gly Pro Gly Ser Gly Gln Tyr Gly Pro Gly Gln Gln Gly Pro Gly
    530                 535                 540

Pro Ser Ala Ala Ala Ala Ala Ala Ala Gly Pro Gly Ser Gly Gln Gln
545                 550                 555                 560

Gly Pro Gly Ala Ser
                565


<210> SEQ ID NO 9
<211> LENGTH: 2364
<212> TYPE: PRT
<213> ORGANISM: Artificial Sequence
<220> FEATURE:
<223> OTHER INFORMATION: Met-PRT799

<400> SEQUENCE: 9

Met Gly Pro Gly Gln Gln Gly Pro Tyr Gly Pro Gly Ala Ser Ala Ala
1               5                   10                  15

Ala Ala Ala Gly Gln Asn Gly Pro Gly Ser Gly Gln Gln Gly Pro Gly
            20                  25                  30

Gln Ser Gly Gln Tyr Gly Pro Gly Gln Gln Gly Pro Gly Gln Gln Gly
        35                  40                  45

Pro Gly Ser Ser Ala Ala Ala Ala Ala Gly Pro Gly Gln Tyr Gly Pro
    50                  55                  60

Gly Gln Gln Gly Pro Ser Ala Ser Ala Ala Ala Ala Ala Gly Pro Gly
65                  70                  75                  80

Ser Gly Gln Gln Gly Pro Gly Ala Ser Gly Gln Tyr Gly Pro Gly Gln
                85                  90                  95

Gln Gly Pro Gly Gln Gln Gly Pro Gly Ser Ser Ala Ala Ala Ala Ala
            100                 105                 110

Gly Gln Tyr Gly Ser Gly Pro Gly Gln Gln Gly Pro Tyr Gly Ser Ala
        115                 120                 125

Ala Ala Ala Ala Gly Pro Gly Ser Gly Gln Tyr Gly Gln Gly Pro Tyr
    130                 135                 140

Gly Pro Gly Ala Ser Gly Pro Gly Gln Tyr Gly Pro Gly Gln Gln Gly
145                 150                 155                 160

Pro Ser Ala Ser Ala Ala Ala Ala Ala Gly Ser Gly Gln Gln Gly Pro
                165                 170                 175

Gly Gln Tyr Gly Pro Tyr Ala Ser Ala Ala Ala Ala Ala Gly Gln Tyr
            180                 185                 190

Gly Ser Gly Pro Gly Gln Gln Gly Pro Tyr Gly Pro Gly Gln Ser Gly
        195                 200                 205

Ser Gly Gln Gln Gly Pro Gly Gln Gln Gly Pro Tyr Ala Ser Ala Ala
    210                 215                 220

Ala Ala Ala Gly Pro Gly Gln Gln Gly Pro Tyr Gly Pro Gly Ser Ser
225                 230                 235                 240

Ala Ala Ala Ala Ala Gly Gln Tyr Gly Tyr Gly Pro Gly Gln Gln Gly
                245                 250                 255

Pro Tyr Gly Pro Gly Ala Ser Gly Gln Asn Gly Pro Gly Ser Gly Gln
            260                 265                 270

Tyr Gly Pro Gly Gln Gln Gly Pro Gly Gln Ser Ala Ala Ala Ala Ala
```

```
        275                 280                 285

Gly Pro Gly Gln Gln Gly Pro Tyr Gly Pro Gly Ala Ser Ala Ala Ala
    290                 295                 300

Ala Ala Gly Gln Tyr Gly Pro Gly Gln Gln Gly Pro Gly Gln Tyr Gly
305                 310                 315                 320

Pro Gly Ser Ser Gly Pro Gly Gln Gln Gly Pro Tyr Gly Pro Gly Ser
                325                 330                 335

Ser Ala Ala Ala Ala Ala Gly Gln Tyr Gly Pro Gly Gln Gln Gly Pro
            340                 345                 350

Tyr Gly Pro Gly Gln Ser Ala Ala Ala Ala Ala Gly Gln Tyr Gln Gln
        355                 360                 365

Gly Pro Gly Gln Gln Gly Pro Tyr Gly Pro Gly Ala Ser Gly Pro Gly
    370                 375                 380

Gln Gln Gly Pro Tyr Gly Pro Gly Ala Ser Ala Ala Ala Ala Ala Gly
385                 390                 395                 400

Pro Gly Gln Tyr Gly Pro Gly Gln Gln Gly Pro Ser Ala Ser Ala Ala
                405                 410                 415

Ala Ala Ala Gly Gln Tyr Gly Ser Gly Pro Gly Gln Tyr Gly Pro Tyr
            420                 425                 430

Gly Pro Gly Gln Ser Gly Pro Gly Ser Gly Gln Gln Gly Gln Gly Pro
        435                 440                 445

Tyr Gly Pro Gly Ala Ser Ala Ala Ala Ala Ala Gly Gln Tyr Gly Pro
    450                 455                 460

Gly Gln Gln Gly Pro Tyr Gly Pro Gly Gln Ser Ala Ala Ala Ala Ala
465                 470                 475                 480

Gly Pro Gly Ser Gly Gln Tyr Gly Pro Gly Ala Ser Gly Gln Asn Gly
                485                 490                 495

Pro Gly Ser Gly Gln Tyr Gly Pro Gly Gln Gln Gly Pro Gly Gln Ser
            500                 505                 510

Ala Ala Ala Ala Ala Gly Gln Tyr Gln Gln Gly Pro Gly Gln Gln Gly
        515                 520                 525

Pro Tyr Gly Pro Gly Ala Ser Ala Ala Ala Ala Ala Gly Gln Tyr Gly
    530                 535                 540

Ser Gly Pro Gly Gln Gln Gly Pro Tyr Gly Pro Gly Gln Ser Gly Ser
545                 550                 555                 560

Gly Gln Gln Gly Pro Gly Gln Gln Gly Pro Tyr Ala Ser Ala Ala Ala
                565                 570                 575

Ala Ala Gly Pro Gly Ser Gly Gln Gln Gly Pro Gly Ala Ser Gly Gln
            580                 585                 590

Gln Gly Pro Tyr Gly Pro Gly Ala Ser Ala Ala Ala Ala Ala Gly Gln
        595                 600                 605

Asn Gly Pro Gly Ser Gly Gln Gln Gly Pro Gly Gln Ser Gly Gln Tyr
    610                 615                 620

Gly Pro Gly Gln Gln Gly Pro Gly Gln Gln Gly Pro Gly Ser Ser Ala
625                 630                 635                 640

Ala Ala Ala Ala Gly Pro Gly Gln Tyr Gly Pro Gly Gln Gln Gly Pro
                645                 650                 655

Ser Ala Ser Ala Ala Ala Ala Ala Gly Pro Gly Ser Gly Gln Gln Gly
            660                 665                 670

Pro Gly Ala Ser Gly Gln Tyr Gly Pro Gly Gln Gln Gly Pro Gly Gln
        675                 680                 685

Gln Gly Pro Gly Ser Ser Ala Ala Ala Ala Ala Gly Gln Tyr Gly Ser
    690                 695                 700
```

```
Gly Pro Gly Gln Gln Gly Pro Tyr Gly Ser Ala Ala Ala Ala Ala Gly
705                 710                 715                 720

Pro Gly Ser Gly Gln Tyr Gly Gln Gly Pro Tyr Gly Pro Gly Ala Ser
                725                 730                 735

Gly Pro Gly Gln Tyr Gly Pro Gly Gln Gln Gly Pro Ser Ala Ser Ala
            740                 745                 750

Ala Ala Ala Ala Gly Ser Gly Gln Gln Gly Pro Gly Gln Tyr Gly Pro
        755                 760                 765

Tyr Ala Ser Ala Ala Ala Ala Ala Gly Gln Tyr Gly Ser Gly Pro Gly
    770                 775                 780

Gln Gln Gly Pro Tyr Gly Pro Gly Gln Ser Gly Ser Gly Gln Gln Gly
785                 790                 795                 800

Pro Gly Gln Gln Gly Pro Tyr Ala Ser Ala Ala Ala Ala Ala Gly Pro
                805                 810                 815

Gly Gln Gln Gly Pro Tyr Gly Pro Gly Ser Ser Ala Ala Ala Ala Ala
            820                 825                 830

Gly Gln Tyr Gly Tyr Gly Pro Gly Gln Gln Gly Pro Tyr Gly Pro Gly
        835                 840                 845

Ala Ser Gly Gln Asn Gly Pro Gly Ser Gly Gln Tyr Gly Pro Gly Gln
    850                 855                 860

Gln Gly Pro Gly Gln Ser Ala Ala Ala Ala Ala Gly Pro Gly Gln Gln
865                 870                 875                 880

Gly Pro Tyr Gly Pro Gly Ala Ser Ala Ala Ala Ala Ala Gly Gln Tyr
                885                 890                 895

Gly Pro Gly Gln Gln Gly Pro Gly Gln Tyr Gly Pro Gly Ser Ser Gly
            900                 905                 910

Pro Gly Gln Gln Gly Pro Tyr Gly Pro Gly Ser Ser Ala Ala Ala Ala
        915                 920                 925

Ala Gly Gln Tyr Gly Pro Gly Gln Gln Gly Pro Tyr Gly Pro Gly Gln
    930                 935                 940

Ser Ala Ala Ala Ala Ala Gly Gln Tyr Gln Gln Gly Pro Gly Gln Gln
945                 950                 955                 960

Gly Pro Tyr Gly Pro Gly Ala Ser Gly Pro Gly Gln Gln Gly Pro Tyr
                965                 970                 975

Gly Pro Gly Ala Ser Ala Ala Ala Ala Ala Gly Pro Gly Gln Tyr Gly
            980                 985                 990

Pro Gly Gln Gln Gly Pro Ser Ala  Ser Ala Ala Ala Ala  Ala Gly Gln
        995                 1000                1005

Tyr Gly  Ser Gly Pro Gly Gln  Tyr Gly Pro Tyr Gly  Pro Gly Gln
    1010                1015                1020

Ser Gly  Pro Gly Ser Gly Gln  Gln Gly Gln Gly Pro  Tyr Gly Pro
    1025                1030                1035

Gly Ala  Ser Ala Ala Ala Ala  Ala Gly Gln Tyr Gly  Pro Gly Gln
    1040                1045                1050

Gln Gly  Pro Tyr Gly Pro Gly  Gln Ser Ala Ala Ala  Ala Ala Gly
    1055                1060                1065

Pro Gly  Ser Gly Gln Tyr Gly  Pro Gly Ala Ser Gly  Gln Asn Gly
    1070                1075                1080

Pro Gly  Ser Gly Gln Tyr Gly  Pro Gly Gln Gln Gly  Pro Gly Gln
    1085                1090                1095

Ser Ala  Ala Ala Ala Ala Gly  Gln Tyr Gln Gln Gly  Pro Gly Gln
    1100                1105                1110
```

```
Gln Gly  Pro Tyr Gly Pro Gly  Ala Ser Ala Ala Ala  Ala Ala Gly
    1115                 1120                 1125

Gln Tyr  Gly Ser Gly Pro Gly  Gln Gln Gly Pro Tyr  Gly Pro Gly
    1130                 1135                 1140

Gln Ser  Gly Ser Gly Gln Gln  Gly Pro Gly Gln Gln  Gly Pro Tyr
    1145                 1150                 1155

Ala Ser  Ala Ala Ala Ala Ala  Gly Pro Gly Ser Gly  Gln Gln Gly
    1160                 1165                 1170

Pro Gly  Ala Ser Gly Gln Gln  Gly Pro Tyr Gly Pro  Gly Ala Ser
    1175                 1180                 1185

Ala Ala  Ala Ala Ala Gly Gln  Asn Gly Pro Gly Ser  Gly Gln Gln
    1190                 1195                 1200

Gly Pro  Gly Gln Ser Gly Gln  Tyr Gly Pro Gly Gln  Gln Gly Pro
    1205                 1210                 1215

Gly Gln  Gln Gly Pro Gly Ser  Ser Ala Ala Ala Ala  Ala Gly Pro
    1220                 1225                 1230

Gly Gln  Tyr Gly Pro Gly Gln  Gln Gly Pro Ser Ala  Ser Ala Ala
    1235                 1240                 1245

Ala Ala  Ala Gly Pro Gly Ser  Gly Gln Gln Gly Pro  Gly Ala Ser
    1250                 1255                 1260

Gly Gln  Tyr Gly Pro Gly Gln  Gln Gly Pro Gly Gln  Gln Gly Pro
    1265                 1270                 1275

Gly Ser  Ser Ala Ala Ala Ala  Ala Gly Gln Tyr Gly  Ser Gly Pro
    1280                 1285                 1290

Gly Gln  Gln Gly Pro Tyr Gly  Ser Ala Ala Ala Ala  Ala Gly Pro
    1295                 1300                 1305

Gly Ser  Gly Gln Tyr Gly Gln  Gly Pro Tyr Gly Pro  Gly Ala Ser
    1310                 1315                 1320

Gly Pro  Gly Gln Tyr Gly Pro  Gly Gln Gln Gly Pro  Ser Ala Ser
    1325                 1330                 1335

Ala Ala  Ala Ala Ala Gly Ser  Gly Gln Gln Gly Pro  Gly Gln Tyr
    1340                 1345                 1350

Gly Pro  Tyr Ala Ser Ala Ala  Ala Ala Ala Gly Gln  Tyr Gly Ser
    1355                 1360                 1365

Gly Pro  Gly Gln Gln Gly Pro  Tyr Gly Pro Gly Gln  Ser Gly Ser
    1370                 1375                 1380

Gly Gln  Gln Gly Pro Gly Gln  Gln Gly Pro Tyr Ala  Ser Ala Ala
    1385                 1390                 1395

Ala Ala  Ala Gly Pro Gly Gln  Gln Gly Pro Tyr Gly  Pro Gly Ser
    1400                 1405                 1410

Ser Ala  Ala Ala Ala Ala Gly  Gln Tyr Gly Tyr Gly  Pro Gly Gln
    1415                 1420                 1425

Gln Gly  Pro Tyr Gly Pro Gly  Ala Ser Gly Gln Asn  Gly Pro Gly
    1430                 1435                 1440

Ser Gly  Gln Tyr Gly Pro Gly  Gln Gln Gly Pro Gly  Gln Ser Ala
    1445                 1450                 1455

Ala Ala  Ala Ala Gly Pro Gly  Gln Gln Gly Pro Tyr  Gly Pro Gly
    1460                 1465                 1470

Ala Ser  Ala Ala Ala Ala Ala  Gly Gln Tyr Gly Pro  Gly Gln Gln
    1475                 1480                 1485

Gly Pro  Gly Gln Tyr Gly Pro  Gly Ser Ser Gly Pro  Gly Gln Gln
    1490                 1495                 1500

Gly Pro  Tyr Gly Pro Gly Ser  Ser Ala Ala Ala Ala  Ala Gly Gln
```

```
    1505                1510                1515

Tyr Gly  Pro Gly Gln Gln Gly  Pro Tyr Gly Pro Gly  Gln Ser Ala
    1520                1525                1530

Ala Ala  Ala Ala Gly Gln Tyr  Gln Gln Gly Pro Gly  Gln Gln Gly
    1535                1540                1545

Pro Tyr  Gly Pro Gly Ala Ser  Gly Pro Gly Gln Gln  Gly Pro Tyr
    1550                1555                1560

Gly Pro  Gly Ala Ser Ala Ala  Ala Ala Ala Gly Pro  Gly Gln Tyr
    1565                1570                1575

Gly Pro  Gly Gln Gln Gly Pro  Ser Ala Ser Ala Ala  Ala Ala Ala
    1580                1585                1590

Gly Gln  Tyr Gly Ser Gly Pro  Gly Gln Tyr Gly Pro  Tyr Gly Pro
    1595                1600                1605

Gly Gln  Ser Gly Pro Gly Ser  Gly Gln Gln Gly Gln  Gly Pro Tyr
    1610                1615                1620

Gly Pro  Gly Ala Ser Ala Ala  Ala Ala Ala Gly Gln  Tyr Gly Pro
    1625                1630                1635

Gly Gln  Gln Gly Pro Tyr Gly  Pro Gly Gln Ser Ala  Ala Ala Ala
    1640                1645                1650

Ala Gly  Pro Gly Ser Gly Gln  Tyr Gly Pro Gly Ala  Ser Gly Gln
    1655                1660                1665

Asn Gly  Pro Gly Ser Gly Gln  Tyr Gly Pro Gly Gln  Gln Gly Pro
    1670                1675                1680

Gly Gln  Ser Ala Ala Ala Ala  Ala Gly Gln Tyr Gln  Gln Gly Pro
    1685                1690                1695

Gly Gln  Gln Gly Pro Tyr Gly  Pro Gly Ala Ser Ala  Ala Ala Ala
    1700                1705                1710

Ala Gly  Gln Tyr Gly Ser Gly  Pro Gly Gln Gln Gly  Pro Tyr Gly
    1715                1720                1725

Pro Gly  Gln Ser Gly Ser Gly  Gln Gln Gly Pro Gly  Gln Gln Gly
    1730                1735                1740

Pro Tyr  Ala Ser Ala Ala Ala  Ala Ala Gly Pro Gly  Ser Gly Gln
    1745                1750                1755

Gln Gly  Pro Gly Ala Ser Gly  Gln Gln Gly Pro Tyr  Gly Pro Gly
    1760                1765                1770

Ala Ser  Ala Ala Ala Ala Ala  Gly Gln Asn Gly Pro  Gly Ser Gly
    1775                1780                1785

Gln Gln  Gly Pro Gly Gln Ser  Gly Gln Tyr Gly Pro  Gly Gln Gln
    1790                1795                1800

Gly Pro  Gly Gln Gln Gly Pro  Gly Ser Ser Ala Ala  Ala Ala Ala
    1805                1810                1815

Gly Pro  Gly Gln Tyr Gly Pro  Gly Gln Gln Gly Pro  Ser Ala Ser
    1820                1825                1830

Ala Ala  Ala Ala Ala Gly Pro  Gly Ser Gly Gln Gln  Gly Pro Gly
    1835                1840                1845

Ala Ser  Gly Gln Tyr Gly Pro  Gly Gln Gln Gly Pro  Gly Gln Gln
    1850                1855                1860

Gly Pro  Gly Ser Ser Ala Ala  Ala Ala Ala Gly Gln  Tyr Gly Ser
    1865                1870                1875

Gly Pro  Gly Gln Gln Gly Pro  Tyr Gly Ser Ala Ala  Ala Ala Ala
    1880                1885                1890

Gly Pro  Gly Ser Gly Gln Tyr  Gly Gln Gly Pro Tyr  Gly Pro Gly
    1895                1900                1905
```

```
Ala Ser  Gly Pro Gly Gln Tyr  Gly Pro Gly Gln Gln  Gly Pro Ser
    1910                 1915                 1920

Ala Ser  Ala Ala Ala Ala Ala  Gly Ser Gly Gln Gln  Gly Pro Gly
    1925                 1930                 1935

Gln Tyr  Gly Pro Tyr Ala Ser  Ala Ala Ala Ala Ala  Gly Gln Tyr
    1940                 1945                 1950

Gly Ser  Gly Pro Gly Gln Gln  Gly Pro Tyr Gly Pro  Gly Gln Ser
    1955                 1960                 1965

Gly Ser  Gly Gln Gln Gly Pro  Gly Gln Gln Gly Pro  Tyr Ala Ser
    1970                 1975                 1980

Ala Ala  Ala Ala Ala Gly Pro  Gly Gln Gln Gly Pro  Tyr Gly Pro
    1985                 1990                 1995

Gly Ser  Ser Ala Ala Ala Ala  Ala Gly Gln Tyr Gly  Tyr Gly Pro
    2000                 2005                 2010

Gly Gln  Gln Gly Pro Tyr Gly  Pro Gly Ala Ser Gly  Gln Asn Gly
    2015                 2020                 2025

Pro Gly  Ser Gly Gln Tyr Gly  Pro Gly Gln Gln Gly  Pro Gly Gln
    2030                 2035                 2040

Ser Ala  Ala Ala Ala Ala Gly  Pro Gly Gln Gln Gly  Pro Tyr Gly
    2045                 2050                 2055

Pro Gly  Ala Ser Ala Ala Ala  Ala Ala Gly Gln Tyr  Gly Pro Gly
    2060                 2065                 2070

Gln Gln  Gly Pro Gly Gln Tyr  Gly Pro Gly Ser Ser  Gly Pro Gly
    2075                 2080                 2085

Gln Gln  Gly Pro Tyr Gly Pro  Gly Ser Ser Ala Ala  Ala Ala Ala
    2090                 2095                 2100

Gly Gln  Tyr Gly Pro Gly Gln  Gln Gly Pro Tyr Gly  Pro Gly Gln
    2105                 2110                 2115

Ser Ala  Ala Ala Ala Ala Gly  Gln Tyr Gln Gln Gly  Pro Gly Gln
    2120                 2125                 2130

Gln Gly  Pro Tyr Gly Pro Gly  Ala Ser Gly Pro Gly  Gln Gln Gly
    2135                 2140                 2145

Pro Tyr  Gly Pro Gly Ala Ser  Ala Ala Ala Ala Ala  Gly Pro Gly
    2150                 2155                 2160

Gln Tyr  Gly Pro Gly Gln Gln  Gly Pro Ser Ala Ser  Ala Ala Ala
    2165                 2170                 2175

Ala Ala  Gly Gln Tyr Gly Ser  Gly Pro Gly Gln Tyr  Gly Pro Tyr
    2180                 2185                 2190

Gly Pro  Gly Gln Ser Gly Pro  Gly Ser Gly Gln Gln  Gly Gln Gly
    2195                 2200                 2205

Pro Tyr  Gly Pro Gly Ala Ser  Ala Ala Ala Ala Ala  Gly Gln Tyr
    2210                 2215                 2220

Gly Pro  Gly Gln Gln Gly Pro  Tyr Gly Pro Gly Gln  Ser Ala Ala
    2225                 2230                 2235

Ala Ala  Ala Gly Pro Gly Ser  Gly Gln Tyr Gly Pro  Gly Ala Ser
    2240                 2245                 2250

Gly Gln  Asn Gly Pro Gly Ser  Gly Gln Tyr Gly Pro  Gly Gln Gln
    2255                 2260                 2265

Gly Pro  Gly Gln Ser Ala Ala  Ala Ala Ala Gly Gln  Tyr Gln Gln
    2270                 2275                 2280

Gly Pro  Gly Gln Gln Gly Pro  Tyr Gly Pro Gly Ala  Ser Ala Ala
    2285                 2290                 2295
```

```
Ala Ala  Ala Gly Gln Tyr Gly  Ser Gly Pro Gly Gln  Gln Gly Pro
    2300                2305                2310

Tyr Gly  Pro Gly Gln Ser Gly  Ser Gly Gln Gln Gly  Pro Gly Gln
    2315                2320                2325

Gln Gly  Pro Tyr Ala Ser Ala  Ala Ala Ala Ala Gly  Pro Gly Ser
    2330                2335                2340

Gly Gln  Gln Gly Ser Ser Val  Asp Lys Leu Ala Ala  Ala Leu Glu
    2345                2350                2355

His His  His His His His
    2360


<210> SEQ ID NO 10
<211> LENGTH: 597
<212> TYPE: PRT
<213> ORGANISM: Artificial Sequence
<220> FEATURE:
<223> OTHER INFORMATION: Met-PRT313

<400> SEQUENCE: 10

Met Gly Pro Gly Gly Gln Gly Pro Tyr Gly Pro Gly Ala Ser Ala Ala
1               5                   10                  15

Ala Ala Ala Gly Gly Asn Gly Pro Gly Ser Gly Gln Gln Gly Pro Gly
            20                  25                  30

Gly Ser Ala Ala Ala Ala Ala Gly Gly Tyr Gly Pro Gly Gly Gln Gly
        35                  40                  45

Pro Gly Gln Gln Gly Pro Gly Ser Ser Ala Ala Ala Ala Ala Gly Pro
    50                  55                  60

Gly Gly Tyr Gly Pro Gly Gly Gln Gly Pro Ser Ala Ser Ala Ala Ala
65                  70                  75                  80

Ala Ala Gly Pro Gly Ser Gly Gln Gln Gly Pro Gly Ala Ser Ala Ala
                85                  90                  95

Ala Ala Ala Gly Gly Tyr Gly Pro Gly Gly Gln Gly Pro Gly Gln Gln
            100                 105                 110

Gly Pro Gly Ser Ser Ala Ala Ala Ala Ala Gly Gly Tyr Gly Ser Gly
        115                 120                 125

Pro Gly Gln Gln Gly Pro Tyr Gly Ser Ala Ala Ala Ala Ala Gly Pro
    130                 135                 140

Gly Ser Gly Gly Tyr Gly Gln Gly Pro Tyr Gly Pro Gly Ala Ser Ala
145                 150                 155                 160

Ala Ala Ala Ala Gly Pro Gly Gly Tyr Gly Pro Gly Gly Gln Gly Pro
                165                 170                 175

Ser Ala Ser Ala Ala Ala Ala Ala Gly Ser Gly Gln Gln Gly Pro Gly
            180                 185                 190

Gly Tyr Gly Pro Tyr Ala Ser Ala Ala Ala Ala Ala Gly Gly Tyr Gly
        195                 200                 205

Ser Gly Pro Gly Gln Gln Gly Pro Tyr Gly Pro Gly Gly Ser Ala Ala
    210                 215                 220

Ala Ala Ala Gly Ser Gly Gln Gln Gly Pro Gly Gln Gln Gly Pro Tyr
225                 230                 235                 240

Ala Ser Ala Ala Ala Ala Ala Gly Pro Gly Gly Gln Gly Pro Tyr Gly
                245                 250                 255

Pro Gly Ser Ser Ala Ala Ala Ala Ala Gly Gly Tyr Gly Tyr Gly Pro
            260                 265                 270

Gly Gly Gln Gly Pro Tyr Gly Pro Gly Ala Ser Ala Ala Ala Ala Ala
        275                 280                 285
```

```
Gly Gly Asn Gly Pro Gly Ser Gly Gly Tyr Gly Pro Gly Gln Gln Gly
    290                 295                 300

Pro Gly Gly Ser Ala Ala Ala Ala Ala Gly Pro Gly Gly Gln Gly Pro
305                 310                 315                 320

Tyr Gly Pro Gly Ala Ser Ala Ala Ala Ala Ala Gly Gly Tyr Gly Pro
                325                 330                 335

Gly Gly Gln Gly Pro Gly Gly Tyr Gly Pro Gly Ser Ser Ala Ala Ala
            340                 345                 350

Ala Ala Gly Pro Gly Gly Gln Gly Pro Tyr Gly Pro Gly Ser Ser Ala
        355                 360                 365

Ala Ala Ala Ala Gly Gly Tyr Gly Pro Gly Gln Gln Gly Pro Tyr Gly
    370                 375                 380

Pro Gly Gly Ser Ala Ala Ala Ala Ala Gly Gly Tyr Gln Gln Gly Pro
385                 390                 395                 400

Gly Gly Gln Gly Pro Tyr Gly Pro Gly Ala Ser Ala Ala Ala Ala Ala
                405                 410                 415

Gly Pro Gly Gly Gln Gly Pro Tyr Gly Pro Gly Ala Ser Ala Ala Ala
            420                 425                 430

Ala Ala Gly Pro Gly Gly Tyr Gly Pro Gly Gly Gln Gly Pro Ser Ala
        435                 440                 445

Ser Ala Ala Ala Ala Ala Gly Gly Tyr Gly Ser Gly Pro Gly Gly Tyr
    450                 455                 460

Gly Pro Tyr Gly Pro Gly Gly Ser Ala Ala Ala Ala Ala Gly Pro Gly
465                 470                 475                 480

Ser Gly Gln Gln Gly Gln Gly Pro Tyr Gly Pro Gly Ala Ser Ala Ala
                485                 490                 495

Ala Ala Ala Gly Gly Tyr Gly Pro Gly Gln Gln Gly Pro Tyr Gly Pro
            500                 505                 510

Gly Gly Ser Ala Ala Ala Ala Ala Gly Pro Gly Ser Gly Gly Tyr Gly
        515                 520                 525

Pro Gly Ala Ser Ala Ala Ala Ala Ala Gly Gly Asn Gly Pro Gly Ser
    530                 535                 540

Gly Gly Tyr Gly Pro Gly Gln Gln Gly Pro Gly Gly Ser Ala Ala Ala
545                 550                 555                 560

Ala Ala Gly Gly Tyr Gln Gln Gly Pro Gly Gly Gln Gly Pro Tyr Gly
                565                 570                 575

Pro Gly Ala Ser Ala Ala Ala Ala Ala Gly Pro Gly Ser Gly Gln Gln
            580                 585                 590

Gly Pro Gly Ala Ser
        595


<210> SEQ ID NO 11
<211> LENGTH: 12
<212> TYPE: PRT
<213> ORGANISM: Artificial Sequence
<220> FEATURE:
<223> OTHER INFORMATION: HisTag

<400> SEQUENCE: 11

Met His His His His His His Ser Ser Gly Ser Ser
1               5                   10


<210> SEQ ID NO 12
<211> LENGTH: 608
<212> TYPE: PRT
<213> ORGANISM: Artificial Sequence
<220> FEATURE:
```

<223> OTHER INFORMATION: PRT380

<400> SEQUENCE: 12

```
Met His His His His His His Ser Ser Gly Ser Ser Gly Pro Gly Gln
1               5                   10                  15

Gln Gly Pro Tyr Gly Pro Gly Ala Ser Ala Ala Ala Ala Ala Gly Gln
            20                  25                  30

Asn Gly Pro Gly Ser Gly Gln Gln Gly Pro Gly Gln Ser Ala Ala Ala
        35                  40                  45

Ala Ala Gly Gln Tyr Gly Pro Gly Gln Gln Gly Pro Gly Gln Gln Gly
    50                  55                  60

Pro Gly Ser Ser Ala Ala Ala Ala Ala Gly Pro Gly Gln Tyr Gly Pro
65                  70                  75                  80

Gly Gln Gln Gly Pro Ser Ala Ser Ala Ala Ala Ala Ala Gly Pro Gly
                85                  90                  95

Ser Gly Gln Gln Gly Pro Gly Ala Ser Ala Ala Ala Ala Ala Gly Gln
            100                 105                 110

Tyr Gly Pro Gly Gln Gln Gly Pro Gly Gln Gln Gly Pro Gly Ser Ser
        115                 120                 125

Ala Ala Ala Ala Ala Gly Gln Tyr Gly Ser Gly Pro Gly Gln Gln Gly
    130                 135                 140

Pro Tyr Gly Ser Ala Ala Ala Ala Ala Gly Pro Gly Ser Gly Gln Tyr
145                 150                 155                 160

Gly Gln Gly Pro Tyr Gly Pro Gly Ala Ser Ala Ala Ala Ala Ala Gly
                165                 170                 175

Pro Gly Gln Tyr Gly Pro Gly Gln Gln Gly Pro Ser Ala Ser Ala Ala
            180                 185                 190

Ala Ala Ala Gly Ser Gly Gln Gln Gly Pro Gly Gln Tyr Gly Pro Tyr
        195                 200                 205

Ala Ser Ala Ala Ala Ala Ala Gly Gln Tyr Gly Ser Gly Pro Gly Gln
    210                 215                 220

Gln Gly Pro Tyr Gly Pro Gly Gln Ser Ala Ala Ala Ala Ala Gly Ser
225                 230                 235                 240

Gly Gln Gln Gly Pro Gly Gln Gln Gly Pro Tyr Ala Ser Ala Ala Ala
                245                 250                 255

Ala Ala Gly Pro Gly Gln Gln Gly Pro Tyr Gly Pro Gly Ser Ser Ala
            260                 265                 270

Ala Ala Ala Ala Gly Gln Tyr Gly Tyr Gly Pro Gly Gln Gln Gly Pro
        275                 280                 285

Tyr Gly Pro Gly Ala Ser Ala Ala Ala Ala Ala Gly Gln Asn Gly Pro
    290                 295                 300

Gly Ser Gly Gln Tyr Gly Pro Gly Gln Gln Gly Pro Gly Gln Ser Ala
305                 310                 315                 320

Ala Ala Ala Ala Gly Pro Gly Gln Gln Gly Pro Tyr Gly Pro Gly Ala
                325                 330                 335

Ser Ala Ala Ala Ala Ala Gly Gln Tyr Gly Pro Gly Gln Gln Gly Pro
            340                 345                 350

Gly Gln Tyr Gly Pro Gly Ser Ser Ala Ala Ala Ala Ala Gly Pro Gly
        355                 360                 365

Gln Gln Gly Pro Tyr Gly Pro Gly Ser Ser Ala Ala Ala Ala Ala Gly
    370                 375                 380

Gln Tyr Gly Pro Gly Gln Gln Gly Pro Tyr Gly Pro Gly Gln Ser Ala
385                 390                 395                 400
```

```
Ala Ala Ala Ala Gly Gln Tyr Gln Gln Gly Pro Gly Gln Gln Gly Pro
                405                 410                 415

Tyr Gly Pro Gly Ala Ser Ala Ala Ala Ala Ala Gly Pro Gly Gln Gln
            420                 425                 430

Gly Pro Tyr Gly Pro Gly Ala Ser Ala Ala Ala Ala Ala Gly Pro Gly
        435                 440                 445

Gln Tyr Gly Pro Gly Gln Gln Gly Pro Ser Ala Ser Ala Ala Ala Ala
    450                 455                 460

Ala Gly Gln Tyr Gly Ser Gly Pro Gly Gln Tyr Gly Pro Tyr Gly Pro
465                 470                 475                 480

Gly Gln Ser Ala Ala Ala Ala Ala Gly Pro Gly Ser Gly Gln Gln Gly
                485                 490                 495

Gln Gly Pro Tyr Gly Pro Gly Ala Ser Ala Ala Ala Ala Ala Gly Gln
            500                 505                 510

Tyr Gly Pro Gly Gln Gln Gly Pro Tyr Gly Pro Gly Gln Ser Ala Ala
        515                 520                 525

Ala Ala Ala Gly Pro Gly Ser Gly Gln Tyr Gly Pro Gly Ala Ser Ala
    530                 535                 540

Ala Ala Ala Ala Gly Gln Asn Gly Pro Gly Ser Gly Gln Tyr Gly Pro
545                 550                 555                 560

Gly Gln Gln Gly Pro Gly Gln Ser Ala Ala Ala Ala Ala Gly Gln Tyr
                565                 570                 575

Gln Gln Gly Pro Gly Gln Gln Gly Pro Tyr Gly Pro Gly Ala Ser Ala
            580                 585                 590

Ala Ala Ala Ala Gly Pro Gly Ser Gly Gln Gln Gly Pro Gly Ala Ser
        595                 600                 605


<210> SEQ ID NO 13
<211> LENGTH: 601
<212> TYPE: PRT
<213> ORGANISM: Artificial Sequence
<220> FEATURE:
<223> OTHER INFORMATION: PRT410

<400> SEQUENCE: 13

Met His His His His His His Ser Ser Gly Ser Ser Gly Pro Gly Gln
1               5                   10                  15

Gln Gly Pro Tyr Gly Pro Gly Ala Ser Ala Ala Ala Ala Ala Gly Gln
            20                  25                  30

Asn Gly Pro Gly Ser Gly Gln Gln Gly Pro Gly Gln Ser Gly Gln Tyr
        35                  40                  45

Gly Pro Gly Gln Gln Gly Pro Gly Gln Gln Gly Pro Gly Ser Ser Ala
    50                  55                  60

Ala Ala Ala Ala Gly Pro Gly Gln Tyr Gly Pro Gly Gln Gln Gly Pro
65                  70                  75                  80

Ser Ala Ser Ala Ala Ala Ala Ala Gly Pro Gly Ser Gly Gln Gln Gly
                85                  90                  95

Pro Gly Ala Ser Gly Gln Tyr Gly Pro Gly Gln Gln Gly Pro Gly Gln
            100                 105                 110

Gln Gly Pro Gly Ser Ser Ala Ala Ala Ala Ala Gly Gln Tyr Gly Ser
        115                 120                 125

Gly Pro Gly Gln Gln Gly Pro Tyr Gly Ser Ala Ala Ala Ala Ala Gly
    130                 135                 140

Pro Gly Ser Gly Gln Tyr Gly Gln Gly Pro Tyr Gly Pro Gly Ala Ser
145                 150                 155                 160
```

```
Gly Pro Gly Gln Tyr Gly Pro Gly Gln Gln Gly Pro Ser Ala Ser Ala
                165                 170                 175

Ala Ala Ala Ala Gly Ser Gly Gln Gln Gly Pro Gly Gln Tyr Gly Pro
            180                 185                 190

Tyr Ala Ser Ala Ala Ala Ala Ala Gly Gln Tyr Gly Ser Gly Pro Gly
        195                 200                 205

Gln Gln Gly Pro Tyr Gly Pro Gly Gln Ser Gly Ser Gly Gln Gln Gly
    210                 215                 220

Pro Gly Gln Gln Gly Pro Tyr Ala Ser Ala Ala Ala Ala Ala Gly Pro
225                 230                 235                 240

Gly Gln Gln Gly Pro Tyr Gly Pro Gly Ser Ser Ala Ala Ala Ala Ala
                245                 250                 255

Gly Gln Tyr Gly Tyr Gly Pro Gly Gln Gln Gly Pro Tyr Gly Pro Gly
            260                 265                 270

Ala Ser Gly Gln Asn Gly Pro Gly Ser Gly Gln Tyr Gly Pro Gly Gln
        275                 280                 285

Gln Gly Pro Gly Gln Ser Ala Ala Ala Ala Ala Gly Pro Gly Gln Gln
    290                 295                 300

Gly Pro Tyr Gly Pro Gly Ala Ser Ala Ala Ala Ala Ala Gly Gln Tyr
305                 310                 315                 320

Gly Pro Gly Gln Gln Gly Pro Gly Gln Tyr Gly Pro Gly Ser Ser Gly
                325                 330                 335

Pro Gly Gln Gln Gly Pro Tyr Gly Pro Gly Ser Ser Ala Ala Ala Ala
            340                 345                 350

Ala Gly Gln Tyr Gly Pro Gly Gln Gln Gly Pro Tyr Gly Pro Gly Gln
        355                 360                 365

Ser Ala Ala Ala Ala Ala Gly Gln Tyr Gln Gln Gly Pro Gly Gln Gln
    370                 375                 380

Gly Pro Tyr Gly Pro Gly Ala Ser Gly Pro Gly Gln Gln Gly Pro Tyr
385                 390                 395                 400

Gly Pro Gly Ala Ser Ala Ala Ala Ala Ala Gly Pro Gly Gln Tyr Gly
                405                 410                 415

Pro Gly Gln Gln Gly Pro Ser Ala Ser Ala Ala Ala Ala Ala Gly Gln
            420                 425                 430

Tyr Gly Ser Gly Pro Gly Gln Tyr Gly Pro Tyr Gly Pro Gly Gln Ser
        435                 440                 445

Gly Pro Gly Ser Gly Gln Gln Gly Gln Gly Pro Tyr Gly Pro Gly Ala
    450                 455                 460

Ser Ala Ala Ala Ala Ala Gly Gln Tyr Gly Pro Gly Gln Gln Gly Pro
465                 470                 475                 480

Tyr Gly Pro Gly Gln Ser Ala Ala Ala Ala Ala Gly Pro Gly Ser Gly
                485                 490                 495

Gln Tyr Gly Pro Gly Ala Ser Gly Gln Asn Gly Pro Gly Ser Gly Gln
            500                 505                 510

Tyr Gly Pro Gly Gln Gln Gly Pro Gly Gln Ser Ala Ala Ala Ala Ala
        515                 520                 525

Gly Gln Tyr Gln Gln Gly Pro Gly Gln Gln Gly Pro Tyr Gly Pro Gly
    530                 535                 540

Ala Ser Ala Ala Ala Ala Ala Gly Gln Tyr Gly Ser Gly Pro Gly Gln
545                 550                 555                 560

Gln Gly Pro Tyr Gly Pro Gly Gln Ser Gly Ser Gly Gln Gln Gly Pro
                565                 570                 575

Gly Gln Gln Gly Pro Tyr Ala Ser Ala Ala Ala Ala Ala Gly Pro Gly
```

```
            580                 585                 590

Ser Gly Gln Gln Gly Pro Gly Ala Ser
        595                 600


<210> SEQ ID NO 14
<211> LENGTH: 576
<212> TYPE: PRT
<213> ORGANISM: Artificial Sequence
<220> FEATURE:
<223> OTHER INFORMATION: PRT525

<400> SEQUENCE: 14

Met His His His His His His Ser Ser Gly Ser Ser Gly Pro Gly Gln
1               5                   10                  15

Gln Gly Pro Tyr Gly Pro Gly Ala Ser Ala Ala Ala Ala Ala Ala Ala
            20                  25                  30

Gly Ser Asn Gly Pro Gly Ser Gly Gln Gln Gly Pro Gly Gln Ser Gly
        35                  40                  45

Gln Tyr Gly Pro Gly Gln Gln Gly Pro Gly Gln Gln Gly Pro Gly Ser
    50                  55                  60

Ser Ala Ala Ala Ala Ala Ala Ala Gly Pro Gly Gln Tyr Gly Pro Gly
65                  70                  75                  80

Gln Gln Gly Pro Ser Ala Ser Ala Ala Ala Ala Ala Ala Ala Gly Pro
                85                  90                  95

Gly Ser Gly Gln Gln Gly Pro Gly Ala Ser Gly Gln Tyr Gly Pro Gly
            100                 105                 110

Gln Gln Gly Pro Gly Gln Gln Gly Pro Gly Ser Ser Ala Ala Ala Ala
        115                 120                 125

Ala Ala Ala Gly Ser Tyr Gly Ser Gly Pro Gly Gln Gln Gly Pro Tyr
    130                 135                 140

Gly Ser Ala Ala Ala Ala Ala Ala Ala Gly Pro Gly Ser Gly Gln Tyr
145                 150                 155                 160

Gly Gln Gly Pro Tyr Gly Pro Gly Ala Ser Gly Pro Gly Gln Tyr Gly
                165                 170                 175

Pro Gly Gln Gln Gly Pro Ser Ala Ser Ala Ala Ala Ala Ala Ala Ala
            180                 185                 190

Gly Ser Gly Gln Gln Gly Pro Gly Gln Tyr Gly Pro Tyr Ala Ser Ala
        195                 200                 205

Ala Ala Ala Ala Ala Ala Gly Ser Tyr Gly Ser Gly Pro Gly Gln Gln
    210                 215                 220

Gly Pro Tyr Gly Pro Gly Gln Ser Gly Ser Gly Gln Gln Gly Pro Gly
225                 230                 235                 240

Gln Gln Gly Pro Tyr Ala Ser Ala Ala Ala Ala Ala Ala Ala Gly Pro
                245                 250                 255

Gly Gln Gln Gly Pro Tyr Gly Pro Gly Ser Ser Ala Ala Ala Ala Ala
            260                 265                 270

Ala Ala Gly Ser Tyr Gly Tyr Gly Pro Gly Gln Gln Gly Pro Tyr Gly
        275                 280                 285

Pro Gly Ala Ser Gly Gln Asn Gly Pro Gly Ser Gly Gln Tyr Gly Pro
    290                 295                 300

Gly Gln Gln Gly Pro Gly Pro Ser Ala Ala Ala Ala Ala Ala Ala Gly
305                 310                 315                 320

Pro Gly Gln Gln Gly Pro Tyr Gly Pro Gly Ala Ser Ala Ala Ala Ala
                325                 330                 335

Ala Ala Ala Gly Ser Tyr Gly Pro Gly Gln Gln Gly Pro Gly Gln Tyr
```

```
            340                 345                 350

Gly Pro Gly Ser Ser Gly Pro Gly Gln Gln Gly Pro Tyr Gly Pro Gly
        355                 360                 365

Ser Ser Ala Ala Ala Ala Ala Ala Ala Gly Ser Tyr Gly Pro Gly Gln
    370                 375                 380

Gln Gly Pro Tyr Gly Pro Gly Pro Ser Ala Ala Ala Ala Ala Ala Ala
385                 390                 395                 400

Gly Ser Tyr Gln Gln Gly Pro Gly Gln Gln Gly Pro Tyr Gly Pro Gly
                405                 410                 415

Ala Ser Gly Pro Gly Gln Gln Gly Pro Tyr Gly Pro Gly Ala Ser Ala
            420                 425                 430

Ala Ala Ala Ala Ala Ala Gly Pro Gly Gln Tyr Gly Pro Gly Gln Gln
        435                 440                 445

Gly Pro Ser Ala Ser Ala Ala Ala Ala Ala Ala Ala Gly Ser Tyr Gly
    450                 455                 460

Ser Gly Pro Gly Gln Tyr Gly Pro Tyr Gly Pro Gly Gln Ser Gly Pro
465                 470                 475                 480

Gly Ser Gly Gln Gln Gly Gln Gly Pro Tyr Gly Pro Gly Ala Ser Ala
                485                 490                 495

Ala Ala Ala Ala Ala Ala Gly Ser Tyr Gly Pro Gly Gln Gln Gly Pro
            500                 505                 510

Tyr Gly Pro Gly Pro Ser Ala Ala Ala Ala Ala Ala Ala Gly Pro Gly
        515                 520                 525

Ser Gly Gln Tyr Gly Pro Gly Ala Ser Gly Gln Asn Gly Pro Gly Ser
    530                 535                 540

Gly Gln Tyr Gly Pro Gly Gln Gln Gly Pro Gly Pro Ser Ala Ala Ala
545                 550                 555                 560

Ala Ala Ala Ala Gly Pro Gly Ser Gly Gln Gln Gly Pro Gly Ala Ser
                565                 570                 575


<210> SEQ ID NO 15
<211> LENGTH: 2375
<212> TYPE: PRT
<213> ORGANISM: Artificial Sequence
<220> FEATURE:
<223> OTHER INFORMATION: PRT799

<400> SEQUENCE: 15

Met His His His His His His Ser Ser Gly Ser Ser Gly Pro Gly Gln
1               5                   10                  15

Gln Gly Pro Tyr Gly Pro Gly Ala Ser Ala Ala Ala Ala Ala Gly Gln
            20                  25                  30

Asn Gly Pro Gly Ser Gly Gln Gln Gly Pro Gly Gln Ser Gly Gln Tyr
        35                  40                  45

Gly Pro Gly Gln Gln Gly Pro Gly Gln Gln Gly Pro Gly Ser Ser Ala
    50                  55                  60

Ala Ala Ala Ala Gly Pro Gly Gln Tyr Gly Pro Gly Gln Gln Gly Pro
65                  70                  75                  80

Ser Ala Ser Ala Ala Ala Ala Ala Gly Pro Gly Ser Gly Gln Gln Gly
                85                  90                  95

Pro Gly Ala Ser Gly Gln Tyr Gly Pro Gly Gln Gln Gly Pro Gly Gln
            100                 105                 110

Gln Gly Pro Gly Ser Ser Ala Ala Ala Ala Ala Gly Gln Tyr Gly Ser
        115                 120                 125

Gly Pro Gly Gln Gln Gly Pro Tyr Gly Ser Ala Ala Ala Ala Ala Gly
```

```
    130                 135                 140

Pro Gly Ser Gly Gln Tyr Gly Gln Gly Pro Tyr Gly Pro Gly Ala Ser
145                 150                 155                 160

Gly Pro Gly Gln Tyr Gly Pro Gly Gln Gln Gly Pro Ser Ala Ser Ala
                165                 170                 175

Ala Ala Ala Ala Gly Ser Gly Gln Gln Gly Pro Gly Gln Tyr Gly Pro
            180                 185                 190

Tyr Ala Ser Ala Ala Ala Ala Ala Gly Gln Tyr Gly Ser Gly Pro Gly
        195                 200                 205

Gln Gln Gly Pro Tyr Gly Pro Gly Gln Ser Gly Ser Gly Gln Gln Gly
    210                 215                 220

Pro Gly Gln Gln Gly Pro Tyr Ala Ser Ala Ala Ala Ala Ala Gly Pro
225                 230                 235                 240

Gly Gln Gln Gly Pro Tyr Gly Pro Gly Ser Ser Ala Ala Ala Ala Ala
                245                 250                 255

Gly Gln Tyr Gly Tyr Gly Pro Gly Gln Gln Gly Pro Tyr Gly Pro Gly
            260                 265                 270

Ala Ser Gly Gln Asn Gly Pro Gly Ser Gly Gln Tyr Gly Pro Gly Gln
        275                 280                 285

Gln Gly Pro Gly Gln Ser Ala Ala Ala Ala Ala Gly Pro Gly Gln Gln
    290                 295                 300

Gly Pro Tyr Gly Pro Gly Ala Ser Ala Ala Ala Ala Ala Gly Gln Tyr
305                 310                 315                 320

Gly Pro Gly Gln Gln Gly Pro Gly Gln Tyr Gly Pro Gly Ser Ser Gly
                325                 330                 335

Pro Gly Gln Gln Gly Pro Tyr Gly Pro Gly Ser Ser Ala Ala Ala Ala
            340                 345                 350

Ala Gly Gln Tyr Gly Pro Gly Gln Gln Gly Pro Tyr Gly Pro Gly Gln
        355                 360                 365

Ser Ala Ala Ala Ala Ala Gly Gln Tyr Gln Gln Gly Pro Gly Gln Gln
    370                 375                 380

Gly Pro Tyr Gly Pro Gly Ala Ser Gly Pro Gly Gln Gln Gly Pro Tyr
385                 390                 395                 400

Gly Pro Gly Ala Ser Ala Ala Ala Ala Ala Gly Pro Gly Gln Tyr Gly
                405                 410                 415

Pro Gly Gln Gln Gly Pro Ser Ala Ser Ala Ala Ala Ala Ala Gly Gln
            420                 425                 430

Tyr Gly Ser Gly Pro Gly Gln Tyr Gly Pro Tyr Gly Pro Gly Gln Ser
        435                 440                 445

Gly Pro Gly Ser Gly Gln Gln Gly Gln Gly Pro Tyr Gly Pro Gly Ala
    450                 455                 460

Ser Ala Ala Ala Ala Ala Gly Gln Tyr Gly Pro Gly Gln Gln Gly Pro
465                 470                 475                 480

Tyr Gly Pro Gly Gln Ser Ala Ala Ala Ala Ala Gly Pro Gly Ser Gly
                485                 490                 495

Gln Tyr Gly Pro Gly Ala Ser Gly Gln Asn Gly Pro Gly Ser Gly Gln
            500                 505                 510

Tyr Gly Pro Gly Gln Gln Gly Pro Gly Gln Ser Ala Ala Ala Ala Ala
        515                 520                 525

Gly Gln Tyr Gln Gln Gly Pro Gly Gln Gln Gly Pro Tyr Gly Pro Gly
    530                 535                 540

Ala Ser Ala Ala Ala Ala Ala Gly Gln Tyr Gly Ser Gly Pro Gly Gln
545                 550                 555                 560
```

```
Gln Gly Pro Tyr Gly Pro Gly Gln Ser Gly Ser Gly Gln Gln Gly Pro
                565                 570                 575

Gly Gln Gln Gly Pro Tyr Ala Ser Ala Ala Ala Ala Ala Gly Pro Gly
            580                 585                 590

Ser Gly Gln Gln Gly Pro Gly Ala Ser Gly Gln Gln Gly Pro Tyr Gly
        595                 600                 605

Pro Gly Ala Ser Ala Ala Ala Ala Ala Gly Gln Asn Gly Pro Gly Ser
    610                 615                 620

Gly Gln Gln Gly Pro Gly Gln Ser Gly Gln Tyr Gly Pro Gly Gln Gln
625                 630                 635                 640

Gly Pro Gly Gln Gln Gly Pro Gly Ser Ser Ala Ala Ala Ala Ala Gly
                645                 650                 655

Pro Gly Gln Tyr Gly Pro Gly Gln Gln Gly Pro Ser Ala Ser Ala Ala
            660                 665                 670

Ala Ala Ala Gly Pro Gly Ser Gly Gln Gln Gly Pro Gly Ala Ser Gly
        675                 680                 685

Gln Tyr Gly Pro Gly Gln Gln Gly Pro Gly Gln Gln Gly Pro Gly Ser
    690                 695                 700

Ser Ala Ala Ala Ala Ala Gly Gln Tyr Gly Ser Gly Pro Gly Gln Gln
705                 710                 715                 720

Gly Pro Tyr Gly Ser Ala Ala Ala Ala Ala Gly Pro Gly Ser Gly Gln
                725                 730                 735

Tyr Gly Gln Gly Pro Tyr Gly Pro Gly Ala Ser Gly Pro Gly Gln Tyr
            740                 745                 750

Gly Pro Gly Gln Gln Gly Pro Ser Ala Ser Ala Ala Ala Ala Ala Gly
        755                 760                 765

Ser Gly Gln Gln Gly Pro Gly Gln Tyr Gly Pro Tyr Ala Ser Ala Ala
    770                 775                 780

Ala Ala Ala Gly Gln Tyr Gly Ser Gly Pro Gly Gln Gln Gly Pro Tyr
785                 790                 795                 800

Gly Pro Gly Gln Ser Gly Ser Gly Gln Gln Gly Pro Gly Gln Gln Gly
                805                 810                 815

Pro Tyr Ala Ser Ala Ala Ala Ala Ala Gly Pro Gly Gln Gln Gly Pro
            820                 825                 830

Tyr Gly Pro Gly Ser Ser Ala Ala Ala Ala Ala Gly Gln Tyr Gly Tyr
        835                 840                 845

Gly Pro Gly Gln Gln Gly Pro Tyr Gly Pro Gly Ala Ser Gly Gln Asn
    850                 855                 860

Gly Pro Gly Ser Gly Gln Tyr Gly Pro Gly Gln Gln Gly Pro Gly Gln
865                 870                 875                 880

Ser Ala Ala Ala Ala Ala Gly Pro Gly Gln Gln Gly Pro Tyr Gly Pro
                885                 890                 895

Gly Ala Ser Ala Ala Ala Ala Ala Gly Gln Tyr Gly Pro Gly Gln Gln
            900                 905                 910

Gly Pro Gly Gln Tyr Gly Pro Gly Ser Ser Gly Pro Gly Gln Gln Gly
        915                 920                 925

Pro Tyr Gly Pro Gly Ser Ser Ala Ala Ala Ala Ala Gly Gln Tyr Gly
    930                 935                 940

Pro Gly Gln Gln Gly Pro Tyr Gly Pro Gly Gln Ser Ala Ala Ala Ala
945                 950                 955                 960

Ala Gly Gln Tyr Gln Gln Gly Pro Gly Gln Gln Gly Pro Tyr Gly Pro
                965                 970                 975
```

```
Gly Ala Ser Gly Pro Gly Gln Gln Gly Pro Tyr Gly Pro Gly Ala Ser
            980                 985                 990

Ala Ala Ala Ala Ala Gly Pro Gly  Gln Tyr Gly Pro Gly  Gln Gln Gly
        995                 1000                1005

Pro Ser  Ala Ser Ala Ala Ala  Ala Ala Gly Gln Tyr  Gly Ser Gly
    1010                1015                1020

Pro Gly  Gln Tyr Gly Pro Tyr  Gly Pro Gly Gln Ser  Gly Pro Gly
    1025                1030                1035

Ser Gly  Gln Gln Gly Gln Gly  Pro Tyr Gly Pro Gly  Ala Ser Ala
    1040                1045                1050

Ala Ala  Ala Ala Gly Gln Tyr  Gly Pro Gly Gln Gln  Gly Pro Tyr
    1055                1060                1065

Gly Pro  Gly Gln Ser Ala Ala  Ala Ala Ala Gly Pro  Gly Ser Gly
    1070                1075                1080

Gln Tyr  Gly Pro Gly Ala Ser  Gly Gln Asn Gly Pro  Gly Ser Gly
    1085                1090                1095

Gln Tyr  Gly Pro Gly Gln Gln  Gly Pro Gly Gln Ser  Ala Ala Ala
    1100                1105                1110

Ala Ala  Gly Gln Tyr Gln Gln  Gly Pro Gly Gln Gln  Gly Pro Tyr
    1115                1120                1125

Gly Pro  Gly Ala Ser Ala Ala  Ala Ala Ala Gly Gln  Tyr Gly Ser
    1130                1135                1140

Gly Pro  Gly Gln Gln Gly Pro  Tyr Gly Pro Gly Gln  Ser Gly Ser
    1145                1150                1155

Gly Gln  Gln Gly Pro Gly Gln  Gln Gly Pro Tyr Ala  Ser Ala Ala
    1160                1165                1170

Ala Ala  Ala Gly Pro Gly Ser  Gly Gln Gln Gly Pro  Gly Ala Ser
    1175                1180                1185

Gly Gln  Gln Gly Pro Tyr Gly  Pro Gly Ala Ser Ala  Ala Ala Ala
    1190                1195                1200

Ala Gly  Gln Asn Gly Pro Gly  Ser Gly Gln Gln Gly  Pro Gly Gln
    1205                1210                1215

Ser Gly  Gln Tyr Gly Pro Gly  Gln Gln Gly Pro Gly  Gln Gln Gly
    1220                1225                1230

Pro Gly  Ser Ser Ala Ala Ala  Ala Ala Gly Pro Gly  Gln Tyr Gly
    1235                1240                1245

Pro Gly  Gln Gln Gly Pro Ser  Ala Ser Ala Ala Ala  Ala Ala Gly
    1250                1255                1260

Pro Gly  Ser Gly Gln Gln Gly  Pro Gly Ala Ser Gly  Gln Tyr Gly
    1265                1270                1275

Pro Gly  Gln Gln Gly Pro Gly  Gln Gln Gly Pro Gly  Ser Ser Ala
    1280                1285                1290

Ala Ala  Ala Ala Gly Gln Tyr  Gly Ser Gly Pro Gly  Gln Gln Gly
    1295                1300                1305

Pro Tyr  Gly Ser Ala Ala Ala  Ala Ala Gly Pro Gly  Ser Gly Gln
    1310                1315                1320

Tyr Gly  Gln Gly Pro Tyr Gly  Pro Gly Ala Ser Gly  Pro Gly Gln
    1325                1330                1335

Tyr Gly  Pro Gly Gln Gln Gly  Pro Ser Ala Ser Ala  Ala Ala Ala
    1340                1345                1350

Ala Gly  Ser Gly Gln Gln Gly  Pro Gly Gln Tyr Gly  Pro Tyr Ala
    1355                1360                1365

Ser Ala  Ala Ala Ala Ala Gly  Gln Tyr Gly Ser Gly  Pro Gly Gln
```

```
    1370                1375                1380

Gln Gly  Pro Tyr Gly Pro Gly  Gln Ser Gly Ser Gly  Gln Gln Gly
    1385                1390                1395

Pro Gly  Gln Gln Gly Pro Tyr  Ala Ser Ala Ala Ala  Ala Ala Gly
    1400                1405                1410

Pro Gly  Gln Gln Gly Pro Tyr  Gly Pro Gly Ser Ser  Ala Ala Ala
    1415                1420                1425

Ala Ala  Gly Gln Tyr Gly Tyr  Gly Pro Gly Gln Gln  Gly Pro Tyr
    1430                1435                1440

Gly Pro  Gly Ala Ser Gly Gln  Asn Gly Pro Gly Ser  Gly Gln Tyr
    1445                1450                1455

Gly Pro  Gly Gln Gln Gly Pro  Gly Gln Ser Ala Ala  Ala Ala Ala
    1460                1465                1470

Gly Pro  Gly Gln Gln Gly Pro  Tyr Gly Pro Gly Ala  Ser Ala Ala
    1475                1480                1485

Ala Ala  Ala Gly Gln Tyr Gly  Pro Gly Gln Gln Gly  Pro Gly Gln
    1490                1495                1500

Tyr Gly  Pro Gly Ser Ser Gly  Pro Gly Gln Gln Gly  Pro Tyr Gly
    1505                1510                1515

Pro Gly  Ser Ser Ala Ala Ala  Ala Ala Gly Gln Tyr  Gly Pro Gly
    1520                1525                1530

Gln Gln  Gly Pro Tyr Gly Pro  Gly Gln Ser Ala Ala  Ala Ala Ala
    1535                1540                1545

Gly Gln  Tyr Gln Gln Gly Pro  Gly Gln Gln Gly Pro  Tyr Gly Pro
    1550                1555                1560

Gly Ala  Ser Gly Pro Gly Gln  Gln Gly Pro Tyr Gly  Pro Gly Ala
    1565                1570                1575

Ser Ala  Ala Ala Ala Ala Gly  Pro Gly Gln Tyr Gly  Pro Gly Gln
    1580                1585                1590

Gln Gly  Pro Ser Ala Ser Ala  Ala Ala Ala Ala Gly  Gln Tyr Gly
    1595                1600                1605

Ser Gly  Pro Gly Gln Tyr Gly  Pro Tyr Gly Pro Gly  Gln Ser Gly
    1610                1615                1620

Pro Gly  Ser Gly Gln Gln Gly  Gln Gly Pro Tyr Gly  Pro Gly Ala
    1625                1630                1635

Ser Ala  Ala Ala Ala Ala Gly  Gln Tyr Gly Pro Gly  Gln Gln Gly
    1640                1645                1650

Pro Tyr  Gly Pro Gly Gln Ser  Ala Ala Ala Ala Ala  Gly Pro Gly
    1655                1660                1665

Ser Gly  Gln Tyr Gly Pro Gly  Ala Ser Gly Gln Asn  Gly Pro Gly
    1670                1675                1680

Ser Gly  Gln Tyr Gly Pro Gly  Gln Gln Gly Pro Gly  Gln Ser Ala
    1685                1690                1695

Ala Ala  Ala Ala Gly Gln Tyr  Gln Gln Gly Pro Gly  Gln Gln Gly
    1700                1705                1710

Pro Tyr  Gly Pro Gly Ala Ser  Ala Ala Ala Ala Ala  Gly Gln Tyr
    1715                1720                1725

Gly Ser  Gly Pro Gly Gln Gln  Gly Pro Tyr Gly Pro  Gly Gln Ser
    1730                1735                1740

Gly Ser  Gly Gln Gln Gly Pro  Gly Gln Gln Gly Pro  Tyr Ala Ser
    1745                1750                1755

Ala Ala  Ala Ala Ala Gly Pro  Gly Ser Gly Gln Gln  Gly Pro Gly
    1760                1765                1770
```

```
Ala Ser  Gly Gln Gln Gly Pro  Tyr Gly Pro Gly Ala  Ser Ala Ala
    1775                 1780                 1785

Ala Ala  Ala Gly Gln Asn Gly  Pro Gly Ser Gly Gln  Gln Gly Pro
    1790                 1795                 1800

Gly Gln  Ser Gly Gln Tyr Gly  Pro Gly Gln Gln Gly  Pro Gly Gln
    1805                 1810                 1815

Gln Gly  Pro Gly Ser Ser Ala  Ala Ala Ala Ala Gly  Pro Gly Gln
    1820                 1825                 1830

Tyr Gly  Pro Gly Gln Gln Gly  Pro Ser Ala Ser Ala  Ala Ala Ala
    1835                 1840                 1845

Ala Gly  Pro Gly Ser Gly Gln  Gln Gly Pro Gly Ala  Ser Gly Gln
    1850                 1855                 1860

Tyr Gly  Pro Gly Gln Gln Gly  Pro Gly Gln Gln Gly  Pro Gly Ser
    1865                 1870                 1875

Ser Ala  Ala Ala Ala Ala Gly  Gln Tyr Gly Ser Gly  Pro Gly Gln
    1880                 1885                 1890

Gln Gly  Pro Tyr Gly Ser Ala  Ala Ala Ala Ala Gly  Pro Gly Ser
    1895                 1900                 1905

Gly Gln  Tyr Gly Gln Gly Pro  Tyr Gly Pro Gly Ala  Ser Gly Pro
    1910                 1915                 1920

Gly Gln  Tyr Gly Pro Gly Gln  Gln Gly Pro Ser Ala  Ser Ala Ala
    1925                 1930                 1935

Ala Ala  Ala Gly Ser Gly Gln  Gln Gly Pro Gly Gln  Tyr Gly Pro
    1940                 1945                 1950

Tyr Ala  Ser Ala Ala Ala Ala  Ala Gly Gln Tyr Gly  Ser Gly Pro
    1955                 1960                 1965

Gly Gln  Gln Gly Pro Tyr Gly  Pro Gly Gln Ser Gly  Ser Gly Gln
    1970                 1975                 1980

Gln Gly  Pro Gly Gln Gln Gly  Pro Tyr Ala Ser Ala  Ala Ala Ala
    1985                 1990                 1995

Ala Gly  Pro Gly Gln Gln Gly  Pro Tyr Gly Pro Gly  Ser Ser Ala
    2000                 2005                 2010

Ala Ala  Ala Ala Gly Gln Tyr  Gly Tyr Gly Pro Gly  Gln Gln Gly
    2015                 2020                 2025

Pro Tyr  Gly Pro Gly Ala Ser  Gly Gln Asn Gly Pro  Gly Ser Gly
    2030                 2035                 2040

Gln Tyr  Gly Pro Gly Gln Gln  Gly Pro Gly Gln Ser  Ala Ala Ala
    2045                 2050                 2055

Ala Ala  Gly Pro Gly Gln Gln  Gly Pro Tyr Gly Pro  Gly Ala Ser
    2060                 2065                 2070

Ala Ala  Ala Ala Ala Gly Gln  Tyr Gly Pro Gly Gln  Gln Gly Pro
    2075                 2080                 2085

Gly Gln  Tyr Gly Pro Gly Ser  Ser Gly Pro Gly Gln  Gln Gly Pro
    2090                 2095                 2100

Tyr Gly  Pro Gly Ser Ser Ala  Ala Ala Ala Ala Gly  Gln Tyr Gly
    2105                 2110                 2115

Pro Gly  Gln Gln Gly Pro Tyr  Gly Pro Gly Gln Ser  Ala Ala Ala
    2120                 2125                 2130

Ala Ala  Gly Gln Tyr Gln Gln  Gly Pro Gly Gln Gln  Gly Pro Tyr
    2135                 2140                 2145

Gly Pro  Gly Ala Ser Gly Pro  Gly Gln Gln Gly Pro  Tyr Gly Pro
    2150                 2155                 2160
```

```
Gly Ala  Ser Ala Ala Ala Ala  Ala Gly Pro Gly Gln  Tyr Gly Pro
    2165                 2170                 2175

Gly Gln  Gln Gly Pro Ser Ala  Ser Ala Ala Ala Ala  Ala Gly Gln
    2180                 2185                 2190

Tyr Gly  Ser Gly Pro Gly Gln  Tyr Gly Pro Tyr Gly  Pro Gly Gln
    2195                 2200                 2205

Ser Gly  Pro Gly Ser Gly Gln  Gln Gly Gln Gly Pro  Tyr Gly Pro
    2210                 2215                 2220

Gly Ala  Ser Ala Ala Ala Ala  Ala Gly Gln Tyr Gly  Pro Gly Gln
    2225                 2230                 2235

Gln Gly  Pro Tyr Gly Pro Gly  Gln Ser Ala Ala Ala  Ala Ala Gly
    2240                 2245                 2250

Pro Gly  Ser Gly Gln Tyr Gly  Pro Gly Ala Ser Gly  Gln Asn Gly
    2255                 2260                 2265

Pro Gly  Ser Gly Gln Tyr Gly  Pro Gly Gln Gln Gly  Pro Gly Gln
    2270                 2275                 2280

Ser Ala  Ala Ala Ala Ala Gly  Gln Tyr Gln Gln Gly  Pro Gly Gln
    2285                 2290                 2295

Gln Gly  Pro Tyr Gly Pro Gly  Ala Ser Ala Ala Ala  Ala Ala Gly
    2300                 2305                 2310

Gln Tyr  Gly Ser Gly Pro Gly  Gln Gln Gly Pro Tyr  Gly Pro Gly
    2315                 2320                 2325

Gln Ser  Gly Ser Gly Gln Gln  Gly Pro Gly Gln Gln  Gly Pro Tyr
    2330                 2335                 2340

Ala Ser  Ala Ala Ala Ala Ala  Gly Pro Gly Ser Gly  Gln Gln Gly
    2345                 2350                 2355

Ser Ser  Val Asp Lys Leu Ala  Ala Ala Leu Glu His  His His His
    2360                 2365                 2370

His His
    2375


<210> SEQ ID NO 16
<211> LENGTH: 608
<212> TYPE: PRT
<213> ORGANISM: Artificial Sequence
<220> FEATURE:
<223> OTHER INFORMATION: PRT313

<400> SEQUENCE: 16

Met His His His His His His Ser Ser Gly Ser Ser Gly Pro Gly Gly
1               5                   10                  15

Gln Gly Pro Tyr Gly Pro Gly Ala Ser Ala Ala Ala Ala Ala Gly Gly
            20                  25                  30

Asn Gly Pro Gly Ser Gly Gln Gln Gly Pro Gly Gly Ser Ala Ala Ala
        35                  40                  45

Ala Ala Gly Gly Tyr Gly Pro Gly Gly Gln Gly Pro Gly Gln Gln Gly
    50                  55                  60

Pro Gly Ser Ser Ala Ala Ala Ala Ala Gly Pro Gly Gly Tyr Gly Pro
65                  70                  75                  80

Gly Gly Gln Gly Pro Ser Ala Ser Ala Ala Ala Ala Ala Gly Pro Gly
                85                  90                  95

Ser Gly Gln Gln Gly Pro Gly Ala Ser Ala Ala Ala Ala Ala Gly Gly
            100                 105                 110

Tyr Gly Pro Gly Gly Gln Gly Pro Gly Gln Gln Gly Pro Gly Ser Ser
        115                 120                 125
```

-continued

```
Ala Ala Ala Ala Ala Gly Gly Tyr Gly Ser Gly Pro Gly Gln Gln Gly
    130                 135                 140

Pro Tyr Gly Ser Ala Ala Ala Ala Ala Gly Pro Gly Ser Gly Gly Tyr
145                 150                 155                 160

Gly Gln Gly Pro Tyr Gly Pro Gly Ala Ser Ala Ala Ala Ala Ala Gly
                165                 170                 175

Pro Gly Gly Tyr Gly Pro Gly Gly Gln Gly Pro Ser Ala Ser Ala Ala
            180                 185                 190

Ala Ala Ala Gly Ser Gly Gln Gln Gly Pro Gly Gly Tyr Gly Pro Tyr
        195                 200                 205

Ala Ser Ala Ala Ala Ala Ala Gly Gly Tyr Gly Ser Gly Pro Gly Gln
    210                 215                 220

Gln Gly Pro Tyr Gly Pro Gly Gly Ser Ala Ala Ala Ala Ala Gly Ser
225                 230                 235                 240

Gly Gln Gln Gly Pro Gly Gln Gln Gly Pro Tyr Ala Ser Ala Ala Ala
                245                 250                 255

Ala Ala Gly Pro Gly Gly Gln Gly Pro Tyr Gly Pro Gly Ser Ser Ala
            260                 265                 270

Ala Ala Ala Ala Gly Gly Tyr Gly Tyr Gly Pro Gly Gly Gln Gly Pro
        275                 280                 285

Tyr Gly Pro Gly Ala Ser Ala Ala Ala Ala Ala Gly Gly Asn Gly Pro
    290                 295                 300

Gly Ser Gly Gly Tyr Gly Pro Gly Gln Gln Gly Pro Gly Gly Ser Ala
305                 310                 315                 320

Ala Ala Ala Ala Gly Pro Gly Gly Gln Gly Pro Tyr Gly Pro Gly Ala
                325                 330                 335

Ser Ala Ala Ala Ala Ala Gly Gly Tyr Gly Pro Gly Gly Gln Gly Pro
            340                 345                 350

Gly Gly Tyr Gly Pro Gly Ser Ser Ala Ala Ala Ala Ala Gly Pro Gly
        355                 360                 365

Gly Gln Gly Pro Tyr Gly Pro Gly Ser Ser Ala Ala Ala Ala Ala Gly
    370                 375                 380

Gly Tyr Gly Pro Gly Gln Gln Gly Pro Tyr Gly Pro Gly Gly Ser Ala
385                 390                 395                 400

Ala Ala Ala Ala Gly Gly Tyr Gln Gln Gly Pro Gly Gly Gln Gly Pro
                405                 410                 415

Tyr Gly Pro Gly Ala Ser Ala Ala Ala Ala Ala Gly Pro Gly Gly Gln
            420                 425                 430

Gly Pro Tyr Gly Pro Gly Ala Ser Ala Ala Ala Ala Ala Gly Pro Gly
        435                 440                 445

Gly Tyr Gly Pro Gly Gly Gln Gly Pro Ser Ala Ser Ala Ala Ala Ala
    450                 455                 460

Ala Gly Gly Tyr Gly Ser Gly Pro Gly Gly Tyr Gly Pro Tyr Gly Pro
465                 470                 475                 480

Gly Gly Ser Ala Ala Ala Ala Ala Gly Pro Gly Ser Gly Gln Gln Gly
                485                 490                 495

Gln Gly Pro Tyr Gly Pro Gly Ala Ser Ala Ala Ala Ala Ala Gly Gly
            500                 505                 510

Tyr Gly Pro Gly Gln Gln Gly Pro Tyr Gly Pro Gly Gly Ser Ala Ala
        515                 520                 525

Ala Ala Ala Gly Pro Gly Ser Gly Gly Tyr Gly Pro Gly Ala Ser Ala
    530                 535                 540

Ala Ala Ala Ala Gly Gly Asn Gly Pro Gly Ser Gly Gly Tyr Gly Pro
```

```
545                 550                 555                 560

Gly Gln Gln Gly Pro Gly Gly Ser Ala Ala Ala Ala Ala Gly Gly Tyr
                565                 570                 575

Gln Gln Gly Pro Gly Gly Gln Gly Pro Tyr Gly Pro Gly Ala Ser Ala
            580                 585                 590

Ala Ala Ala Ala Gly Pro Gly Ser Gly Gln Gln Gly Pro Gly Ala Ser
        595                 600                 605


<210> SEQ ID NO 17
<211> LENGTH: 590
<212> TYPE: PRT
<213> ORGANISM: Artificial Sequence
<220> FEATURE:
<223> OTHER INFORMATION: Met-PRT399

<400> SEQUENCE: 17

Met Gly Pro Gly Gly Gln Gly Pro Tyr Gly Pro Gly Ala Ser Ala Ala
1               5                   10                  15

Ala Ala Ala Gly Gly Asn Gly Pro Gly Ser Gly Gln Gln Gly Pro Gly
            20                  25                  30

Gly Ser Gly Gly Tyr Gly Pro Gly Gly Gln Gly Pro Gly Gln Gln Gly
        35                  40                  45

Pro Gly Ser Ser Ala Ala Ala Ala Ala Gly Pro Gly Gly Tyr Gly Pro
    50                  55                  60

Gly Gly Gln Gly Pro Ser Ala Ser Ala Ala Ala Ala Ala Gly Pro Gly
65                  70                  75                  80

Ser Gly Gln Gln Gly Pro Gly Ala Ser Gly Gly Tyr Gly Pro Gly Gly
                85                  90                  95

Gln Gly Pro Gly Gln Gln Gly Pro Gly Ser Ser Ala Ala Ala Ala Ala
            100                 105                 110

Gly Gly Tyr Gly Ser Gly Pro Gly Gln Gln Gly Pro Tyr Gly Ser Ala
        115                 120                 125

Ala Ala Ala Ala Gly Pro Gly Ser Gly Gly Tyr Gly Gln Gly Pro Tyr
    130                 135                 140

Gly Pro Gly Ala Ser Gly Pro Gly Gly Tyr Gly Pro Gly Gly Gln Gly
145                 150                 155                 160

Pro Ser Ala Ser Ala Ala Ala Ala Ala Gly Ser Gly Gln Gln Gly Pro
                165                 170                 175

Gly Gly Tyr Gly Pro Tyr Ala Ser Ala Ala Ala Ala Ala Gly Gly Tyr
            180                 185                 190

Gly Ser Gly Pro Gly Gln Gln Gly Pro Tyr Gly Pro Gly Gly Ser Gly
        195                 200                 205

Ser Gly Gln Gln Gly Pro Gly Gln Gln Gly Pro Tyr Ala Ser Ala Ala
    210                 215                 220

Ala Ala Ala Gly Pro Gly Gly Gln Gly Pro Tyr Gly Pro Gly Ser Ser
225                 230                 235                 240

Ala Ala Ala Ala Ala Gly Gly Tyr Gly Tyr Gly Pro Gly Gly Gln Gly
                245                 250                 255

Pro Tyr Gly Pro Gly Ala Ser Gly Gly Asn Gly Pro Gly Ser Gly Gly
            260                 265                 270

Tyr Gly Pro Gly Gln Gln Gly Pro Gly Gly Ser Ala Ala Ala Ala Ala
        275                 280                 285

Gly Pro Gly Gly Gln Gly Pro Tyr Gly Pro Gly Ala Ser Ala Ala Ala
    290                 295                 300

Ala Ala Gly Gly Tyr Gly Pro Gly Gly Gln Gly Pro Gly Gly Tyr Gly
```

305 310 315 320

Pro Gly Ser Ser Gly Pro Gly Gly Gln Gly Pro Tyr Gly Pro Gly Ser
325 330 335

Ser Ala Ala Ala Ala Ala Gly Gly Tyr Gly Pro Gly Gln Gln Gly Pro
340 345 350

Tyr Gly Pro Gly Gly Ser Ala Ala Ala Ala Ala Gly Gly Tyr Gln Gln
355 360 365

Gly Pro Gly Gly Gln Gly Pro Tyr Gly Pro Gly Ala Ser Gly Pro Gly
370 375 380

Gly Gln Gly Pro Tyr Gly Pro Gly Ala Ser Ala Ala Ala Ala Ala Gly
385 390 395 400

Pro Gly Gly Tyr Gly Pro Gly Gly Gln Gly Pro Ser Ala Ser Ala Ala
405 410 415

Ala Ala Ala Gly Gly Tyr Gly Ser Gly Pro Gly Gly Tyr Gly Pro Tyr
420 425 430

Gly Pro Gly Gly Ser Gly Pro Gly Ser Gly Gln Gln Gly Gln Gly Pro
435 440 445

Tyr Gly Pro Gly Ala Ser Ala Ala Ala Ala Ala Gly Gly Tyr Gly Pro
450 455 460

Gly Gln Gln Gly Pro Tyr Gly Pro Gly Gly Ser Ala Ala Ala Ala Ala
465 470 475 480

Gly Pro Gly Ser Gly Gly Tyr Gly Pro Gly Ala Ser Gly Gly Asn Gly
485 490 495

Pro Gly Ser Gly Gly Tyr Gly Pro Gly Gln Gln Gly Pro Gly Gly Ser
500 505 510

Ala Ala Ala Ala Ala Gly Gly Tyr Gln Gln Gly Pro Gly Gly Gln Gly
515 520 525

Pro Tyr Gly Pro Gly Ala Ser Ala Ala Ala Ala Ala Gly Gly Tyr Gly
530 535 540

Ser Gly Pro Gly Gln Gln Gly Pro Tyr Gly Pro Gly Gly Ser Gly Ser
545 550 555 560

Gly Gln Gln Gly Pro Gly Gln Gln Gly Pro Tyr Ala Ser Ala Ala Ala
565 570 575

Ala Ala Gly Pro Gly Ser Gly Gln Gln Gly Pro Gly Ala Ser
580 585 590

<210> SEQ ID NO 18
<211> LENGTH: 601
<212> TYPE: PRT
<213> ORGANISM: Artificial Sequence
<220> FEATURE:
<223> OTHER INFORMATION: PRT399

<400> SEQUENCE: 18

Met His His His His His His Ser Ser Gly Ser Ser Gly Pro Gly Gly
1 5 10 15

Gln Gly Pro Tyr Gly Pro Gly Ala Ser Ala Ala Ala Ala Ala Gly Gly
20 25 30

Asn Gly Pro Gly Ser Gly Gln Gln Gly Pro Gly Gly Ser Gly Gly Tyr
35 40 45

Gly Pro Gly Gly Gln Gly Pro Gly Gln Gln Gly Pro Gly Ser Ser Ala
50 55 60

Ala Ala Ala Ala Gly Pro Gly Gly Tyr Gly Pro Gly Gly Gln Gly Pro
65 70 75 80

Ser Ala Ser Ala Ala Ala Ala Ala Gly Pro Gly Ser Gly Gln Gln Gly

```
                85                  90                  95

Pro Gly Ala Ser Gly Gly Tyr Gly Pro Gly Gly Gln Gly Pro Gly Gln
            100                 105                 110

Gln Gly Pro Gly Ser Ser Ala Ala Ala Ala Ala Gly Gly Tyr Gly Ser
        115                 120                 125

Gly Pro Gly Gln Gln Gly Pro Tyr Gly Ser Ala Ala Ala Ala Ala Gly
    130                 135                 140

Pro Gly Ser Gly Gly Tyr Gly Gln Gly Pro Tyr Gly Pro Gly Ala Ser
145                 150                 155                 160

Gly Pro Gly Gly Tyr Gly Pro Gly Gly Gln Gly Pro Ser Ala Ser Ala
                165                 170                 175

Ala Ala Ala Ala Gly Ser Gly Gln Gln Gly Pro Gly Gly Tyr Gly Pro
            180                 185                 190

Tyr Ala Ser Ala Ala Ala Ala Ala Gly Gly Tyr Gly Ser Gly Pro Gly
        195                 200                 205

Gln Gln Gly Pro Tyr Gly Pro Gly Gly Ser Gly Ser Gly Gln Gln Gly
    210                 215                 220

Pro Gly Gln Gln Gly Pro Tyr Ala Ser Ala Ala Ala Ala Ala Gly Pro
225                 230                 235                 240

Gly Gly Gln Gly Pro Tyr Gly Pro Gly Ser Ser Ala Ala Ala Ala Ala
                245                 250                 255

Gly Gly Tyr Gly Tyr Gly Pro Gly Gly Gln Gly Pro Tyr Gly Pro Gly
            260                 265                 270

Ala Ser Gly Gly Asn Gly Pro Gly Ser Gly Gly Tyr Gly Pro Gly Gln
        275                 280                 285

Gln Gly Pro Gly Gly Ser Ala Ala Ala Ala Ala Gly Pro Gly Gly Gln
    290                 295                 300

Gly Pro Tyr Gly Pro Gly Ala Ser Ala Ala Ala Ala Ala Gly Gly Tyr
305                 310                 315                 320

Gly Pro Gly Gly Gln Gly Pro Gly Gly Tyr Gly Pro Gly Ser Ser Gly
                325                 330                 335

Pro Gly Gly Gln Gly Pro Tyr Gly Pro Gly Ser Ser Ala Ala Ala Ala
            340                 345                 350

Ala Gly Gly Tyr Gly Pro Gly Gln Gln Gly Pro Tyr Gly Pro Gly Gly
        355                 360                 365

Ser Ala Ala Ala Ala Ala Gly Gly Tyr Gln Gln Gly Pro Gly Gly Gln
    370                 375                 380

Gly Pro Tyr Gly Pro Gly Ala Ser Gly Pro Gly Gly Gln Gly Pro Tyr
385                 390                 395                 400

Gly Pro Gly Ala Ser Ala Ala Ala Ala Ala Gly Pro Gly Gly Tyr Gly
                405                 410                 415

Pro Gly Gly Gln Gly Pro Ser Ala Ser Ala Ala Ala Ala Ala Gly Gly
            420                 425                 430

Tyr Gly Ser Gly Pro Gly Gly Tyr Gly Pro Tyr Gly Pro Gly Gly Ser
        435                 440                 445

Gly Pro Gly Ser Gly Gln Gln Gly Gln Gly Pro Tyr Gly Pro Gly Ala
    450                 455                 460

Ser Ala Ala Ala Ala Ala Gly Gly Tyr Gly Pro Gly Gln Gln Gly Pro
465                 470                 475                 480

Tyr Gly Pro Gly Gly Ser Ala Ala Ala Ala Ala Gly Pro Gly Ser Gly
                485                 490                 495

Gly Tyr Gly Pro Gly Ala Ser Gly Gly Asn Gly Pro Gly Ser Gly Gly
            500                 505                 510
```

```
Tyr Gly Pro Gly Gln Gln Gly Pro Gly Gly Ser Ala Ala Ala Ala Ala
        515                 520                 525

Gly Gly Tyr Gln Gln Gly Pro Gly Gly Gln Gly Pro Tyr Gly Pro Gly
    530                 535                 540

Ala Ser Ala Ala Ala Ala Ala Gly Gly Tyr Gly Ser Gly Pro Gly Gln
545                 550                 555                 560

Gln Gly Pro Tyr Gly Pro Gly Gly Ser Gly Ser Gly Gln Gln Gly Pro
                565                 570                 575

Gly Gln Gln Gly Pro Tyr Ala Ser Ala Ala Ala Ala Ala Gly Pro Gly
            580                 585                 590

Ser Gly Gln Gln Gly Pro Gly Ala Ser
        595                 600


<210> SEQ ID NO 19
<211> LENGTH: 612
<212> TYPE: PRT
<213> ORGANISM: Artificial Sequence
<220> FEATURE:
<223> OTHER INFORMATION: Met-PRT720

<400> SEQUENCE: 19

Met Gly Pro Gly Gln Gln Gly Pro Tyr Gly Pro Gly Ala Ser Ala Ala
1               5                   10                  15

Ala Ala Ala Gly Gln Asn Gly Pro Gly Ser Gly Gln Gln Gly Pro Gly
            20                  25                  30

Gln Ser Gly Gln Tyr Gly Pro Gly Gln Gln Gly Pro Gly Gln Gln Gly
        35                  40                  45

Pro Gly Ser Ser Ala Ala Ala Ala Ala Gly Pro Gly Gln Tyr Val Leu
    50                  55                  60

Ile Gly Pro Gly Gln Gln Val Leu Ile Gly Pro Ser Ala Ser Ala Ala
65                  70                  75                  80

Ala Ala Ala Gly Pro Gly Ser Gly Gln Gln Gly Pro Gly Ala Ser Gly
                85                  90                  95

Gln Tyr Gly Pro Gly Gln Gln Gly Pro Gly Gln Gln Gly Pro Gly Ser
            100                 105                 110

Ser Ala Ala Ala Ala Ala Gly Ser Tyr Gly Ser Val Leu Ile Gly Pro
        115                 120                 125

Gly Gln Gln Val Leu Ile Gly Pro Tyr Gly Ser Ala Ala Ala Ala Ala
    130                 135                 140

Gly Pro Gly Ser Gly Gln Tyr Gly Gln Gly Pro Tyr Gly Pro Gly Ala
145                 150                 155                 160

Ser Gly Pro Gly Gln Tyr Gly Pro Gly Gln Gln Gly Pro Ser Ala Ser
                165                 170                 175

Ala Ala Ala Ala Ala Gly Ser Gly Gln Gln Val Leu Ile Gly Pro Gly
            180                 185                 190

Gln Tyr Val Leu Ile Gly Pro Tyr Ala Ser Ala Ala Ala Ala Ala Gly
        195                 200                 205

Gln Tyr Gly Ser Gly Pro Gly Gln Gln Gly Pro Tyr Gly Pro Gly Gln
    210                 215                 220

Ser Gly Ser Gly Gln Gln Gly Pro Gly Gln Gln Gly Pro Tyr Ala Ser
225                 230                 235                 240

Ala Ala Ala Ala Ala Gly Pro Gly Gln Gln Val Leu Ile Gly Pro Tyr
                245                 250                 255

Val Leu Ile Gly Pro Gly Ser Ser Ala Ala Ala Ala Ala Gly Gln Tyr
            260                 265                 270
```

```
Gly Tyr Gly Pro Gly Gln Gln Gly Pro Tyr Gly Pro Gly Ala Ser Gly
        275                 280                 285

Gln Asn Gly Pro Gly Ser Gly Gln Tyr Gly Pro Gly Gln Gln Gly Pro
    290                 295                 300

Gly Gln Ser Ala Ala Ala Ala Ala Gly Pro Gly Gln Gln Val Leu Ile
305                 310                 315                 320

Gly Pro Tyr Val Leu Ile Gly Pro Gly Ala Ser Ala Ala Ala Ala Ala
                325                 330                 335

Gly Gln Tyr Gly Pro Gly Gln Gln Gly Pro Gly Gln Tyr Gly Pro Gly
            340                 345                 350

Ser Ser Gly Pro Gly Gln Gln Gly Pro Tyr Gly Pro Gly Ser Ser Ala
        355                 360                 365

Ala Ala Ala Ala Gly Ser Tyr Gly Pro Gly Gln Gln Val Leu Ile Gly
    370                 375                 380

Pro Tyr Val Leu Ile Gly Pro Gly Pro Ser Ala Ala Ala Ala Ala Gly
385                 390                 395                 400

Gln Tyr Gln Gln Gly Pro Gly Gln Gln Gly Pro Tyr Gly Pro Gly Ala
                405                 410                 415

Ser Gly Pro Gly Gln Gln Gly Pro Tyr Gly Pro Gly Ala Ser Ala Ala
            420                 425                 430

Ala Ala Ala Gly Pro Gly Gln Tyr Val Leu Ile Gly Pro Gly Gln Gln
        435                 440                 445

Val Leu Ile Gly Pro Ser Ala Ser Ala Ala Ala Ala Ala Gly Gln Tyr
    450                 455                 460

Gly Ser Gly Pro Gly Gln Tyr Gly Pro Tyr Gly Pro Gly Gln Ser Gly
465                 470                 475                 480

Pro Gly Ser Gly Gln Gln Gly Gln Gly Pro Tyr Gly Pro Gly Ala Ser
                485                 490                 495

Ala Ala Ala Ala Ala Gly Ser Tyr Gly Pro Gly Gln Gln Val Leu Ile
            500                 505                 510

Gly Pro Tyr Val Leu Ile Gly Pro Gly Pro Ser Ala Ala Ala Ala Ala
        515                 520                 525

Gly Pro Gly Ser Gly Gln Tyr Gly Pro Gly Ala Ser Gly Gln Asn Gly
    530                 535                 540

Pro Gly Ser Gly Gln Tyr Gly Pro Gly Gln Gln Gly Pro Gly Gln Ser
545                 550                 555                 560

Ala Ala Ala Ala Ala Gly Gln Tyr Gln Gln Val Leu Ile Gly Pro Gly
                565                 570                 575

Gln Gln Gly Pro Tyr Val Leu Ile Gly Pro Gly Ala Ser Ala Ala Ala
            580                 585                 590

Ala Ala Gly Pro Gly Ser Gly Gln Gln Val Leu Ile Gly Pro Gly Ala
        595                 600                 605

Ser Val Leu Ile
    610


<210> SEQ ID NO 20
<211> LENGTH: 592
<212> TYPE: PRT
<213> ORGANISM: Artificial Sequence
<220> FEATURE:
<223> OTHER INFORMATION: Met-PRT665

<400> SEQUENCE: 20

Met Gly Pro Gly Gln Gln Gly Pro Tyr Gly Pro Gly Ala Ser Ala Ala
1               5                   10                  15
```

```
Ala Ala Ala Ala Ala Gly Ser Asn Gly Pro Gly Ser Gly Gln Gln Gly
            20                  25                  30

Pro Gly Gln Ser Gly Gln Tyr Gly Pro Gly Gln Gln Gly Pro Gly Gln
        35                  40                  45

Gln Gly Pro Gly Ser Ser Ala Ala Ala Ala Ala Ala Ala Gly Pro Gly
    50                  55                  60

Gln Tyr Val Leu Ile Gly Pro Gly Gln Gln Gly Pro Ser Ala Ser Ala
65                  70                  75                  80

Ala Ala Ala Ala Ala Ala Gly Pro Gly Ser Gly Gln Gln Gly Pro Gly
                85                  90                  95

Ala Ser Gly Gln Tyr Gly Pro Gly Gln Gln Gly Pro Gly Gln Gln Gly
            100                 105                 110

Pro Gly Ser Ser Ala Ala Ala Ala Ala Ala Ala Gly Ser Tyr Gly Ser
        115                 120                 125

Val Leu Ile Gly Pro Gly Gln Gln Gly Pro Tyr Gly Ser Ala Ala Ala
    130                 135                 140

Ala Ala Ala Ala Gly Pro Gly Ser Gly Gln Tyr Gly Gln Gly Pro Tyr
145                 150                 155                 160

Gly Pro Gly Ala Ser Gly Pro Gly Gln Tyr Gly Pro Gly Gln Gln Gly
                165                 170                 175

Pro Ser Ala Ser Ala Ala Ala Ala Ala Ala Ala Gly Ser Gly Gln Gln
            180                 185                 190

Val Leu Ile Gly Pro Gly Gln Tyr Gly Pro Tyr Ala Ser Ala Ala Ala
        195                 200                 205

Ala Ala Ala Ala Gly Ser Tyr Gly Ser Gly Pro Gly Gln Gln Gly Pro
    210                 215                 220

Tyr Gly Pro Gly Gln Ser Gly Ser Gly Gln Gln Gly Pro Gly Gln Gln
225                 230                 235                 240

Gly Pro Tyr Ala Ser Ala Ala Ala Ala Ala Ala Ala Gly Pro Gly Gln
                245                 250                 255

Gln Val Leu Ile Gly Pro Tyr Gly Pro Gly Ser Ser Ala Ala Ala Ala
            260                 265                 270

Ala Ala Ala Gly Ser Tyr Gly Tyr Gly Pro Gly Gln Gln Gly Pro Tyr
        275                 280                 285

Gly Pro Gly Ala Ser Gly Gln Asn Gly Pro Gly Ser Gly Gln Tyr Gly
    290                 295                 300

Pro Gly Gln Gln Gly Pro Gly Pro Ser Ala Ala Ala Ala Ala Ala Ala
305                 310                 315                 320

Gly Pro Gly Gln Gln Val Leu Ile Gly Pro Tyr Gly Pro Gly Ala Ser
                325                 330                 335

Ala Ala Ala Ala Ala Ala Ala Gly Ser Tyr Gly Pro Gly Gln Gln Gly
            340                 345                 350

Pro Gly Gln Tyr Gly Pro Gly Ser Ser Gly Pro Gly Gln Gln Gly Pro
        355                 360                 365

Tyr Gly Pro Gly Ser Ser Ala Ala Ala Ala Ala Ala Ala Gly Ser Tyr
    370                 375                 380

Gly Pro Gly Gln Gln Val Leu Ile Gly Pro Tyr Gly Pro Gly Pro Ser
385                 390                 395                 400

Ala Ala Ala Ala Ala Ala Ala Gly Ser Tyr Gln Gln Gly Pro Gly Gln
                405                 410                 415

Gln Gly Pro Tyr Gly Pro Gly Ala Ser Gly Pro Gly Gln Gln Gly Pro
            420                 425                 430
```

```
Tyr Gly Pro Gly Ala Ser Ala Ala Ala Ala Ala Ala Ala Gly Pro Gly
        435                 440                 445

Gln Tyr Val Leu Ile Gly Pro Gly Gln Gln Gly Pro Ser Ala Ser Ala
    450                 455                 460

Ala Ala Ala Ala Ala Ala Gly Ser Tyr Gly Ser Gly Pro Gly Gln Tyr
465                 470                 475                 480

Gly Pro Tyr Gly Pro Gly Gln Ser Gly Pro Gly Ser Gly Gln Gln Gly
                485                 490                 495

Gln Gly Pro Tyr Gly Pro Gly Ala Ser Ala Ala Ala Ala Ala Ala Ala
            500                 505                 510

Gly Ser Tyr Gly Pro Gly Gln Gln Val Leu Ile Gly Pro Tyr Gly Pro
        515                 520                 525

Gly Pro Ser Ala Ala Ala Ala Ala Ala Ala Gly Pro Gly Ser Gly Gln
    530                 535                 540

Tyr Gly Pro Gly Ala Ser Gly Gln Asn Gly Pro Gly Ser Gly Gln Tyr
545                 550                 555                 560

Gly Pro Gly Gln Gln Gly Pro Gly Pro Ser Ala Ala Ala Ala Ala Ala
                565                 570                 575

Ala Gly Pro Gly Ser Gly Gln Gln Gly Pro Gly Ala Ser Val Leu Ile
            580                 585                 590


<210> SEQ ID NO 21
<211> LENGTH: 619
<212> TYPE: PRT
<213> ORGANISM: Artificial Sequence
<220> FEATURE:
<223> OTHER INFORMATION: Met-PRT666

<400> SEQUENCE: 21

Met Gly Pro Gly Gln Gln Gly Pro Tyr Gly Pro Gly Ala Ser Ala Ala
1               5                   10                  15

Ala Ala Ala Ala Ala Gly Ser Asn Gly Pro Gly Ser Gly Gln Gln Gly
            20                  25                  30

Pro Gly Gln Ser Gly Gln Tyr Gly Pro Gly Gln Gln Gly Pro Gly Gln
        35                  40                  45

Gln Gly Pro Gly Ser Ser Ala Ala Ala Ala Ala Ala Ala Gly Pro Gly
    50                  55                  60

Gln Tyr Val Leu Ile Gly Pro Gly Gln Gln Val Leu Ile Gly Pro Ser
65                  70                  75                  80

Ala Ser Ala Ala Ala Ala Ala Ala Ala Gly Pro Gly Ser Gly Gln Gln
                85                  90                  95

Gly Pro Gly Ala Ser Gly Gln Tyr Gly Pro Gly Gln Gln Gly Pro Gly
            100                 105                 110

Gln Gln Gly Pro Gly Ser Ser Ala Ala Ala Ala Ala Ala Ala Gly Ser
        115                 120                 125

Tyr Gly Ser Val Leu Ile Gly Pro Gly Gln Gln Val Leu Ile Gly Pro
    130                 135                 140

Tyr Gly Ser Ala Ala Ala Ala Ala Ala Ala Gly Pro Gly Ser Gly Gln
145                 150                 155                 160

Tyr Gly Gln Gly Pro Tyr Gly Pro Gly Ala Ser Gly Pro Gly Gln Tyr
                165                 170                 175

Gly Pro Gly Gln Gln Gly Pro Ser Ala Ser Ala Ala Ala Ala Ala Ala
            180                 185                 190

Ala Gly Ser Gly Gln Gln Val Leu Ile Gly Pro Gly Gln Tyr Val Leu
        195                 200                 205
```

```
Ile Gly Pro Tyr Ala Ser Ala Ala Ala Ala Ala Ala Ala Gly Ser Tyr
    210                 215                 220

Gly Ser Gly Pro Gly Gln Gln Gly Pro Tyr Gly Pro Gly Gln Ser Gly
225                 230                 235                 240

Ser Gly Gln Gln Gly Pro Gly Gln Gln Gly Pro Tyr Ala Ser Ala Ala
                245                 250                 255

Ala Ala Ala Ala Ala Gly Pro Gly Gln Gln Val Leu Ile Gly Pro Tyr
            260                 265                 270

Val Leu Ile Gly Pro Gly Ser Ser Ala Ala Ala Ala Ala Ala Ala Gly
        275                 280                 285

Ser Tyr Gly Tyr Gly Pro Gly Gln Gln Gly Pro Tyr Gly Pro Gly Ala
    290                 295                 300

Ser Gly Gln Asn Gly Pro Gly Ser Gly Gln Tyr Gly Pro Gly Gln Gln
305                 310                 315                 320

Gly Pro Gly Pro Ser Ala Ala Ala Ala Ala Ala Ala Gly Pro Gly Gln
                325                 330                 335

Gln Val Leu Ile Gly Pro Tyr Val Leu Ile Gly Pro Gly Ala Ser Ala
            340                 345                 350

Ala Ala Ala Ala Ala Ala Gly Ser Tyr Gly Pro Gly Gln Gln Gly Pro
        355                 360                 365

Gly Gln Tyr Gly Pro Gly Ser Ser Gly Pro Gly Gln Gln Gly Pro Tyr
    370                 375                 380

Gly Pro Gly Ser Ser Ala Ala Ala Ala Ala Ala Ala Gly Ser Tyr Gly
385                 390                 395                 400

Pro Gly Gln Gln Val Leu Ile Gly Pro Tyr Val Leu Ile Gly Pro Gly
                405                 410                 415

Pro Ser Ala Ala Ala Ala Ala Ala Ala Gly Ser Tyr Gln Gln Gly Pro
            420                 425                 430

Gly Gln Gln Gly Pro Tyr Gly Pro Gly Ala Ser Gly Pro Gly Gln Gln
        435                 440                 445

Gly Pro Tyr Gly Pro Gly Ala Ser Ala Ala Ala Ala Ala Ala Ala Gly
    450                 455                 460

Pro Gly Gln Tyr Val Leu Ile Gly Pro Gly Gln Gln Val Leu Ile Gly
465                 470                 475                 480

Pro Ser Ala Ser Ala Ala Ala Ala Ala Ala Ala Gly Ser Tyr Gly Ser
                485                 490                 495

Gly Pro Gly Gln Tyr Gly Pro Tyr Gly Pro Gly Gln Ser Gly Pro Gly
            500                 505                 510

Ser Gly Gln Gln Gly Gln Gly Pro Tyr Gly Pro Gly Ala Ser Ala Ala
        515                 520                 525

Ala Ala Ala Ala Ala Gly Ser Tyr Gly Pro Gly Gln Gln Val Leu Ile
    530                 535                 540

Gly Pro Tyr Val Leu Ile Gly Pro Gly Pro Ser Ala Ala Ala Ala Ala
545                 550                 555                 560

Ala Ala Gly Pro Gly Ser Gly Gln Tyr Gly Pro Gly Ala Ser Gly Gln
                565                 570                 575

Asn Gly Pro Gly Ser Gly Gln Tyr Gly Pro Gly Gln Gln Gly Pro Gly
            580                 585                 590

Pro Ser Ala Ala Ala Ala Ala Ala Ala Gly Pro Gly Ser Gly Gln Gln
        595                 600                 605

Val Leu Ile Gly Pro Gly Ala Ser Val Leu Ile
    610                 615
```

<210> SEQ ID NO 22
<211> LENGTH: 623
<212> TYPE: PRT
<213> ORGANISM: Artificial Sequence
<220> FEATURE:
<223> OTHER INFORMATION: PRT720

<400> SEQUENCE: 22

Met His His His His His His Ser Ser Gly Ser Ser Gly Pro Gly Gln
1 5 10 15

Gln Gly Pro Tyr Gly Pro Gly Ala Ser Ala Ala Ala Ala Ala Gly Gln
20 25 30

Asn Gly Pro Gly Ser Gly Gln Gln Gly Pro Gly Gln Ser Gly Gln Tyr
35 40 45

Gly Pro Gly Gln Gln Gly Pro Gly Gln Gln Gly Pro Gly Ser Ser Ala
50 55 60

Ala Ala Ala Ala Gly Pro Gly Gln Tyr Val Leu Ile Gly Pro Gly Gln
65 70 75 80

Gln Val Leu Ile Gly Pro Ser Ala Ser Ala Ala Ala Ala Ala Gly Pro
85 90 95

Gly Ser Gly Gln Gln Gly Pro Gly Ala Ser Gly Gln Tyr Gly Pro Gly
100 105 110

Gln Gln Gly Pro Gly Gln Gln Gly Pro Gly Ser Ser Ala Ala Ala Ala
115 120 125

Ala Gly Ser Tyr Gly Ser Val Leu Ile Gly Pro Gly Gln Gln Val Leu
130 135 140

Ile Gly Pro Tyr Gly Ser Ala Ala Ala Ala Ala Gly Pro Gly Ser Gly
145 150 155 160

Gln Tyr Gly Gln Gly Pro Tyr Gly Pro Gly Ala Ser Gly Pro Gly Gln
165 170 175

Tyr Gly Pro Gly Gln Gln Gly Pro Ser Ala Ser Ala Ala Ala Ala Ala
180 185 190

Gly Ser Gly Gln Gln Val Leu Ile Gly Pro Gly Gln Tyr Val Leu Ile
195 200 205

Gly Pro Tyr Ala Ser Ala Ala Ala Ala Ala Gly Gln Tyr Gly Ser Gly
210 215 220

Pro Gly Gln Gln Gly Pro Tyr Gly Pro Gly Gln Ser Gly Ser Gly Gln
225 230 235 240

Gln Gly Pro Gly Gln Gln Gly Pro Tyr Ala Ser Ala Ala Ala Ala Ala
245 250 255

Gly Pro Gly Gln Gln Val Leu Ile Gly Pro Tyr Val Leu Ile Gly Pro
260 265 270

Gly Ser Ser Ala Ala Ala Ala Ala Gly Gln Tyr Gly Tyr Gly Pro Gly
275 280 285

Gln Gln Gly Pro Tyr Gly Pro Gly Ala Ser Gly Gln Asn Gly Pro Gly
290 295 300

Ser Gly Gln Tyr Gly Pro Gly Gln Gln Gly Pro Gly Gln Ser Ala Ala
305 310 315 320

Ala Ala Ala Gly Pro Gly Gln Gln Val Leu Ile Gly Pro Tyr Val Leu
325 330 335

Ile Gly Pro Gly Ala Ser Ala Ala Ala Ala Ala Gly Gln Tyr Gly Pro
340 345 350

Gly Gln Gln Gly Pro Gly Gln Tyr Gly Pro Gly Ser Ser Gly Pro Gly
355 360 365

Gln Gln Gly Pro Tyr Gly Pro Gly Ser Ser Ala Ala Ala Ala Ala Gly

```
    370                 375                 380

Ser Tyr Gly Pro Gly Gln Gln Val Leu Ile Gly Pro Tyr Val Leu Ile
385                 390                 395                 400

Gly Pro Gly Pro Ser Ala Ala Ala Ala Ala Gly Gln Tyr Gln Gln Gly
                405                 410                 415

Pro Gly Gln Gln Gly Pro Tyr Gly Pro Gly Ala Ser Gly Pro Gly Gln
            420                 425                 430

Gln Gly Pro Tyr Gly Pro Gly Ala Ser Ala Ala Ala Ala Ala Gly Pro
        435                 440                 445

Gly Gln Tyr Val Leu Ile Gly Pro Gly Gln Gln Val Leu Ile Gly Pro
    450                 455                 460

Ser Ala Ser Ala Ala Ala Ala Ala Gly Gln Tyr Gly Ser Gly Pro Gly
465                 470                 475                 480

Gln Tyr Gly Pro Tyr Gly Pro Gly Gln Ser Gly Pro Gly Ser Gly Gln
                485                 490                 495

Gln Gly Gln Gly Pro Tyr Gly Pro Gly Ala Ser Ala Ala Ala Ala Ala
            500                 505                 510

Gly Ser Tyr Gly Pro Gly Gln Gln Val Leu Ile Gly Pro Tyr Val Leu
        515                 520                 525

Ile Gly Pro Gly Pro Ser Ala Ala Ala Ala Ala Gly Pro Gly Ser Gly
    530                 535                 540

Gln Tyr Gly Pro Gly Ala Ser Gly Gln Asn Gly Pro Gly Ser Gly Gln
545                 550                 555                 560

Tyr Gly Pro Gly Gln Gln Gly Pro Gly Gln Ser Ala Ala Ala Ala Ala
                565                 570                 575

Gly Gln Tyr Gln Gln Val Leu Ile Gly Pro Gly Gln Gln Gly Pro Tyr
            580                 585                 590

Val Leu Ile Gly Pro Gly Ala Ser Ala Ala Ala Ala Ala Gly Pro Gly
        595                 600                 605

Ser Gly Gln Gln Val Leu Ile Gly Pro Gly Ala Ser Val Leu Ile
    610                 615                 620


<210> SEQ ID NO 23
<211> LENGTH: 603
<212> TYPE: PRT
<213> ORGANISM: Artificial Sequence
<220> FEATURE:
<223> OTHER INFORMATION: PRT665

<400> SEQUENCE: 23

Met His His His His His His Ser Ser Gly Ser Ser Gly Pro Gly Gln
1               5                   10                  15

Gln Gly Pro Tyr Gly Pro Gly Ala Ser Ala Ala Ala Ala Ala Ala Ala
            20                  25                  30

Gly Ser Asn Gly Pro Gly Ser Gly Gln Gln Gly Pro Gly Gln Ser Gly
        35                  40                  45

Gln Tyr Gly Pro Gly Gln Gln Gly Pro Gly Gln Gln Gly Pro Gly Ser
    50                  55                  60

Ser Ala Ala Ala Ala Ala Ala Ala Gly Pro Gly Gln Tyr Val Leu Ile
65                  70                  75                  80

Gly Pro Gly Gln Gln Gly Pro Ser Ala Ser Ala Ala Ala Ala Ala Ala
                85                  90                  95

Ala Gly Pro Gly Ser Gly Gln Gln Gly Pro Gly Ala Ser Gly Gln Tyr
            100                 105                 110

Gly Pro Gly Gln Gln Gly Pro Gly Gln Gln Gly Pro Gly Ser Ser Ala
```

```
        115                 120                 125

Ala Ala Ala Ala Ala Ala Gly Ser Tyr Gly Ser Val Leu Ile Gly Pro
    130                 135                 140

Gly Gln Gln Gly Pro Tyr Gly Ser Ala Ala Ala Ala Ala Ala Ala Gly
145                 150                 155                 160

Pro Gly Ser Gly Gln Tyr Gly Gln Gly Pro Tyr Gly Pro Gly Ala Ser
                165                 170                 175

Gly Pro Gly Gln Tyr Gly Pro Gly Gln Gln Gly Pro Ser Ala Ser Ala
            180                 185                 190

Ala Ala Ala Ala Ala Ala Gly Ser Gly Gln Gln Val Leu Ile Gly Pro
        195                 200                 205

Gly Gln Tyr Gly Pro Tyr Ala Ser Ala Ala Ala Ala Ala Ala Ala Gly
    210                 215                 220

Ser Tyr Gly Ser Gly Pro Gly Gln Gln Gly Pro Tyr Gly Pro Gly Gln
225                 230                 235                 240

Ser Gly Ser Gly Gln Gln Gly Pro Gly Gln Gln Gly Pro Tyr Ala Ser
                245                 250                 255

Ala Ala Ala Ala Ala Ala Ala Gly Pro Gly Gln Gln Val Leu Ile Gly
            260                 265                 270

Pro Tyr Gly Pro Gly Ser Ser Ala Ala Ala Ala Ala Ala Ala Gly Ser
        275                 280                 285

Tyr Gly Tyr Gly Pro Gly Gln Gln Gly Pro Tyr Gly Pro Gly Ala Ser
    290                 295                 300

Gly Gln Asn Gly Pro Gly Ser Gly Gln Tyr Gly Pro Gly Gln Gln Gly
305                 310                 315                 320

Pro Gly Pro Ser Ala Ala Ala Ala Ala Ala Ala Gly Pro Gly Gln Gln
                325                 330                 335

Val Leu Ile Gly Pro Tyr Gly Pro Gly Ala Ser Ala Ala Ala Ala Ala
            340                 345                 350

Ala Ala Gly Ser Tyr Gly Pro Gly Gln Gln Gly Pro Gly Gln Tyr Gly
        355                 360                 365

Pro Gly Ser Ser Gly Pro Gly Gln Gln Gly Pro Tyr Gly Pro Gly Ser
    370                 375                 380

Ser Ala Ala Ala Ala Ala Ala Ala Gly Ser Tyr Gly Pro Gly Gln Gln
385                 390                 395                 400

Val Leu Ile Gly Pro Tyr Gly Pro Gly Pro Ser Ala Ala Ala Ala Ala
                405                 410                 415

Ala Ala Gly Ser Tyr Gln Gln Gly Pro Gly Gln Gln Gly Pro Tyr Gly
            420                 425                 430

Pro Gly Ala Ser Gly Pro Gly Gln Gln Gly Pro Tyr Gly Pro Gly Ala
        435                 440                 445

Ser Ala Ala Ala Ala Ala Ala Ala Gly Pro Gly Gln Tyr Val Leu Ile
    450                 455                 460

Gly Pro Gly Gln Gln Gly Pro Ser Ala Ser Ala Ala Ala Ala Ala Ala
465                 470                 475                 480

Ala Gly Ser Tyr Gly Ser Gly Pro Gly Gln Tyr Gly Pro Tyr Gly Pro
                485                 490                 495

Gly Gln Ser Gly Pro Gly Ser Gly Gln Gln Gly Gln Gly Pro Tyr Gly
            500                 505                 510

Pro Gly Ala Ser Ala Ala Ala Ala Ala Ala Ala Gly Ser Tyr Gly Pro
        515                 520                 525

Gly Gln Gln Val Leu Ile Gly Pro Tyr Gly Pro Gly Pro Ser Ala Ala
    530                 535                 540
```

```
Ala Ala Ala Ala Ala Gly Pro Gly Ser Gly Gln Tyr Gly Pro Gly Ala
545                 550                 555                 560

Ser Gly Gln Asn Gly Pro Gly Ser Gly Gln Tyr Gly Pro Gly Gln Gln
                565                 570                 575

Gly Pro Gly Pro Ser Ala Ala Ala Ala Ala Ala Ala Gly Pro Gly Ser
            580                 585                 590

Gly Gln Gln Gly Pro Gly Ala Ser Val Leu Ile
        595                 600


<210> SEQ ID NO 24
<211> LENGTH: 630
<212> TYPE: PRT
<213> ORGANISM: Artificial Sequence
<220> FEATURE:
<223> OTHER INFORMATION: PRT666

<400> SEQUENCE: 24

Met His His His His His His Ser Ser Gly Ser Ser Gly Pro Gly Gln
1               5                   10                  15

Gln Gly Pro Tyr Gly Pro Gly Ala Ser Ala Ala Ala Ala Ala Ala Ala
            20                  25                  30

Gly Ser Asn Gly Pro Gly Ser Gly Gln Gln Gly Pro Gly Gln Ser Gly
        35                  40                  45

Gln Tyr Gly Pro Gly Gln Gln Gly Pro Gly Gln Gln Gly Pro Gly Ser
    50                  55                  60

Ser Ala Ala Ala Ala Ala Ala Ala Gly Pro Gly Gln Tyr Val Leu Ile
65                  70                  75                  80

Gly Pro Gly Gln Gln Val Leu Ile Gly Pro Ser Ala Ser Ala Ala Ala
                85                  90                  95

Ala Ala Ala Ala Gly Pro Gly Ser Gly Gln Gln Gly Pro Gly Ala Ser
            100                 105                 110

Gly Gln Tyr Gly Pro Gly Gln Gln Gly Pro Gly Gln Gln Gly Pro Gly
        115                 120                 125

Ser Ser Ala Ala Ala Ala Ala Ala Ala Gly Ser Tyr Gly Ser Val Leu
    130                 135                 140

Ile Gly Pro Gly Gln Gln Val Leu Ile Gly Pro Tyr Gly Ser Ala Ala
145                 150                 155                 160

Ala Ala Ala Ala Ala Gly Pro Gly Ser Gly Gln Tyr Gly Gln Gly Pro
                165                 170                 175

Tyr Gly Pro Gly Ala Ser Gly Pro Gly Gln Tyr Gly Pro Gly Gln Gln
            180                 185                 190

Gly Pro Ser Ala Ser Ala Ala Ala Ala Ala Ala Ala Gly Ser Gly Gln
        195                 200                 205

Gln Val Leu Ile Gly Pro Gly Gln Tyr Val Leu Ile Gly Pro Tyr Ala
    210                 215                 220

Ser Ala Ala Ala Ala Ala Ala Ala Gly Ser Tyr Gly Ser Gly Pro Gly
225                 230                 235                 240

Gln Gln Gly Pro Tyr Gly Pro Gly Gln Ser Gly Ser Gly Gln Gln Gly
                245                 250                 255

Pro Gly Gln Gln Gly Pro Tyr Ala Ser Ala Ala Ala Ala Ala Ala Ala
            260                 265                 270

Gly Pro Gly Gln Gln Val Leu Ile Gly Pro Tyr Val Leu Ile Gly Pro
        275                 280                 285

Gly Ser Ser Ala Ala Ala Ala Ala Ala Ala Gly Ser Tyr Gly Tyr Gly
    290                 295                 300
```

```
Pro Gly Gln Gln Gly Pro Tyr Gly Pro Gly Ala Ser Gly Gln Asn Gly
305                 310                 315                 320

Pro Gly Ser Gly Gln Tyr Gly Pro Gly Gln Gln Gly Pro Gly Pro Ser
                325                 330                 335

Ala Ala Ala Ala Ala Ala Ala Gly Pro Gly Gln Gln Val Leu Ile Gly
            340                 345                 350

Pro Tyr Val Leu Ile Gly Pro Gly Ala Ser Ala Ala Ala Ala Ala Ala
        355                 360                 365

Ala Gly Ser Tyr Gly Pro Gly Gln Gln Gly Pro Gly Gln Tyr Gly Pro
    370                 375                 380

Gly Ser Ser Gly Pro Gly Gln Gln Gly Pro Tyr Gly Pro Gly Ser Ser
385                 390                 395                 400

Ala Ala Ala Ala Ala Ala Ala Gly Ser Tyr Gly Pro Gly Gln Gln Val
                405                 410                 415

Leu Ile Gly Pro Tyr Val Leu Ile Gly Pro Gly Pro Ser Ala Ala Ala
            420                 425                 430

Ala Ala Ala Ala Gly Ser Tyr Gln Gln Gly Pro Gly Gln Gln Gly Pro
        435                 440                 445

Tyr Gly Pro Gly Ala Ser Gly Pro Gly Gln Gln Gly Pro Tyr Gly Pro
    450                 455                 460

Gly Ala Ser Ala Ala Ala Ala Ala Ala Ala Gly Pro Gly Gln Tyr Val
465                 470                 475                 480

Leu Ile Gly Pro Gly Gln Gln Val Leu Ile Gly Pro Ser Ala Ser Ala
                485                 490                 495

Ala Ala Ala Ala Ala Ala Gly Ser Tyr Gly Ser Gly Pro Gly Gln Tyr
            500                 505                 510

Gly Pro Tyr Gly Pro Gly Gln Ser Gly Pro Gly Ser Gly Gln Gln Gly
        515                 520                 525

Gln Gly Pro Tyr Gly Pro Gly Ala Ser Ala Ala Ala Ala Ala Ala Ala
    530                 535                 540

Gly Ser Tyr Gly Pro Gly Gln Gln Val Leu Ile Gly Pro Tyr Val Leu
545                 550                 555                 560

Ile Gly Pro Gly Pro Ser Ala Ala Ala Ala Ala Ala Ala Gly Pro Gly
                565                 570                 575

Ser Gly Gln Tyr Gly Pro Gly Ala Ser Gly Gln Asn Gly Pro Gly Ser
            580                 585                 590

Gly Gln Tyr Gly Pro Gly Gln Gln Gly Pro Gly Pro Ser Ala Ala Ala
        595                 600                 605

Ala Ala Ala Ala Gly Pro Gly Ser Gly Gln Gln Val Leu Ile Gly Pro
    610                 615                 620

Gly Ala Ser Val Leu Ile
625                 630


<210> SEQ ID NO 25
<211> LENGTH: 593
<212> TYPE: PRT
<213> ORGANISM: Artificial Sequence
<220> FEATURE:
<223> OTHER INFORMATION: Met-PRT888

<400> SEQUENCE: 25

Met Gly Ser Ser Gly Pro Gly Val Leu Gly Pro Tyr Gly Pro Gly Ala
1               5                   10                  15

Ser Ala Ala Ala Ala Ala Gly Gln Asn Gly Pro Gly Ser Gly Val Leu
            20                  25                  30
```

```
Gly Pro Gly Gln Ser Gly Gln Tyr Gly Pro Gly Val Leu Gly Pro Gly
        35                  40                  45

Val Leu Gly Pro Gly Ser Ser Ala Ala Ala Ala Ala Gly Pro Gly Gln
    50                  55                  60

Tyr Gly Pro Gly Val Leu Gly Pro Ser Ala Ser Ala Ala Ala Ala Ala
65                  70                  75                  80

Gly Pro Gly Ser Gly Val Leu Gly Pro Gly Ala Ser Gly Gln Tyr Gly
                85                  90                  95

Pro Gly Val Leu Gly Pro Gly Val Leu Gly Pro Gly Ser Ser Ala Ala
            100                 105                 110

Ala Ala Ala Gly Gln Tyr Gly Ser Gly Pro Gly Val Leu Gly Pro Tyr
        115                 120                 125

Gly Ser Ala Ala Ala Ala Ala Gly Pro Gly Ser Gly Gln Tyr Gly Gln
    130                 135                 140

Gly Pro Tyr Gly Pro Gly Ala Ser Gly Pro Gly Gln Tyr Gly Pro Gly
145                 150                 155                 160

Val Leu Gly Pro Ser Ala Ser Ala Ala Ala Ala Ala Gly Ser Gly Val
                165                 170                 175

Leu Gly Pro Gly Gln Tyr Gly Pro Tyr Ala Ser Ala Ala Ala Ala Ala
            180                 185                 190

Gly Gln Tyr Gly Ser Gly Pro Gly Val Leu Gly Pro Tyr Gly Pro Gly
        195                 200                 205

Gln Ser Gly Ser Gly Val Leu Gly Pro Gly Val Leu Gly Pro Tyr Ala
    210                 215                 220

Ser Ala Ala Ala Ala Ala Gly Pro Gly Val Leu Gly Pro Tyr Gly Pro
225                 230                 235                 240

Gly Ser Ser Ala Ala Ala Ala Ala Gly Gln Tyr Gly Tyr Gly Pro Gly
                245                 250                 255

Val Leu Gly Pro Tyr Gly Pro Gly Ala Ser Gly Gln Asn Gly Pro Gly
            260                 265                 270

Ser Gly Gln Tyr Gly Pro Gly Val Leu Gly Pro Gly Gln Ser Ala Ala
        275                 280                 285

Ala Ala Ala Gly Pro Gly Val Leu Gly Pro Tyr Gly Pro Gly Ala Ser
    290                 295                 300

Ala Ala Ala Ala Ala Gly Gln Tyr Gly Pro Gly Val Leu Gly Pro Gly
305                 310                 315                 320

Gln Tyr Gly Pro Gly Ser Ser Gly Pro Gly Val Leu Gly Pro Tyr Gly
                325                 330                 335

Pro Gly Ser Ser Ala Ala Ala Ala Ala Gly Gln Tyr Gly Pro Gly Val
            340                 345                 350

Leu Gly Pro Tyr Gly Pro Gly Gln Ser Ala Ala Ala Ala Ala Gly Gln
        355                 360                 365

Tyr Val Leu Gly Pro Gly Val Leu Gly Pro Tyr Gly Pro Gly Ala Ser
    370                 375                 380

Gly Pro Gly Val Leu Gly Pro Tyr Gly Pro Gly Ala Ser Ala Ala Ala
385                 390                 395                 400

Ala Ala Gly Pro Gly Gln Tyr Gly Pro Gly Val Leu Gly Pro Ser Ala
                405                 410                 415

Ser Ala Ala Ala Ala Ala Gly Gln Tyr Gly Ser Gly Pro Gly Gln Tyr
            420                 425                 430

Gly Pro Tyr Gly Pro Gly Gln Ser Gly Pro Gly Ser Gly Val Leu Gly
        435                 440                 445
```

```
Gln Gly Pro Tyr Gly Pro Gly Ala Ser Ala Ala Ala Ala Ala Gly Gln
    450                 455                 460

Tyr Gly Pro Gly Val Leu Gly Pro Tyr Gly Pro Gly Gln Ser Ala Ala
465                 470                 475                 480

Ala Ala Ala Gly Pro Gly Ser Gly Gln Tyr Gly Pro Gly Ala Ser Gly
                485                 490                 495

Gln Asn Gly Pro Gly Ser Gly Gln Tyr Gly Pro Gly Val Leu Gly Pro
            500                 505                 510

Gly Gln Ser Ala Ala Ala Ala Ala Gly Gln Tyr Val Leu Gly Pro Gly
        515                 520                 525

Val Leu Gly Pro Tyr Gly Pro Gly Ala Ser Ala Ala Ala Ala Ala Gly
    530                 535                 540

Gln Tyr Gly Ser Gly Pro Gly Val Leu Gly Pro Tyr Gly Pro Gly Gln
545                 550                 555                 560

Ser Gly Ser Gly Val Leu Gly Pro Gly Val Leu Gly Pro Tyr Ala Ser
                565                 570                 575

Ala Ala Ala Ala Ala Gly Pro Gly Ser Gly Val Leu Gly Pro Gly Ala
            580                 585                 590

Ser


<210> SEQ ID NO 26
<211> LENGTH: 590
<212> TYPE: PRT
<213> ORGANISM: Artificial Sequence
<220> FEATURE:
<223> OTHER INFORMATION: Met-PRT965

<400> SEQUENCE: 26

Met Gly Pro Gly Thr Ser Gly Pro Tyr Gly Pro Gly Ala Ser Ala Ala
1               5                   10                  15

Ala Ala Ala Gly Ala Asn Gly Pro Gly Ser Gly Thr Ser Gly Pro Gly
            20                  25                  30

Ala Ser Gly Ala Tyr Gly Pro Gly Thr Ser Gly Pro Gly Thr Ser Gly
        35                  40                  45

Pro Gly Ser Ser Ala Ala Ala Ala Ala Gly Pro Gly Ala Tyr Gly Pro
    50                  55                  60

Gly Thr Ser Gly Pro Ser Ala Ser Ala Ala Ala Ala Ala Gly Pro Gly
65                  70                  75                  80

Ser Gly Thr Ser Gly Pro Gly Ala Ser Gly Ala Tyr Gly Pro Gly Thr
                85                  90                  95

Ser Gly Pro Gly Thr Ser Gly Pro Gly Ser Ser Ala Ala Ala Ala Ala
            100                 105                 110

Gly Ala Tyr Gly Ser Gly Pro Gly Thr Ser Gly Pro Tyr Gly Ser Ala
        115                 120                 125

Ala Ala Ala Ala Gly Pro Gly Ser Gly Ala Tyr Gly Ala Gly Pro Tyr
    130                 135                 140

Gly Pro Gly Ala Ser Gly Pro Gly Ala Tyr Gly Pro Gly Thr Ser Gly
145                 150                 155                 160

Pro Ser Ala Ser Ala Ala Ala Ala Ala Gly Ser Gly Thr Ser Gly Pro
                165                 170                 175

Gly Ala Tyr Gly Pro Tyr Ala Ser Ala Ala Ala Ala Ala Gly Ala Tyr
            180                 185                 190

Gly Ser Gly Pro Gly Thr Ser Gly Pro Tyr Gly Pro Gly Ala Ser Gly
        195                 200                 205

Ser Gly Thr Ser Gly Pro Gly Thr Ser Gly Pro Tyr Ala Ser Ala Ala
```

```
    210                 215                 220

Ala Ala Ala Gly Pro Gly Thr Ser Gly Pro Tyr Gly Pro Gly Ser Ser
225                 230                 235                 240

Ala Ala Ala Ala Ala Gly Ala Tyr Gly Tyr Gly Pro Gly Thr Ser Gly
                245                 250                 255

Pro Tyr Gly Pro Gly Ala Ser Gly Ala Asn Gly Pro Gly Ser Gly Ala
            260                 265                 270

Tyr Gly Pro Gly Thr Ser Gly Pro Gly Ala Ser Ala Ala Ala Ala Ala
        275                 280                 285

Gly Pro Gly Thr Ser Gly Pro Tyr Gly Pro Gly Ala Ser Ala Ala Ala
    290                 295                 300

Ala Ala Gly Ala Tyr Gly Pro Gly Thr Ser Gly Pro Gly Ala Tyr Gly
305                 310                 315                 320

Pro Gly Ser Ser Gly Pro Gly Thr Ser Gly Pro Tyr Gly Pro Gly Ser
                325                 330                 335

Ser Ala Ala Ala Ala Ala Gly Ala Tyr Gly Pro Gly Thr Ser Gly Pro
            340                 345                 350

Tyr Gly Pro Gly Ala Ser Ala Ala Ala Ala Ala Gly Ala Tyr Thr Ser
        355                 360                 365

Gly Pro Gly Thr Ser Gly Pro Tyr Gly Pro Gly Ala Ser Gly Pro Gly
    370                 375                 380

Thr Ser Gly Pro Tyr Gly Pro Gly Ala Ser Ala Ala Ala Ala Ala Gly
385                 390                 395                 400

Pro Gly Ala Tyr Gly Pro Gly Thr Ser Gly Pro Ser Ala Ser Ala Ala
                405                 410                 415

Ala Ala Ala Gly Ala Tyr Gly Ser Gly Pro Gly Ala Tyr Gly Pro Tyr
            420                 425                 430

Gly Pro Gly Ala Ser Gly Pro Gly Ser Gly Thr Ser Gly Ala Gly Pro
        435                 440                 445

Tyr Gly Pro Gly Ala Ser Ala Ala Ala Ala Ala Gly Ala Tyr Gly Pro
    450                 455                 460

Gly Thr Ser Gly Pro Tyr Gly Pro Gly Ala Ser Ala Ala Ala Ala Ala
465                 470                 475                 480

Gly Pro Gly Ser Gly Ala Tyr Gly Pro Gly Ala Ser Gly Ala Asn Gly
                485                 490                 495

Pro Gly Ser Gly Ala Tyr Gly Pro Gly Thr Ser Gly Pro Gly Ala Ser
            500                 505                 510

Ala Ala Ala Ala Ala Gly Ala Tyr Thr Ser Gly Pro Gly Thr Ser Gly
        515                 520                 525

Pro Tyr Gly Pro Gly Ala Ser Ala Ala Ala Ala Ala Gly Ala Tyr Gly
    530                 535                 540

Ser Gly Pro Gly Thr Ser Gly Pro Tyr Gly Pro Gly Ala Ser Gly Ser
545                 550                 555                 560

Gly Thr Ser Gly Pro Gly Thr Ser Gly Pro Tyr Ala Ser Ala Ala Ala
                565                 570                 575

Ala Ala Gly Pro Gly Ser Gly Thr Ser Gly Pro Gly Ala Ser
            580                 585                 590
```

<210> SEQ ID NO 27
<211> LENGTH: 593
<212> TYPE: PRT
<213> ORGANISM: Artificial Sequence
<220> FEATURE:
<223> OTHER INFORMATION: Met-PRT889

<400> SEQUENCE: 27

Met Gly Ser Ser Gly Pro Gly Val Leu Gly Pro Tyr Gly Pro Gly Ala
1 5 10 15

Ser Ala Ala Ala Ala Ala Gly Ile Asn Gly Pro Gly Ser Gly Val Leu
20 25 30

Gly Pro Gly Ile Ser Gly Ile Tyr Gly Pro Gly Val Leu Gly Pro Gly
35 40 45

Val Leu Gly Pro Gly Ser Ser Ala Ala Ala Ala Ala Gly Pro Gly Ile
50 55 60

Tyr Gly Pro Gly Val Leu Gly Pro Ser Ala Ser Ala Ala Ala Ala Ala
65 70 75 80

Gly Pro Gly Ser Gly Val Leu Gly Pro Gly Ala Ser Gly Ile Tyr Gly
85 90 95

Pro Gly Val Leu Gly Pro Gly Val Leu Gly Pro Gly Ser Ser Ala Ala
100 105 110

Ala Ala Ala Gly Ile Tyr Gly Ser Gly Pro Gly Val Leu Gly Pro Tyr
115 120 125

Gly Ser Ala Ala Ala Ala Ala Gly Pro Gly Ser Gly Ile Tyr Gly Ile
130 135 140

Gly Pro Tyr Gly Pro Gly Ala Ser Gly Pro Gly Ile Tyr Gly Pro Gly
145 150 155 160

Val Leu Gly Pro Ser Ala Ser Ala Ala Ala Ala Ala Gly Ser Gly Val
165 170 175

Leu Gly Pro Gly Ile Tyr Gly Pro Tyr Ala Ser Ala Ala Ala Ala Ala
180 185 190

Gly Ile Tyr Gly Ser Gly Pro Gly Val Leu Gly Pro Tyr Gly Pro Gly
195 200 205

Ile Ser Gly Ser Gly Val Leu Gly Pro Gly Val Leu Gly Pro Tyr Ala
210 215 220

Ser Ala Ala Ala Ala Ala Gly Pro Gly Val Leu Gly Pro Tyr Gly Pro
225 230 235 240

Gly Ser Ser Ala Ala Ala Ala Ala Gly Ile Tyr Gly Tyr Gly Pro Gly
245 250 255

Val Leu Gly Pro Tyr Gly Pro Gly Ala Ser Gly Ile Asn Gly Pro Gly
260 265 270

Ser Gly Ile Tyr Gly Pro Gly Val Leu Gly Pro Gly Ile Ser Ala Ala
275 280 285

Ala Ala Ala Gly Pro Gly Val Leu Gly Pro Tyr Gly Pro Gly Ala Ser
290 295 300

Ala Ala Ala Ala Ala Gly Ile Tyr Gly Pro Gly Val Leu Gly Pro Gly
305 310 315 320

Ile Tyr Gly Pro Gly Ser Ser Gly Pro Gly Val Leu Gly Pro Tyr Gly
325 330 335

Pro Gly Ser Ser Ala Ala Ala Ala Ala Gly Ile Tyr Gly Pro Gly Val
340 345 350

Leu Gly Pro Tyr Gly Pro Gly Ile Ser Ala Ala Ala Ala Ala Gly Ile
355 360 365

Tyr Val Leu Gly Pro Gly Val Leu Gly Pro Tyr Gly Pro Gly Ala Ser
370 375 380

Gly Pro Gly Val Leu Gly Pro Tyr Gly Pro Gly Ala Ser Ala Ala Ala
385 390 395 400

Ala Ala Gly Pro Gly Ile Tyr Gly Pro Gly Val Leu Gly Pro Ser Ala
405 410 415

```
Ser Ala Ala Ala Ala Ala Gly Ile Tyr Gly Ser Gly Pro Gly Ile Tyr
            420                 425                 430

Gly Pro Tyr Gly Pro Gly Ile Ser Gly Pro Gly Ser Gly Val Leu Gly
        435                 440                 445

Ile Gly Pro Tyr Gly Pro Gly Ala Ser Ala Ala Ala Ala Ala Gly Ile
    450                 455                 460

Tyr Gly Pro Gly Val Leu Gly Pro Tyr Gly Pro Gly Ile Ser Ala Ala
465                 470                 475                 480

Ala Ala Ala Gly Pro Gly Ser Gly Ile Tyr Gly Pro Gly Ala Ser Gly
                485                 490                 495

Ile Asn Gly Pro Gly Ser Gly Ile Tyr Gly Pro Gly Val Leu Gly Pro
            500                 505                 510

Gly Ile Ser Ala Ala Ala Ala Ala Gly Ile Tyr Val Leu Gly Pro Gly
        515                 520                 525

Val Leu Gly Pro Tyr Gly Pro Gly Ala Ser Ala Ala Ala Ala Ala Gly
    530                 535                 540

Ile Tyr Gly Ser Gly Pro Gly Val Leu Gly Pro Tyr Gly Pro Gly Ile
545                 550                 555                 560

Ser Gly Ser Gly Val Leu Gly Pro Gly Val Leu Gly Pro Tyr Ala Ser
                565                 570                 575

Ala Ala Ala Ala Ala Gly Pro Gly Ser Gly Val Leu Gly Pro Gly Ala
            580                 585                 590

Ser


<210> SEQ ID NO 28
<211> LENGTH: 590
<212> TYPE: PRT
<213> ORGANISM: Artificial Sequence
<220> FEATURE:
<223> OTHER INFORMATION: Met-PRT916

<400> SEQUENCE: 28

Met Gly Pro Gly Val Ile Gly Pro Tyr Gly Pro Gly Ala Ser Ala Ala
1               5                   10                  15

Ala Ala Ala Gly Leu Asn Gly Pro Gly Ser Gly Val Ile Gly Pro Gly
            20                  25                  30

Leu Ser Gly Leu Tyr Gly Pro Gly Val Ile Gly Pro Gly Val Ile Gly
        35                  40                  45

Pro Gly Ser Ser Ala Ala Ala Ala Ala Gly Pro Gly Leu Tyr Gly Pro
    50                  55                  60

Gly Val Ile Gly Pro Ser Ala Ser Ala Ala Ala Ala Ala Gly Pro Gly
65                  70                  75                  80

Ser Gly Val Ile Gly Pro Gly Ala Ser Gly Leu Tyr Gly Pro Gly Val
                85                  90                  95

Ile Gly Pro Gly Val Ile Gly Pro Gly Ser Ser Ala Ala Ala Ala Ala
            100                 105                 110

Gly Leu Tyr Gly Ser Gly Pro Gly Val Ile Gly Pro Tyr Gly Ser Ala
        115                 120                 125

Ala Ala Ala Ala Gly Pro Gly Ser Gly Leu Tyr Gly Leu Gly Pro Tyr
    130                 135                 140

Gly Pro Gly Ala Ser Gly Pro Gly Leu Tyr Gly Pro Gly Val Ile Gly
145                 150                 155                 160

Pro Ser Ala Ser Ala Ala Ala Ala Ala Gly Ser Gly Val Ile Gly Pro
                165                 170                 175
```

```
Gly Leu Tyr Gly Pro Tyr Ala Ser Ala Ala Ala Ala Ala Gly Leu Tyr
            180                 185                 190

Gly Ser Gly Pro Gly Val Ile Gly Pro Tyr Gly Pro Gly Leu Ser Gly
        195                 200                 205

Ser Gly Val Ile Gly Pro Gly Val Ile Gly Pro Tyr Ala Ser Ala Ala
    210                 215                 220

Ala Ala Ala Gly Pro Gly Val Ile Gly Pro Tyr Gly Pro Gly Ser Ser
225                 230                 235                 240

Ala Ala Ala Ala Ala Gly Leu Tyr Gly Tyr Gly Pro Gly Val Ile Gly
                245                 250                 255

Pro Tyr Gly Pro Gly Ala Ser Gly Leu Asn Gly Pro Gly Ser Gly Leu
            260                 265                 270

Tyr Gly Pro Gly Val Ile Gly Pro Gly Leu Ser Ala Ala Ala Ala Ala
        275                 280                 285

Gly Pro Gly Val Ile Gly Pro Tyr Gly Pro Gly Ala Ser Ala Ala Ala
    290                 295                 300

Ala Ala Gly Leu Tyr Gly Pro Gly Val Ile Gly Pro Gly Leu Tyr Gly
305                 310                 315                 320

Pro Gly Ser Ser Gly Pro Gly Val Ile Gly Pro Tyr Gly Pro Gly Ser
                325                 330                 335

Ser Ala Ala Ala Ala Ala Gly Leu Tyr Gly Pro Gly Val Ile Gly Pro
            340                 345                 350

Tyr Gly Pro Gly Leu Ser Ala Ala Ala Ala Ala Gly Leu Tyr Val Ile
        355                 360                 365

Gly Pro Gly Val Ile Gly Pro Tyr Gly Pro Gly Ala Ser Gly Pro Gly
    370                 375                 380

Val Ile Gly Pro Tyr Gly Pro Gly Ala Ser Ala Ala Ala Ala Ala Gly
385                 390                 395                 400

Pro Gly Leu Tyr Gly Pro Gly Val Ile Gly Pro Ser Ala Ser Ala Ala
                405                 410                 415

Ala Ala Ala Gly Leu Tyr Gly Ser Gly Pro Gly Leu Tyr Gly Pro Tyr
            420                 425                 430

Gly Pro Gly Leu Ser Gly Pro Gly Ser Gly Val Ile Gly Leu Gly Pro
        435                 440                 445

Tyr Gly Pro Gly Ala Ser Ala Ala Ala Ala Ala Gly Leu Tyr Gly Pro
    450                 455                 460

Gly Val Ile Gly Pro Tyr Gly Pro Gly Leu Ser Ala Ala Ala Ala Ala
465                 470                 475                 480

Gly Pro Gly Ser Gly Leu Tyr Gly Pro Gly Ala Ser Gly Leu Asn Gly
                485                 490                 495

Pro Gly Ser Gly Leu Tyr Gly Pro Gly Val Ile Gly Pro Gly Leu Ser
            500                 505                 510

Ala Ala Ala Ala Ala Gly Leu Tyr Val Ile Gly Pro Gly Val Ile Gly
        515                 520                 525

Pro Tyr Gly Pro Gly Ala Ser Ala Ala Ala Ala Ala Gly Leu Tyr Gly
    530                 535                 540

Ser Gly Pro Gly Val Ile Gly Pro Tyr Gly Pro Gly Leu Ser Gly Ser
545                 550                 555                 560

Gly Val Ile Gly Pro Gly Val Ile Gly Pro Tyr Ala Ser Ala Ala Ala
                565                 570                 575

Ala Ala Gly Pro Gly Ser Gly Val Ile Gly Pro Gly Ala Ser
            580                 585                 590
```

<210> SEQ ID NO 29
<211> LENGTH: 590
<212> TYPE: PRT
<213> ORGANISM: Artificial Sequence
<220> FEATURE:
<223> OTHER INFORMATION: Met-PRT918

<400> SEQUENCE: 29

Met Gly Pro Gly Val Phe Gly Pro Tyr Gly Pro Gly Ala Ser Ala Ala
1 5 10 15

Ala Ala Ala Gly Ile Asn Gly Pro Gly Ser Gly Val Phe Gly Pro Gly
20 25 30

Ile Ser Gly Ile Tyr Gly Pro Gly Val Phe Gly Pro Gly Val Phe Gly
35 40 45

Pro Gly Ser Ser Ala Ala Ala Ala Ala Gly Pro Gly Ile Tyr Gly Pro
50 55 60

Gly Val Phe Gly Pro Ser Ala Ser Ala Ala Ala Ala Ala Gly Pro Gly
65 70 75 80

Ser Gly Val Phe Gly Pro Gly Ala Ser Gly Ile Tyr Gly Pro Gly Val
85 90 95

Phe Gly Pro Gly Val Phe Gly Pro Gly Ser Ser Ala Ala Ala Ala Ala
100 105 110

Gly Ile Tyr Gly Ser Gly Pro Gly Val Phe Gly Pro Tyr Gly Ser Ala
115 120 125

Ala Ala Ala Ala Gly Pro Gly Ser Gly Ile Tyr Gly Ile Gly Pro Tyr
130 135 140

Gly Pro Gly Ala Ser Gly Pro Gly Ile Tyr Gly Pro Gly Val Phe Gly
145 150 155 160

Pro Ser Ala Ser Ala Ala Ala Ala Ala Gly Ser Gly Val Phe Gly Pro
165 170 175

Gly Ile Tyr Gly Pro Tyr Ala Ser Ala Ala Ala Ala Ala Gly Ile Tyr
180 185 190

Gly Ser Gly Pro Gly Val Phe Gly Pro Tyr Gly Pro Gly Ile Ser Gly
195 200 205

Ser Gly Val Phe Gly Pro Gly Val Phe Gly Pro Tyr Ala Ser Ala Ala
210 215 220

Ala Ala Ala Gly Pro Gly Val Phe Gly Pro Tyr Gly Pro Gly Ser Ser
225 230 235 240

Ala Ala Ala Ala Ala Gly Ile Tyr Gly Tyr Gly Pro Gly Val Phe Gly
245 250 255

Pro Tyr Gly Pro Gly Ala Ser Gly Ile Asn Gly Pro Gly Ser Gly Ile
260 265 270

Tyr Gly Pro Gly Val Phe Gly Pro Gly Ile Ser Ala Ala Ala Ala Ala
275 280 285

Gly Pro Gly Val Phe Gly Pro Tyr Gly Pro Gly Ala Ser Ala Ala Ala
290 295 300

Ala Ala Gly Ile Tyr Gly Pro Gly Val Phe Gly Pro Gly Ile Tyr Gly
305 310 315 320

Pro Gly Ser Ser Gly Pro Gly Val Phe Gly Pro Tyr Gly Pro Gly Ser
325 330 335

Ser Ala Ala Ala Ala Ala Gly Ile Tyr Gly Pro Gly Val Phe Gly Pro
340 345 350

Tyr Gly Pro Gly Ile Ser Ala Ala Ala Ala Ala Gly Ile Tyr Val Phe
355 360 365

Gly Pro Gly Val Phe Gly Pro Tyr Gly Pro Gly Ala Ser Gly Pro Gly

```
    370                 375                 380

Val Phe Gly Pro Tyr Gly Pro Gly Ala Ser Ala Ala Ala Ala Ala Gly
385                 390                 395                 400

Pro Gly Ile Tyr Gly Pro Gly Val Phe Gly Pro Ser Ala Ser Ala Ala
                405                 410                 415

Ala Ala Ala Gly Ile Tyr Gly Ser Gly Pro Gly Ile Tyr Gly Pro Tyr
            420                 425                 430

Gly Pro Gly Ile Ser Gly Pro Gly Ser Gly Val Phe Gly Ile Gly Pro
        435                 440                 445

Tyr Gly Pro Gly Ala Ser Ala Ala Ala Ala Ala Gly Ile Tyr Gly Pro
    450                 455                 460

Gly Val Phe Gly Pro Tyr Gly Pro Gly Ile Ser Ala Ala Ala Ala Ala
465                 470                 475                 480

Gly Pro Gly Ser Gly Ile Tyr Gly Pro Gly Ala Ser Gly Ile Asn Gly
                485                 490                 495

Pro Gly Ser Gly Ile Tyr Gly Pro Gly Val Phe Gly Pro Gly Ile Ser
            500                 505                 510

Ala Ala Ala Ala Ala Gly Ile Tyr Val Phe Gly Pro Gly Val Phe Gly
        515                 520                 525

Pro Tyr Gly Pro Gly Ala Ser Ala Ala Ala Ala Ala Gly Ile Tyr Gly
    530                 535                 540

Ser Gly Pro Gly Val Phe Gly Pro Tyr Gly Pro Gly Ile Ser Gly Ser
545                 550                 555                 560

Gly Val Phe Gly Pro Gly Val Phe Gly Pro Tyr Ala Ser Ala Ala Ala
                565                 570                 575

Ala Ala Gly Pro Gly Ser Gly Val Phe Gly Pro Gly Ala Ser
            580                 585                 590


<210> SEQ ID NO 30
<211> LENGTH: 565
<212> TYPE: PRT
<213> ORGANISM: Artificial Sequence
<220> FEATURE:
<223> OTHER INFORMATION: Met-PRT699

<400> SEQUENCE: 30

Met Gly Pro Gly Val Leu Gly Pro Tyr Gly Pro Gly Ala Ser Ala Ala
1               5                   10                  15

Ala Ala Ala Ala Ala Gly Ser Asn Gly Pro Gly Ser Gly Val Leu Gly
            20                  25                  30

Pro Gly Gln Ser Gly Gln Tyr Gly Pro Gly Val Leu Gly Pro Gly Val
        35                  40                  45

Leu Gly Pro Gly Ser Ser Ala Ala Ala Ala Ala Ala Ala Gly Pro Gly
    50                  55                  60

Gln Tyr Gly Pro Gly Val Leu Gly Pro Ser Ala Ser Ala Ala Ala Ala
65                  70                  75                  80

Ala Ala Ala Gly Pro Gly Ser Gly Val Leu Gly Pro Gly Ala Ser Gly
                85                  90                  95

Gln Tyr Gly Pro Gly Val Leu Gly Pro Gly Val Leu Gly Pro Gly Ser
            100                 105                 110

Ser Ala Ala Ala Ala Ala Ala Ala Gly Ser Tyr Gly Ser Gly Pro Gly
        115                 120                 125

Val Leu Gly Pro Tyr Gly Ser Ala Ala Ala Ala Ala Ala Ala Gly Pro
    130                 135                 140

Gly Ser Gly Gln Tyr Gly Gln Gly Pro Tyr Gly Pro Gly Ala Ser Gly
```

```
145                 150                 155                 160

Pro Gly Gln Tyr Gly Pro Gly Val Leu Gly Pro Ser Ala Ser Ala Ala
                165                 170                 175

Ala Ala Ala Ala Ala Gly Ser Gly Val Leu Gly Pro Gly Gln Tyr Gly
            180                 185                 190

Pro Tyr Ala Ser Ala Ala Ala Ala Ala Ala Ala Gly Ser Tyr Gly Ser
        195                 200                 205

Gly Pro Gly Val Leu Gly Pro Tyr Gly Pro Gly Gln Ser Gly Ser Gly
    210                 215                 220

Val Leu Gly Pro Gly Val Leu Gly Pro Tyr Ala Ser Ala Ala Ala Ala
225                 230                 235                 240

Ala Ala Ala Gly Pro Gly Val Leu Gly Pro Tyr Gly Pro Gly Ser Ser
                245                 250                 255

Ala Ala Ala Ala Ala Ala Ala Gly Ser Tyr Gly Tyr Gly Pro Gly Val
            260                 265                 270

Leu Gly Pro Tyr Gly Pro Gly Ala Ser Gly Gln Asn Gly Pro Gly Ser
        275                 280                 285

Gly Gln Tyr Gly Pro Gly Val Leu Gly Pro Gly Pro Ser Ala Ala Ala
    290                 295                 300

Ala Ala Ala Ala Gly Pro Gly Val Leu Gly Pro Tyr Gly Pro Gly Ala
305                 310                 315                 320

Ser Ala Ala Ala Ala Ala Ala Ala Gly Ser Tyr Gly Pro Gly Val Leu
                325                 330                 335

Gly Pro Gly Gln Tyr Gly Pro Gly Ser Ser Gly Pro Gly Val Leu Gly
            340                 345                 350

Pro Tyr Gly Pro Gly Ser Ser Ala Ala Ala Ala Ala Ala Ala Gly Ser
        355                 360                 365

Tyr Gly Pro Gly Val Leu Gly Pro Tyr Gly Pro Gly Pro Ser Ala Ala
    370                 375                 380

Ala Ala Ala Ala Ala Gly Ser Tyr Val Leu Gly Pro Gly Val Leu Gly
385                 390                 395                 400

Pro Tyr Gly Pro Gly Ala Ser Gly Pro Gly Val Leu Gly Pro Tyr Gly
                405                 410                 415

Pro Gly Ala Ser Ala Ala Ala Ala Ala Ala Ala Gly Pro Gly Gln Tyr
            420                 425                 430

Gly Pro Gly Val Leu Gly Pro Ser Ala Ser Ala Ala Ala Ala Ala Ala
        435                 440                 445

Ala Gly Ser Tyr Gly Ser Gly Pro Gly Gln Tyr Gly Pro Tyr Gly Pro
    450                 455                 460

Gly Gln Ser Gly Pro Gly Ser Gly Val Leu Gly Gln Gly Pro Tyr Gly
465                 470                 475                 480

Pro Gly Ala Ser Ala Ala Ala Ala Ala Ala Ala Gly Ser Tyr Gly Pro
                485                 490                 495

Gly Val Leu Gly Pro Tyr Gly Pro Gly Pro Ser Ala Ala Ala Ala Ala
            500                 505                 510

Ala Ala Gly Pro Gly Ser Gly Gln Tyr Gly Pro Gly Ala Ser Gly Gln
        515                 520                 525

Asn Gly Pro Gly Ser Gly Gln Tyr Gly Pro Gly Val Leu Gly Pro Gly
    530                 535                 540

Pro Ser Ala Ala Ala Ala Ala Ala Ala Gly Pro Gly Ser Gly Val Leu
545                 550                 555                 560

Gly Pro Gly Ala Ser
                565
```

<210> SEQ ID NO 31
<211> LENGTH: 565
<212> TYPE: PRT
<213> ORGANISM: Artificial Sequence
<220> FEATURE:
<223> OTHER INFORMATION: Met-PRT698

<400> SEQUENCE: 31

Met Gly Pro Gly Val Leu Gly Pro Tyr Gly Pro Gly Ala Ser Ala Ala
1 5 10 15

Ala Ala Ala Ala Ala Gly Ser Asn Gly Pro Gly Ser Gly Val Leu Gly
20 25 30

Pro Gly Ile Ser Gly Ile Tyr Gly Pro Gly Val Leu Gly Pro Gly Val
35 40 45

Leu Gly Pro Gly Ser Ser Ala Ala Ala Ala Ala Ala Ala Gly Pro Gly
50 55 60

Ile Tyr Gly Pro Gly Val Leu Gly Pro Ser Ala Ser Ala Ala Ala Ala
65 70 75 80

Ala Ala Ala Gly Pro Gly Ser Gly Val Leu Gly Pro Gly Ala Ser Gly
85 90 95

Ile Tyr Gly Pro Gly Val Leu Gly Pro Gly Val Leu Gly Pro Gly Ser
100 105 110

Ser Ala Ala Ala Ala Ala Ala Ala Gly Ser Tyr Gly Ser Gly Pro Gly
115 120 125

Val Leu Gly Pro Tyr Gly Ser Ala Ala Ala Ala Ala Ala Ala Gly Pro
130 135 140

Gly Ser Gly Ile Tyr Gly Ile Gly Pro Tyr Gly Pro Gly Ala Ser Gly
145 150 155 160

Pro Gly Ile Tyr Gly Pro Gly Val Leu Gly Pro Ser Ala Ser Ala Ala
165 170 175

Ala Ala Ala Ala Ala Gly Ser Gly Val Leu Gly Pro Gly Ile Tyr Gly
180 185 190

Pro Tyr Ala Ser Ala Ala Ala Ala Ala Ala Ala Gly Ser Tyr Gly Ser
195 200 205

Gly Pro Gly Val Leu Gly Pro Tyr Gly Pro Gly Ile Ser Gly Ser Gly
210 215 220

Val Leu Gly Pro Gly Val Leu Gly Pro Tyr Ala Ser Ala Ala Ala Ala
225 230 235 240

Ala Ala Ala Gly Pro Gly Val Leu Gly Pro Tyr Gly Pro Gly Ser Ser
245 250 255

Ala Ala Ala Ala Ala Ala Ala Gly Ser Tyr Gly Tyr Gly Pro Gly Val
260 265 270

Leu Gly Pro Tyr Gly Pro Gly Ala Ser Gly Ile Asn Gly Pro Gly Ser
275 280 285

Gly Ile Tyr Gly Pro Gly Val Leu Gly Pro Gly Pro Ser Ala Ala Ala
290 295 300

Ala Ala Ala Ala Gly Pro Gly Val Leu Gly Pro Tyr Gly Pro Gly Ala
305 310 315 320

Ser Ala Ala Ala Ala Ala Ala Ala Gly Ser Tyr Gly Pro Gly Val Leu
325 330 335

Gly Pro Gly Ile Tyr Gly Pro Gly Ser Ser Gly Pro Gly Val Leu Gly
340 345 350

Pro Tyr Gly Pro Gly Ser Ser Ala Ala Ala Ala Ala Ala Ala Gly Ser
355 360 365

```
Tyr Gly Pro Gly Val Leu Gly Pro Tyr Gly Pro Gly Pro Ser Ala Ala
    370                 375                 380

Ala Ala Ala Ala Ala Gly Ser Tyr Val Leu Gly Pro Gly Val Leu Gly
385                 390                 395                 400

Pro Tyr Gly Pro Gly Ala Ser Gly Pro Gly Val Leu Gly Pro Tyr Gly
                405                 410                 415

Pro Gly Ala Ser Ala Ala Ala Ala Ala Ala Ala Gly Pro Gly Ile Tyr
            420                 425                 430

Gly Pro Gly Val Leu Gly Pro Ser Ala Ser Ala Ala Ala Ala Ala Ala
        435                 440                 445

Ala Gly Ser Tyr Gly Ser Gly Pro Gly Ile Tyr Gly Pro Tyr Gly Pro
    450                 455                 460

Gly Ile Ser Gly Pro Gly Ser Gly Val Leu Gly Ile Gly Pro Tyr Gly
465                 470                 475                 480

Pro Gly Ala Ser Ala Ala Ala Ala Ala Ala Ala Gly Ser Tyr Gly Pro
                485                 490                 495

Gly Val Leu Gly Pro Tyr Gly Pro Gly Pro Ser Ala Ala Ala Ala Ala
            500                 505                 510

Ala Ala Gly Pro Gly Ser Gly Ile Tyr Gly Pro Gly Ala Ser Gly Ile
        515                 520                 525

Asn Gly Pro Gly Ser Gly Ile Tyr Gly Pro Gly Val Leu Gly Pro Gly
    530                 535                 540

Pro Ser Ala Ala Ala Ala Ala Ala Ala Gly Pro Gly Ser Gly Val Leu
545                 550                 555                 560

Gly Pro Gly Ala Ser
                565


<210> SEQ ID NO 32
<211> LENGTH: 1179
<212> TYPE: PRT
<213> ORGANISM: Artificial Sequence
<220> FEATURE:
<223> OTHER INFORMATION: Met-PRT966

<400> SEQUENCE: 32

Met Gly Pro Gly Val Phe Gly Pro Tyr Gly Pro Gly Ala Ser Ala Ala
1               5                   10                  15

Ala Ala Ala Gly Ile Asn Gly Pro Gly Ser Gly Val Phe Gly Pro Gly
            20                  25                  30

Ile Ser Gly Ile Tyr Gly Pro Gly Val Phe Gly Pro Gly Val Phe Gly
        35                  40                  45

Pro Gly Ser Ser Ala Ala Ala Ala Ala Gly Pro Gly Ile Tyr Gly Pro
    50                  55                  60

Gly Val Phe Gly Pro Ser Ala Ser Ala Ala Ala Ala Ala Gly Pro Gly
65                  70                  75                  80

Ser Gly Val Phe Gly Pro Gly Ala Ser Gly Ile Tyr Gly Pro Gly Val
                85                  90                  95

Phe Gly Pro Gly Val Phe Gly Pro Gly Ser Ser Ala Ala Ala Ala Ala
            100                 105                 110

Gly Ile Tyr Gly Ser Gly Pro Gly Val Phe Gly Pro Tyr Gly Ser Ala
        115                 120                 125

Ala Ala Ala Ala Gly Pro Gly Ser Gly Ile Tyr Gly Ile Gly Pro Tyr
    130                 135                 140

Gly Pro Gly Ala Ser Gly Pro Gly Ile Tyr Gly Pro Gly Val Phe Gly
145                 150                 155                 160
```

```
Pro Ser Ala Ser Ala Ala Ala Ala Ala Gly Ser Gly Val Phe Gly Pro
                165                 170                 175

Gly Ile Tyr Gly Pro Tyr Ala Ser Ala Ala Ala Ala Ala Gly Ile Tyr
            180                 185                 190

Gly Ser Gly Pro Gly Val Phe Gly Pro Tyr Gly Pro Gly Ile Ser Gly
        195                 200                 205

Ser Gly Val Phe Gly Pro Gly Val Phe Gly Pro Tyr Ala Ser Ala Ala
    210                 215                 220

Ala Ala Ala Gly Pro Gly Val Phe Gly Pro Tyr Gly Pro Gly Ser Ser
225                 230                 235                 240

Ala Ala Ala Ala Ala Gly Ile Tyr Gly Tyr Gly Pro Gly Val Phe Gly
                245                 250                 255

Pro Tyr Gly Pro Gly Ala Ser Gly Ile Asn Gly Pro Gly Ser Gly Ile
            260                 265                 270

Tyr Gly Pro Gly Val Phe Gly Pro Gly Ile Ser Ala Ala Ala Ala Ala
        275                 280                 285

Gly Pro Gly Val Phe Gly Pro Tyr Gly Pro Gly Ala Ser Ala Ala Ala
    290                 295                 300

Ala Ala Gly Ile Tyr Gly Pro Gly Val Phe Gly Pro Gly Ile Tyr Gly
305                 310                 315                 320

Pro Gly Ser Ser Gly Pro Gly Val Phe Gly Pro Tyr Gly Pro Gly Ser
                325                 330                 335

Ser Ala Ala Ala Ala Ala Gly Ile Tyr Gly Pro Gly Val Phe Gly Pro
            340                 345                 350

Tyr Gly Pro Gly Ile Ser Ala Ala Ala Ala Ala Gly Ile Tyr Val Phe
        355                 360                 365

Gly Pro Gly Val Phe Gly Pro Tyr Gly Pro Gly Ala Ser Gly Pro Gly
    370                 375                 380

Val Phe Gly Pro Tyr Gly Pro Gly Ala Ser Ala Ala Ala Ala Ala Gly
385                 390                 395                 400

Pro Gly Ile Tyr Gly Pro Gly Val Phe Gly Pro Ser Ala Ser Ala Ala
                405                 410                 415

Ala Ala Ala Gly Ile Tyr Gly Ser Gly Pro Gly Ile Tyr Gly Pro Tyr
            420                 425                 430

Gly Pro Gly Ile Ser Gly Pro Gly Ser Gly Val Phe Gly Ile Gly Pro
        435                 440                 445

Tyr Gly Pro Gly Ala Ser Ala Ala Ala Ala Ala Gly Ile Tyr Gly Pro
    450                 455                 460

Gly Val Phe Gly Pro Tyr Gly Pro Gly Ile Ser Ala Ala Ala Ala Ala
465                 470                 475                 480

Gly Pro Gly Ser Gly Ile Tyr Gly Pro Gly Ala Ser Gly Ile Asn Gly
                485                 490                 495

Pro Gly Ser Gly Ile Tyr Gly Pro Gly Val Phe Gly Pro Gly Ile Ser
            500                 505                 510

Ala Ala Ala Ala Ala Gly Ile Tyr Val Phe Gly Pro Gly Val Phe Gly
        515                 520                 525

Pro Tyr Gly Pro Gly Ala Ser Ala Ala Ala Ala Ala Gly Ile Tyr Gly
    530                 535                 540

Ser Gly Pro Gly Val Phe Gly Pro Tyr Gly Pro Gly Ile Ser Gly Ser
545                 550                 555                 560

Gly Val Phe Gly Pro Gly Val Phe Gly Pro Tyr Ala Ser Ala Ala Ala
                565                 570                 575
```

```
Ala Ala Gly Pro Gly Ser Gly Val Phe Gly Pro Gly Ala Ser Gly Pro
            580                 585                 590

Gly Val Phe Gly Pro Tyr Gly Pro Gly Ala Ser Ala Ala Ala Ala Ala
        595                 600                 605

Gly Ile Asn Gly Pro Gly Ser Gly Val Phe Gly Pro Gly Ile Ser Gly
    610                 615                 620

Ile Tyr Gly Pro Gly Val Phe Gly Pro Gly Val Phe Gly Pro Gly Ser
625                 630                 635                 640

Ser Ala Ala Ala Ala Ala Gly Pro Gly Ile Tyr Gly Pro Gly Val Phe
                645                 650                 655

Gly Pro Ser Ala Ser Ala Ala Ala Ala Ala Gly Pro Gly Ser Gly Val
            660                 665                 670

Phe Gly Pro Gly Ala Ser Gly Ile Tyr Gly Pro Gly Val Phe Gly Pro
        675                 680                 685

Gly Val Phe Gly Pro Gly Ser Ser Ala Ala Ala Ala Ala Gly Ile Tyr
    690                 695                 700

Gly Ser Gly Pro Gly Val Phe Gly Pro Tyr Gly Ser Ala Ala Ala Ala
705                 710                 715                 720

Ala Gly Pro Gly Ser Gly Ile Tyr Gly Ile Gly Pro Tyr Gly Pro Gly
                725                 730                 735

Ala Ser Gly Pro Gly Ile Tyr Gly Pro Gly Val Phe Gly Pro Ser Ala
            740                 745                 750

Ser Ala Ala Ala Ala Ala Gly Ser Gly Val Phe Gly Pro Gly Ile Tyr
        755                 760                 765

Gly Pro Tyr Ala Ser Ala Ala Ala Ala Ala Gly Ile Tyr Gly Ser Gly
    770                 775                 780

Pro Gly Val Phe Gly Pro Tyr Gly Pro Gly Ile Ser Gly Ser Gly Val
785                 790                 795                 800

Phe Gly Pro Gly Val Phe Gly Pro Tyr Ala Ser Ala Ala Ala Ala Ala
                805                 810                 815

Gly Pro Gly Val Phe Gly Pro Tyr Gly Pro Gly Ser Ser Ala Ala Ala
            820                 825                 830

Ala Ala Gly Ile Tyr Gly Tyr Gly Pro Gly Val Phe Gly Pro Tyr Gly
        835                 840                 845

Pro Gly Ala Ser Gly Ile Asn Gly Pro Gly Ser Gly Ile Tyr Gly Pro
    850                 855                 860

Gly Val Phe Gly Pro Gly Ile Ser Ala Ala Ala Ala Ala Gly Pro Gly
865                 870                 875                 880

Val Phe Gly Pro Tyr Gly Pro Gly Ala Ser Ala Ala Ala Ala Ala Gly
                885                 890                 895

Ile Tyr Gly Pro Gly Val Phe Gly Pro Gly Ile Tyr Gly Pro Gly Ser
            900                 905                 910

Ser Gly Pro Gly Val Phe Gly Pro Tyr Gly Pro Gly Ser Ser Ala Ala
        915                 920                 925

Ala Ala Ala Gly Ile Tyr Gly Pro Gly Val Phe Gly Pro Tyr Gly Pro
    930                 935                 940

Gly Ile Ser Ala Ala Ala Ala Ala Gly Ile Tyr Val Phe Gly Pro Gly
945                 950                 955                 960

Val Phe Gly Pro Tyr Gly Pro Gly Ala Ser Gly Pro Gly Val Phe Gly
                965                 970                 975

Pro Tyr Gly Pro Gly Ala Ser Ala Ala Ala Ala Ala Gly Pro Gly Ile
            980                 985                 990

Tyr Gly Pro Gly Val Phe Gly Pro  Ser Ala Ser Ala Ala  Ala Ala Ala
```

```
        995                 1000                1005

Gly Ile  Tyr Gly Ser Gly Pro  Gly Ile Tyr Gly Pro  Tyr Gly Pro
    1010                1015                1020

Gly Ile  Ser Gly Pro Gly Ser  Gly Val Phe Gly Ile  Gly Pro Tyr
    1025                1030                1035

Gly Pro  Gly Ala Ser Ala Ala  Ala Ala Ala Gly Ile  Tyr Gly Pro
    1040                1045                1050

Gly Val  Phe Gly Pro Tyr Gly  Pro Gly Ile Ser Ala  Ala Ala Ala
    1055                1060                1065

Ala Gly  Pro Gly Ser Gly Ile  Tyr Gly Pro Gly Ala  Ser Gly Ile
    1070                1075                1080

Asn Gly  Pro Gly Ser Gly Ile  Tyr Gly Pro Gly Val  Phe Gly Pro
    1085                1090                1095

Gly Ile  Ser Ala Ala Ala Ala  Ala Gly Ile Tyr Val  Phe Gly Pro
    1100                1105                1110

Gly Val  Phe Gly Pro Tyr Gly  Pro Gly Ala Ser Ala  Ala Ala Ala
    1115                1120                1125

Ala Gly  Ile Tyr Gly Ser Gly  Pro Gly Val Phe Gly  Pro Tyr Gly
    1130                1135                1140

Pro Gly  Ile Ser Gly Ser Gly  Val Phe Gly Pro Gly  Val Phe Gly
    1145                1150                1155

Pro Tyr  Ala Ser Ala Ala Ala  Ala Ala Gly Pro Gly  Ser Gly Val
    1160                1165                1170

Phe Gly  Pro Gly Ala Ser
    1175


<210> SEQ ID NO 33
<211> LENGTH: 601
<212> TYPE: PRT
<213> ORGANISM: Artificial Sequence
<220> FEATURE:
<223> OTHER INFORMATION: PRT888

<400> SEQUENCE: 33

Met His His His His His His Ser Ser Gly Ser Ser Gly Pro Gly Val
1               5                   10                  15

Leu Gly Pro Tyr Gly Pro Gly Ala Ser Ala Ala Ala Ala Ala Gly Gln
            20                  25                  30

Asn Gly Pro Gly Ser Gly Val Leu Gly Pro Gly Gln Ser Gly Gln Tyr
        35                  40                  45

Gly Pro Gly Val Leu Gly Pro Gly Val Leu Gly Pro Gly Ser Ser Ala
    50                  55                  60

Ala Ala Ala Ala Gly Pro Gly Gln Tyr Gly Pro Gly Val Leu Gly Pro
65                  70                  75                  80

Ser Ala Ser Ala Ala Ala Ala Ala Gly Pro Gly Ser Gly Val Leu Gly
                85                  90                  95

Pro Gly Ala Ser Gly Gln Tyr Gly Pro Gly Val Leu Gly Pro Gly Val
            100                 105                 110

Leu Gly Pro Gly Ser Ser Ala Ala Ala Ala Ala Gly Gln Tyr Gly Ser
        115                 120                 125

Gly Pro Gly Val Leu Gly Pro Tyr Gly Ser Ala Ala Ala Ala Ala Gly
    130                 135                 140

Pro Gly Ser Gly Gln Tyr Gly Gln Gly Pro Tyr Gly Pro Gly Ala Ser
145                 150                 155                 160

Gly Pro Gly Gln Tyr Gly Pro Gly Val Leu Gly Pro Ser Ala Ser Ala
```

```
                165                 170                 175

Ala Ala Ala Ala Gly Ser Gly Val Leu Gly Pro Gly Gln Tyr Gly Pro
            180                 185                 190

Tyr Ala Ser Ala Ala Ala Ala Ala Gly Gln Tyr Gly Ser Gly Pro Gly
        195                 200                 205

Val Leu Gly Pro Tyr Gly Pro Gly Gln Ser Gly Ser Gly Val Leu Gly
    210                 215                 220

Pro Gly Val Leu Gly Pro Tyr Ala Ser Ala Ala Ala Ala Ala Gly Pro
225                 230                 235                 240

Gly Val Leu Gly Pro Tyr Gly Pro Gly Ser Ser Ala Ala Ala Ala Ala
                245                 250                 255

Gly Gln Tyr Gly Tyr Gly Pro Gly Val Leu Gly Pro Tyr Gly Pro Gly
            260                 265                 270

Ala Ser Gly Gln Asn Gly Pro Gly Ser Gly Gln Tyr Gly Pro Gly Val
        275                 280                 285

Leu Gly Pro Gly Gln Ser Ala Ala Ala Ala Ala Gly Pro Gly Val Leu
    290                 295                 300

Gly Pro Tyr Gly Pro Gly Ala Ser Ala Ala Ala Ala Ala Gly Gln Tyr
305                 310                 315                 320

Gly Pro Gly Val Leu Gly Pro Gly Gln Tyr Gly Pro Gly Ser Ser Gly
                325                 330                 335

Pro Gly Val Leu Gly Pro Tyr Gly Pro Gly Ser Ser Ala Ala Ala Ala
            340                 345                 350

Ala Gly Gln Tyr Gly Pro Gly Val Leu Gly Pro Tyr Gly Pro Gly Gln
        355                 360                 365

Ser Ala Ala Ala Ala Ala Gly Gln Tyr Val Leu Gly Pro Gly Val Leu
    370                 375                 380

Gly Pro Tyr Gly Pro Gly Ala Ser Gly Pro Gly Val Leu Gly Pro Tyr
385                 390                 395                 400

Gly Pro Gly Ala Ser Ala Ala Ala Ala Ala Gly Pro Gly Gln Tyr Gly
                405                 410                 415

Pro Gly Val Leu Gly Pro Ser Ala Ser Ala Ala Ala Ala Ala Gly Gln
            420                 425                 430

Tyr Gly Ser Gly Pro Gly Gln Tyr Gly Pro Tyr Gly Pro Gly Gln Ser
        435                 440                 445

Gly Pro Gly Ser Gly Val Leu Gly Gln Gly Pro Tyr Gly Pro Gly Ala
    450                 455                 460

Ser Ala Ala Ala Ala Ala Gly Gln Tyr Gly Pro Gly Val Leu Gly Pro
465                 470                 475                 480

Tyr Gly Pro Gly Gln Ser Ala Ala Ala Ala Ala Gly Pro Gly Ser Gly
                485                 490                 495

Gln Tyr Gly Pro Gly Ala Ser Gly Gln Asn Gly Pro Gly Ser Gly Gln
            500                 505                 510

Tyr Gly Pro Gly Val Leu Gly Pro Gly Gln Ser Ala Ala Ala Ala Ala
        515                 520                 525

Gly Gln Tyr Val Leu Gly Pro Gly Val Leu Gly Pro Tyr Gly Pro Gly
    530                 535                 540

Ala Ser Ala Ala Ala Ala Ala Gly Gln Tyr Gly Ser Gly Pro Gly Val
545                 550                 555                 560

Leu Gly Pro Tyr Gly Pro Gly Gln Ser Gly Ser Gly Val Leu Gly Pro
                565                 570                 575

Gly Val Leu Gly Pro Tyr Ala Ser Ala Ala Ala Ala Ala Gly Pro Gly
            580                 585                 590
```

```
Ser Gly Val Leu Gly Pro Gly Ala Ser
        595                 600


<210> SEQ ID NO 34
<211> LENGTH: 601
<212> TYPE: PRT
<213> ORGANISM: Artificial Sequence
<220> FEATURE:
<223> OTHER INFORMATION: PRT965

<400> SEQUENCE: 34

Met His His His His His His Ser Ser Gly Ser Ser Gly Pro Gly Thr
1               5                   10                  15

Ser Gly Pro Tyr Gly Pro Gly Ala Ser Ala Ala Ala Ala Ala Gly Ala
            20                  25                  30

Asn Gly Pro Gly Ser Gly Thr Ser Gly Pro Gly Ala Ser Gly Ala Tyr
        35                  40                  45

Gly Pro Gly Thr Ser Gly Pro Gly Thr Ser Gly Pro Gly Ser Ser Ala
    50                  55                  60

Ala Ala Ala Ala Gly Pro Gly Ala Tyr Gly Pro Gly Thr Ser Gly Pro
65                  70                  75                  80

Ser Ala Ser Ala Ala Ala Ala Ala Gly Pro Gly Ser Gly Thr Ser Gly
                85                  90                  95

Pro Gly Ala Ser Gly Ala Tyr Gly Pro Gly Thr Ser Gly Pro Gly Thr
            100                 105                 110

Ser Gly Pro Gly Ser Ser Ala Ala Ala Ala Ala Gly Ala Tyr Gly Ser
        115                 120                 125

Gly Pro Gly Thr Ser Gly Pro Tyr Gly Ser Ala Ala Ala Ala Ala Gly
    130                 135                 140

Pro Gly Ser Gly Ala Tyr Gly Ala Gly Pro Tyr Gly Pro Gly Ala Ser
145                 150                 155                 160

Gly Pro Gly Ala Tyr Gly Pro Gly Thr Ser Gly Pro Ser Ala Ser Ala
                165                 170                 175

Ala Ala Ala Ala Gly Ser Gly Thr Ser Gly Pro Gly Ala Tyr Gly Pro
            180                 185                 190

Tyr Ala Ser Ala Ala Ala Ala Ala Gly Ala Tyr Gly Ser Gly Pro Gly
        195                 200                 205

Thr Ser Gly Pro Tyr Gly Pro Gly Ala Ser Gly Ser Gly Thr Ser Gly
    210                 215                 220

Pro Gly Thr Ser Gly Pro Tyr Ala Ser Ala Ala Ala Ala Ala Gly Pro
225                 230                 235                 240

Gly Thr Ser Gly Pro Tyr Gly Pro Gly Ser Ser Ala Ala Ala Ala Ala
                245                 250                 255

Gly Ala Tyr Gly Tyr Gly Pro Gly Thr Ser Gly Pro Tyr Gly Pro Gly
            260                 265                 270

Ala Ser Gly Ala Asn Gly Pro Gly Ser Gly Ala Tyr Gly Pro Gly Thr
        275                 280                 285

Ser Gly Pro Gly Ala Ser Ala Ala Ala Ala Ala Gly Pro Gly Thr Ser
    290                 295                 300

Gly Pro Tyr Gly Pro Gly Ala Ser Ala Ala Ala Ala Ala Gly Ala Tyr
305                 310                 315                 320

Gly Pro Gly Thr Ser Gly Pro Gly Ala Tyr Gly Pro Gly Ser Ser Gly
                325                 330                 335

Pro Gly Thr Ser Gly Pro Tyr Gly Pro Gly Ser Ser Ala Ala Ala Ala
            340                 345                 350
```

```
Ala Gly Ala Tyr Gly Pro Gly Thr Ser Gly Pro Tyr Gly Pro Gly Ala
        355                 360                 365

Ser Ala Ala Ala Ala Ala Gly Ala Tyr Thr Ser Gly Pro Gly Thr Ser
    370                 375                 380

Gly Pro Tyr Gly Pro Gly Ala Ser Gly Pro Gly Thr Ser Gly Pro Tyr
385                 390                 395                 400

Gly Pro Gly Ala Ser Ala Ala Ala Ala Ala Gly Pro Gly Ala Tyr Gly
                405                 410                 415

Pro Gly Thr Ser Gly Pro Ser Ala Ser Ala Ala Ala Ala Ala Gly Ala
            420                 425                 430

Tyr Gly Ser Gly Pro Gly Ala Tyr Gly Pro Tyr Gly Pro Gly Ala Ser
        435                 440                 445

Gly Pro Gly Ser Gly Thr Ser Gly Ala Gly Pro Tyr Gly Pro Gly Ala
    450                 455                 460

Ser Ala Ala Ala Ala Ala Gly Ala Tyr Gly Pro Gly Thr Ser Gly Pro
465                 470                 475                 480

Tyr Gly Pro Gly Ala Ser Ala Ala Ala Ala Ala Gly Pro Gly Ser Gly
                485                 490                 495

Ala Tyr Gly Pro Gly Ala Ser Gly Ala Asn Gly Pro Gly Ser Gly Ala
            500                 505                 510

Tyr Gly Pro Gly Thr Ser Gly Pro Gly Ala Ser Ala Ala Ala Ala Ala
        515                 520                 525

Gly Ala Tyr Thr Ser Gly Pro Gly Thr Ser Gly Pro Tyr Gly Pro Gly
    530                 535                 540

Ala Ser Ala Ala Ala Ala Ala Gly Ala Tyr Gly Ser Gly Pro Gly Thr
545                 550                 555                 560

Ser Gly Pro Tyr Gly Pro Gly Ala Ser Gly Ser Gly Thr Ser Gly Pro
                565                 570                 575

Gly Thr Ser Gly Pro Tyr Ala Ser Ala Ala Ala Ala Ala Gly Pro Gly
            580                 585                 590

Ser Gly Thr Ser Gly Pro Gly Ala Ser
        595                 600


<210> SEQ ID NO 35
<211> LENGTH: 601
<212> TYPE: PRT
<213> ORGANISM: Artificial Sequence
<220> FEATURE:
<223> OTHER INFORMATION: PRT889

<400> SEQUENCE: 35

Met His His His His His His Ser Ser Gly Ser Ser Gly Pro Gly Val
1               5                   10                  15

Leu Gly Pro Tyr Gly Pro Gly Ala Ser Ala Ala Ala Ala Ala Gly Ile
            20                  25                  30

Asn Gly Pro Gly Ser Gly Val Leu Gly Pro Gly Ile Ser Gly Ile Tyr
        35                  40                  45

Gly Pro Gly Val Leu Gly Pro Gly Val Leu Gly Pro Gly Ser Ser Ala
    50                  55                  60

Ala Ala Ala Ala Gly Pro Gly Ile Tyr Gly Pro Gly Val Leu Gly Pro
65                  70                  75                  80

Ser Ala Ser Ala Ala Ala Ala Ala Gly Pro Gly Ser Gly Val Leu Gly
                85                  90                  95

Pro Gly Ala Ser Gly Ile Tyr Gly Pro Gly Val Leu Gly Pro Gly Val
            100                 105                 110
```

```
Leu Gly Pro Gly Ser Ser Ala Ala Ala Ala Ala Gly Ile Tyr Gly Ser
        115                 120                 125

Gly Pro Gly Val Leu Gly Pro Tyr Gly Ser Ala Ala Ala Ala Ala Gly
    130                 135                 140

Pro Gly Ser Gly Ile Tyr Gly Ile Gly Pro Tyr Gly Pro Gly Ala Ser
145                 150                 155                 160

Gly Pro Gly Ile Tyr Gly Pro Gly Val Leu Gly Pro Ser Ala Ser Ala
                165                 170                 175

Ala Ala Ala Ala Gly Ser Gly Val Leu Gly Pro Gly Ile Tyr Gly Pro
            180                 185                 190

Tyr Ala Ser Ala Ala Ala Ala Ala Gly Ile Tyr Gly Ser Gly Pro Gly
        195                 200                 205

Val Leu Gly Pro Tyr Gly Pro Gly Ile Ser Gly Ser Gly Val Leu Gly
    210                 215                 220

Pro Gly Val Leu Gly Pro Tyr Ala Ser Ala Ala Ala Ala Ala Gly Pro
225                 230                 235                 240

Gly Val Leu Gly Pro Tyr Gly Pro Gly Ser Ser Ala Ala Ala Ala Ala
                245                 250                 255

Gly Ile Tyr Gly Tyr Gly Pro Gly Val Leu Gly Pro Tyr Gly Pro Gly
            260                 265                 270

Ala Ser Gly Ile Asn Gly Pro Gly Ser Gly Ile Tyr Gly Pro Gly Val
        275                 280                 285

Leu Gly Pro Gly Ile Ser Ala Ala Ala Ala Ala Gly Pro Gly Val Leu
    290                 295                 300

Gly Pro Tyr Gly Pro Gly Ala Ser Ala Ala Ala Ala Ala Gly Ile Tyr
305                 310                 315                 320

Gly Pro Gly Val Leu Gly Pro Gly Ile Tyr Gly Pro Gly Ser Ser Gly
                325                 330                 335

Pro Gly Val Leu Gly Pro Tyr Gly Pro Gly Ser Ser Ala Ala Ala Ala
            340                 345                 350

Ala Gly Ile Tyr Gly Pro Gly Val Leu Gly Pro Tyr Gly Pro Gly Ile
        355                 360                 365

Ser Ala Ala Ala Ala Ala Gly Ile Tyr Val Leu Gly Pro Gly Val Leu
    370                 375                 380

Gly Pro Tyr Gly Pro Gly Ala Ser Gly Pro Gly Val Leu Gly Pro Tyr
385                 390                 395                 400

Gly Pro Gly Ala Ser Ala Ala Ala Ala Ala Gly Pro Gly Ile Tyr Gly
                405                 410                 415

Pro Gly Val Leu Gly Pro Ser Ala Ser Ala Ala Ala Ala Ala Gly Ile
            420                 425                 430

Tyr Gly Ser Gly Pro Gly Ile Tyr Gly Pro Tyr Gly Pro Gly Ile Ser
        435                 440                 445

Gly Pro Gly Ser Gly Val Leu Gly Ile Gly Pro Tyr Gly Pro Gly Ala
    450                 455                 460

Ser Ala Ala Ala Ala Ala Gly Ile Tyr Gly Pro Gly Val Leu Gly Pro
465                 470                 475                 480

Tyr Gly Pro Gly Ile Ser Ala Ala Ala Ala Ala Gly Pro Gly Ser Gly
                485                 490                 495

Ile Tyr Gly Pro Gly Ala Ser Gly Ile Asn Gly Pro Gly Ser Gly Ile
            500                 505                 510

Tyr Gly Pro Gly Val Leu Gly Pro Gly Ile Ser Ala Ala Ala Ala Ala
        515                 520                 525
```

```
Gly Ile Tyr Val Leu Gly Pro Gly Val Leu Gly Pro Tyr Gly Pro Gly
    530                 535                 540

Ala Ser Ala Ala Ala Ala Ala Gly Ile Tyr Gly Ser Gly Pro Gly Val
545                 550                 555                 560

Leu Gly Pro Tyr Gly Pro Gly Ile Ser Gly Ser Gly Val Leu Gly Pro
                565                 570                 575

Gly Val Leu Gly Pro Tyr Ala Ser Ala Ala Ala Ala Ala Gly Pro Gly
            580                 585                 590

Ser Gly Val Leu Gly Pro Gly Ala Ser
        595                 600


<210> SEQ ID NO 36
<211> LENGTH: 601
<212> TYPE: PRT
<213> ORGANISM: Artificial Sequence
<220> FEATURE:
<223> OTHER INFORMATION: PRT916

<400> SEQUENCE: 36

Met His His His His His His Ser Ser Gly Ser Ser Gly Pro Gly Val
1               5                   10                  15

Ile Gly Pro Tyr Gly Pro Gly Ala Ser Ala Ala Ala Ala Ala Gly Leu
            20                  25                  30

Asn Gly Pro Gly Ser Gly Val Ile Gly Pro Gly Leu Ser Gly Leu Tyr
        35                  40                  45

Gly Pro Gly Val Ile Gly Pro Gly Val Ile Gly Pro Gly Ser Ser Ala
    50                  55                  60

Ala Ala Ala Ala Gly Pro Gly Leu Tyr Gly Pro Gly Val Ile Gly Pro
65                  70                  75                  80

Ser Ala Ser Ala Ala Ala Ala Ala Gly Pro Gly Ser Gly Val Ile Gly
                85                  90                  95

Pro Gly Ala Ser Gly Leu Tyr Gly Pro Gly Val Ile Gly Pro Gly Val
            100                 105                 110

Ile Gly Pro Gly Ser Ser Ala Ala Ala Ala Ala Gly Leu Tyr Gly Ser
        115                 120                 125

Gly Pro Gly Val Ile Gly Pro Tyr Gly Ser Ala Ala Ala Ala Ala Gly
    130                 135                 140

Pro Gly Ser Gly Leu Tyr Gly Leu Gly Pro Tyr Gly Pro Gly Ala Ser
145                 150                 155                 160

Gly Pro Gly Leu Tyr Gly Pro Gly Val Ile Gly Pro Ser Ala Ser Ala
                165                 170                 175

Ala Ala Ala Ala Gly Ser Gly Val Ile Gly Pro Gly Leu Tyr Gly Pro
            180                 185                 190

Tyr Ala Ser Ala Ala Ala Ala Ala Gly Leu Tyr Gly Ser Gly Pro Gly
        195                 200                 205

Val Ile Gly Pro Tyr Gly Pro Gly Leu Ser Gly Ser Gly Val Ile Gly
    210                 215                 220

Pro Gly Val Ile Gly Pro Tyr Ala Ser Ala Ala Ala Ala Ala Gly Pro
225                 230                 235                 240

Gly Val Ile Gly Pro Tyr Gly Pro Gly Ser Ser Ala Ala Ala Ala Ala
                245                 250                 255

Gly Leu Tyr Gly Tyr Gly Pro Gly Val Ile Gly Pro Tyr Gly Pro Gly
            260                 265                 270

Ala Ser Gly Leu Asn Gly Pro Gly Ser Gly Leu Tyr Gly Pro Gly Val
        275                 280                 285
```

```
Ile Gly Pro Gly Leu Ser Ala Ala Ala Ala Ala Gly Pro Gly Val Ile
    290                 295                 300

Gly Pro Tyr Gly Pro Gly Ala Ser Ala Ala Ala Ala Ala Gly Leu Tyr
305                 310                 315                 320

Gly Pro Gly Val Ile Gly Pro Gly Leu Tyr Gly Pro Gly Ser Ser Gly
                325                 330                 335

Pro Gly Val Ile Gly Pro Tyr Gly Pro Gly Ser Ser Ala Ala Ala Ala
            340                 345                 350

Ala Gly Leu Tyr Gly Pro Gly Val Ile Gly Pro Tyr Gly Pro Gly Leu
        355                 360                 365

Ser Ala Ala Ala Ala Ala Gly Leu Tyr Val Ile Gly Pro Gly Val Ile
    370                 375                 380

Gly Pro Tyr Gly Pro Gly Ala Ser Gly Pro Gly Val Ile Gly Pro Tyr
385                 390                 395                 400

Gly Pro Gly Ala Ser Ala Ala Ala Ala Ala Gly Pro Gly Leu Tyr Gly
                405                 410                 415

Pro Gly Val Ile Gly Pro Ser Ala Ser Ala Ala Ala Ala Ala Gly Leu
            420                 425                 430

Tyr Gly Ser Gly Pro Gly Leu Tyr Gly Pro Tyr Gly Pro Gly Leu Ser
        435                 440                 445

Gly Pro Gly Ser Gly Val Ile Gly Leu Gly Pro Tyr Gly Pro Gly Ala
    450                 455                 460

Ser Ala Ala Ala Ala Ala Gly Leu Tyr Gly Pro Gly Val Ile Gly Pro
465                 470                 475                 480

Tyr Gly Pro Gly Leu Ser Ala Ala Ala Ala Ala Gly Pro Gly Ser Gly
                485                 490                 495

Leu Tyr Gly Pro Gly Ala Ser Gly Leu Asn Gly Pro Gly Ser Gly Leu
            500                 505                 510

Tyr Gly Pro Gly Val Ile Gly Pro Gly Leu Ser Ala Ala Ala Ala Ala
        515                 520                 525

Gly Leu Tyr Val Ile Gly Pro Gly Val Ile Gly Pro Tyr Gly Pro Gly
    530                 535                 540

Ala Ser Ala Ala Ala Ala Ala Gly Leu Tyr Gly Ser Gly Pro Gly Val
545                 550                 555                 560

Ile Gly Pro Tyr Gly Pro Gly Leu Ser Gly Ser Gly Val Ile Gly Pro
                565                 570                 575

Gly Val Ile Gly Pro Tyr Ala Ser Ala Ala Ala Ala Ala Gly Pro Gly
            580                 585                 590

Ser Gly Val Ile Gly Pro Gly Ala Ser
        595                 600


<210> SEQ ID NO 37
<211> LENGTH: 601
<212> TYPE: PRT
<213> ORGANISM: Artificial Sequence
<220> FEATURE:
<223> OTHER INFORMATION: PRT918

<400> SEQUENCE: 37

Met His His His His His His Ser Ser Gly Ser Ser Gly Pro Gly Val
1               5                   10                  15

Phe Gly Pro Tyr Gly Pro Gly Ala Ser Ala Ala Ala Ala Ala Gly Ile
            20                  25                  30

Asn Gly Pro Gly Ser Gly Val Phe Gly Pro Gly Ile Ser Gly Ile Tyr
        35                  40                  45
```

```
Gly Pro Gly Val Phe Gly Pro Gly Val Phe Gly Pro Gly Ser Ser Ala
    50                  55                  60

Ala Ala Ala Ala Gly Pro Gly Ile Tyr Gly Pro Gly Val Phe Gly Pro
65                  70                  75                  80

Ser Ala Ser Ala Ala Ala Ala Ala Gly Pro Gly Ser Gly Val Phe Gly
                85                  90                  95

Pro Gly Ala Ser Gly Ile Tyr Gly Pro Gly Val Phe Gly Pro Gly Val
            100                 105                 110

Phe Gly Pro Gly Ser Ser Ala Ala Ala Ala Ala Gly Ile Tyr Gly Ser
        115                 120                 125

Gly Pro Gly Val Phe Gly Pro Tyr Gly Ser Ala Ala Ala Ala Ala Gly
    130                 135                 140

Pro Gly Ser Gly Ile Tyr Gly Ile Gly Pro Tyr Gly Pro Gly Ala Ser
145                 150                 155                 160

Gly Pro Gly Ile Tyr Gly Pro Gly Val Phe Gly Pro Ser Ala Ser Ala
                165                 170                 175

Ala Ala Ala Ala Gly Ser Gly Val Phe Gly Pro Gly Ile Tyr Gly Pro
            180                 185                 190

Tyr Ala Ser Ala Ala Ala Ala Ala Gly Ile Tyr Gly Ser Gly Pro Gly
        195                 200                 205

Val Phe Gly Pro Tyr Gly Pro Gly Ile Ser Gly Ser Gly Val Phe Gly
    210                 215                 220

Pro Gly Val Phe Gly Pro Tyr Ala Ser Ala Ala Ala Ala Ala Gly Pro
225                 230                 235                 240

Gly Val Phe Gly Pro Tyr Gly Pro Gly Ser Ser Ala Ala Ala Ala Ala
                245                 250                 255

Gly Ile Tyr Gly Tyr Gly Pro Gly Val Phe Gly Pro Tyr Gly Pro Gly
            260                 265                 270

Ala Ser Gly Ile Asn Gly Pro Gly Ser Gly Ile Tyr Gly Pro Gly Val
        275                 280                 285

Phe Gly Pro Gly Ile Ser Ala Ala Ala Ala Ala Gly Pro Gly Val Phe
    290                 295                 300

Gly Pro Tyr Gly Pro Gly Ala Ser Ala Ala Ala Ala Ala Gly Ile Tyr
305                 310                 315                 320

Gly Pro Gly Val Phe Gly Pro Gly Ile Tyr Gly Pro Gly Ser Ser Gly
                325                 330                 335

Pro Gly Val Phe Gly Pro Tyr Gly Pro Gly Ser Ser Ala Ala Ala Ala
            340                 345                 350

Ala Gly Ile Tyr Gly Pro Gly Val Phe Gly Pro Tyr Gly Pro Gly Ile
        355                 360                 365

Ser Ala Ala Ala Ala Ala Gly Ile Tyr Val Phe Gly Pro Gly Val Phe
    370                 375                 380

Gly Pro Tyr Gly Pro Gly Ala Ser Gly Pro Gly Val Phe Gly Pro Tyr
385                 390                 395                 400

Gly Pro Gly Ala Ser Ala Ala Ala Ala Ala Gly Pro Gly Ile Tyr Gly
                405                 410                 415

Pro Gly Val Phe Gly Pro Ser Ala Ser Ala Ala Ala Ala Ala Gly Ile
            420                 425                 430

Tyr Gly Ser Gly Pro Gly Ile Tyr Gly Pro Tyr Gly Pro Gly Ile Ser
        435                 440                 445

Gly Pro Gly Ser Gly Val Phe Gly Ile Gly Pro Tyr Gly Pro Gly Ala
    450                 455                 460

Ser Ala Ala Ala Ala Ala Gly Ile Tyr Gly Pro Gly Val Phe Gly Pro
```

465 470 475 480

Tyr Gly Pro Gly Ile Ser Ala Ala Ala Ala Ala Gly Pro Gly Ser Gly
485 490 495

Ile Tyr Gly Pro Gly Ala Ser Gly Ile Asn Gly Pro Gly Ser Gly Ile
500 505 510

Tyr Gly Pro Gly Val Phe Gly Pro Gly Ile Ser Ala Ala Ala Ala Ala
515 520 525

Gly Ile Tyr Val Phe Gly Pro Gly Val Phe Gly Pro Tyr Gly Pro Gly
530 535 540

Ala Ser Ala Ala Ala Ala Ala Gly Ile Tyr Gly Ser Gly Pro Gly Val
545 550 555 560

Phe Gly Pro Tyr Gly Pro Gly Ile Ser Gly Ser Gly Val Phe Gly Pro
565 570 575

Gly Val Phe Gly Pro Tyr Ala Ser Ala Ala Ala Ala Ala Gly Pro Gly
580 585 590

Ser Gly Val Phe Gly Pro Gly Ala Ser
595 600

<210> SEQ ID NO 38
<211> LENGTH: 576
<212> TYPE: PRT
<213> ORGANISM: Artificial Sequence
<220> FEATURE:
<223> OTHER INFORMATION: PRT699

<400> SEQUENCE: 38

Met His His His His His His Ser Ser Gly Ser Ser Gly Pro Gly Val
1 5 10 15

Leu Gly Pro Tyr Gly Pro Gly Ala Ser Ala Ala Ala Ala Ala Ala Ala
20 25 30

Gly Ser Asn Gly Pro Gly Ser Gly Val Leu Gly Pro Gly Gln Ser Gly
35 40 45

Gln Tyr Gly Pro Gly Val Leu Gly Pro Gly Val Leu Gly Pro Gly Ser
50 55 60

Ser Ala Ala Ala Ala Ala Ala Ala Gly Pro Gly Gln Tyr Gly Pro Gly
65 70 75 80

Val Leu Gly Pro Ser Ala Ser Ala Ala Ala Ala Ala Ala Ala Gly Pro
85 90 95

Gly Ser Gly Val Leu Gly Pro Gly Ala Ser Gly Gln Tyr Gly Pro Gly
100 105 110

Val Leu Gly Pro Gly Val Leu Gly Pro Gly Ser Ser Ala Ala Ala Ala
115 120 125

Ala Ala Ala Gly Ser Tyr Gly Ser Gly Pro Gly Val Leu Gly Pro Tyr
130 135 140

Gly Ser Ala Ala Ala Ala Ala Ala Ala Gly Pro Gly Ser Gly Gln Tyr
145 150 155 160

Gly Gln Gly Pro Tyr Gly Pro Gly Ala Ser Gly Pro Gly Gln Tyr Gly
165 170 175

Pro Gly Val Leu Gly Pro Ser Ala Ser Ala Ala Ala Ala Ala Ala Ala
180 185 190

Gly Ser Gly Val Leu Gly Pro Gly Gln Tyr Gly Pro Tyr Ala Ser Ala
195 200 205

Ala Ala Ala Ala Ala Ala Gly Ser Tyr Gly Ser Gly Pro Gly Val Leu
210 215 220

Gly Pro Tyr Gly Pro Gly Gln Ser Gly Ser Gly Val Leu Gly Pro Gly

```
225                 230                 235                 240

Val Leu Gly Pro Tyr Ala Ser Ala Ala Ala Ala Ala Ala Ala Gly Pro
                245                 250                 255

Gly Val Leu Gly Pro Tyr Gly Pro Gly Ser Ser Ala Ala Ala Ala Ala
            260                 265                 270

Ala Ala Gly Ser Tyr Gly Tyr Gly Pro Gly Val Leu Gly Pro Tyr Gly
        275                 280                 285

Pro Gly Ala Ser Gly Gln Asn Gly Pro Gly Ser Gly Gln Tyr Gly Pro
    290                 295                 300

Gly Val Leu Gly Pro Gly Pro Ser Ala Ala Ala Ala Ala Ala Ala Gly
305                 310                 315                 320

Pro Gly Val Leu Gly Pro Tyr Gly Pro Gly Ala Ser Ala Ala Ala Ala
                325                 330                 335

Ala Ala Ala Gly Ser Tyr Gly Pro Gly Val Leu Gly Pro Gly Gln Tyr
            340                 345                 350

Gly Pro Gly Ser Ser Gly Pro Gly Val Leu Gly Pro Tyr Gly Pro Gly
        355                 360                 365

Ser Ser Ala Ala Ala Ala Ala Ala Ala Gly Ser Tyr Gly Pro Gly Val
    370                 375                 380

Leu Gly Pro Tyr Gly Pro Gly Pro Ser Ala Ala Ala Ala Ala Ala Ala
385                 390                 395                 400

Gly Ser Tyr Val Leu Gly Pro Gly Val Leu Gly Pro Tyr Gly Pro Gly
                405                 410                 415

Ala Ser Gly Pro Gly Val Leu Gly Pro Tyr Gly Pro Gly Ala Ser Ala
            420                 425                 430

Ala Ala Ala Ala Ala Ala Gly Pro Gly Gln Tyr Gly Pro Gly Val Leu
        435                 440                 445

Gly Pro Ser Ala Ser Ala Ala Ala Ala Ala Ala Ala Gly Ser Tyr Gly
    450                 455                 460

Ser Gly Pro Gly Gln Tyr Gly Pro Tyr Gly Pro Gly Gln Ser Gly Pro
465                 470                 475                 480

Gly Ser Gly Val Leu Gly Gln Gly Pro Tyr Gly Pro Gly Ala Ser Ala
                485                 490                 495

Ala Ala Ala Ala Ala Ala Gly Ser Tyr Gly Pro Gly Val Leu Gly Pro
            500                 505                 510

Tyr Gly Pro Gly Pro Ser Ala Ala Ala Ala Ala Ala Ala Gly Pro Gly
        515                 520                 525

Ser Gly Gln Tyr Gly Pro Gly Ala Ser Gly Gln Asn Gly Pro Gly Ser
    530                 535                 540

Gly Gln Tyr Gly Pro Gly Val Leu Gly Pro Gly Pro Ser Ala Ala Ala
545                 550                 555                 560

Ala Ala Ala Ala Gly Pro Gly Ser Gly Val Leu Gly Pro Gly Ala Ser
                565                 570                 575


<210> SEQ ID NO 39
<211> LENGTH: 576
<212> TYPE: PRT
<213> ORGANISM: Artificial Sequence
<220> FEATURE:
<223> OTHER INFORMATION: PRT698

<400> SEQUENCE: 39

Met His His His His His His Ser Ser Gly Ser Ser Gly Pro Gly Val
1               5                   10                  15

Leu Gly Pro Tyr Gly Pro Gly Ala Ser Ala Ala Ala Ala Ala Ala Ala
```

```
            20                  25                  30

Gly Ser Asn Gly Pro Gly Ser Gly Val Leu Gly Pro Gly Ile Ser Gly
        35                  40                  45

Ile Tyr Gly Pro Gly Val Leu Gly Pro Gly Val Leu Gly Pro Gly Ser
    50                  55                  60

Ser Ala Ala Ala Ala Ala Ala Ala Gly Pro Gly Ile Tyr Gly Pro Gly
65                  70                  75                  80

Val Leu Gly Pro Ser Ala Ser Ala Ala Ala Ala Ala Ala Ala Gly Pro
                85                  90                  95

Gly Ser Gly Val Leu Gly Pro Gly Ala Ser Gly Ile Tyr Gly Pro Gly
            100                 105                 110

Val Leu Gly Pro Gly Val Leu Gly Pro Gly Ser Ser Ala Ala Ala Ala
        115                 120                 125

Ala Ala Ala Gly Ser Tyr Gly Ser Gly Pro Gly Val Leu Gly Pro Tyr
    130                 135                 140

Gly Ser Ala Ala Ala Ala Ala Ala Ala Gly Pro Gly Ser Gly Ile Tyr
145                 150                 155                 160

Gly Ile Gly Pro Tyr Gly Pro Gly Ala Ser Gly Pro Gly Ile Tyr Gly
                165                 170                 175

Pro Gly Val Leu Gly Pro Ser Ala Ser Ala Ala Ala Ala Ala Ala Ala
            180                 185                 190

Gly Ser Gly Val Leu Gly Pro Gly Ile Tyr Gly Pro Tyr Ala Ser Ala
        195                 200                 205

Ala Ala Ala Ala Ala Ala Gly Ser Tyr Gly Ser Gly Pro Gly Val Leu
    210                 215                 220

Gly Pro Tyr Gly Pro Gly Ile Ser Gly Ser Gly Val Leu Gly Pro Gly
225                 230                 235                 240

Val Leu Gly Pro Tyr Ala Ser Ala Ala Ala Ala Ala Ala Ala Gly Pro
                245                 250                 255

Gly Val Leu Gly Pro Tyr Gly Pro Gly Ser Ser Ala Ala Ala Ala Ala
            260                 265                 270

Ala Ala Gly Ser Tyr Gly Tyr Gly Pro Gly Val Leu Gly Pro Tyr Gly
        275                 280                 285

Pro Gly Ala Ser Gly Ile Asn Gly Pro Gly Ser Gly Ile Tyr Gly Pro
    290                 295                 300

Gly Val Leu Gly Pro Gly Pro Ser Ala Ala Ala Ala Ala Ala Ala Gly
305                 310                 315                 320

Pro Gly Val Leu Gly Pro Tyr Gly Pro Gly Ala Ser Ala Ala Ala Ala
                325                 330                 335

Ala Ala Ala Gly Ser Tyr Gly Pro Gly Val Leu Gly Pro Gly Ile Tyr
            340                 345                 350

Gly Pro Gly Ser Ser Gly Pro Gly Val Leu Gly Pro Tyr Gly Pro Gly
        355                 360                 365

Ser Ser Ala Ala Ala Ala Ala Ala Ala Gly Ser Tyr Gly Pro Gly Val
    370                 375                 380

Leu Gly Pro Tyr Gly Pro Gly Pro Ser Ala Ala Ala Ala Ala Ala Ala
385                 390                 395                 400

Gly Ser Tyr Val Leu Gly Pro Gly Val Leu Gly Pro Tyr Gly Pro Gly
                405                 410                 415

Ala Ser Gly Pro Gly Val Leu Gly Pro Tyr Gly Pro Gly Ala Ser Ala
            420                 425                 430

Ala Ala Ala Ala Ala Ala Gly Pro Gly Ile Tyr Gly Pro Gly Val Leu
        435                 440                 445
```

```
Gly Pro Ser Ala Ser Ala Ala Ala Ala Ala Ala Ala Gly Ser Tyr Gly
    450                 455                 460

Ser Gly Pro Gly Ile Tyr Gly Pro Tyr Gly Pro Gly Ile Ser Gly Pro
465                 470                 475                 480

Gly Ser Gly Val Leu Gly Ile Gly Pro Tyr Gly Pro Gly Ala Ser Ala
                485                 490                 495

Ala Ala Ala Ala Ala Ala Gly Ser Tyr Gly Pro Gly Val Leu Gly Pro
            500                 505                 510

Tyr Gly Pro Gly Pro Ser Ala Ala Ala Ala Ala Ala Ala Gly Pro Gly
        515                 520                 525

Ser Gly Ile Tyr Gly Pro Gly Ala Ser Gly Ile Asn Gly Pro Gly Ser
    530                 535                 540

Gly Ile Tyr Gly Pro Gly Val Leu Gly Pro Gly Pro Ser Ala Ala Ala
545                 550                 555                 560

Ala Ala Ala Ala Gly Pro Gly Ser Gly Val Leu Gly Pro Gly Ala Ser
                565                 570                 575


<210> SEQ ID NO 40
<211> LENGTH: 1190
<212> TYPE: PRT
<213> ORGANISM: Artificial Sequence
<220> FEATURE:
<223> OTHER INFORMATION: PRT966

<400> SEQUENCE: 40

Met His His His His His His Ser Ser Gly Ser Ser Gly Pro Gly Val
1               5                   10                  15

Phe Gly Pro Tyr Gly Pro Gly Ala Ser Ala Ala Ala Ala Ala Gly Ile
            20                  25                  30

Asn Gly Pro Gly Ser Gly Val Phe Gly Pro Gly Ile Ser Gly Ile Tyr
        35                  40                  45

Gly Pro Gly Val Phe Gly Pro Gly Val Phe Gly Pro Gly Ser Ser Ala
    50                  55                  60

Ala Ala Ala Ala Gly Pro Gly Ile Tyr Gly Pro Gly Val Phe Gly Pro
65                  70                  75                  80

Ser Ala Ser Ala Ala Ala Ala Ala Gly Pro Gly Ser Gly Val Phe Gly
                85                  90                  95

Pro Gly Ala Ser Gly Ile Tyr Gly Pro Gly Val Phe Gly Pro Gly Val
            100                 105                 110

Phe Gly Pro Gly Ser Ser Ala Ala Ala Ala Ala Gly Ile Tyr Gly Ser
        115                 120                 125

Gly Pro Gly Val Phe Gly Pro Tyr Gly Ser Ala Ala Ala Ala Ala Gly
    130                 135                 140

Pro Gly Ser Gly Ile Tyr Gly Ile Gly Pro Tyr Gly Pro Gly Ala Ser
145                 150                 155                 160

Gly Pro Gly Ile Tyr Gly Pro Gly Val Phe Gly Pro Ser Ala Ser Ala
                165                 170                 175

Ala Ala Ala Ala Gly Ser Gly Val Phe Gly Pro Gly Ile Tyr Gly Pro
            180                 185                 190

Tyr Ala Ser Ala Ala Ala Ala Ala Gly Ile Tyr Gly Ser Gly Pro Gly
        195                 200                 205

Val Phe Gly Pro Tyr Gly Pro Gly Ile Ser Gly Ser Gly Val Phe Gly
    210                 215                 220

Pro Gly Val Phe Gly Pro Tyr Ala Ser Ala Ala Ala Ala Ala Gly Pro
225                 230                 235                 240
```

```
Gly Val Phe Gly Pro Tyr Gly Pro Gly Ser Ser Ala Ala Ala Ala Ala
                245                 250                 255

Gly Ile Tyr Gly Tyr Gly Pro Gly Val Phe Gly Pro Tyr Gly Pro Gly
            260                 265                 270

Ala Ser Gly Ile Asn Gly Pro Gly Ser Gly Ile Tyr Gly Pro Gly Val
        275                 280                 285

Phe Gly Pro Gly Ile Ser Ala Ala Ala Ala Ala Gly Pro Gly Val Phe
    290                 295                 300

Gly Pro Tyr Gly Pro Gly Ala Ser Ala Ala Ala Ala Ala Gly Ile Tyr
305                 310                 315                 320

Gly Pro Gly Val Phe Gly Pro Gly Ile Tyr Gly Pro Gly Ser Ser Gly
                325                 330                 335

Pro Gly Val Phe Gly Pro Tyr Gly Pro Gly Ser Ser Ala Ala Ala Ala
            340                 345                 350

Ala Gly Ile Tyr Gly Pro Gly Val Phe Gly Pro Tyr Gly Pro Gly Ile
        355                 360                 365

Ser Ala Ala Ala Ala Ala Gly Ile Tyr Val Phe Gly Pro Gly Val Phe
    370                 375                 380

Gly Pro Tyr Gly Pro Gly Ala Ser Gly Pro Gly Val Phe Gly Pro Tyr
385                 390                 395                 400

Gly Pro Gly Ala Ser Ala Ala Ala Ala Ala Gly Pro Gly Ile Tyr Gly
                405                 410                 415

Pro Gly Val Phe Gly Pro Ser Ala Ser Ala Ala Ala Ala Ala Gly Ile
            420                 425                 430

Tyr Gly Ser Gly Pro Gly Ile Tyr Gly Pro Tyr Gly Pro Gly Ile Ser
        435                 440                 445

Gly Pro Gly Ser Gly Val Phe Gly Ile Gly Pro Tyr Gly Pro Gly Ala
    450                 455                 460

Ser Ala Ala Ala Ala Ala Gly Ile Tyr Gly Pro Gly Val Phe Gly Pro
465                 470                 475                 480

Tyr Gly Pro Gly Ile Ser Ala Ala Ala Ala Ala Gly Pro Gly Ser Gly
                485                 490                 495

Ile Tyr Gly Pro Gly Ala Ser Gly Ile Asn Gly Pro Gly Ser Gly Ile
            500                 505                 510

Tyr Gly Pro Gly Val Phe Gly Pro Gly Ile Ser Ala Ala Ala Ala Ala
        515                 520                 525

Gly Ile Tyr Val Phe Gly Pro Gly Val Phe Gly Pro Tyr Gly Pro Gly
    530                 535                 540

Ala Ser Ala Ala Ala Ala Ala Gly Ile Tyr Gly Ser Gly Pro Gly Val
545                 550                 555                 560

Phe Gly Pro Tyr Gly Pro Gly Ile Ser Gly Ser Gly Val Phe Gly Pro
                565                 570                 575

Gly Val Phe Gly Pro Tyr Ala Ser Ala Ala Ala Ala Ala Gly Pro Gly
            580                 585                 590

Ser Gly Val Phe Gly Pro Gly Ala Ser Gly Pro Gly Val Phe Gly Pro
        595                 600                 605

Tyr Gly Pro Gly Ala Ser Ala Ala Ala Ala Ala Gly Ile Asn Gly Pro
    610                 615                 620

Gly Ser Gly Val Phe Gly Pro Gly Ile Ser Gly Ile Tyr Gly Pro Gly
625                 630                 635                 640

Val Phe Gly Pro Gly Val Phe Gly Pro Gly Ser Ser Ala Ala Ala Ala
                645                 650                 655
```

```
Ala Gly Pro Gly Ile Tyr Gly Pro Gly Val Phe Gly Pro Ser Ala Ser
            660                 665                 670

Ala Ala Ala Ala Ala Gly Pro Gly Ser Gly Val Phe Gly Pro Gly Ala
        675                 680                 685

Ser Gly Ile Tyr Gly Pro Gly Val Phe Gly Pro Gly Val Phe Gly Pro
    690                 695                 700

Gly Ser Ser Ala Ala Ala Ala Ala Gly Ile Tyr Gly Ser Gly Pro Gly
705                 710                 715                 720

Val Phe Gly Pro Tyr Gly Ser Ala Ala Ala Ala Ala Gly Pro Gly Ser
                725                 730                 735

Gly Ile Tyr Gly Ile Gly Pro Tyr Gly Pro Gly Ala Ser Gly Pro Gly
            740                 745                 750

Ile Tyr Gly Pro Gly Val Phe Gly Pro Ser Ala Ser Ala Ala Ala Ala
        755                 760                 765

Ala Gly Ser Gly Val Phe Gly Pro Gly Ile Tyr Gly Pro Tyr Ala Ser
    770                 775                 780

Ala Ala Ala Ala Ala Gly Ile Tyr Gly Ser Gly Pro Gly Val Phe Gly
785                 790                 795                 800

Pro Tyr Gly Pro Gly Ile Ser Gly Ser Gly Val Phe Gly Pro Gly Val
                805                 810                 815

Phe Gly Pro Tyr Ala Ser Ala Ala Ala Ala Ala Gly Pro Gly Val Phe
            820                 825                 830

Gly Pro Tyr Gly Pro Gly Ser Ser Ala Ala Ala Ala Ala Gly Ile Tyr
        835                 840                 845

Gly Tyr Gly Pro Gly Val Phe Gly Pro Tyr Gly Pro Gly Ala Ser Gly
    850                 855                 860

Ile Asn Gly Pro Gly Ser Gly Ile Tyr Gly Pro Gly Val Phe Gly Pro
865                 870                 875                 880

Gly Ile Ser Ala Ala Ala Ala Ala Gly Pro Gly Val Phe Gly Pro Tyr
                885                 890                 895

Gly Pro Gly Ala Ser Ala Ala Ala Ala Ala Gly Ile Tyr Gly Pro Gly
            900                 905                 910

Val Phe Gly Pro Gly Ile Tyr Gly Pro Gly Ser Ser Gly Pro Gly Val
        915                 920                 925

Phe Gly Pro Tyr Gly Pro Gly Ser Ser Ala Ala Ala Ala Ala Gly Ile
    930                 935                 940

Tyr Gly Pro Gly Val Phe Gly Pro Tyr Gly Pro Gly Ile Ser Ala Ala
945                 950                 955                 960

Ala Ala Ala Gly Ile Tyr Val Phe Gly Pro Gly Val Phe Gly Pro Tyr
                965                 970                 975

Gly Pro Gly Ala Ser Gly Pro Gly Val Phe Gly Pro Tyr Gly Pro Gly
            980                 985                 990

Ala Ser Ala Ala Ala Ala Ala Gly  Pro Gly Ile Tyr Gly  Pro Gly Val
        995                 1000                1005

Phe Gly  Pro Ser Ala Ser Ala  Ala Ala Ala Ala Gly  Ile Tyr Gly
    1010                1015                1020

Ser Gly  Pro Gly Ile Tyr Gly  Pro Tyr Gly Pro Gly  Ile Ser Gly
    1025                1030                1035

Pro Gly  Ser Gly Val Phe Gly  Ile Gly Pro Tyr Gly  Pro Gly Ala
    1040                1045                1050

Ser Ala  Ala Ala Ala Ala Gly  Ile Tyr Gly Pro Gly  Val Phe Gly
    1055                1060                1065

Pro Tyr  Gly Pro Gly Ile Ser  Ala Ala Ala Ala Ala  Gly Pro Gly
```

```
    1070                1075                1080

Ser Gly  Ile Tyr Gly Pro Gly  Ala Ser Gly Ile Asn  Gly Pro Gly
    1085                1090                1095

Ser Gly  Ile Tyr Gly Pro Gly  Val Phe Gly Pro Gly  Ile Ser Ala
    1100                1105                1110

Ala Ala  Ala Ala Gly Ile Tyr  Val Phe Gly Pro Gly  Val Phe Gly
    1115                1120                1125

Pro Tyr  Gly Pro Gly Ala Ser  Ala Ala Ala Ala Ala  Gly Ile Tyr
    1130                1135                1140

Gly Ser  Gly Pro Gly Val Phe  Gly Pro Tyr Gly Pro  Gly Ile Ser
    1145                1150                1155

Gly Ser  Gly Val Phe Gly Pro  Gly Val Phe Gly Pro  Tyr Ala Ser
    1160                1165                1170

Ala Ala  Ala Ala Ala Gly Pro  Gly Ser Gly Val Phe  Gly Pro Gly
    1175                1180                1185

Ala Ser
    1190


<210> SEQ ID NO 41
<211> LENGTH: 590
<212> TYPE: PRT
<213> ORGANISM: Artificial Sequence
<220> FEATURE:
<223> OTHER INFORMATION: Met-PRT917

<400> SEQUENCE: 41

Met Gly Pro Gly Leu Ile Gly Pro Tyr Gly Pro Gly Ala Ser Ala Ala
1               5                   10                  15

Ala Ala Ala Gly Val Asn Gly Pro Gly Ser Gly Leu Ile Gly Pro Gly
            20                  25                  30

Val Ser Gly Val Tyr Gly Pro Gly Leu Ile Gly Pro Gly Leu Ile Gly
        35                  40                  45

Pro Gly Ser Ser Ala Ala Ala Ala Ala Gly Pro Gly Val Tyr Gly Pro
    50                  55                  60

Gly Leu Ile Gly Pro Ser Ala Ser Ala Ala Ala Ala Ala Gly Pro Gly
65                  70                  75                  80

Ser Gly Leu Ile Gly Pro Gly Ala Ser Gly Val Tyr Gly Pro Gly Leu
                85                  90                  95

Ile Gly Pro Gly Leu Ile Gly Pro Gly Ser Ser Ala Ala Ala Ala Ala
            100                 105                 110

Gly Val Tyr Gly Ser Gly Pro Gly Leu Ile Gly Pro Tyr Gly Ser Ala
        115                 120                 125

Ala Ala Ala Ala Gly Pro Gly Ser Gly Val Tyr Gly Val Gly Pro Tyr
    130                 135                 140

Gly Pro Gly Ala Ser Gly Pro Gly Val Tyr Gly Pro Gly Leu Ile Gly
145                 150                 155                 160

Pro Ser Ala Ser Ala Ala Ala Ala Ala Gly Ser Gly Leu Ile Gly Pro
                165                 170                 175

Gly Val Tyr Gly Pro Tyr Ala Ser Ala Ala Ala Ala Ala Gly Val Tyr
            180                 185                 190

Gly Ser Gly Pro Gly Leu Ile Gly Pro Tyr Gly Pro Gly Val Ser Gly
        195                 200                 205

Ser Gly Leu Ile Gly Pro Gly Leu Ile Gly Pro Tyr Ala Ser Ala Ala
    210                 215                 220

Ala Ala Ala Gly Pro Gly Leu Ile Gly Pro Tyr Gly Pro Gly Ser Ser
```

```
225                 230                 235                 240

Ala Ala Ala Ala Ala Gly Val Tyr Gly Tyr Gly Pro Gly Leu Ile Gly
                245                 250                 255

Pro Tyr Gly Pro Gly Ala Ser Gly Val Asn Gly Pro Gly Ser Gly Val
            260                 265                 270

Tyr Gly Pro Gly Leu Ile Gly Pro Gly Val Ser Ala Ala Ala Ala Ala
        275                 280                 285

Gly Pro Gly Leu Ile Gly Pro Tyr Gly Pro Gly Ala Ser Ala Ala Ala
    290                 295                 300

Ala Ala Gly Val Tyr Gly Pro Gly Leu Ile Gly Pro Gly Val Tyr Gly
305                 310                 315                 320

Pro Gly Ser Ser Gly Pro Gly Leu Ile Gly Pro Tyr Gly Pro Gly Ser
                325                 330                 335

Ser Ala Ala Ala Ala Ala Gly Val Tyr Gly Pro Gly Leu Ile Gly Pro
            340                 345                 350

Tyr Gly Pro Gly Val Ser Ala Ala Ala Ala Ala Gly Val Tyr Leu Ile
        355                 360                 365

Gly Pro Gly Leu Ile Gly Pro Tyr Gly Pro Gly Ala Ser Gly Pro Gly
    370                 375                 380

Leu Ile Gly Pro Tyr Gly Pro Gly Ala Ser Ala Ala Ala Ala Ala Gly
385                 390                 395                 400

Pro Gly Val Tyr Gly Pro Gly Leu Ile Gly Pro Ser Ala Ser Ala Ala
                405                 410                 415

Ala Ala Ala Gly Val Tyr Gly Ser Gly Pro Gly Val Tyr Gly Pro Tyr
            420                 425                 430

Gly Pro Gly Val Ser Gly Pro Gly Ser Gly Leu Ile Gly Val Gly Pro
        435                 440                 445

Tyr Gly Pro Gly Ala Ser Ala Ala Ala Ala Ala Gly Val Tyr Gly Pro
    450                 455                 460

Gly Leu Ile Gly Pro Tyr Gly Pro Gly Val Ser Ala Ala Ala Ala Ala
465                 470                 475                 480

Gly Pro Gly Ser Gly Val Tyr Gly Pro Gly Ala Ser Gly Val Asn Gly
                485                 490                 495

Pro Gly Ser Gly Val Tyr Gly Pro Gly Leu Ile Gly Pro Gly Val Ser
            500                 505                 510

Ala Ala Ala Ala Ala Gly Val Tyr Leu Ile Gly Pro Gly Leu Ile Gly
        515                 520                 525

Pro Tyr Gly Pro Gly Ala Ser Ala Ala Ala Ala Ala Gly Val Tyr Gly
    530                 535                 540

Ser Gly Pro Gly Leu Ile Gly Pro Tyr Gly Pro Gly Val Ser Gly Ser
545                 550                 555                 560

Gly Leu Ile Gly Pro Gly Leu Ile Gly Pro Tyr Ala Ser Ala Ala Ala
                565                 570                 575

Ala Ala Gly Pro Gly Ser Gly Leu Ile Gly Pro Gly Ala Ser
            580                 585                 590


<210> SEQ ID NO 42
<211> LENGTH: 587
<212> TYPE: PRT
<213> ORGANISM: Artificial Sequence
<220> FEATURE:
<223> OTHER INFORMATION: Met-PRT1028

<400> SEQUENCE: 42

Met Gly Pro Gly Ile Phe Gly Pro Tyr Gly Pro Gly Ala Ser Ala Ala
```

-continued

```
1               5                   10                  15

Ala Ala Ala Gly Thr Gly Pro Gly Ser Gly Ile Phe Gly Pro Gly Thr
            20                  25                  30

Ser Gly Thr Tyr Gly Pro Gly Ile Phe Gly Pro Gly Ile Phe Gly Pro
        35                  40                  45

Gly Ser Ser Ala Ala Ala Ala Ala Gly Pro Gly Thr Tyr Gly Pro Gly
    50                  55                  60

Ile Phe Gly Pro Ser Ala Ser Ala Ala Ala Ala Ala Gly Pro Gly Ser
65                  70                  75                  80

Gly Ile Phe Gly Pro Gly Ala Ser Gly Thr Tyr Gly Pro Gly Ile Phe
                85                  90                  95

Gly Pro Gly Ile Phe Gly Pro Gly Ser Ser Ala Ala Ala Ala Ala Gly
            100                 105                 110

Thr Tyr Gly Ser Gly Pro Gly Ile Phe Gly Pro Tyr Gly Ser Ala Ala
        115                 120                 125

Ala Ala Ala Gly Pro Gly Ser Gly Thr Tyr Gly Thr Gly Pro Tyr Gly
    130                 135                 140

Pro Gly Ala Ser Gly Pro Gly Thr Tyr Gly Pro Gly Ile Phe Gly Pro
145                 150                 155                 160

Ser Ala Ser Ala Ala Ala Ala Ala Gly Ser Gly Ile Phe Gly Pro Gly
                165                 170                 175

Thr Tyr Gly Pro Tyr Ala Ser Ala Ala Ala Ala Ala Gly Thr Tyr Gly
            180                 185                 190

Ser Gly Pro Gly Ile Phe Gly Pro Tyr Gly Pro Gly Thr Ser Gly Ser
        195                 200                 205

Gly Ile Phe Gly Pro Gly Ile Phe Gly Pro Tyr Ala Ser Ala Ala Ala
    210                 215                 220

Ala Ala Gly Pro Gly Ile Phe Gly Pro Tyr Gly Pro Gly Ser Ser Ala
225                 230                 235                 240

Ala Ala Ala Ala Gly Thr Tyr Gly Tyr Gly Pro Gly Ile Phe Gly Pro
                245                 250                 255

Tyr Gly Pro Gly Ala Ser Gly Thr Gly Pro Gly Ser Gly Thr Tyr Gly
            260                 265                 270

Pro Gly Ile Phe Gly Pro Gly Thr Ser Ala Ala Ala Ala Ala Gly Pro
        275                 280                 285

Gly Ile Phe Gly Pro Tyr Gly Pro Gly Ala Ser Ala Ala Ala Ala Ala
    290                 295                 300

Gly Thr Tyr Gly Pro Gly Ile Phe Gly Pro Gly Thr Tyr Gly Pro Gly
305                 310                 315                 320

Ser Ser Gly Pro Gly Ile Phe Gly Pro Tyr Gly Pro Gly Ser Ser Ala
                325                 330                 335

Ala Ala Ala Ala Gly Thr Tyr Gly Pro Gly Ile Phe Gly Pro Tyr Gly
            340                 345                 350

Pro Gly Thr Ser Ala Ala Ala Ala Ala Gly Thr Tyr Ile Phe Gly Pro
        355                 360                 365

Gly Ile Phe Gly Pro Tyr Gly Pro Gly Ala Ser Gly Pro Gly Ile Phe
    370                 375                 380

Gly Pro Tyr Gly Pro Gly Ala Ser Ala Ala Ala Ala Ala Gly Pro Gly
385                 390                 395                 400

Thr Tyr Gly Pro Gly Ile Phe Gly Pro Ser Ala Ser Ala Ala Ala Ala
                405                 410                 415

Ala Gly Thr Tyr Gly Ser Gly Pro Gly Thr Tyr Gly Pro Tyr Gly Pro
            420                 425                 430
```

```
Gly Thr Ser Gly Pro Gly Ser Gly Ile Phe Gly Thr Gly Pro Tyr Gly
        435                 440                 445

Pro Gly Ala Ser Ala Ala Ala Ala Ala Gly Thr Tyr Gly Pro Gly Ile
    450                 455                 460

Phe Gly Pro Tyr Gly Pro Gly Thr Ser Ala Ala Ala Ala Ala Gly Pro
465                 470                 475                 480

Gly Ser Gly Thr Tyr Gly Pro Gly Ala Ser Gly Thr Gly Pro Gly Ser
                485                 490                 495

Gly Thr Tyr Gly Pro Gly Ile Phe Gly Pro Gly Thr Ser Ala Ala Ala
            500                 505                 510

Ala Ala Gly Thr Tyr Ile Phe Gly Pro Gly Ile Phe Gly Pro Tyr Gly
        515                 520                 525

Pro Gly Ala Ser Ala Ala Ala Ala Ala Gly Thr Tyr Gly Ser Gly Pro
    530                 535                 540

Gly Ile Phe Gly Pro Tyr Gly Pro Gly Thr Ser Gly Ser Gly Ile Phe
545                 550                 555                 560

Gly Pro Gly Ile Phe Gly Pro Tyr Ala Ser Ala Ala Ala Ala Ala Gly
                565                 570                 575

Pro Gly Ser Gly Ile Phe Gly Pro Gly Ala Ser
            580                 585


<210> SEQ ID NO 43
<211> LENGTH: 601
<212> TYPE: PRT
<213> ORGANISM: Artificial Sequence
<220> FEATURE:
<223> OTHER INFORMATION: PRT917

<400> SEQUENCE: 43

Met His His His His His His Ser Ser Gly Ser Ser Gly Pro Gly Leu
1               5                   10                  15

Ile Gly Pro Tyr Gly Pro Gly Ala Ser Ala Ala Ala Ala Ala Gly Val
            20                  25                  30

Asn Gly Pro Gly Ser Gly Leu Ile Gly Pro Gly Val Ser Gly Val Tyr
        35                  40                  45

Gly Pro Gly Leu Ile Gly Pro Gly Leu Ile Gly Pro Gly Ser Ser Ala
    50                  55                  60

Ala Ala Ala Ala Gly Pro Gly Val Tyr Gly Pro Gly Leu Ile Gly Pro
65                  70                  75                  80

Ser Ala Ser Ala Ala Ala Ala Ala Gly Pro Gly Ser Gly Leu Ile Gly
                85                  90                  95

Pro Gly Ala Ser Gly Val Tyr Gly Pro Gly Leu Ile Gly Pro Gly Leu
            100                 105                 110

Ile Gly Pro Gly Ser Ser Ala Ala Ala Ala Ala Gly Val Tyr Gly Ser
        115                 120                 125

Gly Pro Gly Leu Ile Gly Pro Tyr Gly Ser Ala Ala Ala Ala Ala Gly
    130                 135                 140

Pro Gly Ser Gly Val Tyr Gly Val Gly Pro Tyr Gly Pro Gly Ala Ser
145                 150                 155                 160

Gly Pro Gly Val Tyr Gly Pro Gly Leu Ile Gly Pro Ser Ala Ser Ala
                165                 170                 175

Ala Ala Ala Ala Gly Ser Gly Leu Ile Gly Pro Gly Val Tyr Gly Pro
            180                 185                 190

Tyr Ala Ser Ala Ala Ala Ala Ala Gly Val Tyr Gly Ser Gly Pro Gly
        195                 200                 205
```

```
Leu Ile Gly Pro Tyr Gly Pro Gly Val Ser Gly Ser Gly Leu Ile Gly
    210                 215                 220

Pro Gly Leu Ile Gly Pro Tyr Ala Ser Ala Ala Ala Ala Ala Gly Pro
225                 230                 235                 240

Gly Leu Ile Gly Pro Tyr Gly Pro Gly Ser Ser Ala Ala Ala Ala Ala
                245                 250                 255

Gly Val Tyr Gly Tyr Gly Pro Gly Leu Ile Gly Pro Tyr Gly Pro Gly
            260                 265                 270

Ala Ser Gly Val Asn Gly Pro Gly Ser Gly Val Tyr Gly Pro Gly Leu
        275                 280                 285

Ile Gly Pro Gly Val Ser Ala Ala Ala Ala Ala Gly Pro Gly Leu Ile
    290                 295                 300

Gly Pro Tyr Gly Pro Gly Ala Ser Ala Ala Ala Ala Ala Gly Val Tyr
305                 310                 315                 320

Gly Pro Gly Leu Ile Gly Pro Gly Val Tyr Gly Pro Gly Ser Ser Gly
                325                 330                 335

Pro Gly Leu Ile Gly Pro Tyr Gly Pro Gly Ser Ser Ala Ala Ala Ala
            340                 345                 350

Ala Gly Val Tyr Gly Pro Gly Leu Ile Gly Pro Tyr Gly Pro Gly Val
        355                 360                 365

Ser Ala Ala Ala Ala Ala Gly Val Tyr Leu Ile Gly Pro Gly Leu Ile
    370                 375                 380

Gly Pro Tyr Gly Pro Gly Ala Ser Gly Pro Gly Leu Ile Gly Pro Tyr
385                 390                 395                 400

Gly Pro Gly Ala Ser Ala Ala Ala Ala Ala Gly Pro Gly Val Tyr Gly
                405                 410                 415

Pro Gly Leu Ile Gly Pro Ser Ala Ser Ala Ala Ala Ala Ala Gly Val
            420                 425                 430

Tyr Gly Ser Gly Pro Gly Val Tyr Gly Pro Tyr Gly Pro Gly Val Ser
        435                 440                 445

Gly Pro Gly Ser Gly Leu Ile Gly Val Gly Pro Tyr Gly Pro Gly Ala
    450                 455                 460

Ser Ala Ala Ala Ala Ala Gly Val Tyr Gly Pro Gly Leu Ile Gly Pro
465                 470                 475                 480

Tyr Gly Pro Gly Val Ser Ala Ala Ala Ala Ala Gly Pro Gly Ser Gly
                485                 490                 495

Val Tyr Gly Pro Gly Ala Ser Gly Val Asn Gly Pro Gly Ser Gly Val
            500                 505                 510

Tyr Gly Pro Gly Leu Ile Gly Pro Gly Val Ser Ala Ala Ala Ala Ala
        515                 520                 525

Gly Val Tyr Leu Ile Gly Pro Gly Leu Ile Gly Pro Tyr Gly Pro Gly
    530                 535                 540

Ala Ser Ala Ala Ala Ala Ala Gly Val Tyr Gly Ser Gly Pro Gly Leu
545                 550                 555                 560

Ile Gly Pro Tyr Gly Pro Gly Val Ser Gly Ser Gly Leu Ile Gly Pro
                565                 570                 575

Gly Leu Ile Gly Pro Tyr Ala Ser Ala Ala Ala Ala Ala Gly Pro Gly
            580                 585                 590

Ser Gly Leu Ile Gly Pro Gly Ala Ser
        595                 600
```

<210> SEQ ID NO 44
<211> LENGTH: 598

<212> TYPE: PRT
<213> ORGANISM: Artificial Sequence
<220> FEATURE:
<223> OTHER INFORMATION: PRT1028

<400> SEQUENCE: 44

Met His His His His His His Ser Ser Gly Ser Ser Gly Pro Gly Ile
1 5 10 15

Phe Gly Pro Tyr Gly Pro Gly Ala Ser Ala Ala Ala Ala Ala Gly Thr
20 25 30

Gly Pro Gly Ser Gly Ile Phe Gly Pro Gly Thr Ser Gly Thr Tyr Gly
35 40 45

Pro Gly Ile Phe Gly Pro Gly Ile Phe Gly Pro Gly Ser Ser Ala Ala
50 55 60

Ala Ala Ala Gly Pro Gly Thr Tyr Gly Pro Gly Ile Phe Gly Pro Ser
65 70 75 80

Ala Ser Ala Ala Ala Ala Ala Gly Pro Gly Ser Gly Ile Phe Gly Pro
85 90 95

Gly Ala Ser Gly Thr Tyr Gly Pro Gly Ile Phe Gly Pro Gly Ile Phe
100 105 110

Gly Pro Gly Ser Ser Ala Ala Ala Ala Ala Gly Thr Tyr Gly Ser Gly
115 120 125

Pro Gly Ile Phe Gly Pro Tyr Gly Ser Ala Ala Ala Ala Ala Gly Pro
130 135 140

Gly Ser Gly Thr Tyr Gly Thr Gly Pro Tyr Gly Pro Gly Ala Ser Gly
145 150 155 160

Pro Gly Thr Tyr Gly Pro Gly Ile Phe Gly Pro Ser Ala Ser Ala Ala
165 170 175

Ala Ala Ala Gly Ser Gly Ile Phe Gly Pro Gly Thr Tyr Gly Pro Tyr
180 185 190

Ala Ser Ala Ala Ala Ala Ala Gly Thr Tyr Gly Ser Gly Pro Gly Ile
195 200 205

Phe Gly Pro Tyr Gly Pro Gly Thr Ser Gly Ser Gly Ile Phe Gly Pro
210 215 220

Gly Ile Phe Gly Pro Tyr Ala Ser Ala Ala Ala Ala Ala Gly Pro Gly
225 230 235 240

Ile Phe Gly Pro Tyr Gly Pro Gly Ser Ser Ala Ala Ala Ala Ala Gly
245 250 255

Thr Tyr Gly Tyr Gly Pro Gly Ile Phe Gly Pro Tyr Gly Pro Gly Ala
260 265 270

Ser Gly Thr Gly Pro Gly Ser Gly Thr Tyr Gly Pro Gly Ile Phe Gly
275 280 285

Pro Gly Thr Ser Ala Ala Ala Ala Ala Gly Pro Gly Ile Phe Gly Pro
290 295 300

Tyr Gly Pro Gly Ala Ser Ala Ala Ala Ala Ala Gly Thr Tyr Gly Pro
305 310 315 320

Gly Ile Phe Gly Pro Gly Thr Tyr Gly Pro Gly Ser Ser Gly Pro Gly
325 330 335

Ile Phe Gly Pro Tyr Gly Pro Gly Ser Ser Ala Ala Ala Ala Ala Gly
340 345 350

Thr Tyr Gly Pro Gly Ile Phe Gly Pro Tyr Gly Pro Gly Thr Ser Ala
355 360 365

Ala Ala Ala Ala Gly Thr Tyr Ile Phe Gly Pro Gly Ile Phe Gly Pro
370 375 380

-continued

```
Tyr Gly Pro Gly Ala Ser Gly Pro Gly Ile Phe Gly Pro Tyr Gly Pro
385                 390                 395                 400

Gly Ala Ser Ala Ala Ala Ala Ala Gly Pro Gly Thr Tyr Gly Pro Gly
                405                 410                 415

Ile Phe Gly Pro Ser Ala Ser Ala Ala Ala Ala Ala Gly Thr Tyr Gly
            420                 425                 430

Ser Gly Pro Gly Thr Tyr Gly Pro Tyr Gly Pro Gly Thr Ser Gly Pro
        435                 440                 445

Gly Ser Gly Ile Phe Gly Thr Gly Pro Tyr Gly Pro Gly Ala Ser Ala
    450                 455                 460

Ala Ala Ala Ala Gly Thr Tyr Gly Pro Gly Ile Phe Gly Pro Tyr Gly
465                 470                 475                 480

Pro Gly Thr Ser Ala Ala Ala Ala Ala Gly Pro Gly Ser Gly Thr Tyr
                485                 490                 495

Gly Pro Gly Ala Ser Gly Thr Gly Pro Gly Ser Gly Thr Tyr Gly Pro
            500                 505                 510

Gly Ile Phe Gly Pro Gly Thr Ser Ala Ala Ala Ala Ala Gly Thr Tyr
        515                 520                 525

Ile Phe Gly Pro Gly Ile Phe Gly Pro Tyr Gly Pro Gly Ala Ser Ala
    530                 535                 540

Ala Ala Ala Ala Gly Thr Tyr Gly Ser Gly Pro Gly Ile Phe Gly Pro
545                 550                 555                 560

Tyr Gly Pro Gly Thr Ser Gly Ser Gly Ile Phe Gly Pro Gly Ile Phe
                565                 570                 575

Gly Pro Tyr Ala Ser Ala Ala Ala Ala Ala Gly Pro Gly Ser Gly Ile
            580                 585                 590

Phe Gly Pro Gly Ala Ser
        595
```

The invention claimed is:

1. An artificial hair comprising a fiber bundle comprising a plurality of single yarns of fiber, each yarn having a diameter of about 15 μm or more, and wherein at least one of the single yarns of fiber has a predetermined shape including a curved part, the fiber comprising a synthetic fibroin fiber containing a modified fibroin, and the artificial hair expanding when placed in a wet state and contracting when dried from a wet state, wherein the modified fibroin comprises a protein containing a domain sequence represented by Formula 1: $[(A)_n \text{ motif-REP}]_m$ or Formula 2: $[(A)_n \text{ motif-REP}]_m\text{-}(A)_n$ motif, wherein the $(A)_n$ motif comprises an amino acid sequence including alanine residues, a proportion of a number of alanine residues with respect to a total number of amino acid residues in the $(A)_n$ motif is 40% or more, and wherein REP comprises an amino acid sequence containing from 2 to 200 amino acid residues.

2. A method for producing the artificial hair according to claim 1, the method comprising producing at least one single yarn of fiber having a predetermined shape by retaining a fibroin fiber containing a modified fibroin in a state conforming to the predetermined shape.

3. The method according to claim 2, wherein the fibroin fiber is retained in a state conforming to a shape including a curved part, by being wound around a core material.

4. The method according to claim 2, wherein the diameter of the fibroin fiber is more than 30 μm.

5. The method according to claim 2, wherein the fibroin fiber that is retained in the state conforming to a predetermined shape is heated.

6. The method according to claim 5, wherein the fibroin fiber that is retained in the state conforming to a predetermined shape is heated to a temperature below 100° C.

7. The method according to claim 2, further comprising drying the fibroin fiber, wherein the dried fibroin fiber is retained in the state conforming to a predetermined shape.

8. A method for producing the artificial hair according to claim 1, the method comprising obtaining at least one single yarn of fiber that is given a predetermined shape by heating a fibroin fiber that contains a modified fibroin and has been wetted with water, while retaining the fibroin fiber in a state conforming to the predetermined shape.

9. The method according to claim 8, further comprising wetting the fibroin fiber with water before retaining the fibroin fiber in the state conforming to the predetermined state.

10. The method according to claim 8, wherein the fibroin fiber that is retained in the state conforming to the predetermined shape is immersed in heated water.

11. The method according to claim 8, wherein the fibroin fiber that is retained in the state conforming to the predetermined shape is exposed to water vapor.

12. The method according to claim 8, wherein the fibroin fiber is retained in the state conforming to the predetermined shape including a curved part by being wound around a core material.

13. The method according to claim 2, wherein the fibroin fiber is a fiber that expands when placed in a wet state and contracts when dried from a wet state.

14. The method according to claim 2, wherein the modified fibroin includes a modified spider thread fibroin.

15. The artificial hair as claimed in claim 1, wherein each yarn has a diameter of from about 15 μm to about 100 μm.

* * * * *